US011364447B2

(12) United States Patent
Allmendinger et al.

(10) Patent No.: US 11,364,447 B2
(45) **Date of Patent: *Jun. 21, 2022**

(54) MOTOR-OPERATED MODEL VEHICLE

(71) Applicant: TRAXXAS, L.P., McKinney, TX (US)

(72) Inventors: Otto Karl Allmendinger, Rowlett, TX (US); Casey Christen Jens Christensen, McKinney, TX (US); Adam Cole Ewing, McKinney, TX (US); Jonathan Scott Wood, Frisco, TX (US)

(73) Assignee: TRAXXAS, L.P., McKinney, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/082,238

(22) Filed: Oct. 28, 2020

(65) Prior Publication Data

US 2021/0046395 A1 Feb. 18, 2021

Related U.S. Application Data

(63) Continuation of application No. 15/272,127, filed on Sep. 21, 2016, now Pat. No. 10,894,218.
(Continued)

(51) Int. Cl.
*A63H 17/26* (2006.01)
*A63H 29/22* (2006.01)
(Continued)

(52) U.S. Cl.
CPC ..... *A63H 17/262* (2013.01); *A63H 17/26* (2013.01); *A63H 17/264* (2013.01); *A63H 23/02* (2013.01);
(Continued)

(58) Field of Classification Search
CPC ..... A63H 17/26; A63H 17/262
See application file for complete search history.

(56) References Cited

U.S. PATENT DOCUMENTS 1,895,968 A * 1/1933 Brubaker ..... A63H 17/262 446/471
2,141,267 A 12/1938 Dillon
(Continued)

FOREIGN PATENT DOCUMENTS

CN 202242977 U 5/2012
CN 202822774 U 3/2013
(Continued)

OTHER PUBLICATIONS

European Search Report; European Patent Application No. EP 21183318; completed Nov. 12, 2021.

*Primary Examiner* — Eugene L Kim
*Assistant Examiner* — Alyssa M Hylinski
(74) *Attorney, Agent, or Firm* — Daryl R. Wright; Greg Carr

(57) ABSTRACT

A model vehicle with body mount components are provided. A tongue member attached to a model vehicle body with a first and second tongue member is configured to engage a first securing member attached to a model vehicle chassis. A top surface of the second tongue member draws the model vehicle body towards the model vehicle chassis when the second tongue member engages the first securing member. A lever member with a lever handle, jaw clamp, and a lever pivot is configured to pivot between an engage and an unengaged position. The jaw clamp engages with a second securing member in the engaged position. The lever member further contains a retaining mechanism that is configured to rotate between a retained and unretained position. The retaining mechanism inhibits the lever handle from moving from the engaged to the unengaged position when the retaining mechanism is in the retained position.

14 Claims, 89 Drawing Sheets

Related U.S. Application Data

(60) Provisional application No. 62/222,094, filed on Sep. 22, 2015.

(51) Int. Cl.
*A63H 30/04* (2006.01)
*A63H 23/02* (2006.01)
*A63H 27/00* (2006.01)
*A63H 31/08* (2006.01)

(52) U.S. Cl.
CPC ..... *A63H 27/02* (2013.01); *A63H 27/12* (2013.01); *A63H 29/22* (2013.01); *A63H 30/04* (2013.01); *A63H 31/08* (2013.01)

(56) References Cited

U.S. PATENT DOCUMENTS 2,691,244 A 10/1954 Steinke
3,653,149 A 4/1972 Prodger et al.
4,466,215 A 8/1984 Hanazato
4,470,219 A 9/1984 Sugimoto
4,615,686 A * 10/1986 Bartos ..... A63H 17/262 446/469
4,655,727 A * 4/1987 Swisher ..... A63H 33/003 446/470
4,764,150 A 8/1988 Uchino
4,986,789 A * 1/1991 Hang ..... G09B 19/00 446/470
4,993,983 A * 2/1991 Kurita ..... A63H 17/26 446/272
5,002,515 A * 3/1991 Aoyagi ..... A63H 17/26 446/457
5,292,275 A * 3/1994 Swisher ..... A63H 17/34 446/470
5,322,469 A * 6/1994 Tilbor ..... A63H 17/004 446/454
5,334,078 A * 8/1994 Hippely ..... A63H 17/26 446/470
5,482,474 A * 1/1996 Yohn ..... H01R 12/7005 439/79
5,482,494 A * 1/1996 Ishimoto ..... A63H 17/004 446/466
5,816,888 A * 10/1998 Myers ..... A63H 17/004 446/471
7,387,558 B2 * 6/2008 Swisher ..... A63H 17/02 446/470
7,641,263 B2 * 1/2010 Ruslanov ..... A63H 17/002 446/470
9,370,725 B2 * 6/2016 Choi ..... A63F 1/04
10,894,218 B2 * 1/2021 Allmendinger ..... A63H 17/262
2002/0094751 A1 7/2002 Clark, Jr. et al.
2003/0073377 A1 4/2003 Mataja et al.
2003/0236121 A1 12/2003 Byers
2005/0070390 A1 3/2005 Irikura et al.
2005/0079792 A1 4/2005 Ogihara
2008/0143141 A1 * 6/2008 Ruslanov ..... A63H 17/002 296/181.1
2009/0036021 A1 2/2009 Byers et al.
2011/0176861 A1 7/2011 Nakayama et al.
2013/0309938 A1 11/2013 Houlahan et al.
2015/0050859 A1 * 2/2015 Choi ..... A63F 1/06 446/72
2015/0367242 A1 * 12/2015 Calello ..... A63H 17/002 446/465

FOREIGN PATENT DOCUMENTS

EP 2818217 A2 12/2014
TW 201138918 A 11/2011

* cited by examiner

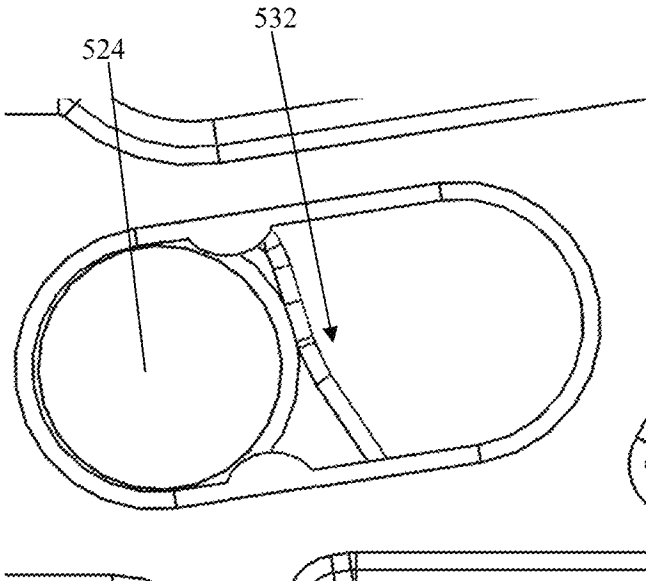
Figure 5S2
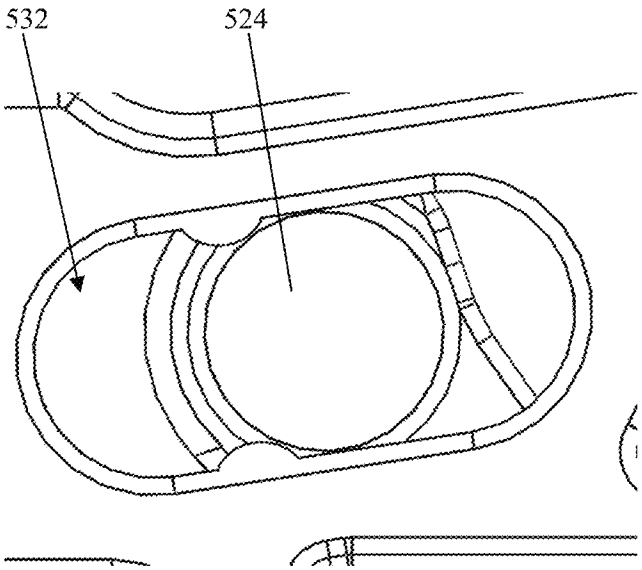
Figure 5S1

MOTOR-OPERATED MODEL VEHICLE

CROSS-REFERENCE TO RELATED APPLICATIONS

This application relates to, and claims the benefit of the filing date of, U.S. patent application Ser. No. 15/272,127 entitled MOTOR-OPERATED MODEL VEHICLE, filed on Sep. 21, 2016, which claims the benefit of U.S. provisional patent application Ser. No. 62/222,094 entitled MOTOR-OPERATED MODEL VEHICLE, filed on Sep. 22, 2015, the entire contents of which are incorporated herein by reference for all purposes.

BACKGROUND

Field of the Invention

The present invention relates to vehicle design and has particular application in the design of remote control and model vehicles.

Background of the Invention

Remote control and model vehicles are assembled from a variety of components and parts employed in the assembly, operation, and control of vehicles.

SUMMARY

Provided are methods, apparatus and articles for use in the assembly, operation, and control of vehicles.

BRIEF DESCRIPTION OF THE DRAWINGS

For a more complete understanding of the present invention and the advantages thereof, reference is now made to the following Detailed Description taken in conjunction with the accompanying drawings, in which:

FIG. 3I is a top view of the lever body mount engaged and the vehicle body;

FIGS. 4I-4K are detail bottom views of the transition between engaging and disengaging the "snap in" feature between the chassis and the lower rear chassis bulkhead;

FIGS. 5S1-5S2 are close up views of an alternative embodiment of the supporting members with the slider member inside a slider opening with a spring or detent feature;

FIGS. 6D-9E are top views of the pinholes in the rear chassis bulkhead and the motor mount;

FIGS. 6G and 9H are perspective views of the motor with front and rear motor mounts;

DETAILED DESCRIPTION

In the following discussion, numerous specific details are set forth to provide a thorough understanding of the present invention. However, those skilled in the art will appreciate that the present invention may be practiced without such specific details. In other instances, certain specific details, and the like have been omitted inasmuch as such details are not considered necessary to obtain a complete understanding of the present invention, and are considered to be within the understanding of persons of ordinary skill in the relevant art.

The entire contents of Provisional Patent Application Ser. No. 62/222,094, entitled: "MOTOR-OPERATED MODEL VEHICLE" filed on Sep. 22, 2015, are incorporated herein by reference for all purposes.

Model Vehicle General Construction

Figure 1A:
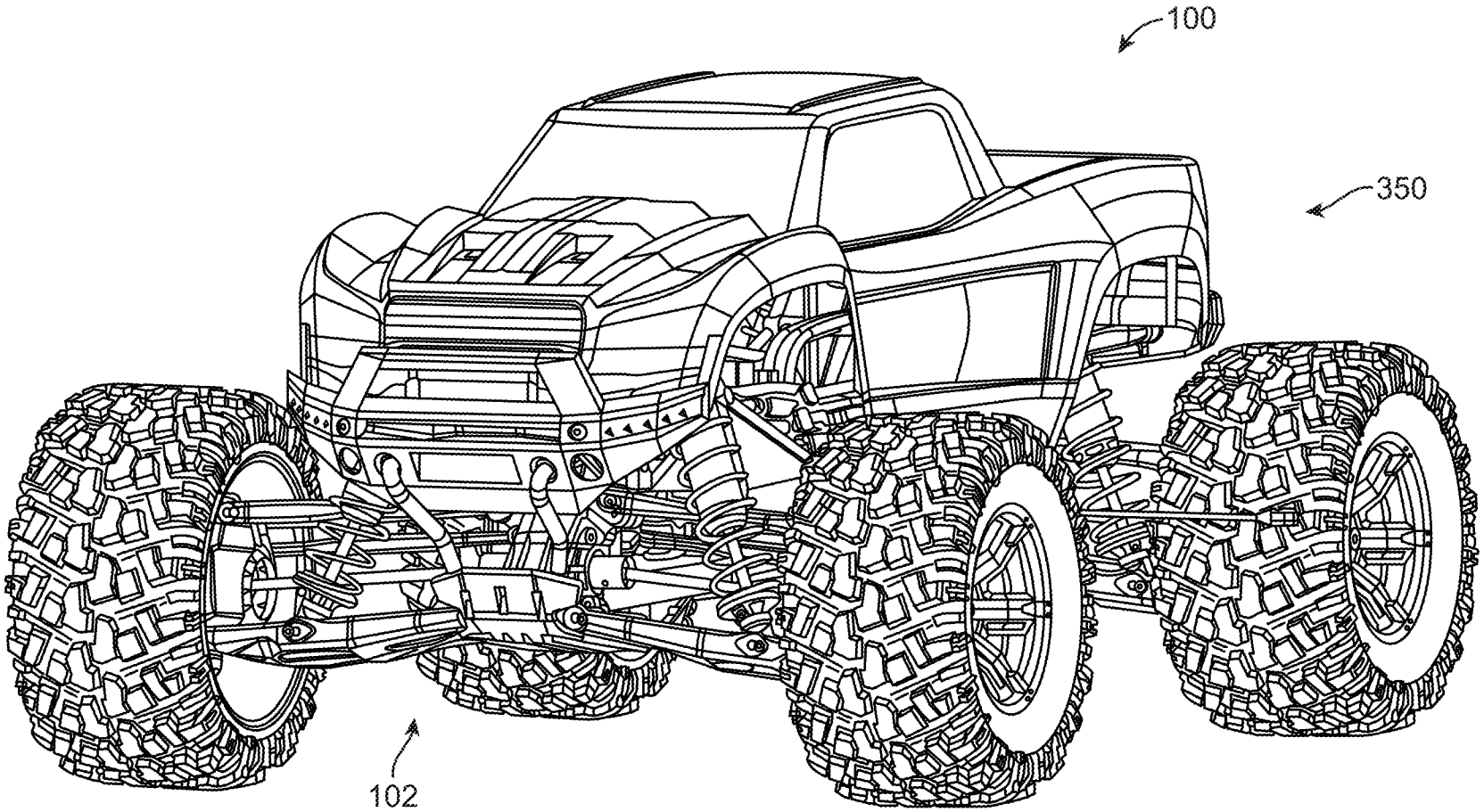
FIG. 1A is a perspective view of a model vehicle.

Turning now to FIG. 1A, a perspective view of an embodiment of a model vehicle 100 is shown. The model vehicle 100 may be motorized or otherwise self-propelled. The model vehicle 100 may be controlled remotely via radio control signals in a well-known manner. The model vehicle 100 may be a ground vehicle, such as an automobile or a truck. Alternatively, the model vehicle 100 may be a watercraft, boat, and the like. Furthermore, the model vehicle 100 may be an aircraft, helicopter, quadcopter, plane, and the like. In an embodiment, the model vehicle 100 may be a model of an off-road pickup truck, for example.

Figure 1B:
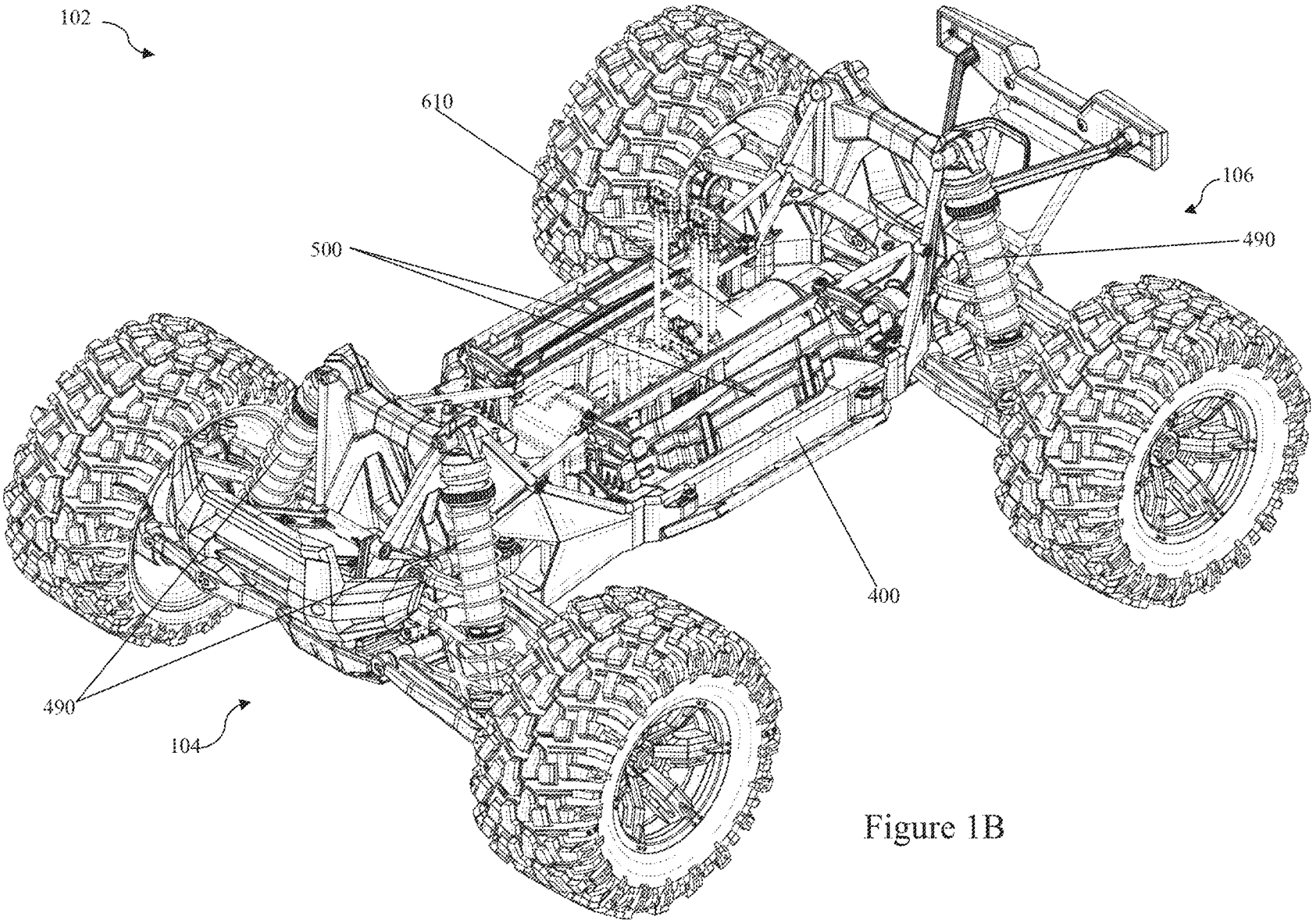
FIG. 1B is a perspective view of a main assembly of the model vehicle.
Figure 1C:
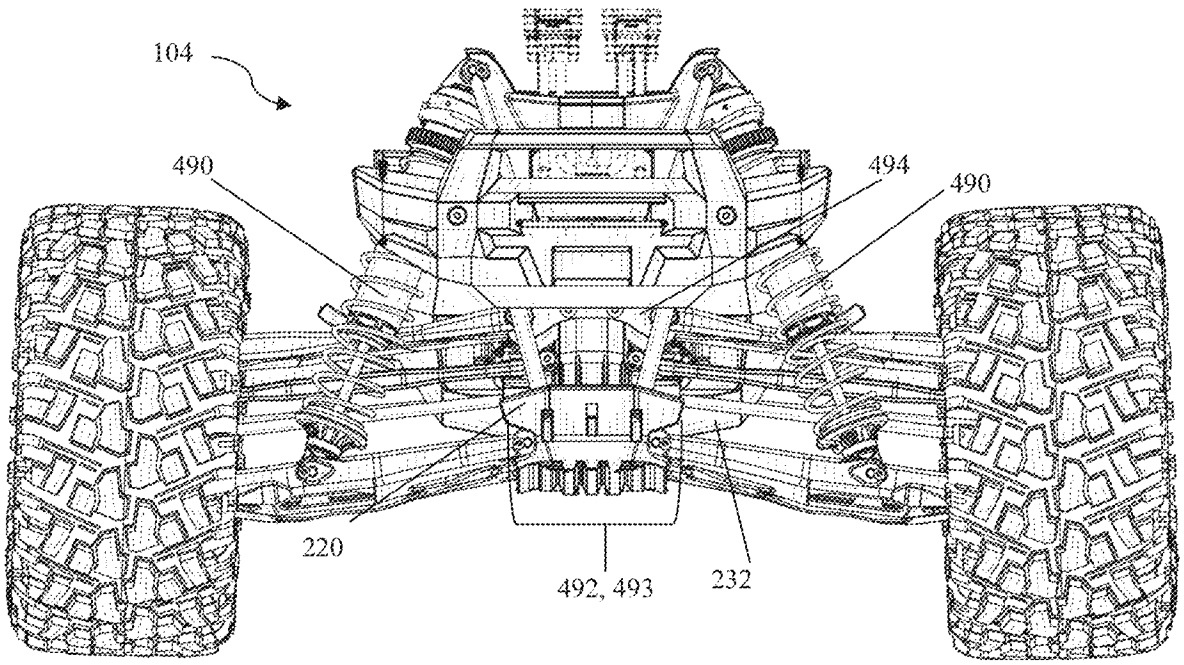
FIG. 1C is a front view of the main assembly of the model vehicle.
Figure 1D:
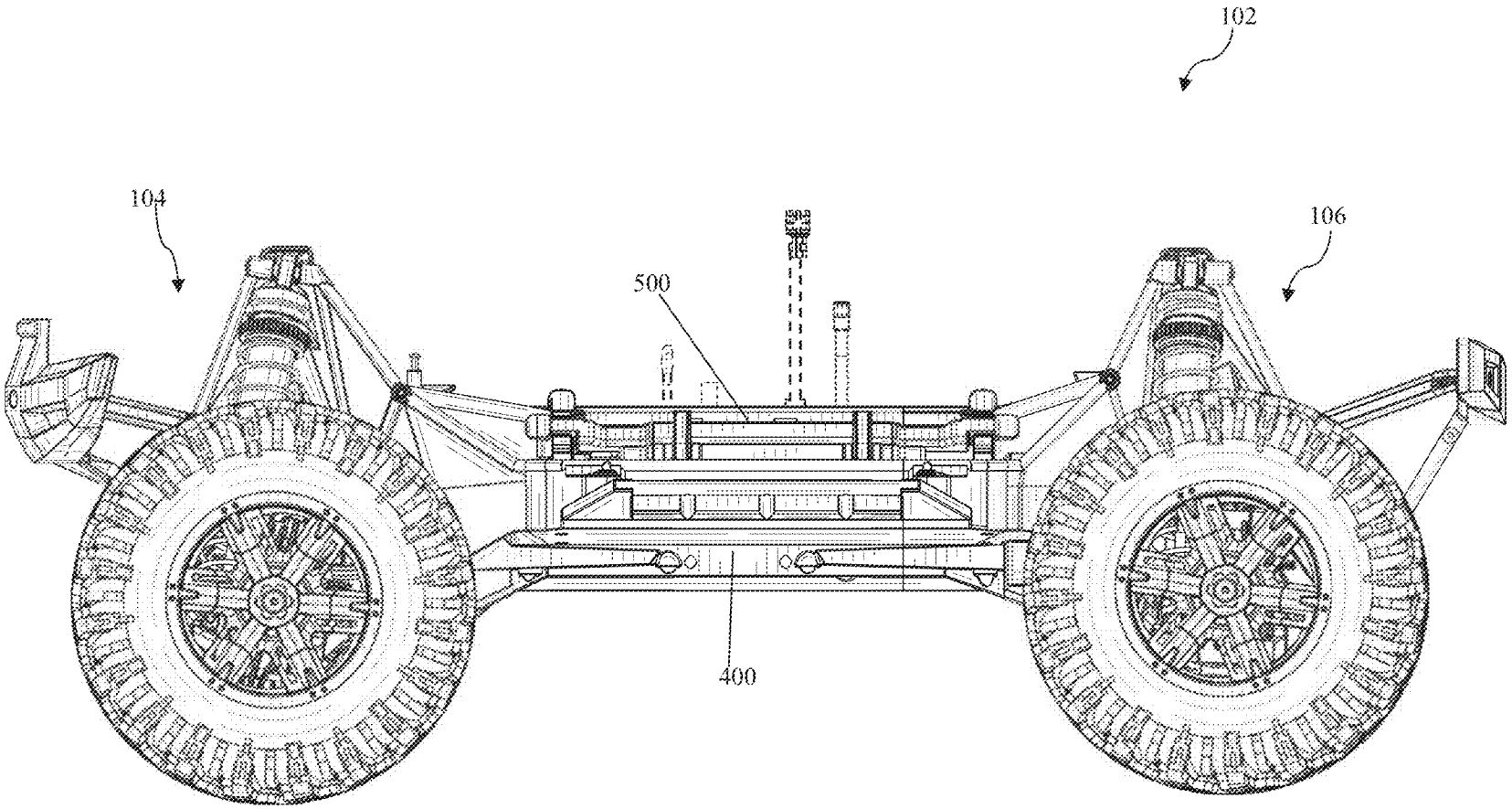
FIG. 1D is a sectional lateral view of the main assembly of the model vehicle.
Figure 1E:
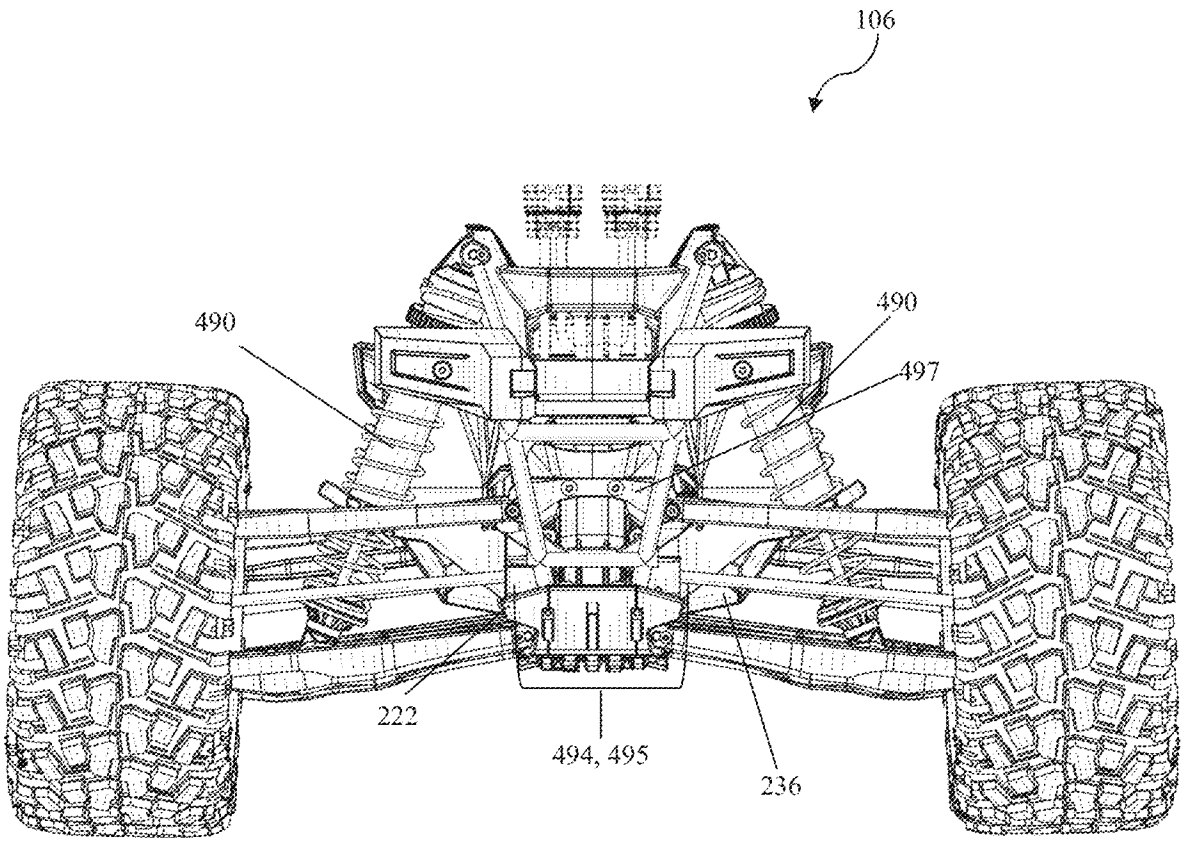
FIG. 1E is a rear view of the main assembly of the model vehicle.

In an embodiment, the model vehicle 100 may comprise a vehicle body 350 detachably mounted to and secured to the model vehicle main assembly 102. The model vehicle main assembly 102, hereafter referred to as the main assembly 102, may be provided with a particular mounting system 300, 302 for mounting the front and rear portions of vehicle body 350 to the main assembly 102. In FIG. 1B, the main assembly 102 may comprise a model vehicle front assembly 104, a model vehicle rear assembly 106, and a particularly configured chassis 400. In FIG. 1C, the model vehicle front assembly 104, herein after referred to as the front assembly 104, may be provided on a lower front chassis bulkhead 232 and connected to the chassis 400. In FIG. 1E, the model vehicle rear assembly 106, herein after referred to as the rear assembly 106, may be provided on a lower rear chassis bulkhead 236 and connected to the chassis 400. As shown in FIGS. 1D, 1G, and 1H, the lower front and rear chassis bulkheads 232, 236 provided on the front and rear assemblies 104, 106 may be configured to connect to the chassis 400 with a particular "snap in" connection.

Figure 1F:
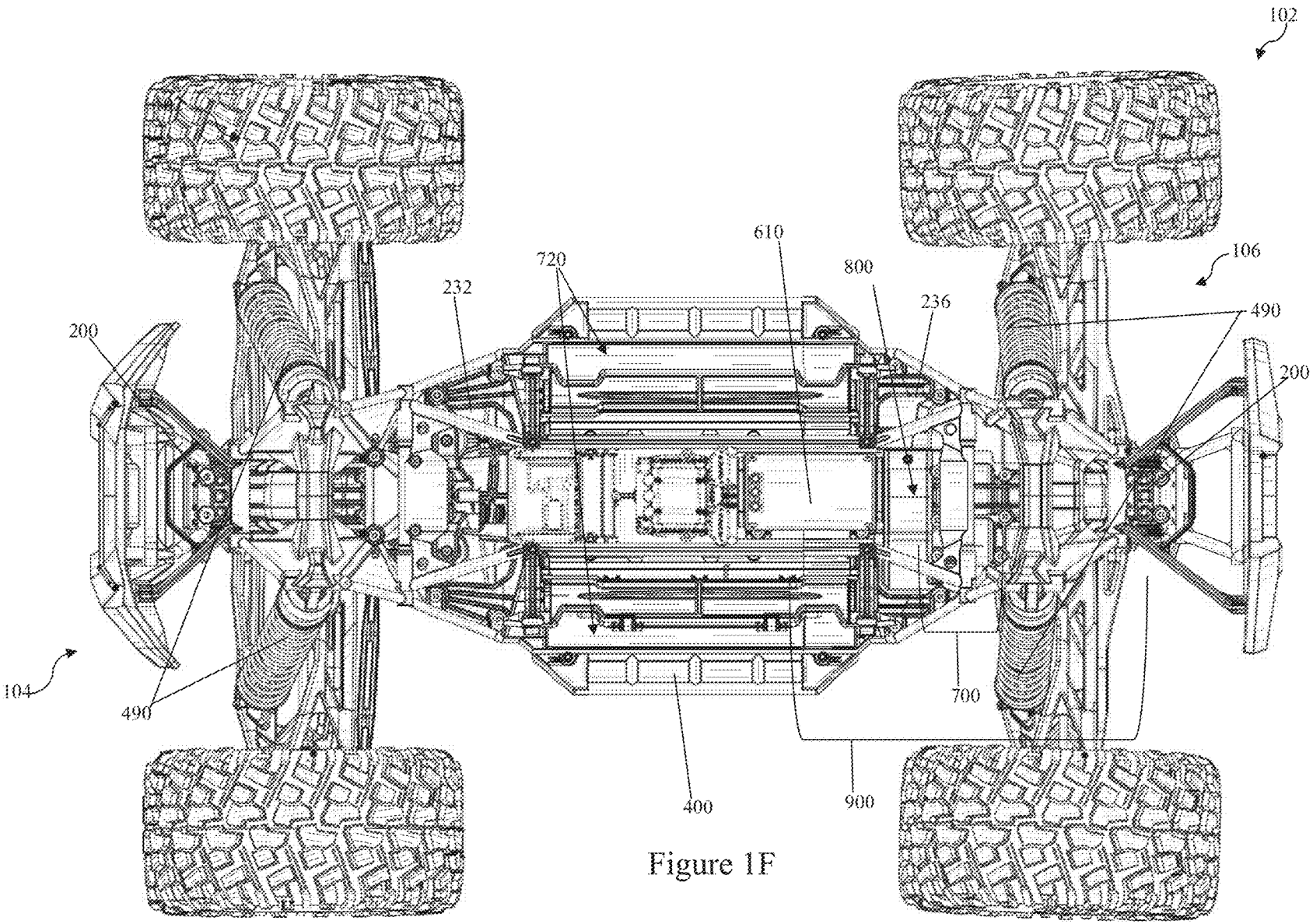
FIG. 1F is a top view of the main assembly of the model vehicle.
Figure 1G:
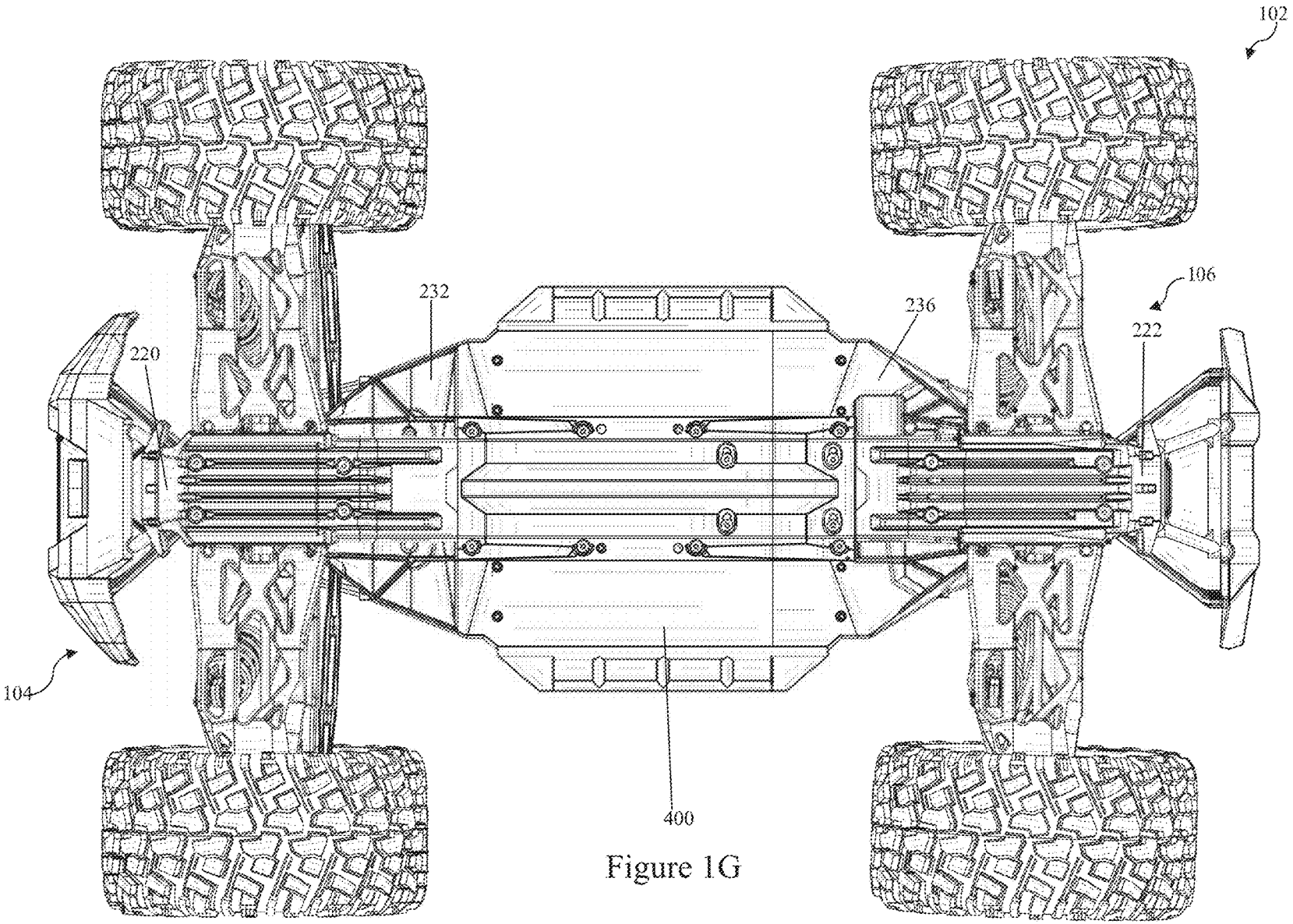
FIG. 1G is a bottom view of the main assembly of the model vehicle.
Figure 1H:
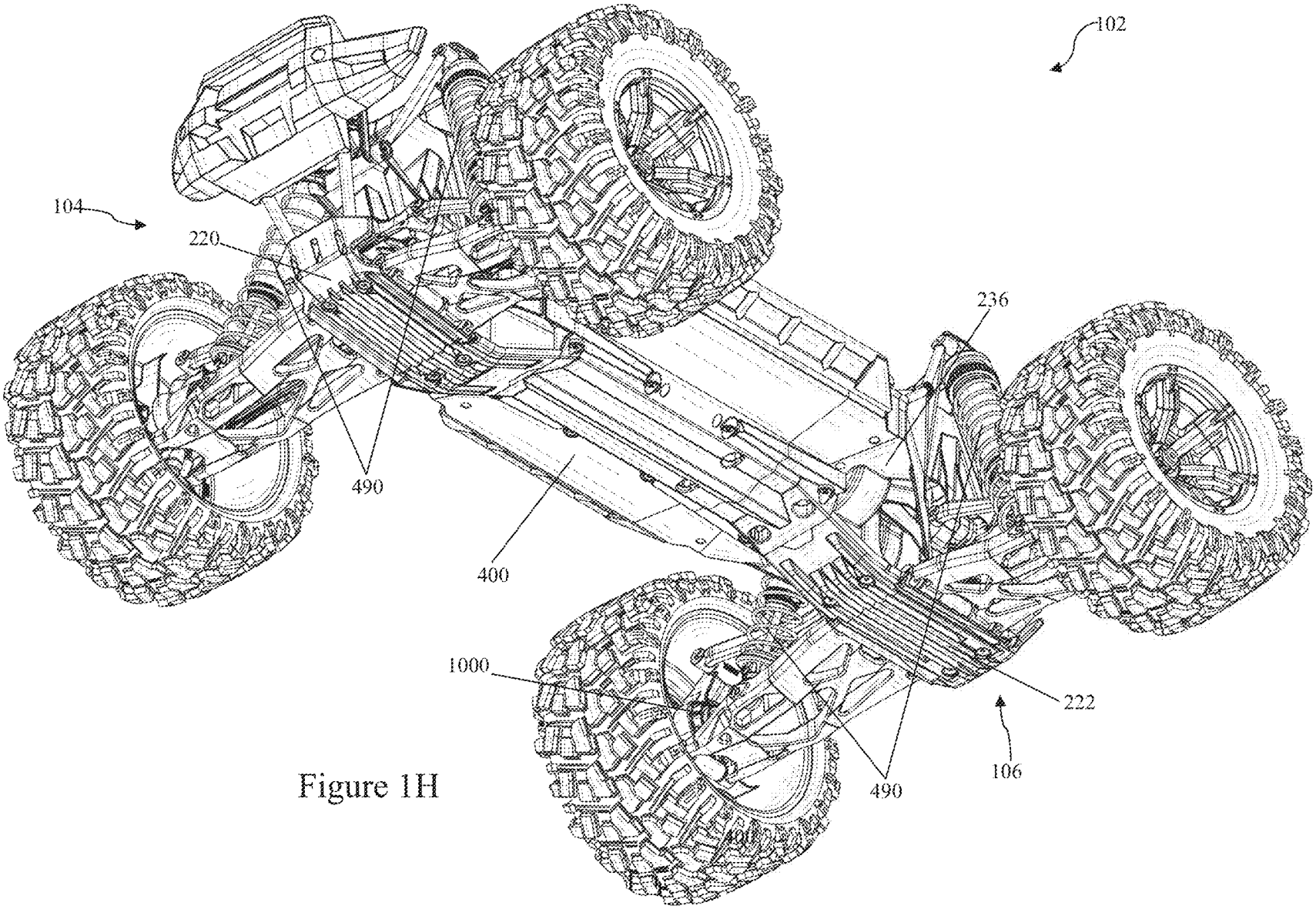
FIG. 1H is a perspective view of the bottom of the main assembly of the model vehicle.

In the embodiment shown in FIG. 1F, the main assembly 102 may be provided with a particular skid-plate shock absorber 200 mounted on both the front and rear assemblies 104, 106. The skid-plate shock absorber 200 at each of the front and rear assemblies 104, 106 may be provided to buffer impact taken by the front skid-plate 220 and the rear skid-plate 222, respectively. The main assembly 102 may be provided with a particular damper 490 to form part of a suspension system of the main assembly 102. The damper 490 may be configured to connect a wheel of the model vehicle 100 to the front and rear assemblies 104, 106. The damper 490 may provide shock absorption and damping functions during operation of the model vehicle 100. The main assembly 102 may be provided with a particular tie-bar 492, 493, 494, 495, 496, 497 configuration for securing the suspension system on the front and rear assemblies 104, 106.

The main assembly 102 may be provided with a particular configuration for securing one or more batteries to the chassis 400. The chassis 400 may be configured with a pair of battery slots 520 each capable of housing at least one battery. The main assembly 102 may be provided with a battery hold down 500 mounted on the chassis 400 to at least one battery in each of the battery slots 520 in the chassis 400. The main assembly 102 may be provided with a particular configuration for mounting a servomechanism. The servomechanism on the main assembly 102 may comprise an actuator assembly 800 mounted internally on the front assembly 104.

The main assembly 102 may be provided with a particular configuration 600 for adjustably mounting a motor 610 on the rear assembly 106. The rear assembly 106 may be provided with a slipper clutch assembly 700 mounted adjacent to the motor 610 on the lower rear chassis bulkhead 236. The main assembly 102 may be provided with a drivetrain 900 mounted to the chassis 400. The drivetrain 900 may span from the chassis 400 to the front assembly 104 and rear assembly 106 to couple the wheel assemblies 1000 of the main assembly 102 to the motor 610. The rear assembly 102 may be provided with an integrated transmission housing 800 encasing portions of the motor 610, the slipper clutch assembly 700 and portions of the drive train 900.

Skid-Plate Shock Absorber

Figure 2A:
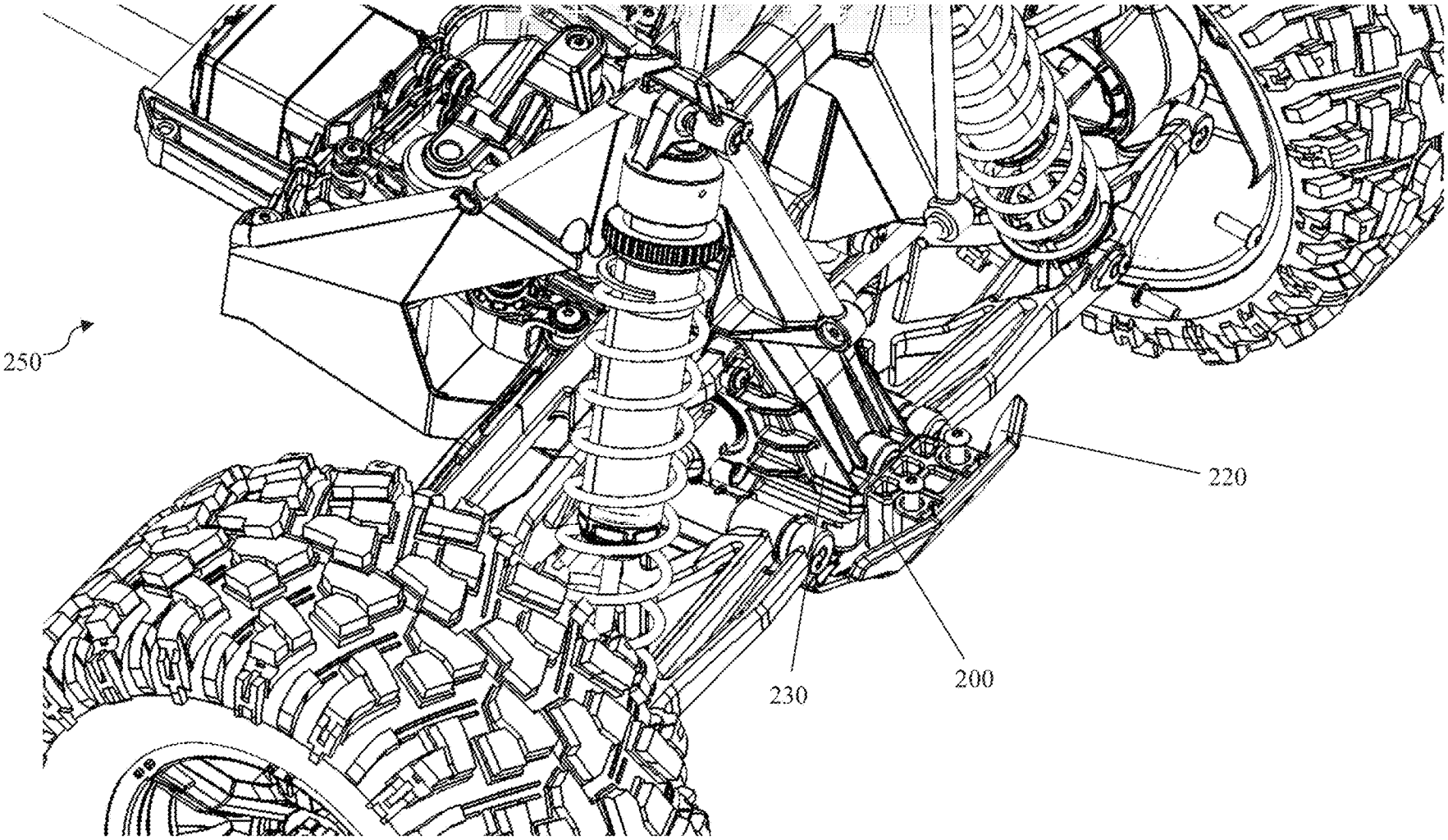
FIG. 2A is a perspective view of the front of the model vehicle with a skid-plate shock absorber.

FIG. 2A illustrates a skid-plate shock absorber 200 which may act as a buffer for the front chassis differential cover 230 and the lower front chassis bulkhead (232 in FIG. 2F) in a model vehicle 100. The skid-plate shock absorber 200 may reduce the force transferred to the front chassis differential cover 230 or the lower front chassis bulkhead (232 in FIG. 2F) of model vehicle 100 when the front skid-plate 220 is impacted.

Figure 2C:
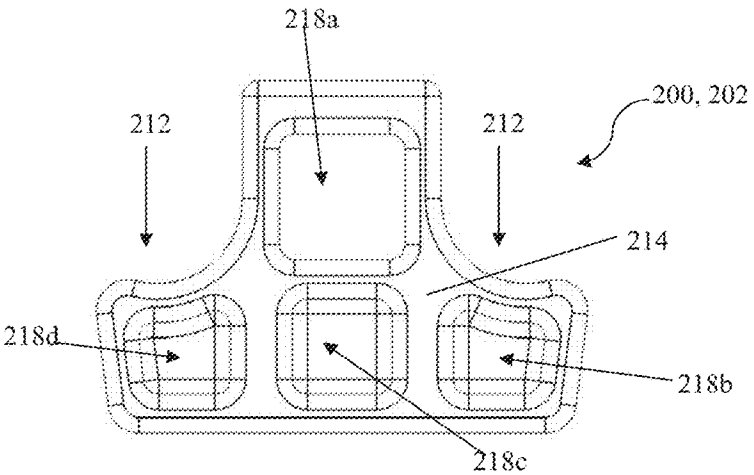
FIGS. 2B-2E is a perspective, top, bottom, and longitudinal side view of the skid-plate shock absorber.
Figure 2E:
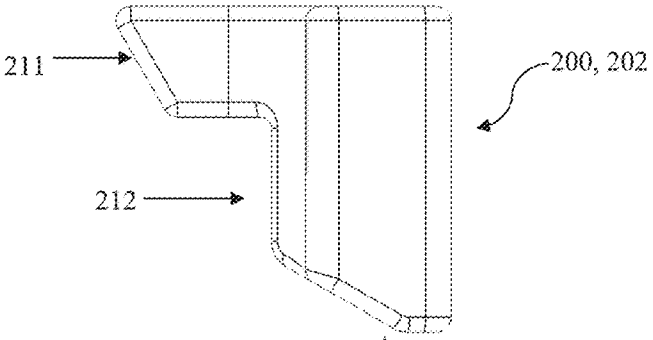
Figure 2B:
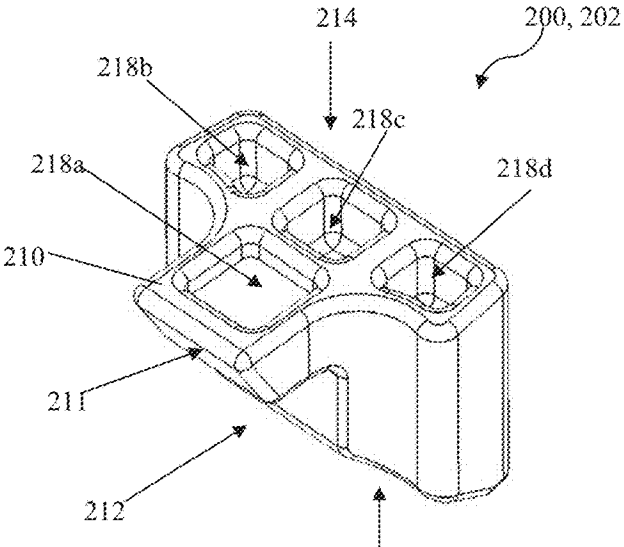
Figure 2D:
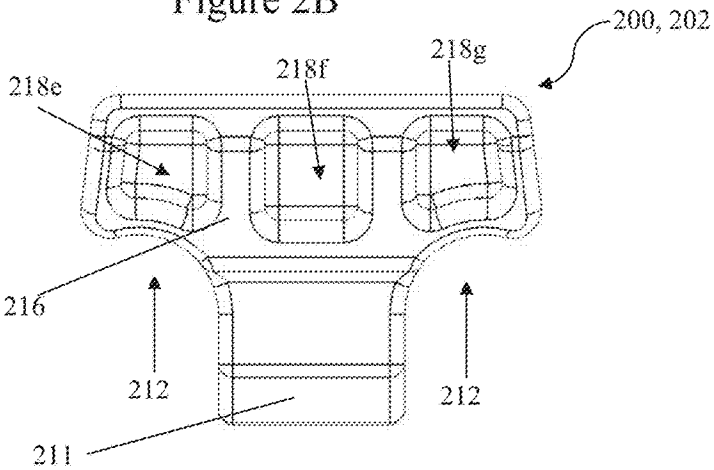

Turning to FIGS. 2B-2E, in an embodiment, the skid-plate shock absorbers 200, 202 may comprise a rectangular prism with a front surface 212, a top surface 214, and a bottom surface 216. The front surface 212 may have an extending member 210 extending out of the upper, middle portion of the front surface 212 only. The top surface of the extending member 210 may be flush with the top surface 214 as shown in FIG. 2B. The extending member 210 may only extend out of an upper third portion longitudinally of the front surface 214 as shown in FIG. 2D, and out of a middle third portion of the front surface 214 laterally as shown in FIG. 2C.

The extending member 210 may have a negative tapered surface 211 at the side of the extending member 210 opposite of the front surface 212 such that the extending member 210 may form like a "cliff" extending out of the front surface 212. The negative tapered face 211 may be formed by cutting a right triangular prism out of the surface of the extending member 210 on the opposite side of the front surface 212 with the right angle planes of the right triangular prism cut from the surface of extending member 210 opposite of the front surface 212 and the bottom surface of extending member 210. The right triangular prism cut from the extending member 210 may essentially remove an edge of the extending member 210 where the bottom surface of the extending member 210 and the surface opposite of the front surface 212 intersect. The portion of the bottom surface of extending member 210 cut may be smaller than the portion of the surface of extending member 210 opposite of the front surface 212. The skid-plate shock absorber 200, 202 may also have similar right triangular prism cut made along the edge where the front surface 212 and bottom surface 216 intersect as shown in FIG. 2E. This may also create a negative tapered surface along the front bottom edge of the front surface 212.

The skid-plate shock absorber 200, 202 may also have a series of square concave depressions 218*a-g* in the top surface of the extending member 210, the top surface 214, and the bottom surface 216 as seen in FIGS. 2B, 2C and 2D. The extending member 210 may have a square depression 218*a* that is substantially bordered by the outer edges of the extending member 210 and the transition area where the extending member 210 extends from the front surface 212. In the top surface 214, there may be three separate square concave depressions 218*b-d* as shown in FIG. 2C. The top surface 214 may comprise the square concave depression 218*c* directly adjacent to the square depression 218*a* in the extending member 210, and a pair of smaller square concave depressions 218*b*, 218*d* flanking the square concave depression 218*c*. The flanking square concave depressions 218*b*, 218*d* may be shaped to border and match the curves along the outer edges of the top surface 214. The bottom surface 218 of the skid-plate shock absorber 200, 202 may comprise three square concave depressions 218*e-g* that substantially mirror the three square concave depressions 218*b-d* on the top surface 214. In the shown embodiment, the bottom surface of the extending member 210 may not comprise any square concave depressions. However, in alternative embodiments, the skid-plate shock absorber 200 may comprise additional shock absorbing features such as additional concave depressions on the bottom surface of the extending member 210.

The square concave depressions 218 may buffer mechanical force transferred when either the front skid-plate 220 or the rear skid-plate 222 of the model vehicle 100 is impacted. The square shape of the concave depressions 218*a-g* may be just one shape of depressions that may be used in the shock absorber to buffer mechanical force. Alternatively, other shaped depressions may be used to create space and air buffers in the shock absorber 200, 202. In another embodiment, the skid-plate shock absorber 200, 202 may also be substantially solid without any shaped depressions at all. The skid-plate shock absorber 200, 202 may also be constructed with various other force buffering characteristics such as being an air-filled hollow structure, having complete through openings instead of notches, and the like. Furthermore, the skid-plate shock absorber 200, 202 may also be constructed with other spring like or cushiony materials such as foam, rubber, and the like to buffer impact taken at front or rear skid-plate 220, 222. The skid-plate shock absorber 200, 202 may also be constructed with additional mechanical fixtures that may buffer mechanical forces such as a skid-plate shock absorber 200, 202 with springs, dash pots, and the like.

Figure 2F:
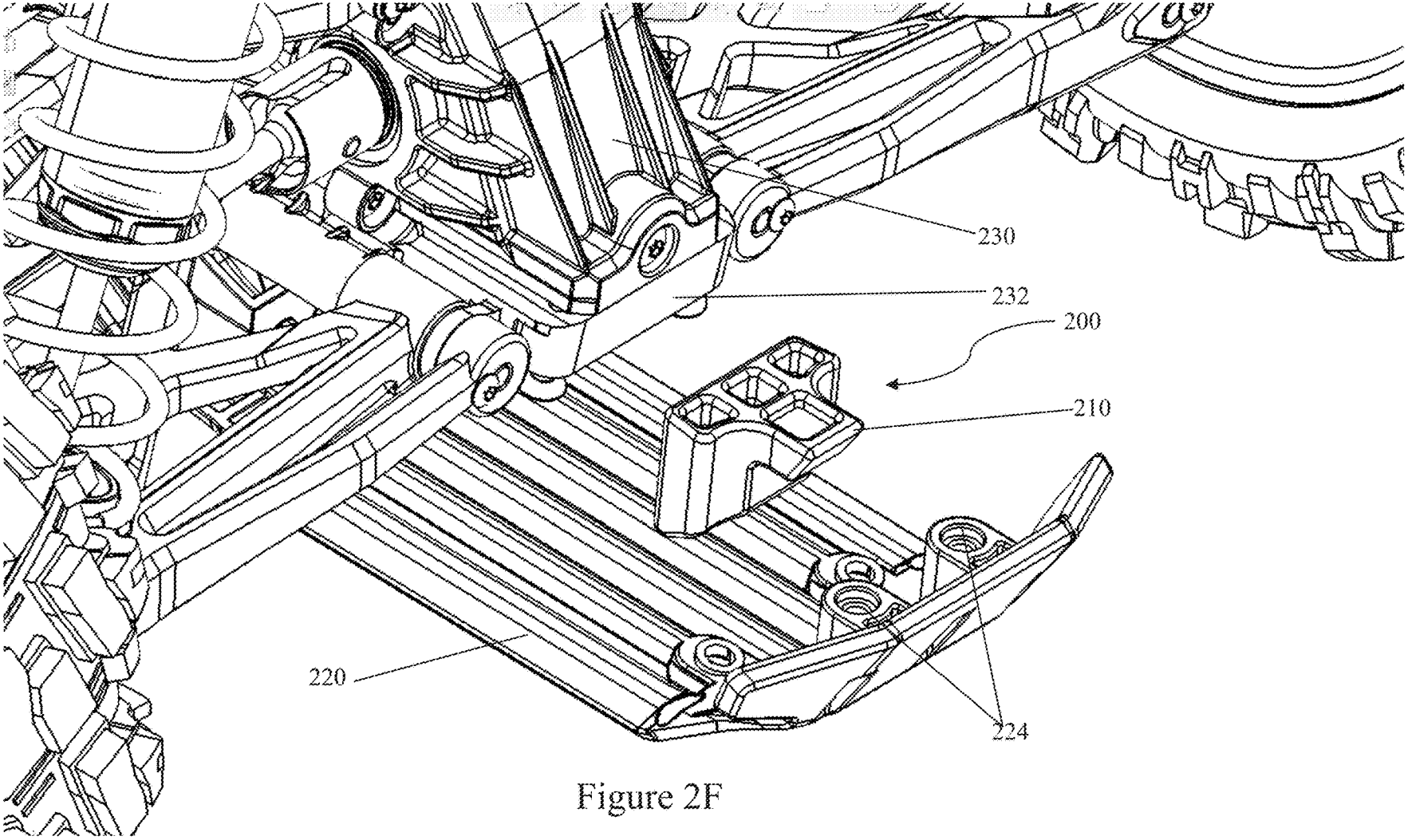
FIG. 2F is an exploded view of the front skid-plate shock absorbers within the model vehicle.
Figure 2G:
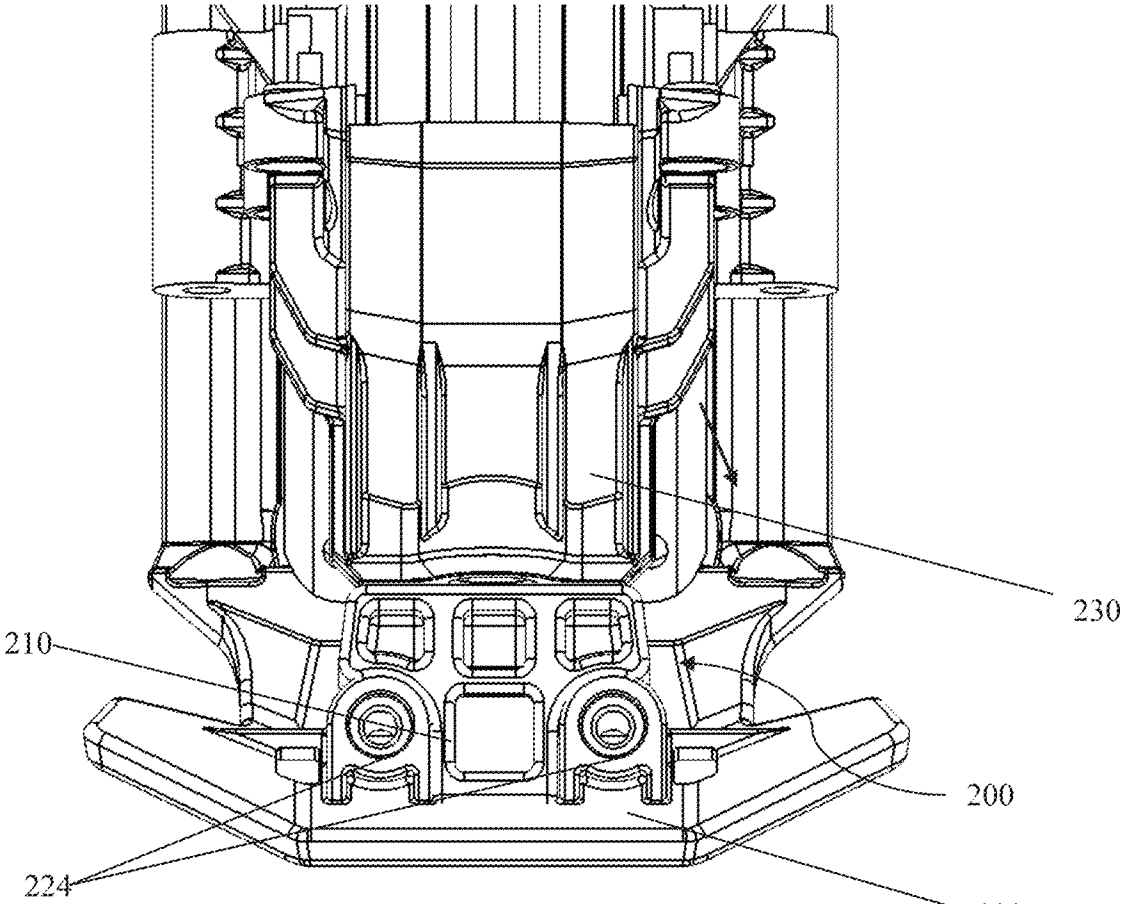
FIG. 2G is a top view of the front of a model vehicle with a skid-plate shock absorber.
Figure 2H:
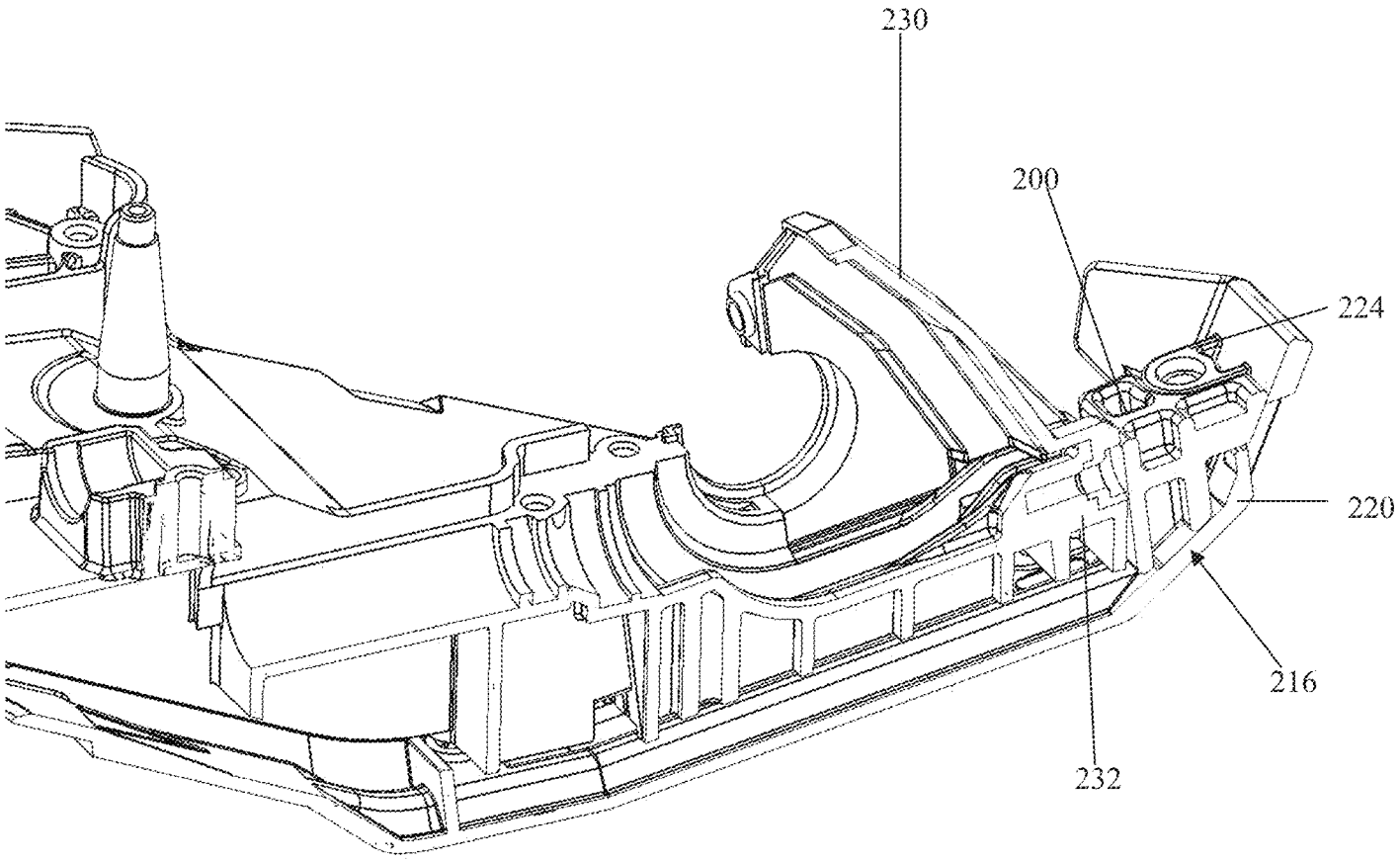
FIG. 2H is a perspective sectional view of the front of the model vehicle with a skid-plate shock absorber.

In FIGS. 2F-2H, in an embodiment, the skid-plate shock absorber 200 may be positioned behind the front skid-plate 220 and in front of the front chassis differential cover 230 and lower front chassis bulkhead 232 to act as a buffer. The front skid-plate 220 may begin in front of the skid-plate shock absorber 200 and curve below the shock absorber 200 and extend under the lower front chassis bulkhead 232. The skid-plate shock absorber 200 may be secured to the front skid-plate 220 by interlocking the extending member 210 between a pair of front skid-plate extending members 224. The skid-plate extending members 224 may be located on the interior surface of the front skid-plate 220 as shown in FIG. 2F and may be spaced apart slightly less than the width of the extending member 210. This may allow for some tension to secure the skid-plate shock absorber 200 when the extending member 210 is fitted tightly between the front skid-plate extending members 224. The front skid-plate extending members 224 may also prevent the skid-plate shock absorber 200 from any lateral movement or being displaced when the front skid-plate 220 is impacted. The skid-plate shock absorber 200 may be installed and secured to the front skid-plate 220 without the use of separate fasteners or tools. Alternatively, the skid-plate shock absorber 200 may be secured instead by being interlocked in the front chassis differential cover 230 or the lower front chassis bulkhead 232.

As shown in FIG. 2H, the negative tapered surface along the front bottom edge of the front surface 212 may permit the bottom surface 216 of the skid-plate shock absorber 200 to tightly contact the curved interior surface of the front skid-plate 220. The skid-plate shock absorber 200 may also be constructed to be at least as wide as the entire end of the front chassis differential cover 230 and the lower front chassis bulkhead 232 to completely buffer the front chassis differential cover 230 and the lower front chassis bulkhead 232 from any impact to the front skid plate 220. Alternatively, the skid-plate shock absorber 200 may be wider or narrower than the front chassis differential cover 230 and the lower front chassis bulkhead 232. The skid-plate shock absorber 200 may also be constructed to be as high as the combined height of the front chassis differential cover 230 and the lower front chassis bulkhead 232. This may allow a single skid-plate shock absorber 200 to buffer both the front chassis differential cover 230 and the lower front chassis bulkhead 232. The skid-plate shock absorber 200 may therefore be positioned directly in contact with both the front chassis differential cover 230 and the lower front chassis bulkhead 232 to absorb and reduce the force transferred to both when the front skid-plate 220 is impacted. Alternatively, a separate skid-plate shock absorber 200 may be used to buffer each of the front chassis differential cover 230 and the lower front chassis bulkhead 232. If more than one skid-plate shock absorber 200 is used, each of the skid-plate shock absorbers 200 may comprise an extending member 210 that may interlock into at least one of the front skid-plate 220, the front chassis differential cover 230, or the lower front chassis bulkhead 232 to secure each respective skid-plate shock absorber 200 used in place.

Figure 2I:
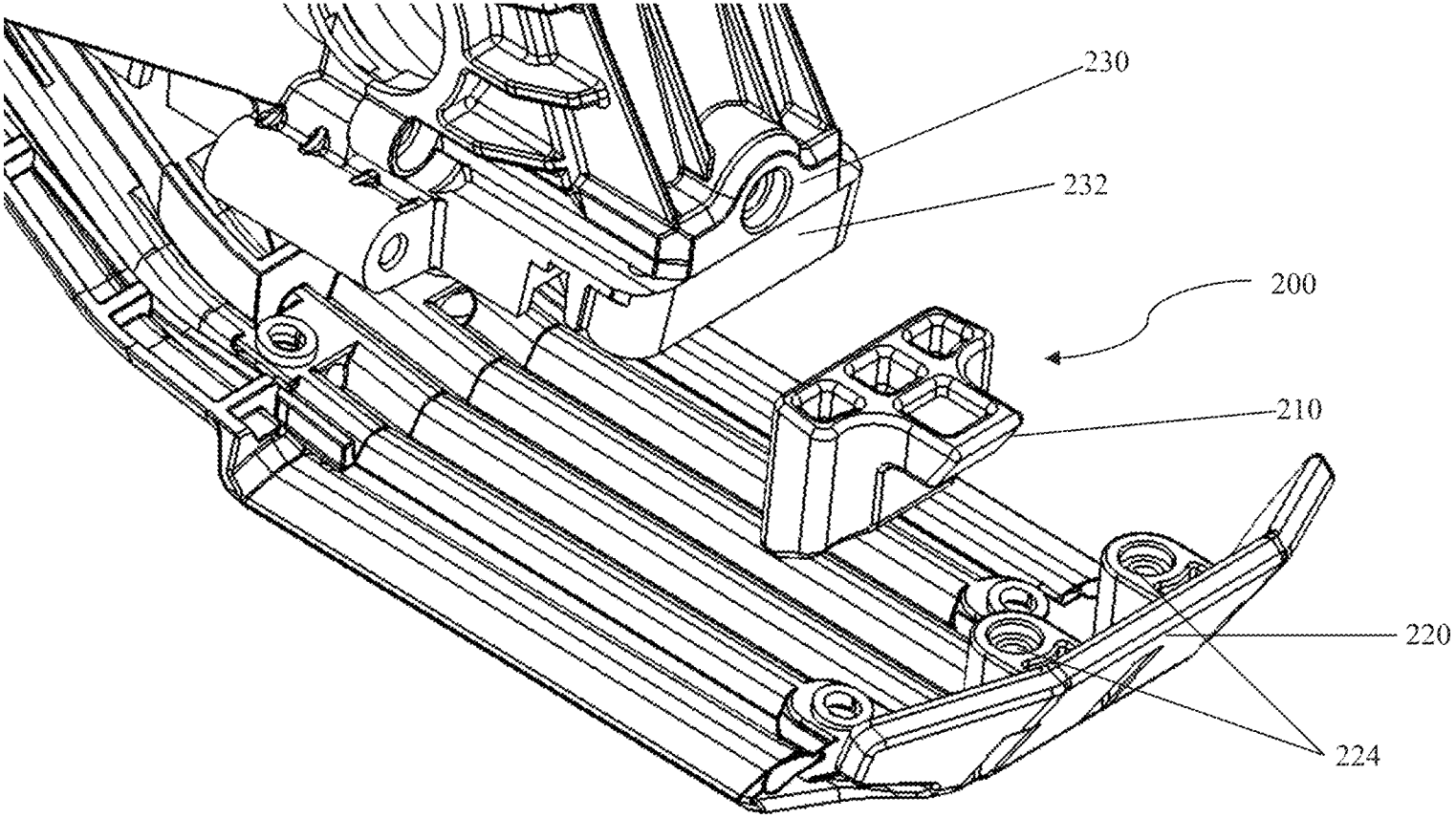
FIG. 2I is an exploded view of the front skid-plate shock absorber and surrounding parts only.

FIG. 2I illustrates how the skid-plate shock absorber 200 may be assembled with the front skid-plate 220, the front chassis differential cover 230, and the lower front chassis bulkhead 232, with the rest of the model vehicle 100 removed to avoid obscuring the views.

Figure 2J:
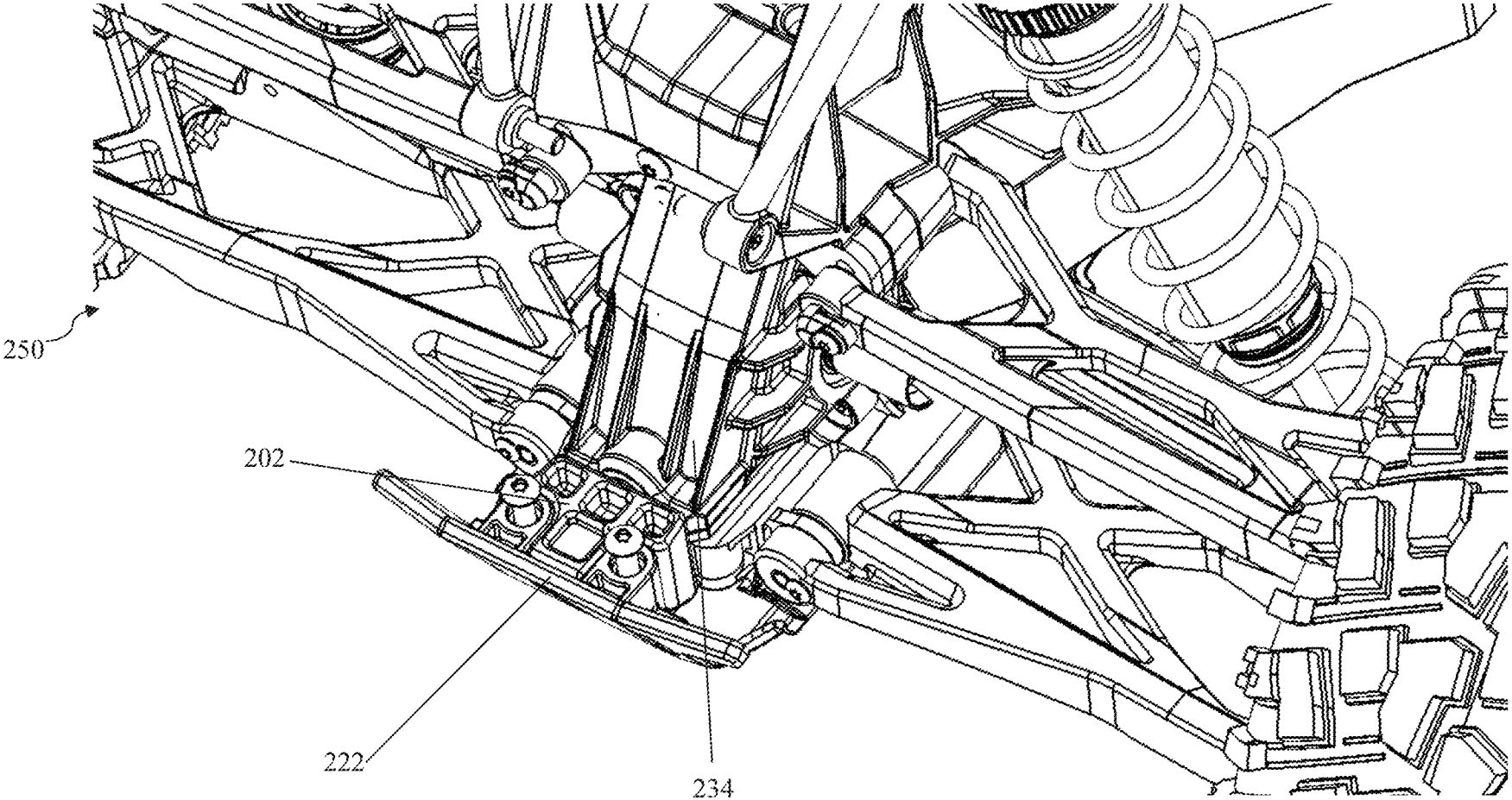
FIG. 2J is a perspective view of the rear of the model vehicle with a skid-plate shock absorber.
Figure 2K:
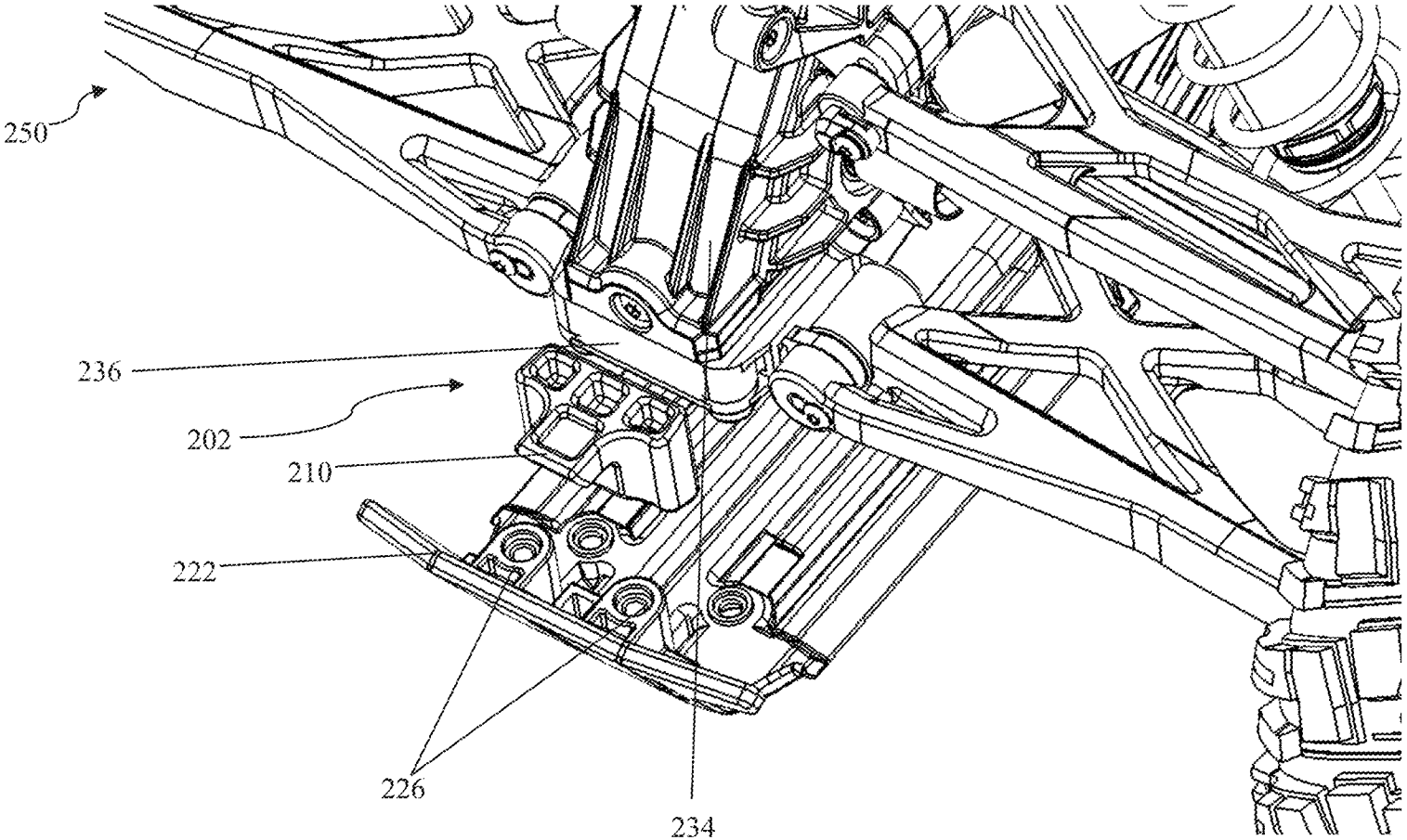
FIG. 2K is an exploded view of the rear skid-plate shock absorbers within the model vehicle.

Turning now to FIGS. 2J and 2K, a skid-plate shock absorber 202 may be used on the rear portion of the model vehicle 100 to reduce the force taken by the rear chassis differential cover 234 or the lower front chassis bulkhead (236 in FIG. 2K) when model vehicle 100 is impacted at the rear skid-plate 222. The skid-plate shock absorber 202 in model vehicle 100 may act as a buffer against a force when the rear skid-plate 222 of the model vehicle 100 is impacted.

Figure 2L:
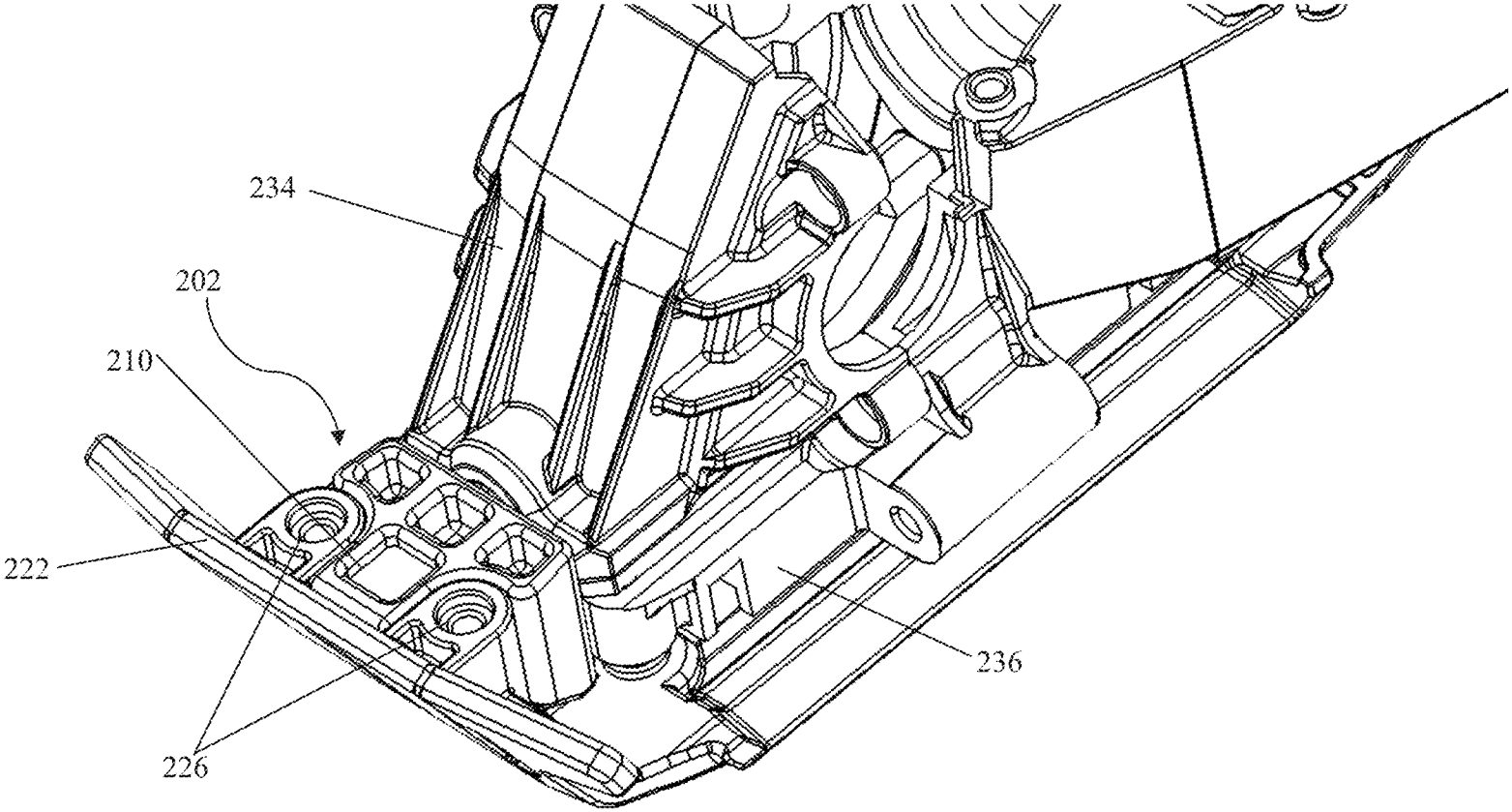
FIGS. 2L-2N is a perspective, top, and longitudinal side view of the rear of the model vehicle with a skid-plate shock absorber.
Figure 2M:
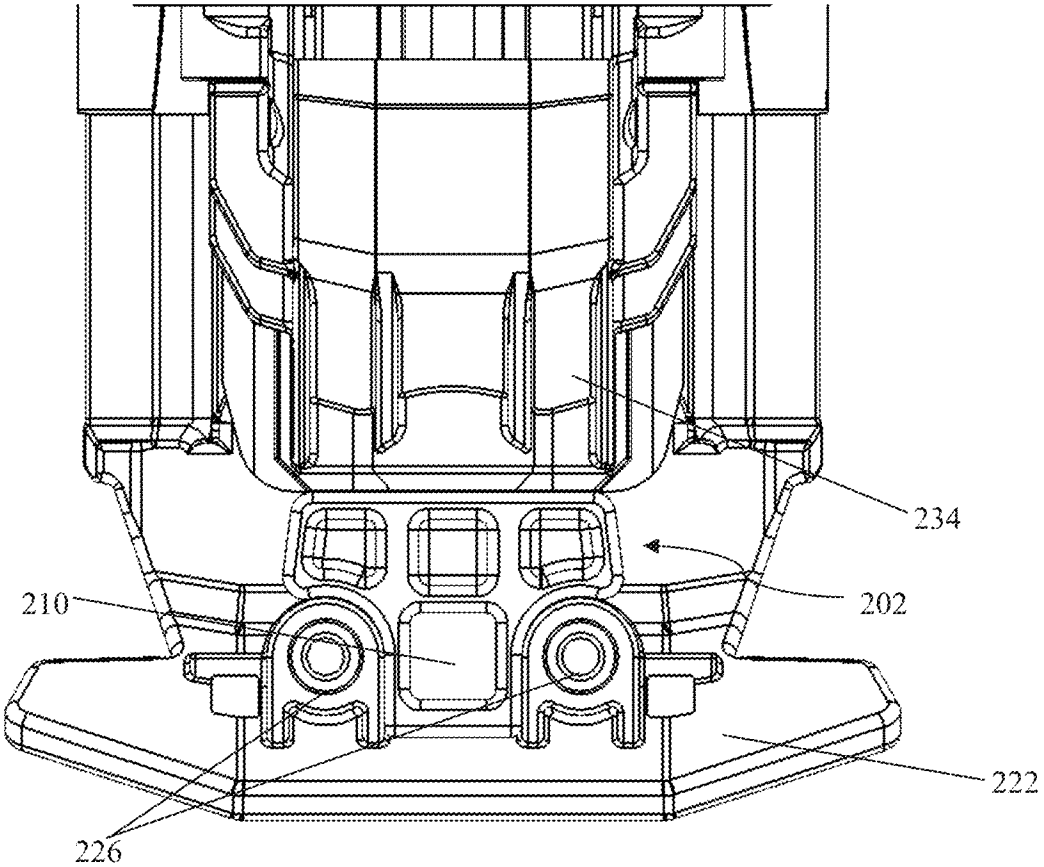

In an embodiment, the skid-plate shock absorber 202 may be positioned behind the rear skid-plate 222 and in front of the rear chassis differential cover 234 and lower rear chassis bulkhead 236 to act as a buffer. The rear skid-plate 220 may begin in front of the skid-plate shock absorber 202 and curve below the shock absorber 202 and extend under the lower rear chassis bulkhead 236. The skid-plate shock absorber 202 may be secured to the rear skid-plate 222 by interlocking the extending member 210 between a pair of rear skid-plate extending members 226. The skid-plate extending members 226 may be located on the interior surface of the rear skid-plate 222 as shown in FIG. 2L and may be spaced apart slightly less than the width of the extending member 210. This may allow for some tension to secure the skid-plate shock absorber 202 when the extending member 210 is fitted tightly between the rear skid-plate extending members 226. The rear skid-plate extending members 226 may also prevent the skid-plate shock absorber 202 from any lateral movement or being displaced when the rear skid-plate 220 is impacted. The skid-plate shock absorber 200 202 be installed and secured to the rear skid-plate 222 without the use of separate fasteners or tools. Alternatively, the skid-plate shock absorber 202 may be secured instead by being interlocked in the rear chassis differential cover 234 or the lower rear chassis bulkhead 236.

Figure 2N:
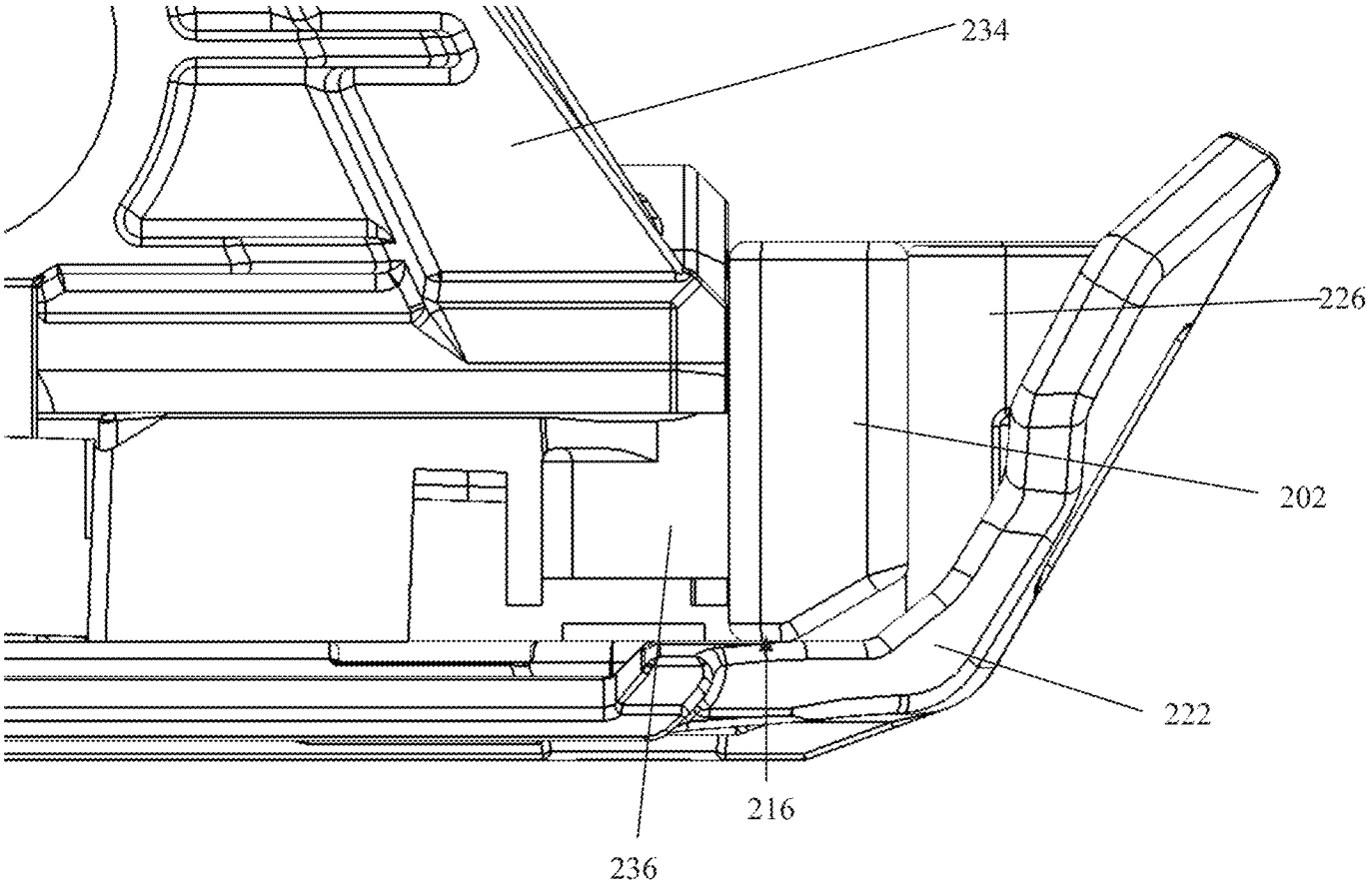

As shown in FIG. 2N, the negative tapered surface along the front bottom edge of the front surface 212 of the skid-plate shock absorber 202 may not make contact with the rear skid-plate 222. Only the remaining portions of the bottom 202 216 may contact the interior surface of the rear skid-plate 222. The skid-plate shock absorber 200 may also be constructed to be at least as wide as the entire end of the rear chassis differential cover 234 and the lower front chassis bulkhead 236 to completely buffer both parts from any impact to the rear skid plate 222. Alternatively, the skid-plate shock absorber 200 may be wider or narrower than the rear chassis differential cover 234 and the lower front chassis bulkhead 236. As shown in FIG. 2N, the skid-plate shock absorber 202 may also be constructed to be as high as the combined height of the rear chassis differential cover 234 and the lower rear chassis bulkhead 236. This may allow a single skid-plate shock absorber 202 to buffer both parts. The skid-plate shock absorber 202 may therefore be positioned directly in contact with both the rear chassis differential cover 234 and the lower rear chassis bulkhead 236 to absorb and reduce the force transferred to both parts when the rear skid-plate 222 is impacted. Alternatively, a separate skid-plate shock absorber 202 may be used to buffer each of the front chassis differential cover 230 and the lower front chassis bulkhead 232. If more than one skid-plate shock absorber 202 is used, each of the skid-plate shock absorbers 202 may comprise an extending member 210 that may interlock into at least one of the rear skid-plate 222, the rear chassis differential cover 234, or the lower rear chassis bulkhead 236 to secure each respective skid-plate shock absorber 202 used in place.

Figure 2O:
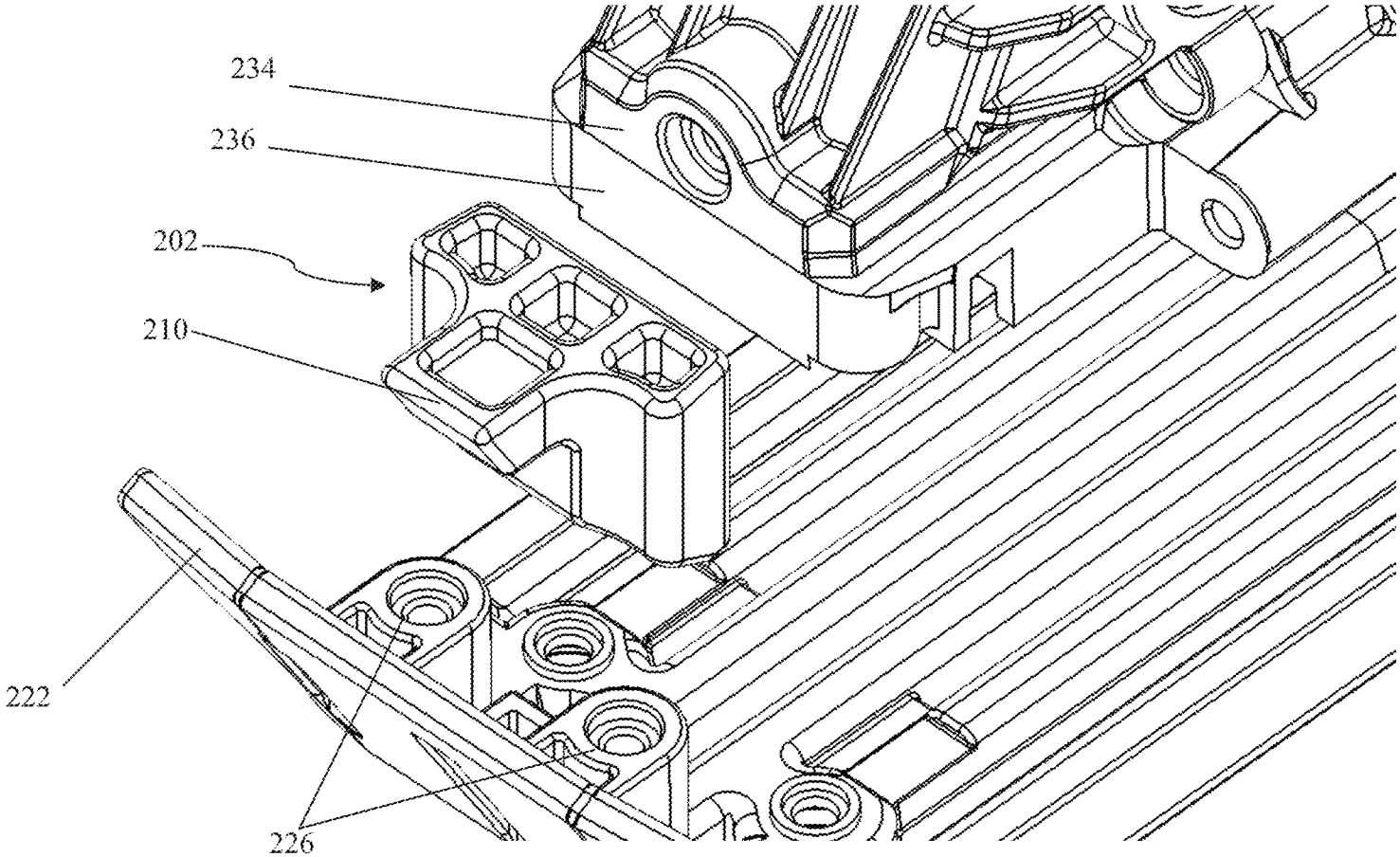
FIG. 2O is an exploded view of the rear skid-plate shock absorber and surrounding parts only.

FIG. 2O illustrates how the skid-plate shock absorber 202 may be assembled with the rear skid-plate 222, the rear chassis differential cover 234, and the lower rear chassis bulkhead 236, with the rest of the model vehicle 100 removed to avoid obscuring the views.

Body Mounting Provisions

Figure 3A:
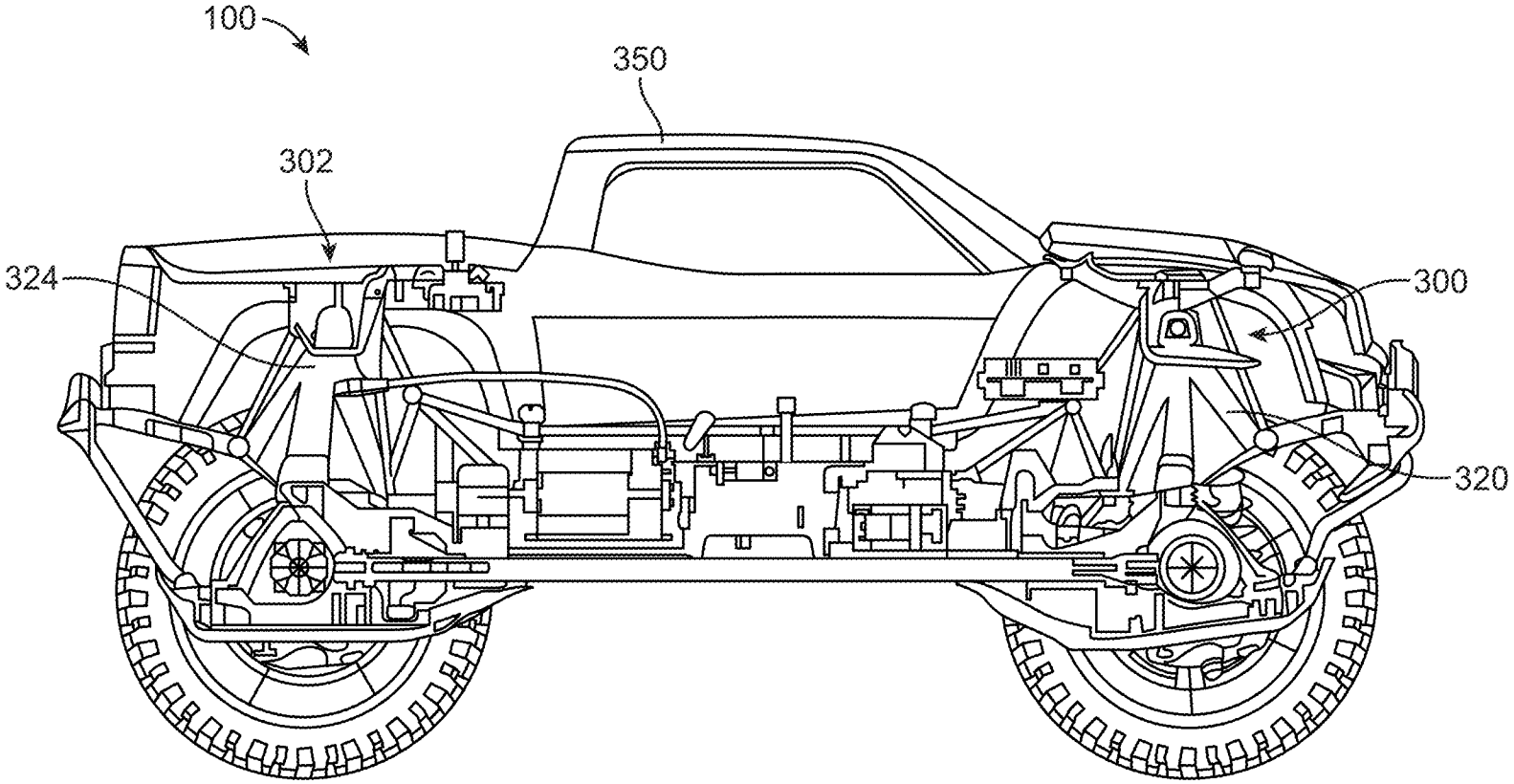
FIG. 3A is a longitudinal sectional view taken along approximately the middle of the model vehicle with a tongue body mount and a lever body mount.
Figure 3B:
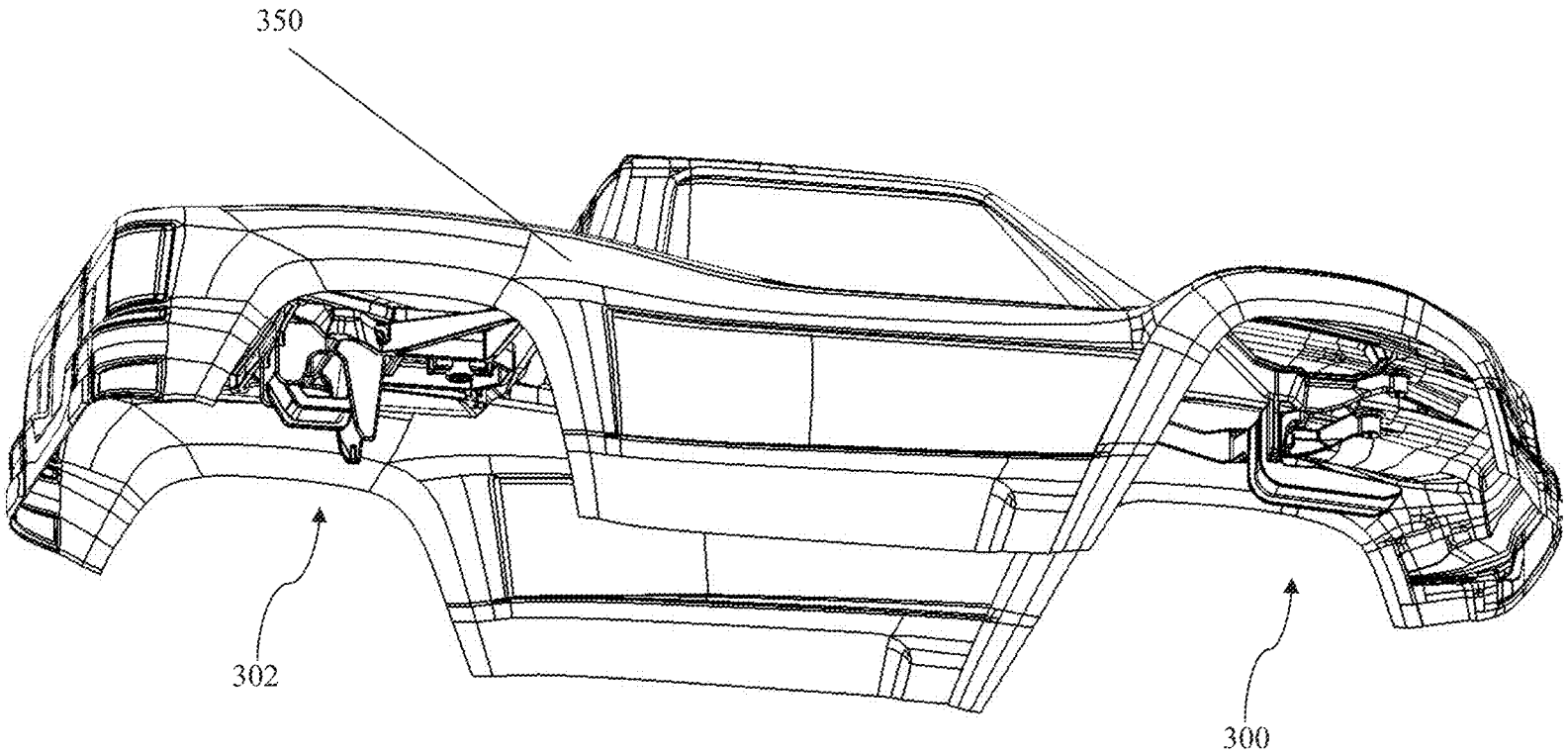
FIG. 3B is a perspective view of the vehicle body with the tongue body mount and the lever body mount.

FIGS. 3A and 3B illustrate a model vehicle 100 with a vehicle body 350 mounted using a tongue body mount 300 in the front and a lever body mount 302 in the rear. In an embodiment, the tongue body mount 300 may be used to mount the front of the vehicle body 350 to the front shock towers 320. The lever body mount 302 may be used to mount the rear of the vehicle body 350 to the rear shock towers 324. Alternatively, the model vehicle 100 may be a watercraft, boat, and the like. The model vehicle 100 may also be an aircraft, helicopter, quadcopter, plane, and the like. Furthermore, the vehicle body 350 may be a car body, a boat hatch, a quadcopter canopy, and the like. In the embodiment shown, the vehicle body 350 may be a truck body to be mounted on the model vehicle 100. At least one of the tongue body mount 300 or the lever body mount 302 may each be used to mount any portion of vehicle body 350 for the model vehicle 100. In an embodiment, at least one tongue body mount 300 may be used to secure the front portion, the rear portion, or the whole vehicle body 350 for the model vehicle 100. Alternatively, at least one lever body mount 302 may be used to secure the front portion, the rear portion, or the whole vehicle body 350 for the model vehicle 100.

Figure 3C:
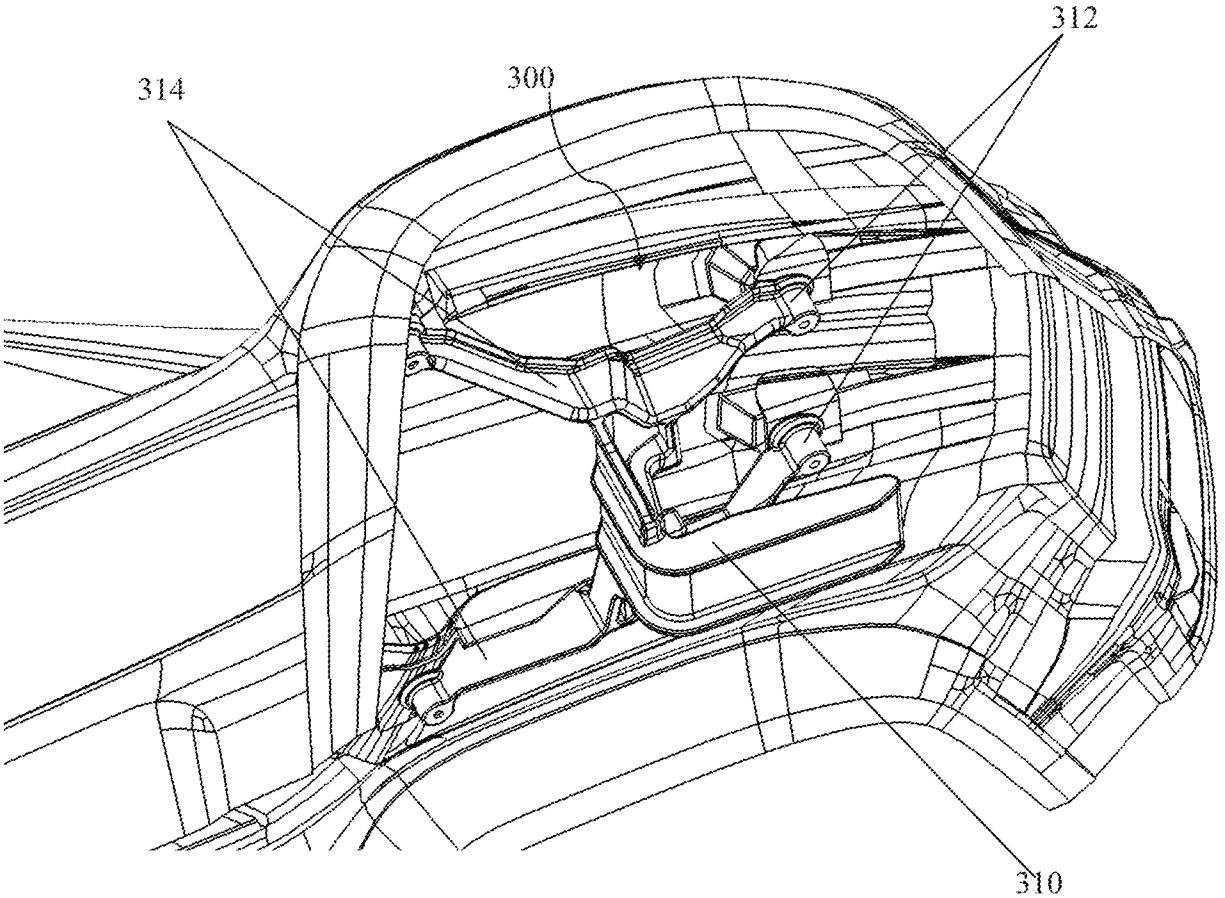
FIG. 3C is a perspective view of the tongue body mount on the vehicle body.

In FIG. 3C, the tongue body mount 300 may comprise an angled tongue member 310 that may be configured to engage the front shock towers (320 in FIG. 3G) of the model vehicle 100. The angled tongue member 310 may be connected to a pair of tongue mount front support arms 312 and a pair of tongue mount rear support arms 314 to secure the angled tongue member 310 to the vehicle body 350. The front or rear tongue mount support arms 312, 314 may be secured to the vehicle body 350 by an adhesive, screws, bolts, clips, bindings, magnets, mechanical fasteners or the like. The tongue body mount 300 including the front and rear tongue mount support arms 312, 314 may also be constructed as part of the vehicle body 350 in a unitary construction. The tongue body mount 300 may not necessarily require a pair of tongue mount front support arms 312 or a pair of tongue mount rear support arms 314 to secure the angled tongue member 310 to the vehicle body 350. The tongue body mount 300 may comprise a single support arm in the front and/or the rear, or a single support arm overall to secure the tongue body mount 300 to the vehicle body 350. The angled tongue member 310 may also be directly attached to the vehicle body 350.

Figure 3D:
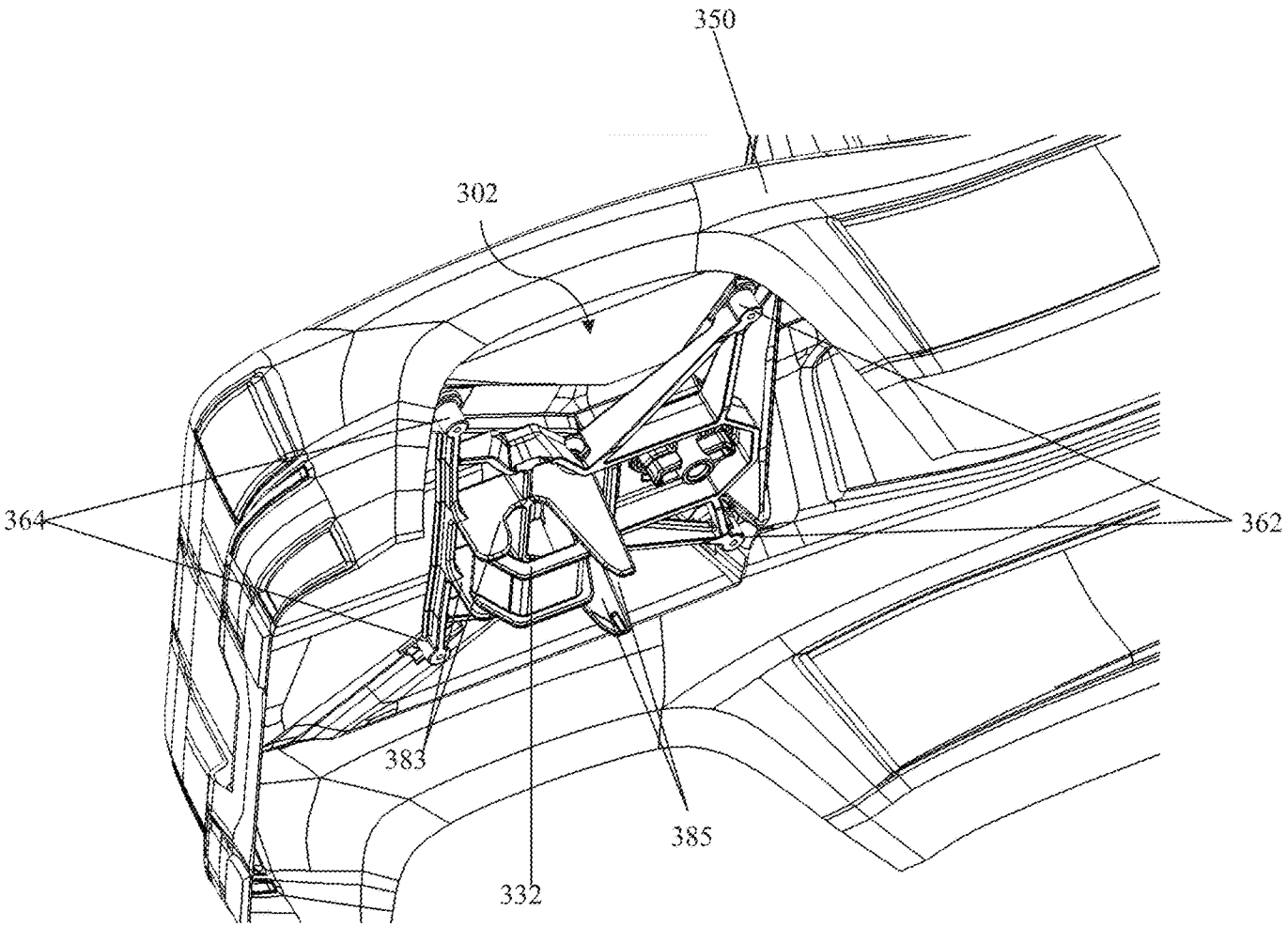
FIG. 3D is a perspective view of the lever body mount on the vehicle body.

The lever body mount 302 as shown in FIG. 3D may comprise a jaw clamp 332 that may be moveable to engage the rear shock towers (324 in FIG. 3W) of the model vehicle 100. The jaw clamp 332 may be moved between an engaged and disengaged position. FIG. 3D currently shows the jaw clamp 332 in an engaged position. The lever body mount 302 may be secured to the vehicle body 350 by a pair of lever mount front support arms 362 and a pair of lever mount rear support arms 364. The front lever mount support arms 362 and the rear lever mount support arms 364 may be secured to the vehicle body 350 using an adhesive, screws, bolts, clips, bindings, magnets, mechanical fasteners or the like. The lever body mount 302 including the front and rear lever mount support arms 362, 364 may also be constructed as part of the vehicle body 350 in a unitary construction. The lever body mount 302 may not necessarily require a pair of lever mount front support arms 362 or a pair of lever mount rear support arms 314 to secure the lever body mount 302 to the vehicle body 350. The lever body mount 302 may instead comprise a single front and/or the rear support arm, or a single support arm overall to secure the lever body mount 302 to the vehicle body 350.

Figure 3E:
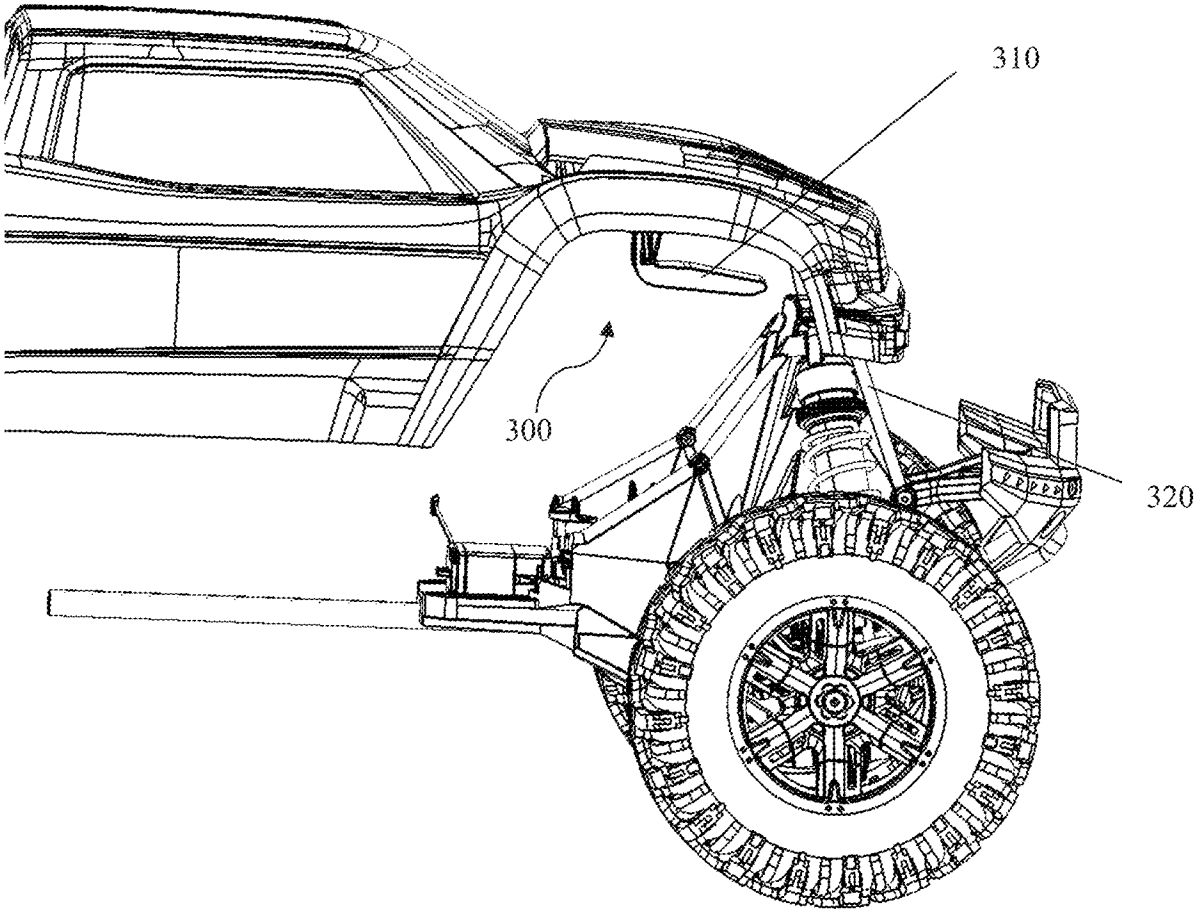
FIG. 3E is a longitudinal side view of the tongue body mount on the vehicle body next to the front shock towers.
Figure 3F:
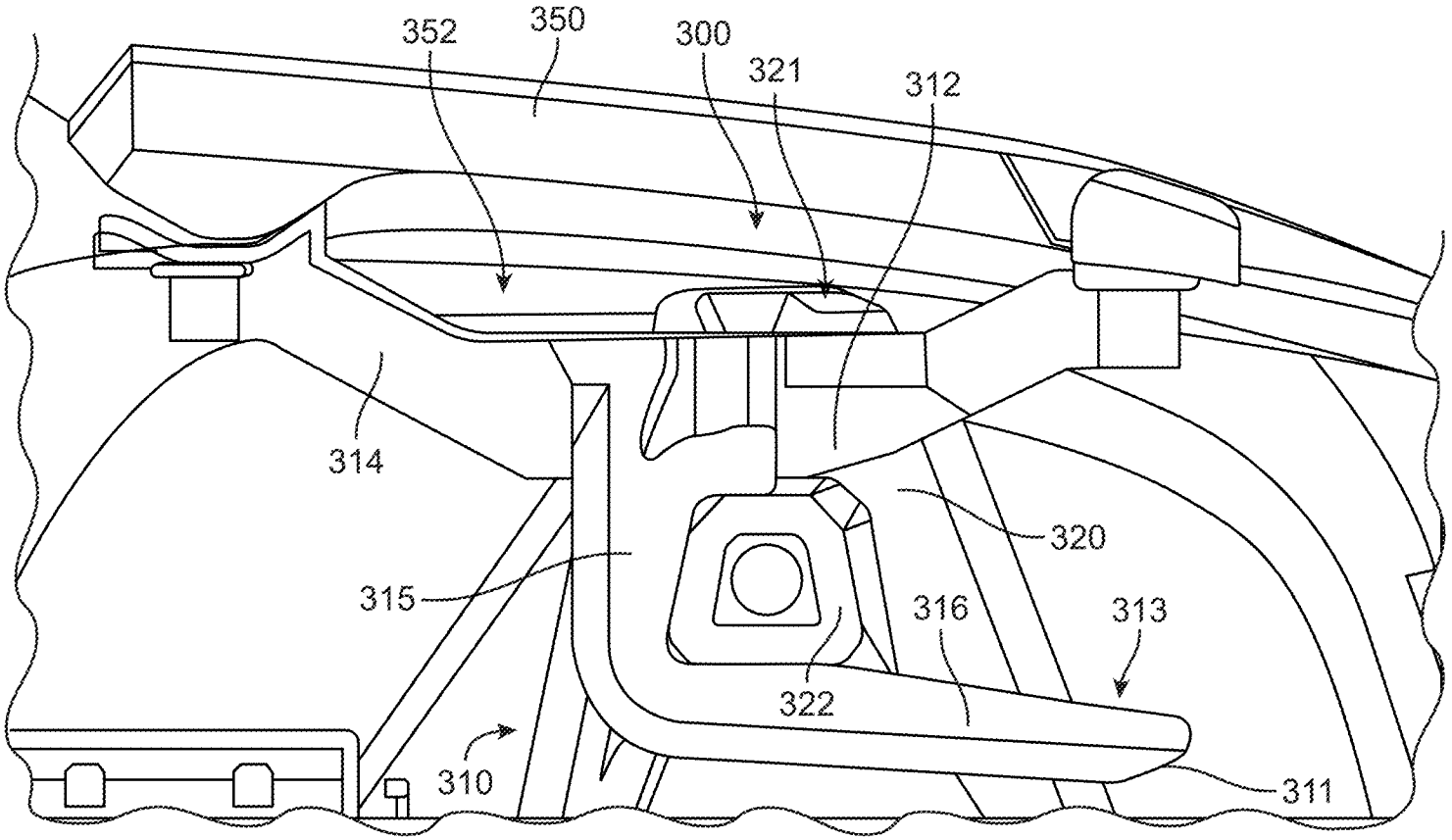
FIG. 3F is a longitudinal sectional view of the tongue body mount engaged to the front cross beam.

Turning to FIGS. 3E-3H, the tongue body mount 300 mounts the vehicle body 350 by engaging the angled tongue member 310 with a front cross beam (322 in FIG. 3F) of the front shock towers 320 of model vehicle 100. In an embodiment, the angled tongue member 310 may comprise a vertical first tongue member 315 and a horizontal second tongue member 316 as shown in FIG. 3F. The first tongue member 315 may be connected to the front and rear tongue mount support arms 312, 314 to secure the angled tongue member 310 to the vehicle body 350. Alternatively, the first tongue member 315 may be directly attached to the interior surface 352 of the vehicle body 350. The second tongue member 316 may form a substantially right angle with first tongue member 315 so that the second tongue member 316 may be substantially parallel with the vehicle body 350.

The second tongue member 316 may comprise an upward sloping tapered tip 311 that may aid in engaging the angled tongue member 310 to the front cross beam 322. The upward sloping tapered tip 311 may have an inclined angled cut from the bottom of the tapered tip 311 so that the angled tongue member 310 may avoid snagging parts beneath the front cross beam 322 when engaging it. The top surface 313 of the second tongue member 316 may be a declining sloped surface. Starting from where the second tongue member 316 connects to the first tongue member 315, the top surface 313 may begin to slope downward towards the tapered tip 311.

Figure 3G:
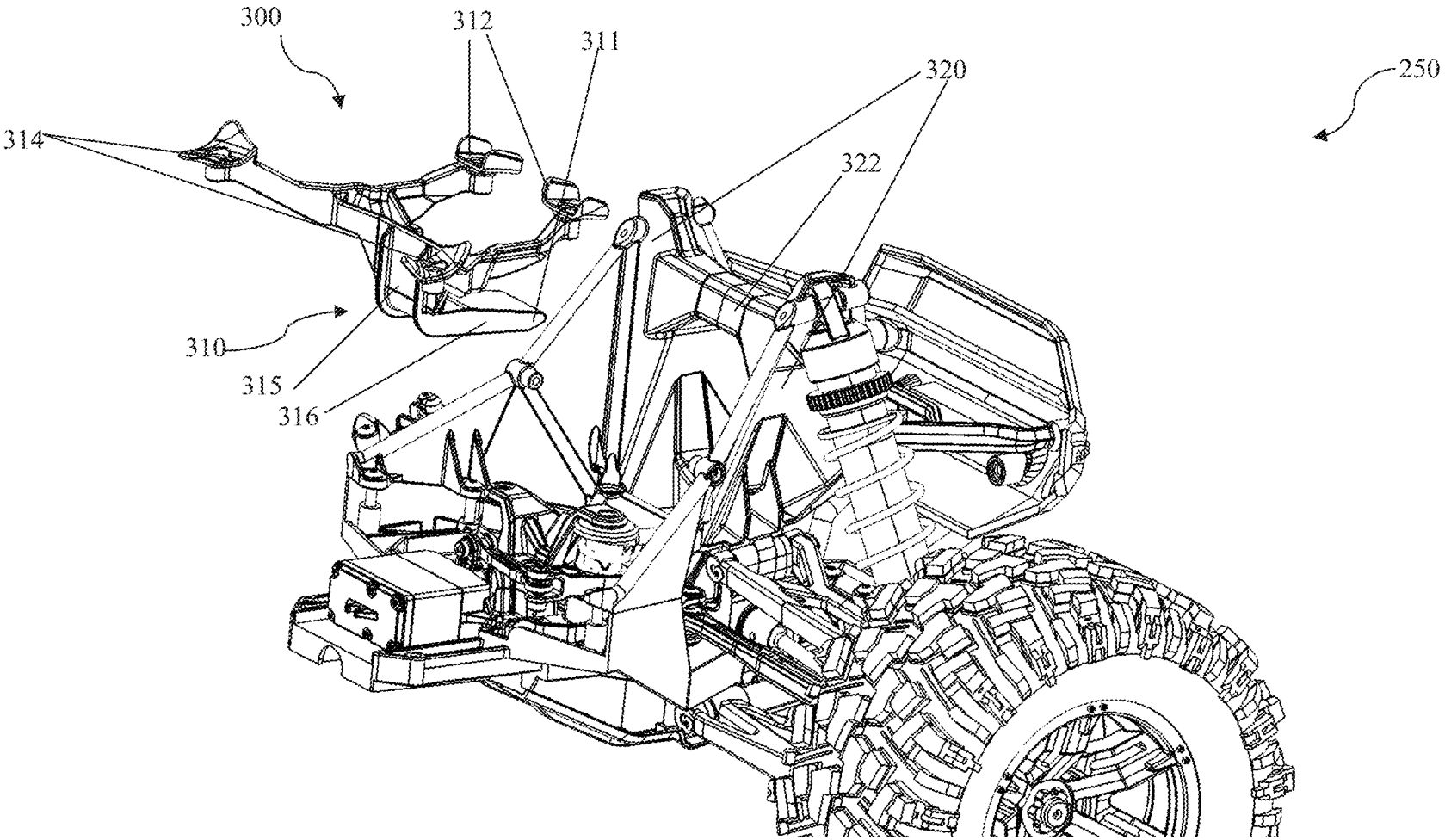
FIG. 3G is a perspective view of the tongue body mount prior to engaging the front cross beam.
Figure 3H:
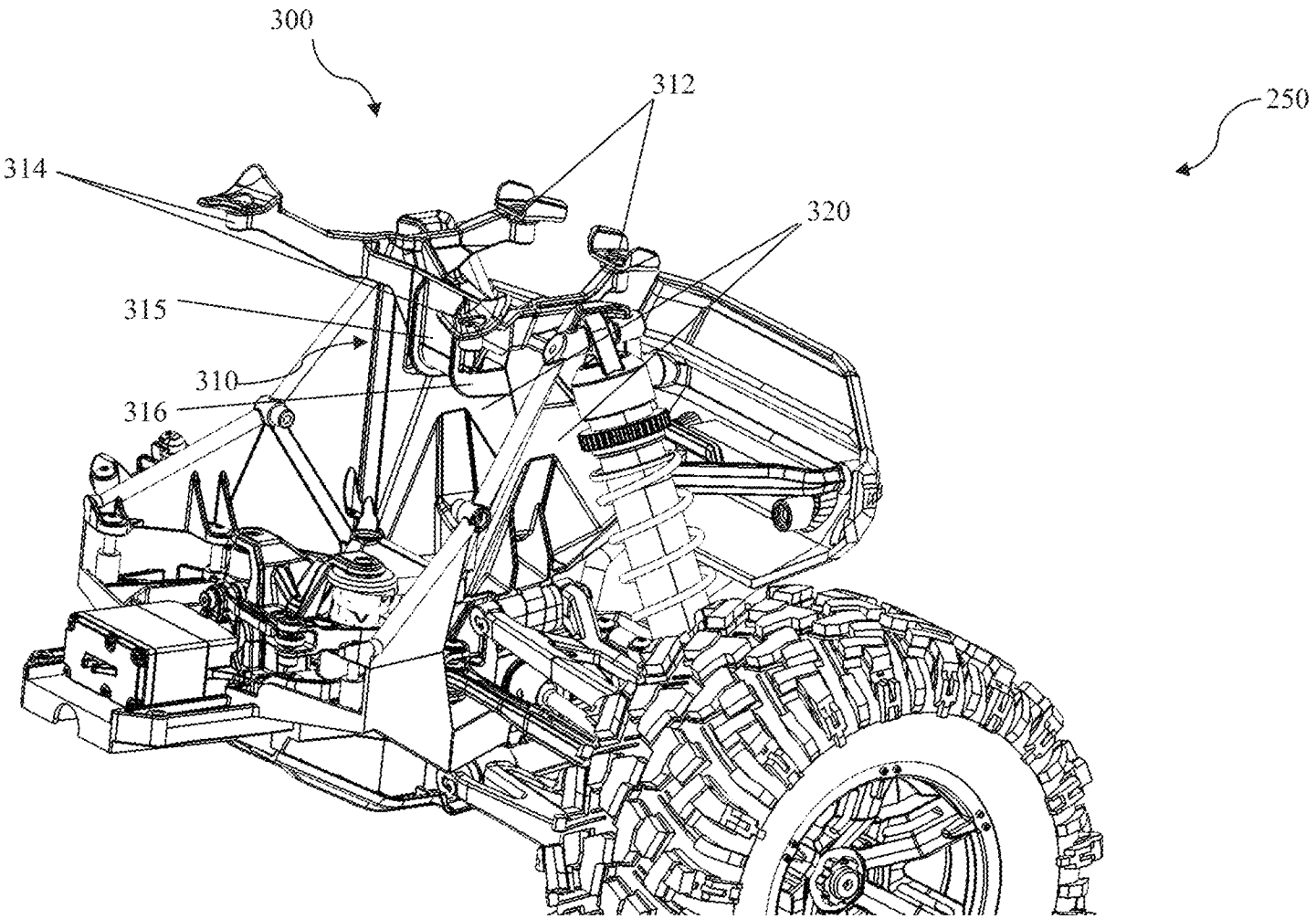
FIG. 3H is a perspective view of the tongue body mount engaged to the front cross beam.
Figure 31:
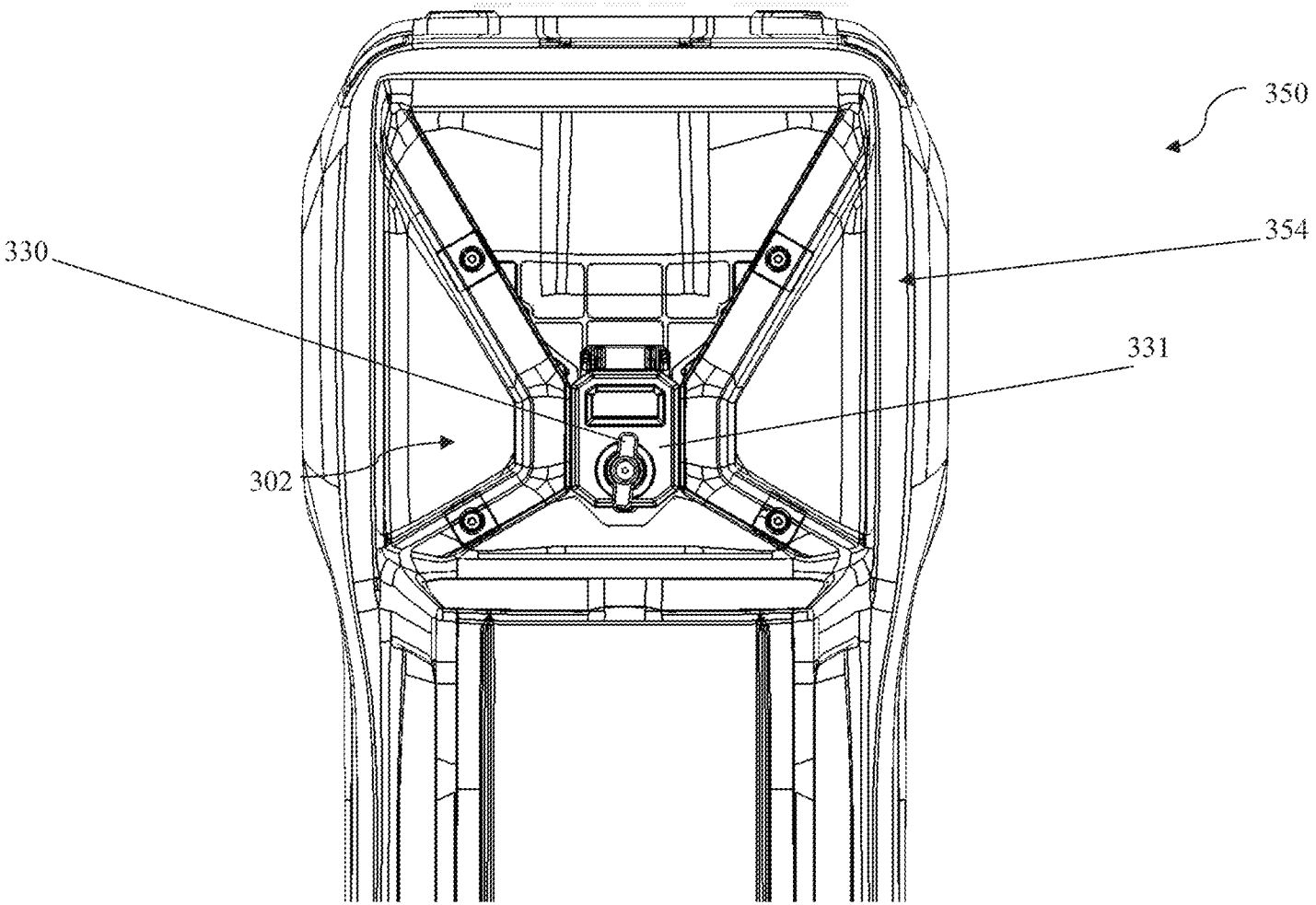

To mount the tongue body mount 300 to the front shock towers 320, the vehicle body 350 containing the tongue body mount 300 may be positioned rearward of the front shock towers 320 as shown in FIG. 3E. The tongue body mount 310 may then be moved towards the front shock towers 320 so that the angled tongue member 310 may engage the front cross beam 322. The second tongue member 316 may then slide beneath the front cross beam 322 as shown in FIG. 3F so that the front cross beam 322 may be interlocked between the second tongue member 316 and the front tongue mount support arms 312. FIGS. 3F, 3G and 3H, respectively, illustrate the tongue body mount 300 engaging the front cross beam 322 of the front shock towers 320, and the tongue body mount 300 (without the vehicle body 350 shown, to avoid obstructing the views) engaging the front cross beam 322.

When the front cross beam 322 slides along the top surface 313 on top of the second tongue member 316, the front cross beam 322 may also be sliding towards the vehicle body 350 by sliding up the downward sloping top surface of the second tongue member 316 towards the first tongue member 315. The downward sloping top surface 313 of the angled tongue member 310 may act like a cam to pull the vehicle body 350 down closer together to the front shock towers 320. The front cross beam 322 may slide up the top surface 313 of the second tongue member 316 until the front cross beam 322 contacts the first tongue member 315. At this point, as shown in FIG. 3F, the vehicle body 350 may be pulled down towards the front shock towers 320 so that the interior surface 352 may be directly in contact with or may be fully supported by the top surface 321 of the front shock towers 320. The height of the first tongue member 315 between the second tongue member 316 and the front tongue mount support arms 312 may also be substantially similar to the height of the front cross beam 322 so that the front cross beam 322 may be interlocked tightly within the angled tongue member 310 when the front cross beam 322 contacts the first tongue member 315. With the front cross beam 322 tightly fitted between within the angled tongue member 310 and the front shock towers 320 directly contacted with the vehicle body 350; the vehicle body 350 may be mounted securely by the tongue body mount 300 without rattling.

To disengage the vehicle body 350 and the tongue body mount 300 from the front cross beam 322, the vehicle body 350 containing the tongue body mount 300 may be moved rearward disengaging the angled member from the front cross beam 322, the front the shock towers 320 and the rest of the model vehicle 100 generally.

Alternatively, instead of having a first and second tongue member 315, 316, the angled tongue member 310 may instead comprise a single declined angled tongue member originating from either the front and rear tongue mount support arms 312, 314, or the interior surface 352 of the vehicle body 350 and extending at approximately a 45 degree angle from the vehicle body 350. Furthermore, the tongue body mount 300 may not be limited to merely a single angled tongue member 310. The tongue body mount 300 may comprise more than one angled tongue member 310 to secure the vehicle body 350 to the front shock towers 320. As previously mentioned, the tongue body mount 300 may also be used on different portions of the model 100 to secure the vehicle body 350. The vehicle body 350 may also comprise more than one tongue body mount 300 to mount the vehicle body 350.

Figure 3J:
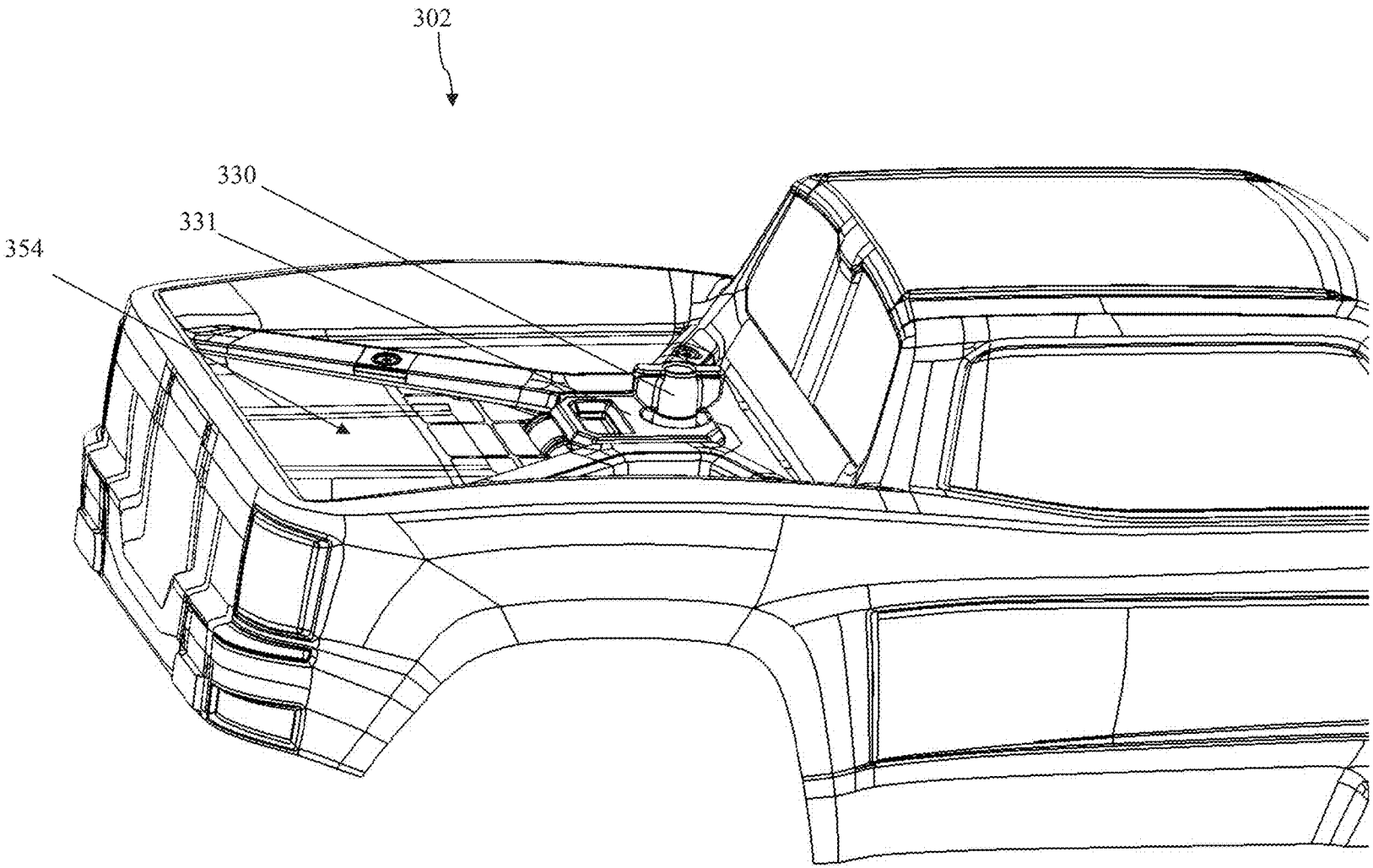
FIG. 3J is a perspective view of the lever body mount engaged and vehicle body.
Figure 3K:
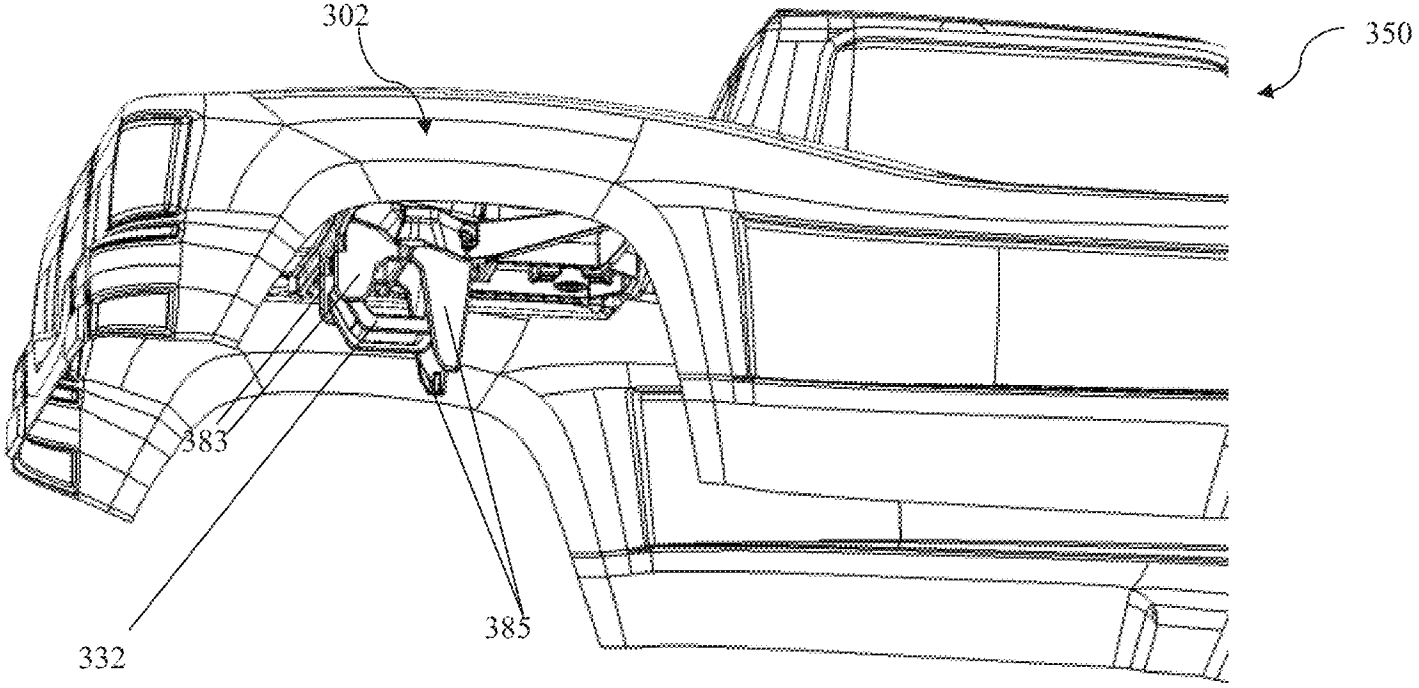
FIG. 3K is a perspective view under the interior of the vehicle body of the lever body mount engaged.

Turning to FIGS. 3I-3K, in an embodiment, the lever body mount 302 may be attached to the rear portion of vehicle body 350 for mounting the rear portion of the vehicle body 350. The lever body mount 302 may position a jaw clamp 332 in a locking position around the rear cross beam (326 in FIGS. 3R and 3W) to secure the vehicle body 350 to the rear shock towers (324 in FIGS. 3R and 3W). Alternatively, the lever body mount 302 may be used on any other portion of the vehicle body 350 or on multiple portions of the vehicle body 350 to mount the vehicle body 350.

Figure 3L:
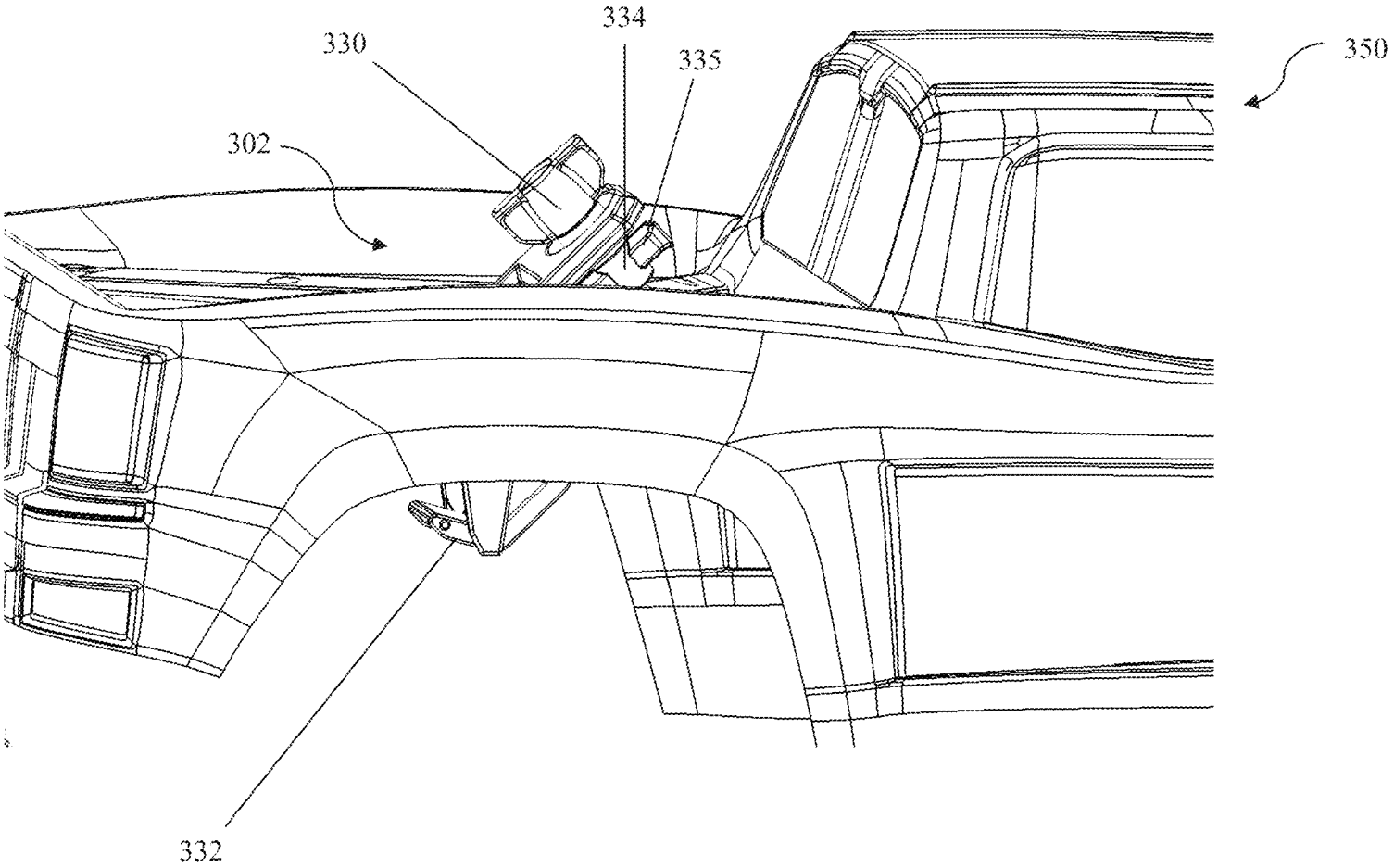
FIG. 3L is a perspective view of the lever body mount partially engaged.
Figure 3M:
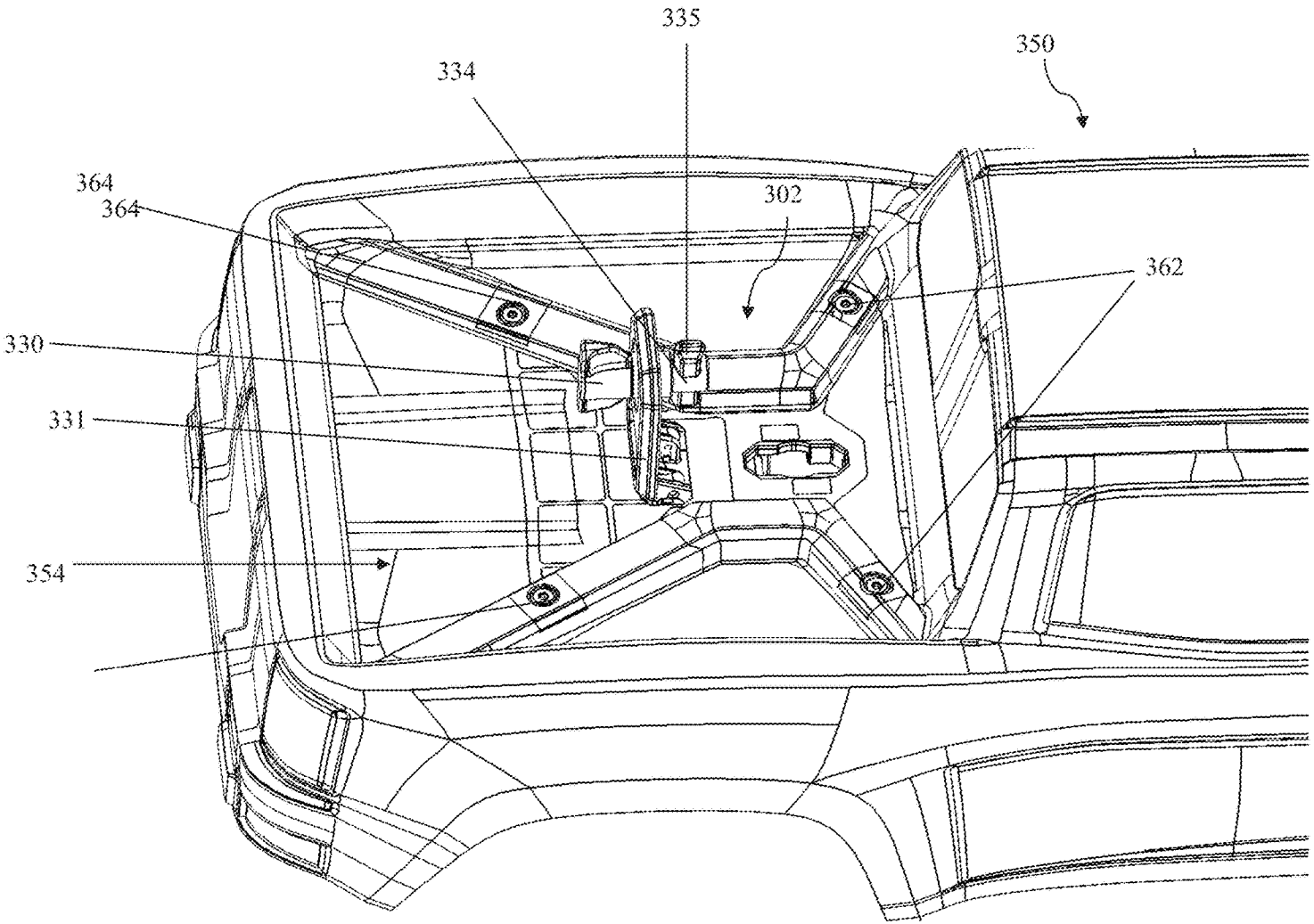
FIG. 3M is a perspective view of the lever body mount disengaged.
Figure 3N:
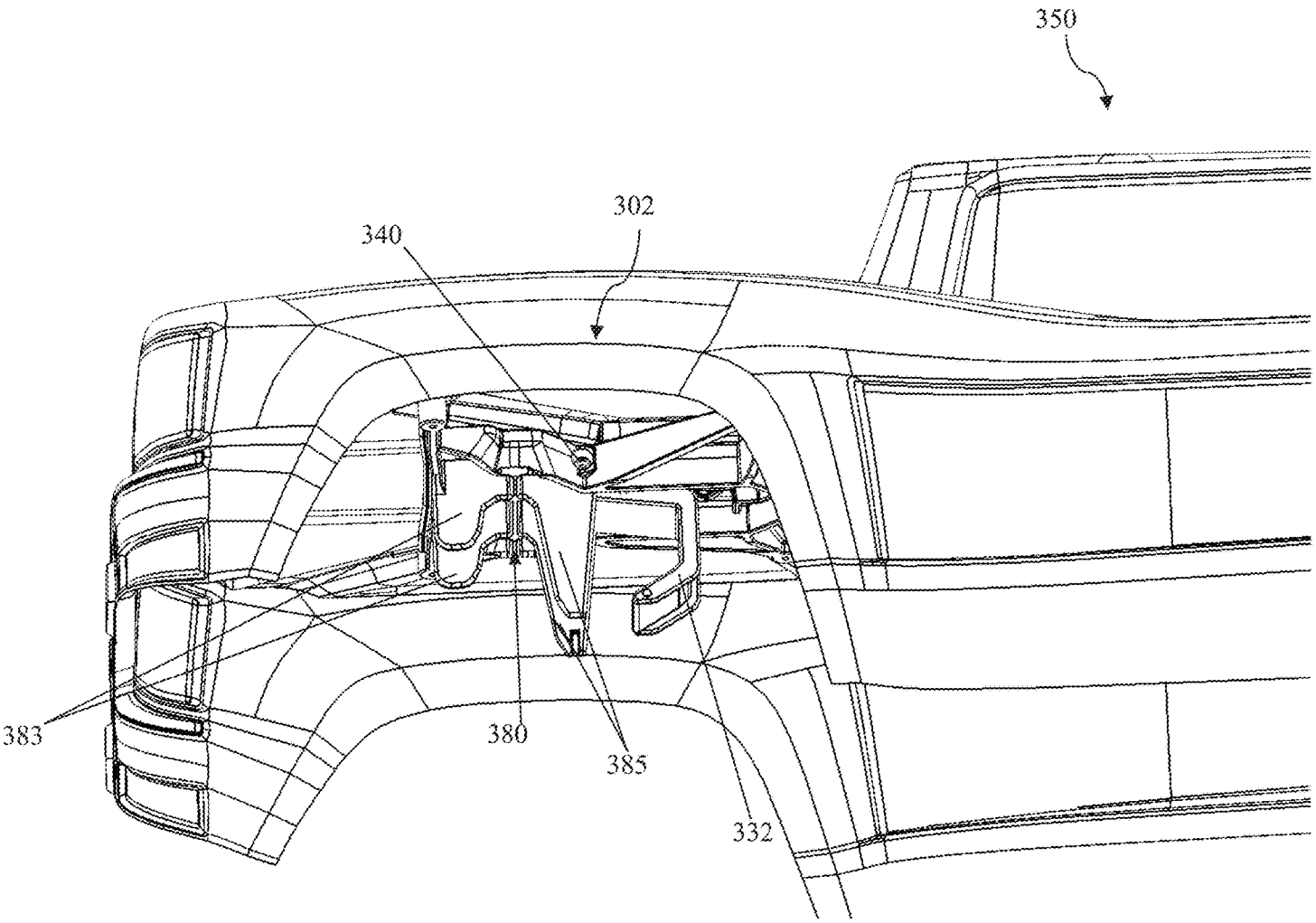
FIG. 3N is a perspective view under the interior of the vehicle body of the lever body mount unengaged.

In FIGS. 3M-3N, the lever body mount 302 may comprise a lever hatch 331 connected to a jaw clamp 332 at a hinge 340. The lever hatch 331 and the jaw clamp 332 may both extend from and rotate around the hinge 340. The jaw clamp 332 may be actuated by the lever hatch 331 being rotated about the hinge. The jaw clamp 332 may also rotate about the hinge 340 under the rotational force supplied by the lever hatch 331 being rotated around the hinge 340. The jaw clamp 332 and the lever hatch 331 may generally be on opposite sides of the hinge 340.

The lever hatch 331 may include a lever handle 330 that may be gripped to rotate the lever hatch 331 from a position substantially perpendicular with the top surface 354 of vehicle body 350 (as shown in FIG. 3M) to a position substantially flush with the top surface 354 (as shown in FIG. 3J). Rotation of the lever hatch 331 may move the jaw clamp 332 connected to the lever hatch 331 between an open or disengaged position and a closed or engaged position. Moving the lever hatch 331 into a position flush with the top surface 354 of vehicle body 350 may move the jaw clamp 332 to a closed or locked position as shown in FIG. 3K. Positioning the lever hatch 331 perpendicular with the top surface 354 may move the jaw clamp 332 to an open or disengaged position as shown in FIG. 3N.

Figure 3P:
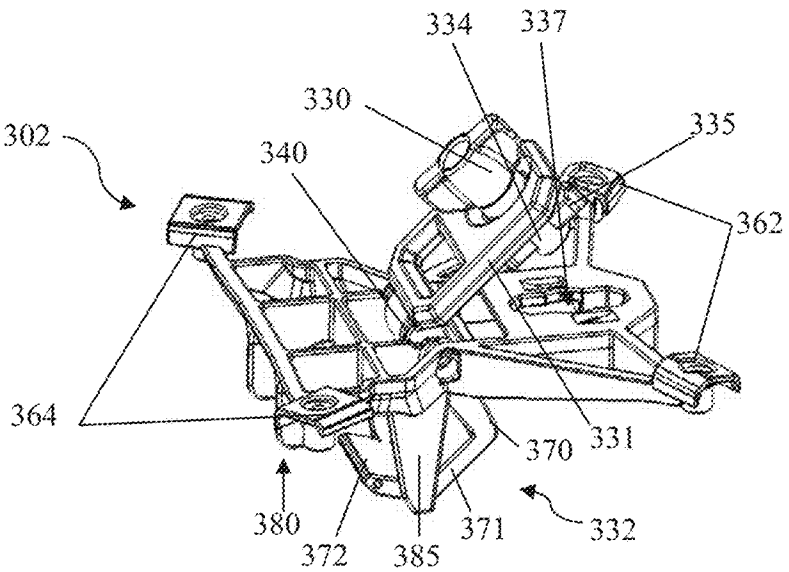
FIG. 3O-3Q is a perspective of the lever body mount only in multiple engaged positions.
Figure 3O:
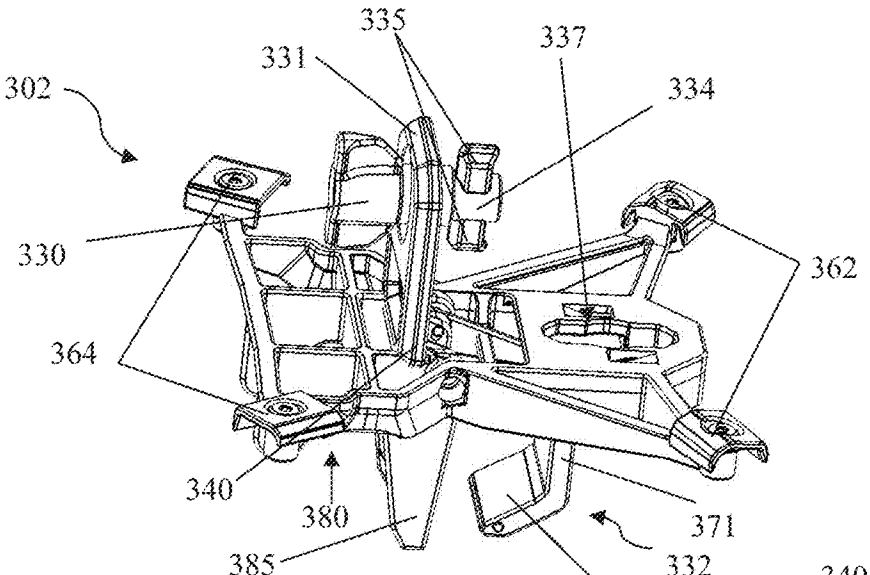
Figure 3Q:
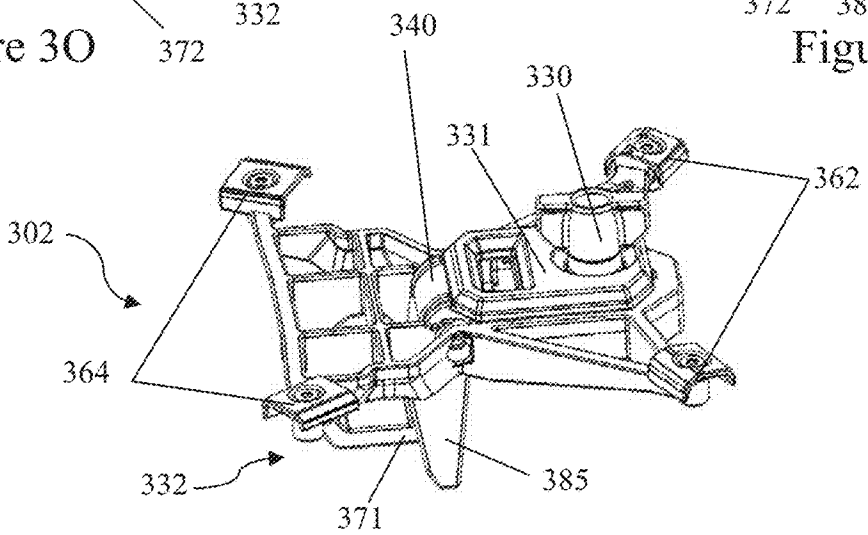
Figure 3R:
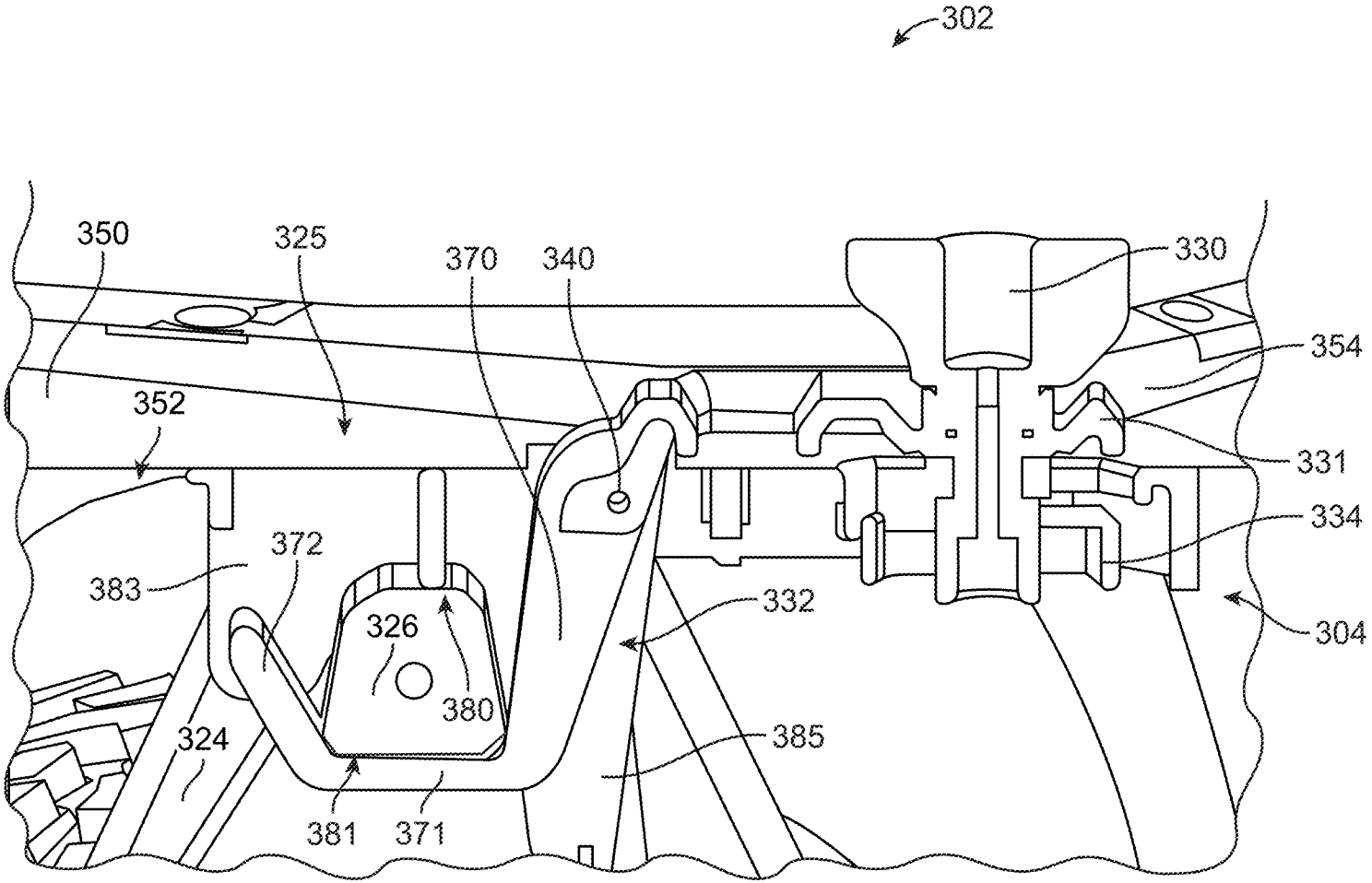
FIG. 3R is a longitudinal sectional view of the lever body mount with the jaw clamp fully engaged to the cross beam.

The jaw clamp 332 may be configured to enclose around a rear cross beam 326 when in the locked position as shown in FIG. 3R. The jaw clamp 332 may comprise three panels that form a three sided hook with a first panel 370 extending from the hinge 340, a second panel 371 extending from the first panel 370 away from the lever hatch 331, wherein the second panel 371 may form a substantially right angle with the first panel 370, and an upward sloping third panel 372 extending from the second panel 371, wherein the third panel 372 may be across, but inclined away from the first panel 370. The third panel 372 may generally be opposite of the first panel 370 such that the three panels 370, 371, 372 of jaw clamp 332 comprises a "C" shaped hook. The upward sloping third panel 372 may generally form an inclined plane starting from the second panel 371 such that the third panel 372 and the second panel 371 generally form an obtuse angle. When the jaw clamp 332 is engaged to the rear cross beam 326, the second panel 371 may be in direct contact with a bottom surface 381 of the rear cross beam 326 as shown in FIG. 3R. As such, the second panel 371 extending between the first panel 370 and the third panel 372 may be sized to be generally the same length as the width of the bottom surface 381 of the rear cross beam 326 so that when jaw clamp 332 is engaged, the rear cross beam 326 may be fitted tightly between the first panel 370 and the third panel 372 of the jaw clamp 332. This may allow the lever body mount 302 to more securely mount the vehicle body 350 to the rear shock towers 324, and prevent rattling of the vehicle body 360 when the model vehicle 350 is being operated.

In FIG. 3R, the lever body mount 302 may be mounted to the rear shock towers 324 by rotating the jaw clamp 332 around the rear cross beam 326. The lever hatch 331 and the jaw clamp 332 operate as opposite ends of a lever around the hinge 340. Moving the lever hatch 331 as shown in FIG. 3R to a position flush with the top surface 354 may correspondingly rotate the jaw clamp 332 to an engaged position around the rear cross beam 326. When the jaw clamp 332 closes around the rear cross beam 326, the second panel 371 of the jaw clamp 332 contacts the bottom surface 381 of the rear cross beam 326 to bring the lever body mount 302 and the vehicle body 350 closer with the rear shock towers 324. The top surface 325 of the rear shock towers 324 may then be brought in direct contact with a bottom surface 380 of the lever body mount 302 to secure the vehicle body 350 to the rear shock towers 324.

As shown in FIG. 3N, the lever body mount 302 may comprise a pair of first supporting members 385 and a pair of second supporting members 383. To mount the rear portion of the vehicle body 350 to the model vehicle 100, the bottom surface 380 of the lever body mount 302 may be brought in contact with the rear shock towers 324. As the lever body mount 302 is brought in contact with the rear cross beam 326, the first supporting members 385 of the lever body mount may push the vehicle body 350 and secure the rear cross beam 326 between the first and second supporting members 385, 383. The first supporting members 385 pushing the vehicle body 350 forward when mounting the rear portion of the vehicle body 350 may further secure the tongue body mount 300. The first tongue member 316 of the angled tongue member 310 may be further compressed against the front cross beam 322.

The lever body mount 302 may also operate as a cam to push the vehicle body 350 forward as the jaw clamp 332 engages around the rear cross beam 326 to mount the vehicle body 350. When the jaw clamp 332 is rotated to engage the rear cross beam 326, the upward sloping third panel 372 of the jaw clamp 332 may be the first portion of the jaw clamp 332 to contact the rear cross beam 326. To further move the jaw clamp 332 so that the second panel 371 may be brought in contact with the rear cross beam 326, the jaw clamp 332 may be further rotated to bring the third panel 372 up towards the vehicle body 350. This may position the third panel 372 at the rear of the rear cross beam 326. The complete rearward rotation of the jaw clamp 332 therefore may create a forward displacement of the lever body mount 302 that may push the overall mounted vehicle body 350 forward relative to the rear cross beam 326. This may result in a forward adjustment of the vehicle body 350 upon the engagement of the jaw clamp 332 to the rear cross beam 326. The forward adjustment of the vehicle body 350 may further secure the tongue body mount 300 engaged to the front shock towers 320 as shown in FIG. 3H. The forward adjustment may further push the first tongue member 315 of the angled tongue member 310 against the front cross beam 322 which may provide greater contact and engagement between the tongue body mount 300 and the front cross beam 322. If the front cross beam 322 is already in full contact against the first tongue member 315, the forward adjustment may further compress the tongue body mount 300 into the front cross beam 322. The additional compression may further secure the contact between the interior surface 354 of vehicle body 350 to the front shock towers 320 and rear shock towers 324.

FIGS. 3O-3Q illustrate the transition positions of the lever body mount 302 with the jaw clamp 332 being moved between the closed and open positions shown in FIGS. 3L-3N, with the vehicle body 350 removed to avoid obscuring the views.

Figure 3S:
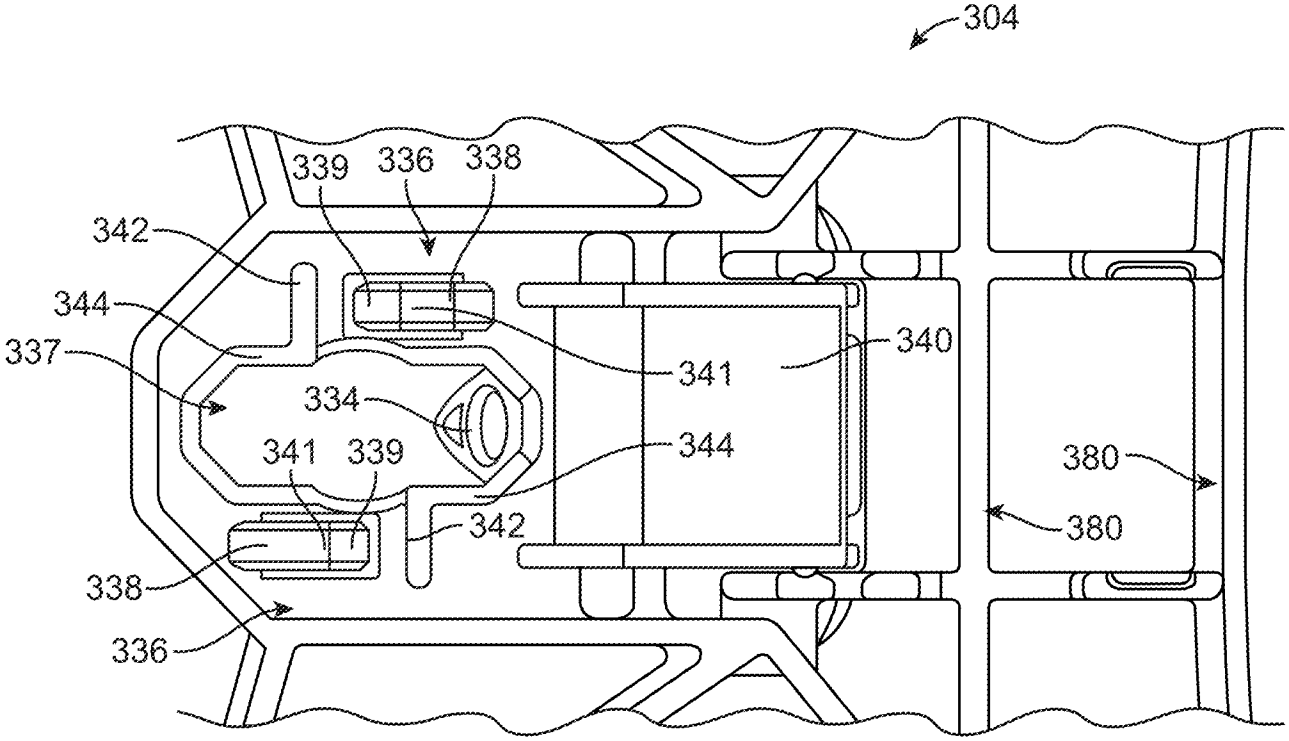
FIG. 3S is a bottom view of the retaining system of the lever body mount.

Turning to FIGS. 3R and 3S, in an embodiment, the lever body mount 302 may also include a retaining system 304 in the top surface 354 of the vehicle body 350 that the lever hatch 331 may engage to prevent the inadvertent release of the jaw clamp 332 from the rear cross beam 326. The retaining system 304 may be fitted into the vehicle body 350 such that the retaining system 304 is structurally within the same plane as the top surface 354. The retaining system 304 may be positioned adjacent to the hinge 340 such that the lever hatch 331 may engage the retaining system 304 when rotated around hinge 340 to a closed or flush position with top surface 354, as shown in FIG. 3J.

The retaining system 304 may comprise a slot 337 that a locking member 334 connected to the lever handle 330 may engage with when the lever hatch 331 is closed. The locking member 334 may be on the opposite end of the lever handle 330 on the opposite side of the lever hatch 331. The locking member 334 may comprise a pair of locking arms 335 as shown in FIG. 3O. Rotation of the lever handle 330 may correspondingly rotate the locking member 334 and locking arms 335. The slot 337 may be shaped such that the locking member 334 with locking arms 335 may only fit through the slot 337 when the locking arms are rotated to a first position. Rotation of the lever handle 330 which correspondingly rotates the locking member 334 and locking arms 335 out of the first position may prevent the locking member 334 and the locking arms 335 from fitting through the slot 337. FIG. 3S shows retaining system 304 with the locking member 334 and locking arms 335 aligned with the slot 337 in the first position just prior to being fitted through slot 337.

The retaining system 304 may also comprise a pair of leaf spring detents 336 that the locking arms 335 may engage with to maintain the lever hatch 331 in the locked position when engaged to the retaining system 304. Each leaf spring detent 336 may be located on opposite sides of the slot 337 and may have an inclined surface 338 and a declined surface 339 that extending toward a blocking panel 342 adjacent and perpendicular to the left spring detent 336, respectively, as shown in FIG. 3S. Adjacent and extending from each of the blocking panels 342 may be a supporting panel 344 each formed along a partial part of perimeter of the slot 337. Each of the supporting panels 344 may generally form a right angle with its corresponding blocking panel 342 and may extend away from the leaf spring detent 336. The pair of blocking panels 342 with the connected supporting panels 344 may be formed to at least a height that the locking arms 335 may not pass over when inserted through the slot 337. The declined surfaces 339 of each of the leaf spring detents 336 may be downwardly sloping toward its adjacent and perpendicular blocking panel 342. Each of the leaf spring detents 336 may be configured to begin the declined surface a distance away from its corresponding blocking panel 342 greater than the width of the locking arm 335 passing over the leaf spring detent 336.

Figure 3U:
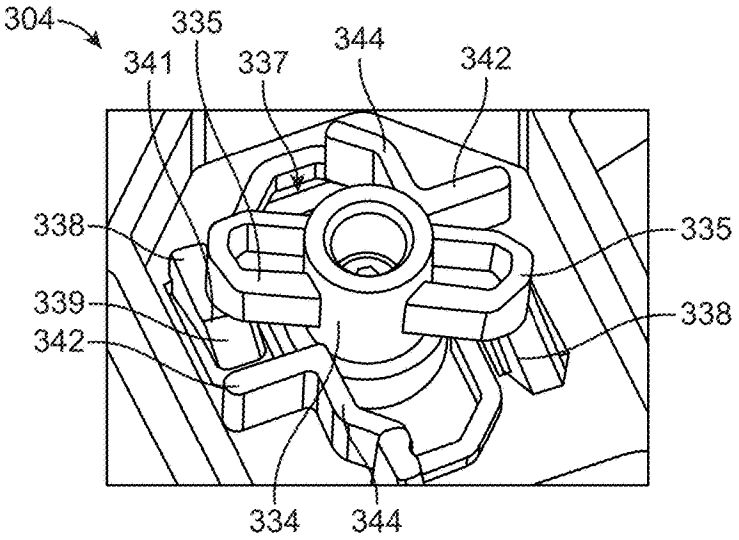
FIG. 3T-3V shows the retaining system securing the lever body mount in the engaged position.
Figure 3T:
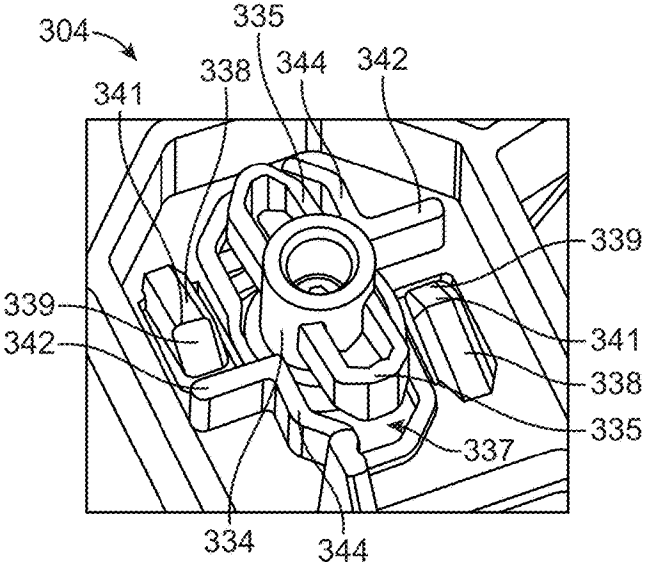
Figure 3V:
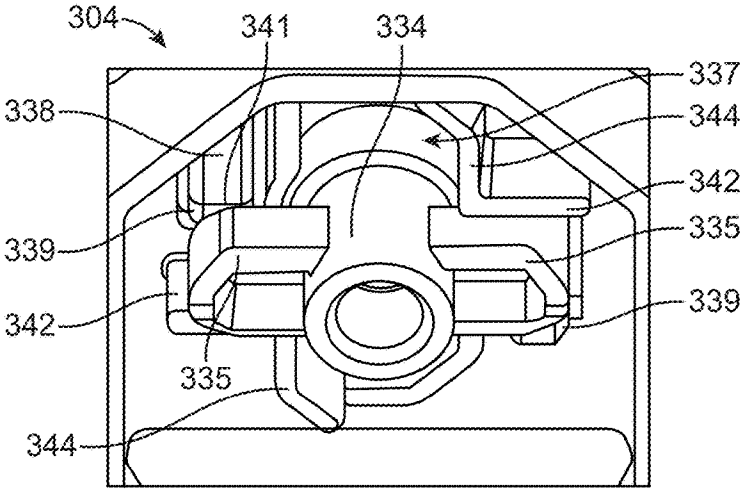

Turning to FIGS. 3T-3V, after the locking member 334 is fitted through slot 337 to engage the lever hatch 331 to the retaining system 304, the locking member 334 and the locking arms 335 may be rotated to a second position to secure the lever hatch 331 to the retaining system 304. When the locking arms 335 are rotated to the first position, the locking arms 334 are aligned with the slot 337 as shown in FIG. 3T. In this position, the locking member 334 and the locking arms 335 may be freely fitted through slot 337. In this position, the lever hatch 331 may freely engage or disengage from the retaining system 304. Rotation of the lever handle 330 and correspondingly, the locking member 334 out of the first position shown in FIG. 3T repositions and therefore prevents the locking member 334 from fitting through the slot 337. FIGS. 3U and 3V show examples of the locking member 334 with the locking arms 335 rotated out of the first position in FIG. 3T. When rotated to the second position as shown in FIG. 3V, the locking arms 335 may run substantially perpendicular to the slot 337 and extend outwardly beyond the width of the slot 337. FIG. 3U shows the locking member 334 partially rotated between the first position in FIG. 3T where the locking member 334 is unsecured, and the second position in FIG. 3V where the locking member 334 is secured. When the lever hatch 331 is secured as in FIG. 3V, the locking arms 335 may extend beyond the width of the slot 337 which prevents the locking member 334 from being withdrawn back through the slot 337. This prevents the lever hatch 331 from being moved and may therefore secure the jaw clamp 332 in the engaged position around the rear cross beam 326, as shown in FIG. 3R.

When rotating the locking arms 335 between the first position as shown in FIG. 3T and the second position as shown in 3V, the blocking panels 342 and the supporting panels 344 may prevent over rotation of the locking member 335. The blocking panels 342 adjacent to each of the leaf spring detents 336 may prevent the over rotation of the locking members 335 when transitioning from the first position in FIG. 3T to the second position in FIG. 3V. When the locking arms 335 are rotated toward the second position, the locking arms 335 may contact the blocking panels 342 once the second position is reached. Without the blocking panels 342, an over rotation of the locking arms 335 beyond the position in FIG. 3V may bring the locking arms 335 back to the first position shown in FIG. 3T which may not be desired when attempting to secure the lever hatch 331 to the retaining system 304.

The supporting panels 344 connected to each of the blocking panels 342 may prevent over rotation when rotating the locking member 334 from the second position in FIG. 3V to the first position in FIG. 3T. The locking member 334 may be rotated from the second secured position towards the first position until the locking arms 335 contact the corresponding supporting panels 344. The supporting panels 344 prevent over rotation of the locking member 334 when the first position is reached. After the rotation of the locking member 334 to the first position in FIG. 3T, the locking member 334 and the locking arms 335 may then be fitted through the slot 337 which may enable the lever hatch 331 to freely disengage from the retaining system 304.

Figure 3W:
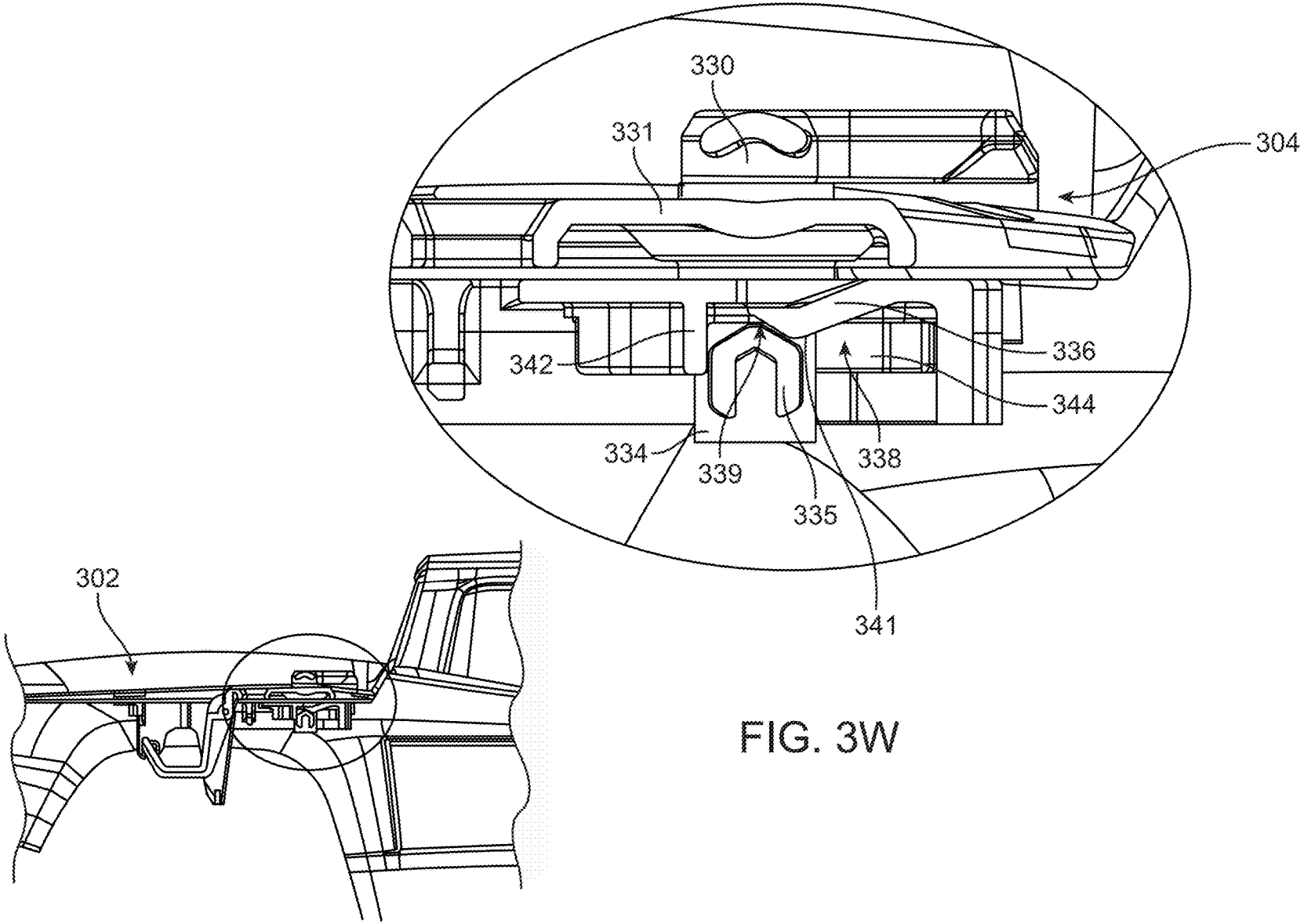
FIG. 3W is a close up longitudinal sectional view of the retaining system when the lever body mount is engaged and secured.

The leaf spring detents 336 may be engaged and depressed by the locking arms 335 as the locking member 334 is rotated toward the secured position in FIG. 3V. As shown in FIG. 3W, the leaf spring detents 336 may help keep the locking member 334 in the secured position once the locking member 334 is rotated and secured in the second position. The leaf spring detents 336 may comprise a detent peak 341 where the inclined surface 338 and the declined surface 339 meet that may exert a compressive force against the associated locking arm 335 after the locking arm 335 has passed over the leaf spring detent 336. The leaf spring detents 336 may be constructed to exhibit a spring like feature to exert a compressive force against the locking arms 335, or alternatively configured with additional external springs in another embodiment. When rotated to the second position, the locking arms 335 may then be retained between the detent peak 341 of the leaf spring detents 336 and the blocking panel 342, as shown in FIG. 3W. The compressive force exerted by the leaf spring detents 336 against the locking arms 335 secures the locking member 334 in the retainer system 304 such that it may require an additional force to rotate the locking member 334 out of engagement with the leaf spring detents 336 and back towards the first position in FIG. 3T. This may prevent the inadvertent release of the lever hatch 331 from the retainer system 304, and the corresponding inadvertent disengagement of the jaw clamp 332 from the rear cross beam 326. When the locking member 334 is back in the first position, the lever hatch 331 may then be disengaged from the retaining system 304 which would correspondingly disengage the connected jaw clamp 332 from the rear cross beam 326. The vehicle body 350 and the lever body mount 302 may then be removed from the rear shock towers 324 of the model vehicle 100.

Figure 3X:
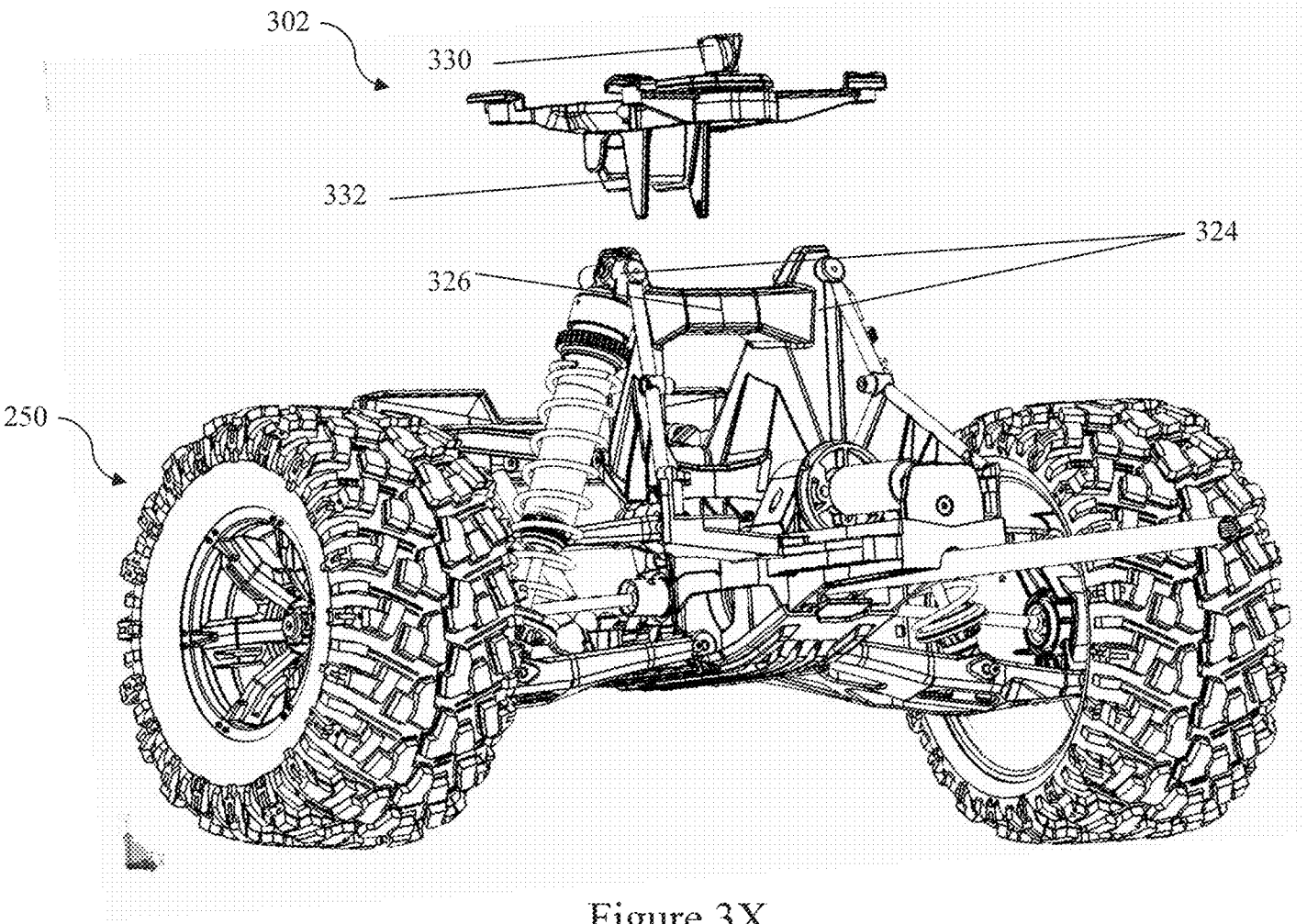
FIG. 3X is a perspective sectional view of the lever body mount only in an engaged position above the rear shock towers.
Figure 3Y:
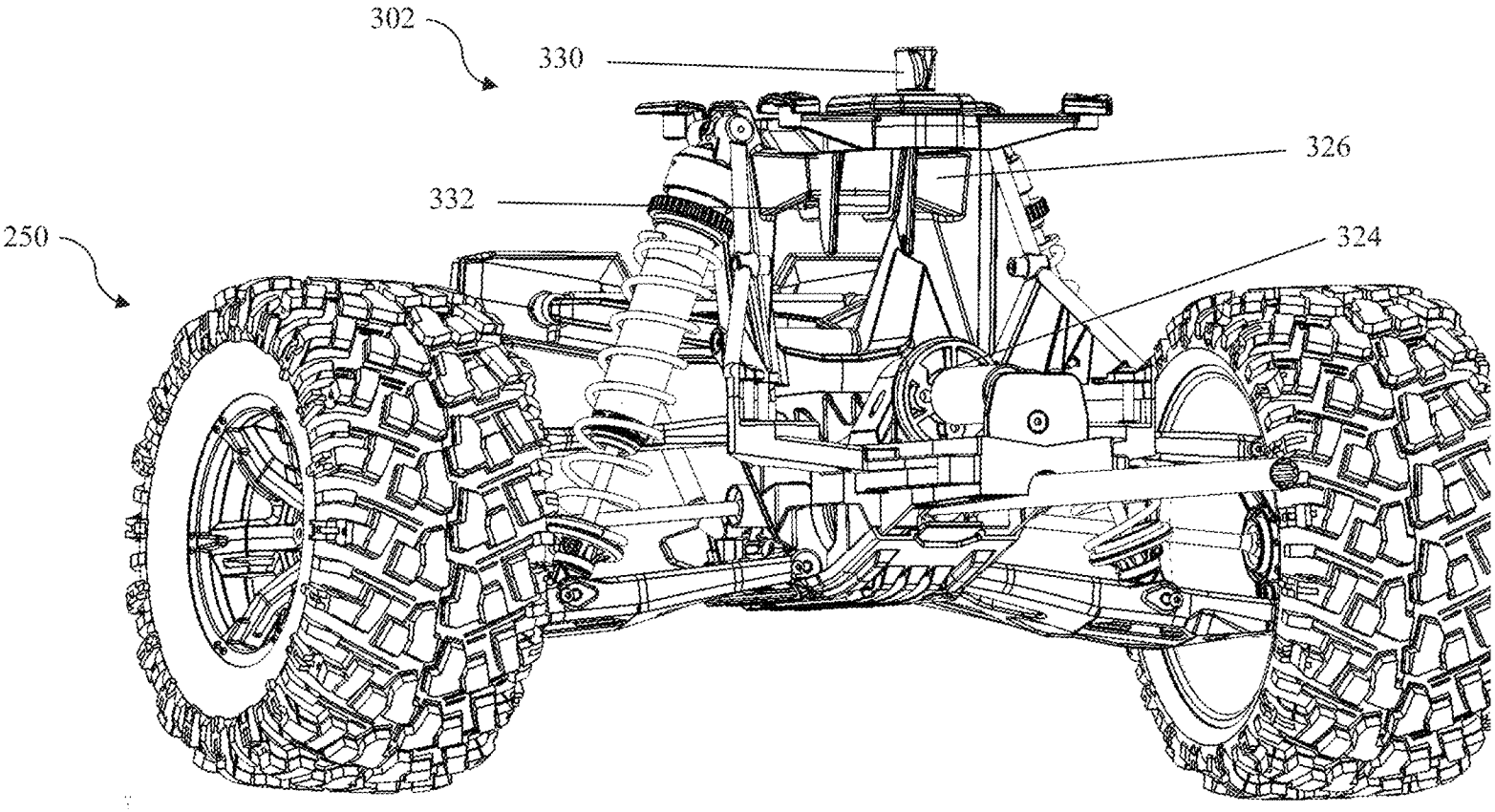
FIG. 3Y is a perspective view of the lever body mount only in an engaged position engaging the cross beam of the rear shock towers.

FIGS. 3X and 3Y, respectively, show the lever body mount 302 and the rear shock towers 324 in a disengaged and engaged positions without the vehicle body 350 to avoid obscuring the views. In FIG. 3Y, the lever body mount 302 is engaged such that jaw clamp 332 may be enclosed around the rear cross beam 326 when the lever hatch 331 is engaged with the retaining system 304.

Snap-In Modular Construction Provisions

Figure 4A:
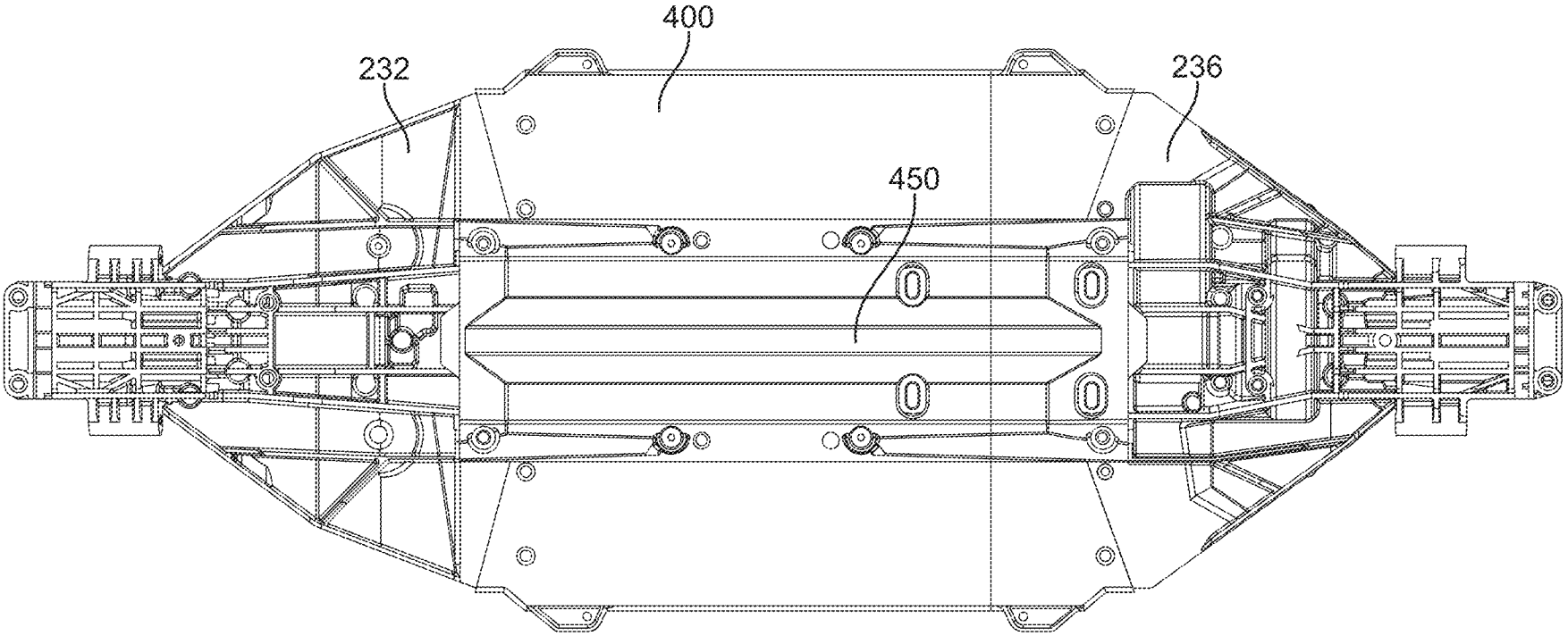
FIG. 4A is a bottom view of the front and rear chassis bulkheads engaged to the chassis with the bottom skid-plate attached.
Figure 4B:
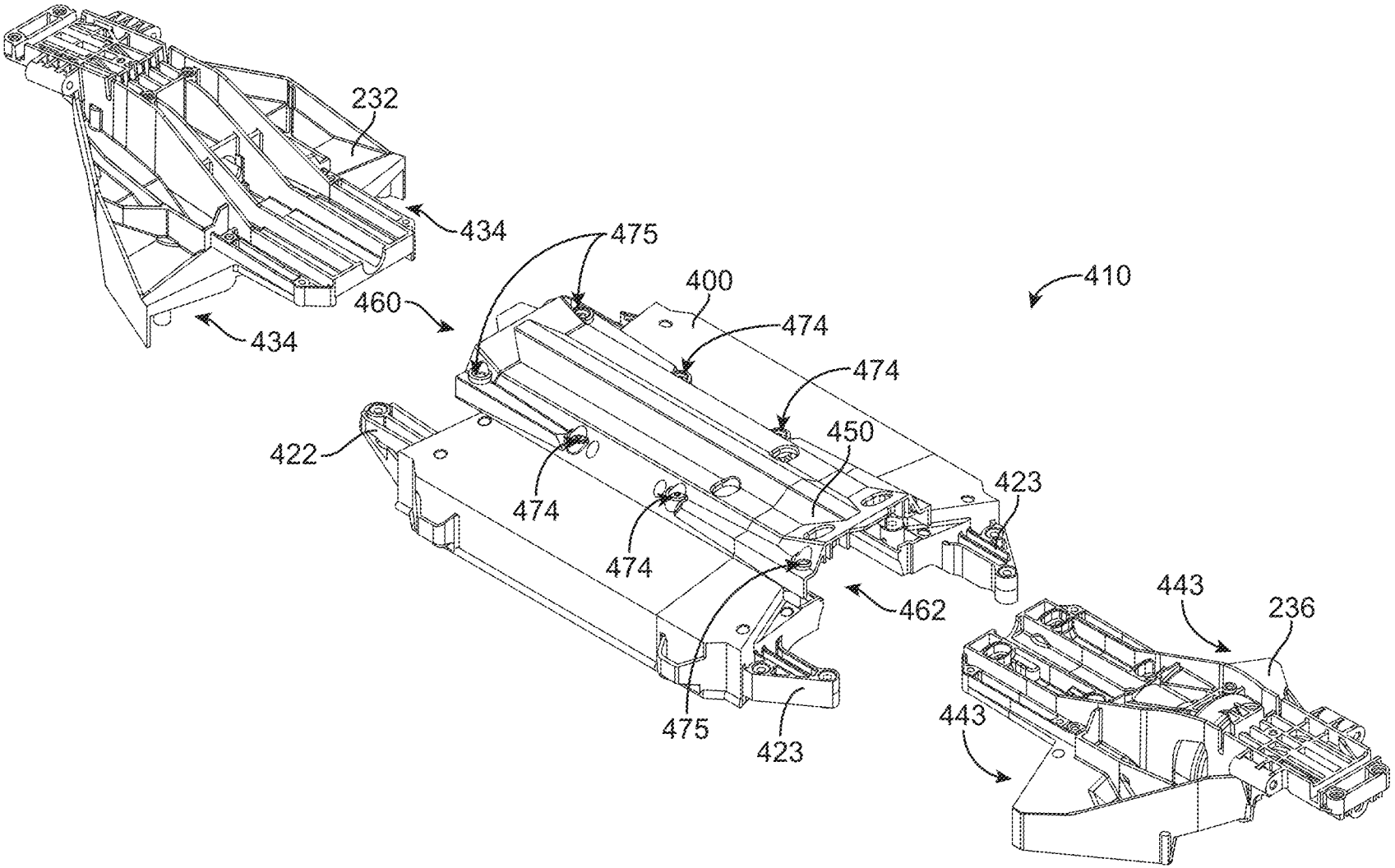
FIG. 4B is a perspective view of the bottom of the front and rear chassis bulkheads disengaged from the chassis and the bottom skid-plate.
Figure 4C:
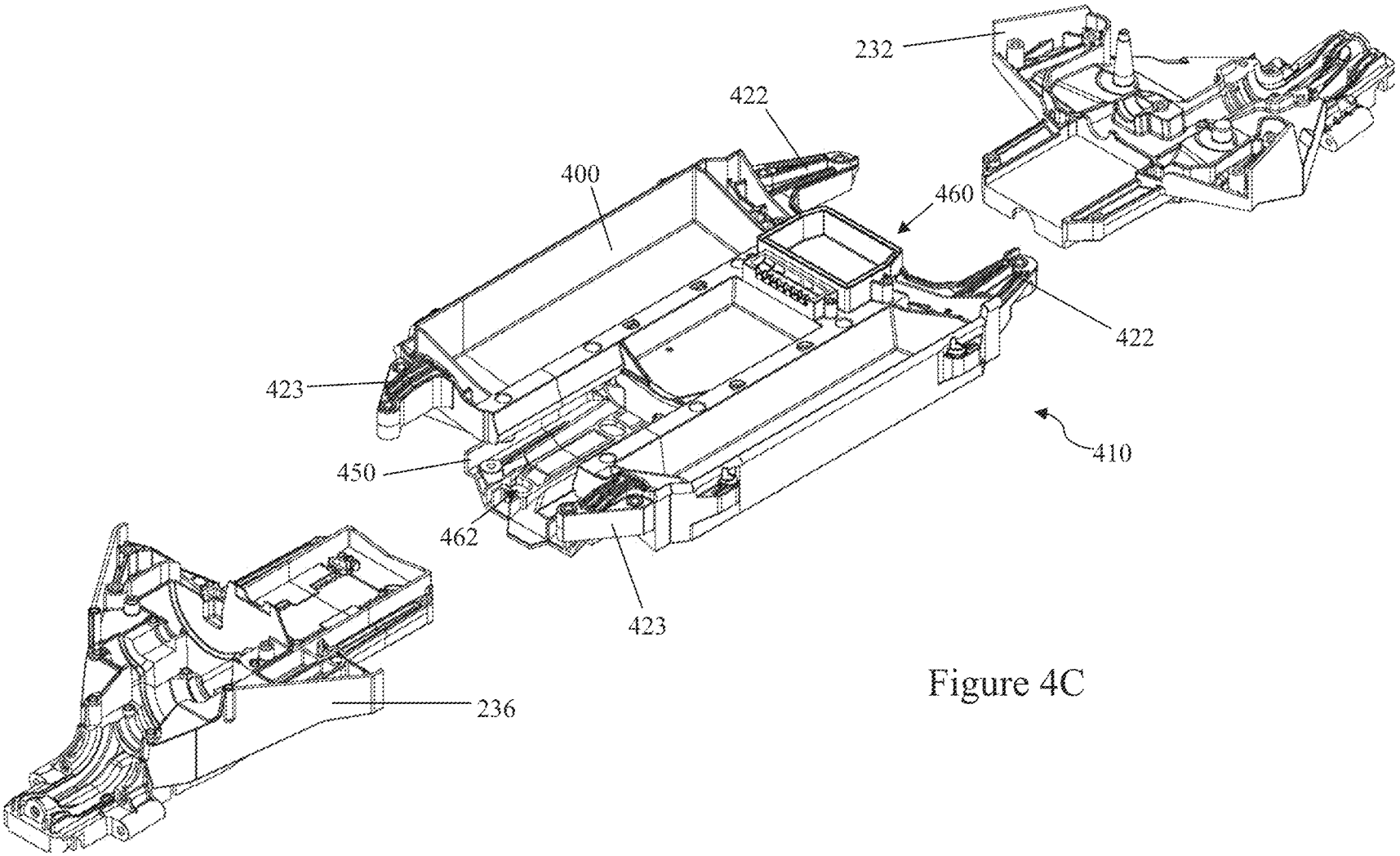
FIG. 4C is a perspective view of the top of the front and rear chassis bulkheads disengaged from the chassis and the bottom skid-plate.

In FIG. 4A, a lower front chassis bulkhead 232 and a lower rear chassis bulkhead 236 is shown engaged to the chassis 400 and the bottom skid-plate 450 of a model vehicle. In an embodiment, the bottom skid-plate 450 may be attached to the chassis 400 to form a chassis assembly 410. When assembling the model vehicle during production or servicing, in order to connect the front and rear chassis bulkheads 232, 236 to the chassis 400, the chassis bulkheads 232, 236 may be engaged to the chassis assembly 410. FIGS. 4B and 4C show the chassis bulkheads 232, 236 positioned at each of the respective ends of the chassis assembly 410 in preparation for engagement. The front bulkhead 232 may be inserted into the chassis assembly 410 to engage the front bulkhead 232 with a front surface 404 on the chassis 400. The rear bulkhead 236 may be inserted into the chassis assembly 410 to engage the rear bulkhead 236 with a rear surface 406 on the chassis 400.

The front chassis bulkhead 232 and the rear chassis bulkhead 236 may each "snap" into the chassis assembly 410 using an extension member and detent system. Each of the chassis bulkheads 232, 236 may comprise a pair of rounded members 430 that may each correspondingly snap into a pair of rounded detents 420 in the chassis 400. During assembly of the model vehicle, the chassis bulkheads 232, 236 may be inserted into the chassis assembly 410 until each of the chassis bulkheads 232, 236 "snap" into the chassis assembly 410. The "snap in" feature may securely connect the chassis assembly 410 to the chassis bulkheads 232, 236 to ease the assembly or servicing process. The "snap in" feature may temporarily stabilize the chassis assembly 410 and the connected chassis bulkheads 232, 236 during assembly to allow screws or other mechanical fixtures to further secure the chassis assembly 410 and the chassis bulkheads 232, 236 together. The "snap in" feature may also stabilize the chassis assembly 410 and the chassis bulkheads 232, 236 to allow other parts of the model vehicle to be mounted and connected to further assemble the model vehicle. The "snap in" feature may provide such a secure connection between the chassis assembly 410 and the chassis bulkheads 232, 236 that the model vehicle may be operated without the use of any additional mechanical fixtures, screws, or supports.

Figure 4D:
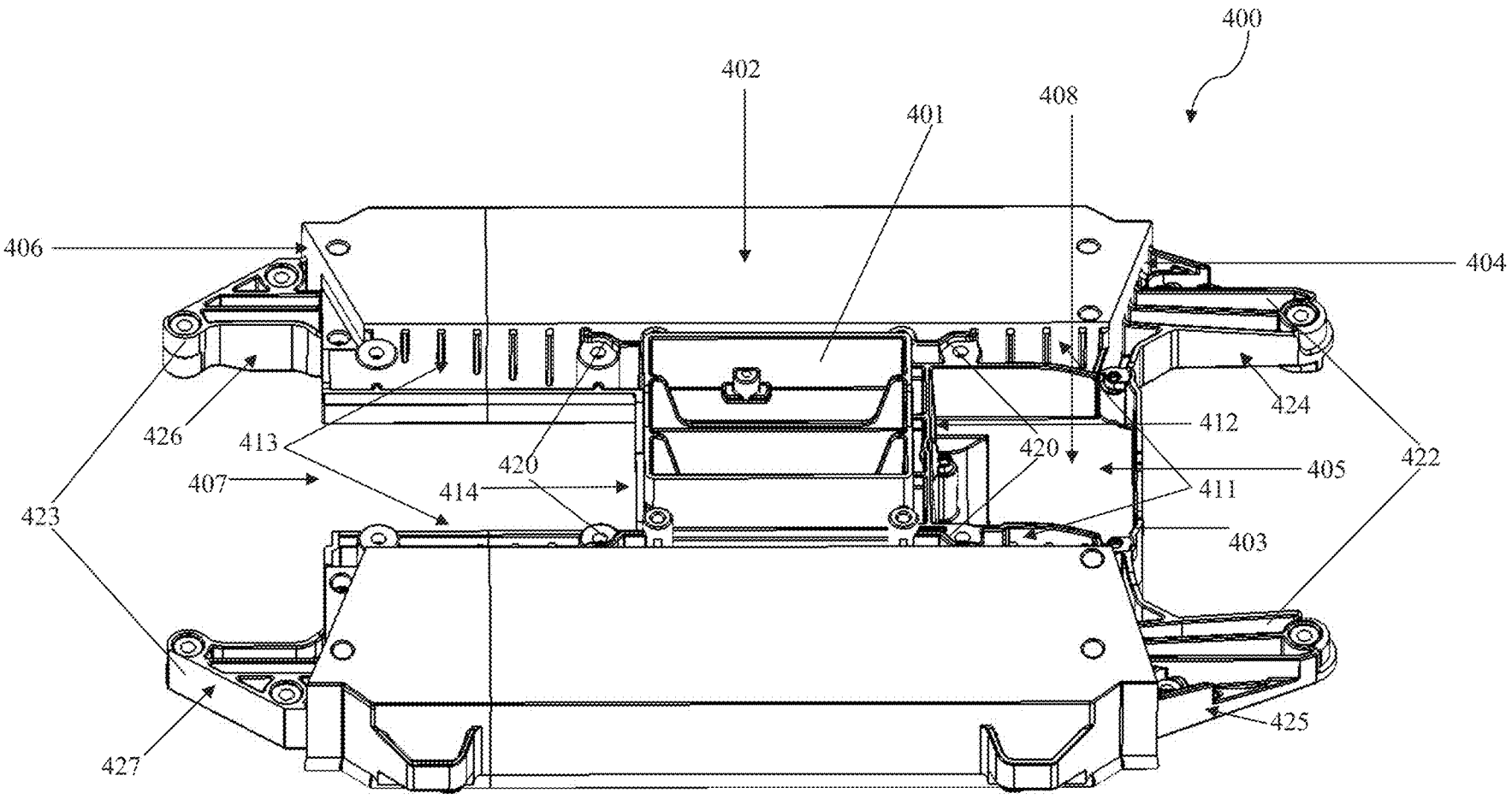
FIGS. 4D and 4E are perspective and bottom views of the chassis.
Figure 4E:
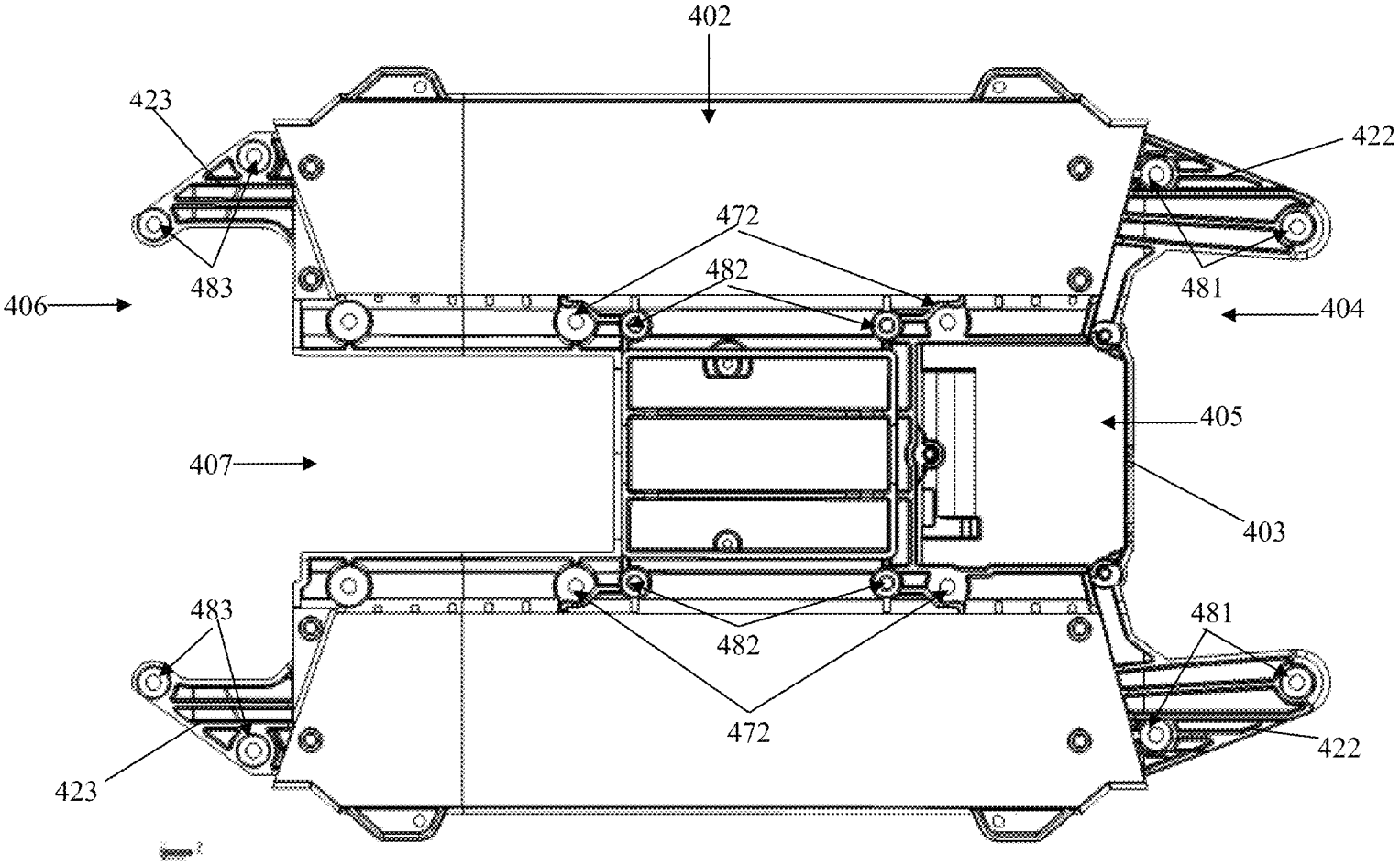

Turning to FIGS. 4D and 4E, in an embodiment, the chassis 400 may comprise a bottom surface 402, a front surface 404 where the lower front chassis bulkhead 232 connects to, and a rear surface 406 where the lower rear chassis bulkhead 236 connects to. The chassis 400 may comprise a middle body 401 flanked by a quadrilateral cutout 405 adjacent to the front surface 404, and a quadrilateral opening 407 adjacent to the rear surface 406.

At the front surface 404, the quadrilateral cutout 405 may extend from the bottom surface 402 to a top surface 408 in the chassis 400, and laterally from the front surface 404 into the body of the chassis 400 except for a connecting surface 403. The connecting surface 403 may border the cutout 405 along the perimeter of the front surface 404 with a height comprising only a portion of the chassis 400 such that that a portion of the cutout 405 in the bottom surface 402 may extend from the middle body 401 through the front surface 404. The connecting surface 403 may extend from the top surface 408 of the chassis 400 to about half way down the height of the chassis 400. The quadrilateral opening 407 at the rear surface 406 may extend from the bottom surface 402 through the chassis 400; and from the rear surface 406 through to the middle body 401 of the chassis 400. The quadrilateral opening 407 may essentially be a rectangular prism cut out of the body of the chassis 400.

A pair of rounded detents 420 may be formed in the quadrilateral cutout 405 and quadrilateral opening 407 to engage the chassis bulkheads 232, 236. At the cutout 405, the chassis 400 may comprise a pair of interior surfaces 411 adjacent to a first middle surface 412 bordering the opening 405. The interior surfaces 411 may comprise rib extrusions extending from the bottom surface 402 of the chassis 400 towards the top surface 408. The rib extrusions may be intermittently spaced across both interior surfaces 411 inside the quadrilateral cutout 405. At the corners of the cutout 405 where each of the interior surfaces 411 intersect the first middle surface 412; a rounded detent 420 may be formed into each of the interior surfaces 411. At the opening 407, the chassis 400 may comprise a pair of interior surfaces 413 adjacent to a second middle surface 414 bordering the opening 407. The interior surfaces 413 may comprise rib extrusions extending from the bottom surface 402 of the chassis 400 towards the top surface 408. The rib extrusions may be intermittently spaced across both interior surfaces 413 inside the quadrilateral opening 407. At the corners of the opening 407 where each of the interior surfaces 413 intersect the second middle surface 414; a rounded detent 420 may also be formed into each of the interior surfaces 413.

Each of the rounded detents 420 may comprise an initial flat plane extending from the middle surfaces 412, 414, respectively, followed by a rounded curve extending towards each of the interior surfaces 412, 414, respectively. There may be a gap between the interior surfaces 412, 414 and the rounded portion of the detents 420 which may provide the detents 420 with a spring like feature to allow the detents to be temporarily widened for a corresponding rounded members (430 in FIGS. 4D and 4E) to "snap" into, or engage with. Each of the rounded portions of the detents 420 may be formed on a cylindrical base that extends towards the top surface of the chassis 400. Each of the cylindrical bases with a detent 420 may also comprise a bore 472 that a screw may be threaded through to further secure the chassis bulkheads 234, 236 to the chassis 400, after each of the rounded members 430-engage with their respective rounded detents 420.

As shown in FIG. 4E, the chassis 400 may comprise a pair of front chassis members 422 extending out of the front surface 404 of the chassis 400. Each of the front chassis members 422 may extend from opposite ends of the front surface 404 away from the middle body 401. Each of the front chassis members 422 extending from the front surface 404 may comprise an angled extrusion with a curved surface 424 extending from an end of the connecting surface 403 and intersecting an angled surface 425 extending from an outer surface) of the chassis 400. The two surfaces 424, 425 may intersect to form a rounded tip for each of the front chassis members 422 that may engage the front chassis bulkhead 232. Each of the rounded tips at the ends of the front chassis members 422 may comprise a bore 481. Each of the front chassis members 422 may also comprise a second bore 481 near the outer edge of each member 422 to aid in securing the chassis 400 to the front bulkhead 232, as shown in FIGS. 4E and 4N. The front chassis members 422 may be formed to be slightly angled towards each other. The front chassis members 422 may comprise a height substantially similar to the connecting surface 403 and may only extend from a mid-portion of the chassis 400 to the top surface of the chassis 400. The height of each of the front chassis members 422 may match with the height of the connecting surfaces 403.

The chassis 400 may comprise a pair of rear chassis members 423 extending from the rear surface 406. Each of the rear chassis members 423 may extend from opposite ends of the rear surface 406 away from the middle body 401. Each of the rear chassis members 423 extending from the rear surface 406 may comprise an angled extrusion with a curved surface 426 extending from the rear surface 406, and intersecting an angled surface 427 extending from an outer surface of the chassis 400. The two surfaces 426, 427 may intersect to form a rounded tip for each of the rear chassis members 423 that may engage the rear chassis bulkhead 236. Each of the rounded tips at the ends of the rear chassis members 423 may comprise a bore 483. Each of the rear chassis members 423 may also comprise a second bore 483 near the outer edge of each member 423 to aid in securing the chassis 400 to the rear bulkhead 236, as shown in FIGS. 4E and 4N. The rear chassis members 423 may be formed to be angled towards each other such that a diagonal cut may be made at each of the outer corners leaving each of the rear chassis members 423 extending from the rear surface 406 shaped like a triangular prism. The rear chassis members 423 may only begin forming from a mid-portion of the chassis 400 and extending towards the top surface of the chassis 400. The bottom surface of the rear chassis members 423 may not be flush with the bottom surface 402 of the chassis 400.

Figure 4F:
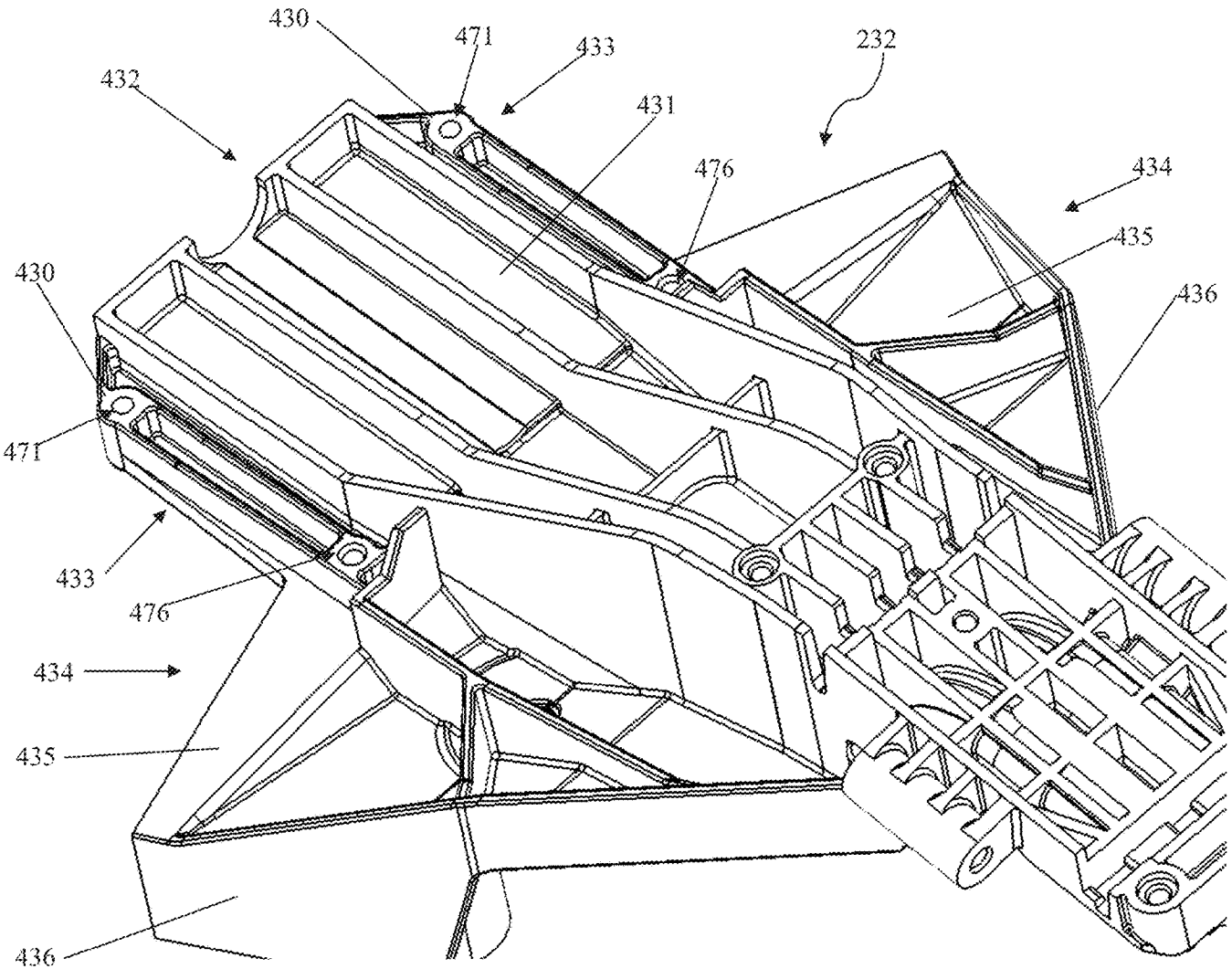
FIGS. 4F and 4G are perspective views of the front and rear chassis bulkheads, respectively.

Turning now to FIG. 4F, the lower front chassis bulkhead 232 may be connected to the chassis 400 and the chassis assembly 410 by being inserted into the quadrilateral cutout 405 in the front surface 404 of the chassis 400. The lower front chassis bulkhead 232 may comprise a quadrilateral extension 431 with a front end contact surface 432 adjacent to a pair of front side contact surfaces 433 on each side. Each of the front side contact surfaces 433 may comprise a rounded member 430 formed right before where each of the front side contact surfaces 433 intersect the front end contact surface 432. Each of the rounded members 430 may comprise a protruding rounded surface formed by extending out of the respective front side contact surface 433 and curving back to form a rounded curve feature, before extending diagonally straight to intersect the front end contact surface 432. The extension from each of the rounded members 430 to its respective end of the front end contact surface 432 may form a diagonal cut across each of the corners where the front side contact surface 433 and the front end contact surface 432 would have formed. This may create a trapezoidal surface along the front end contact surface 432 of the lower front chassis bulkhead 232. Each of the rounded members 430 may also comprise a bore 471 that a screw may be threaded through to further secure the lower front chassis bulkheads 232 to the chassis 400 after each of the rounded members 430 engage with their respective rounded detents 420. The bores in rounded members 430 may be aligned with the bores 472 in the cylindrical base the rounded detents 420 extend from.

The lower front chassis bulkhead 232 may also comprise a pair of front chassis wings 434 extending from both sides of the lower front chassis bulkhead 232 adjacent to the quadrilateral extension 431. Each of the front chassis wings 434 may comprise a front wing base 435 extending laterally from a mid-section of the lower front chassis bulkhead 232. Each of the front wing bases 435 may be partially bordered by a front wing edge 436 extending along a portion of the front wing base 435. The front wing base 435 may be shaped like a triangle with an edge along the side of the lower front chassis bulkhead 232 extending from the base of the quadrilateral extension 431 towards the tip of the lower front chassis bulkhead 232, a short edge extending laterally out of the side of the lower front chassis bulkhead 232, and a long edge extending from the end of the short edge back towards the tip of the bulkhead 232. The front wing edge 436 borders along the long edge of the wing base 435 and may extend downwards creating a triangular enclosure beneath the wing base 435. As shown in FIGS. 4B and 4M, the front chassis wings 434 may be where each of the front chassis members 422 may correspondingly be inserted into, respectively, when inserting the quadrilateral extension 431 of the lower front chassis bulkhead 232 into the cutout 405 in the chassis 400.

Figure 4G:
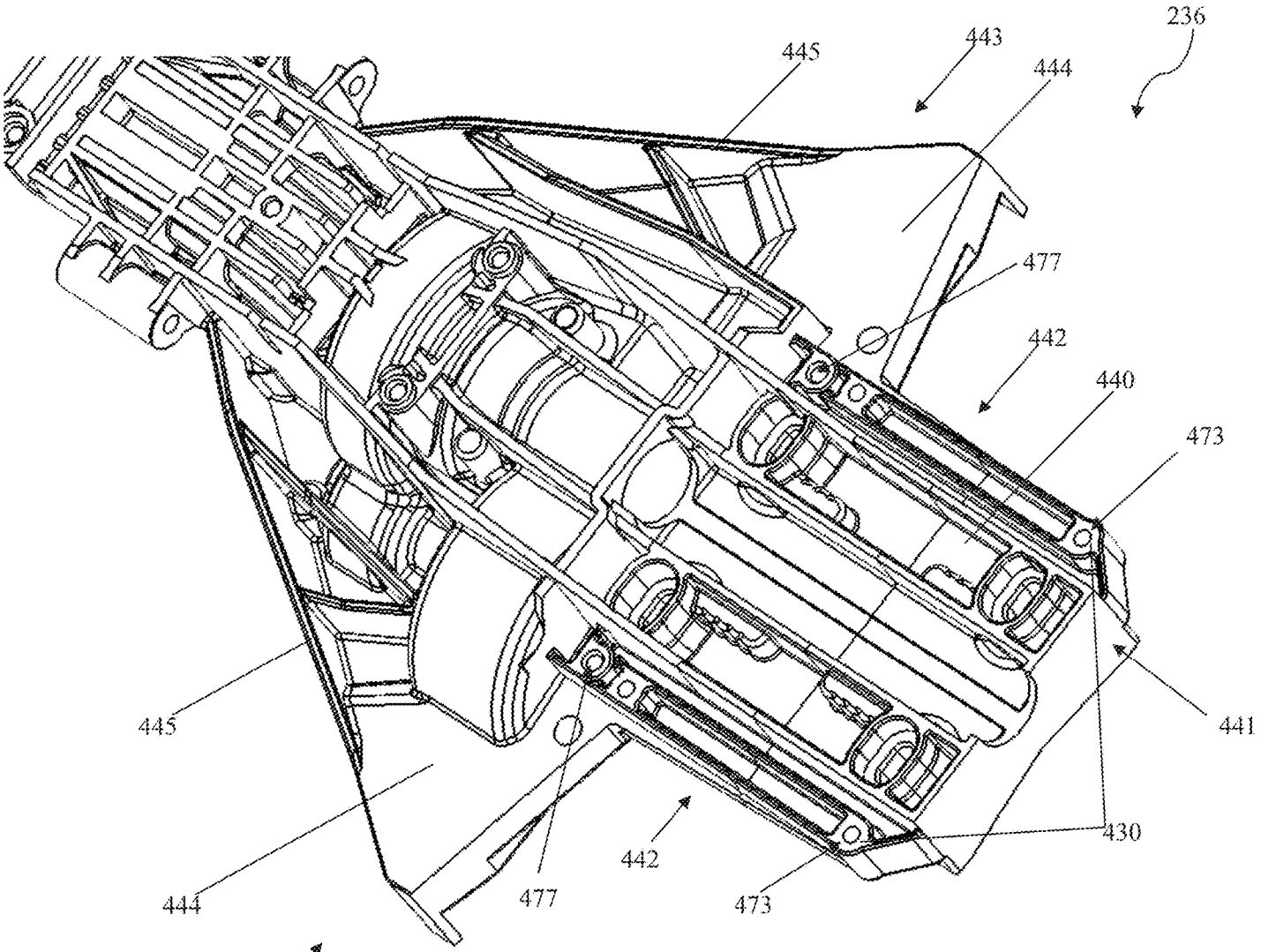

Turning now to FIG. 4G, the lower rear chassis bulkhead 236 may be connected to the chassis 400 by being inserted into the quadrilateral opening 407 in the rear surface 406 of the chassis 400. The lower rear chassis bulkhead 236 may comprise a quadrilateral extension 440 with a rear end contact surface 441 adjacent to a pair of rear side contact surfaces 442 on each side of the rear end contact surface 441. Each of the rear side contact surfaces 442 may comprise a rounded member 430 formed right before where each of the rear side contact surfaces 442 intersect the rear end contact surface 441. Each of the rounded members 430 may comprise a protruding rounded surface formed by extending out of the respective rear side contact surface 442 and curving to form a rounded surface, before extending diagonally straight to intersect the rear end contact surface 441. The extension from each of the rounded members 430 to its respective end of the rear end contact surface 441 may form a diagonal cut across each of the corners where the rear side contact surface 442 and the rear end contact surface 441 may intersect. This may form a trapezoidal shaped extrusion along the rear end contact surface 441 of the lower rear chassis bulkhead 462. Each of the rounded members 430 may also comprise a bore 473 that a screw may be threaded through to further secure the lower rear chassis bulkheads 236 to the chassis 400, after each of the rounded members 430 engage with their respective rounded detents 420. Alternatively, the screws may be any type of mechanical fasteners including clips, bolts, rods, pins, and the like. The bores 473 in rounded members 430 may be aligned with the bores 472 in the cylindrical base the rounded detents 420 may extend from.

The lower rear chassis bulkhead 236 may also comprise a pair of rear chassis wings 443 extending from both sides of the lower rear chassis bulkhead 236 adjacent to the quadrilateral extension 440. Each of the rear chassis wings 443 may comprise a rear wing base 444 extending laterally from a mid-section of the lower rear chassis bulkhead 236. The rear wing base 444 may be partially bordered by a rear wing edge 445 extending along a portion of the rear wing base 444. The rear wing base 444 may be shaped like a triangle comprising an edge along the body of the lower rear chassis bulkhead 236 extending from the base of the quadrilateral extension 440 towards the tip of the lower rear chassis bulkhead 236, a short edge extending laterally out of the side of the lower rear chassis bulkhead 236, and a long edge extending from the end of the short edge back towards the tip of the bulkhead 236. As shown in FIG. 4G, the rear wing edge 445 borders the long edge of the wing base 444 and may extend downwards creating a triangular enclosure beneath the rear wing base 444. The rear chassis wings 443 may be where each of the rear chassis members 423 may correspondingly be inserted into, respectively, when inserting the quadrilateral extension 440 of the lower rear chassis bulkhead 236 into the opening 407 in the chassis 400.

The front and rear chassis bulkheads 232, 236 may be assembled on the model vehicle by being connected to the chassis assembly 410. The chassis assembly 410 may be formed by attaching the bottom skid-plate 450 to the chassis 400. As shown in FIG. 4M, the bottom skid-plate 450 may be secured to the bottom surface 402 of the chassis 400 by threading screws 480 through the four bores 474 in the bottom skid-plate 450 into the fours bores 482 in the chassis 400. Screws 480 may alternatively be bolts, clips, pins, other mechanical fasteners, and the like. As previously shown in FIG. 4B, the chassis assembly 410 may comprise a front cavity 460 near the front surface 404 of the chassis 400, and a rear cavity 462 at the rear surface 406 of the chassis 400. The cavities 460, 462 may be formed by the attachment of the bottom skid-plate 450 to the chassis 400.

When connecting either the front chassis bulkhead 232 or the rear chassis bulkhead 236 to the chassis assembly 410, the corresponding quadrilateral extension 431, 440 of the chassis bulkheads 232, 236 may be inserted into the corresponding cavity 460, 462 in the chassis assembly 410. The connection between each of the chassis bulkheads 232, 236 and the respective cavity 460, 462 in the chassis assembly 410 may represent a male/female connector with the quadrilateral cutouts 431, 440 of the chassis bulkheads 232, 236 representing the male end, and the cavities 460, 462 of the chassis assembly 410 representing the female end. Each of the chassis bulkheads 232, 236 may be inserted into a respective cavity 460, 462 in the chassis assembly 410 until the rounded members 430 of each of the chassis bulkheads 232, 236 "snap" into the rounded detents 420 in the chassis 400.

Figure 4H:
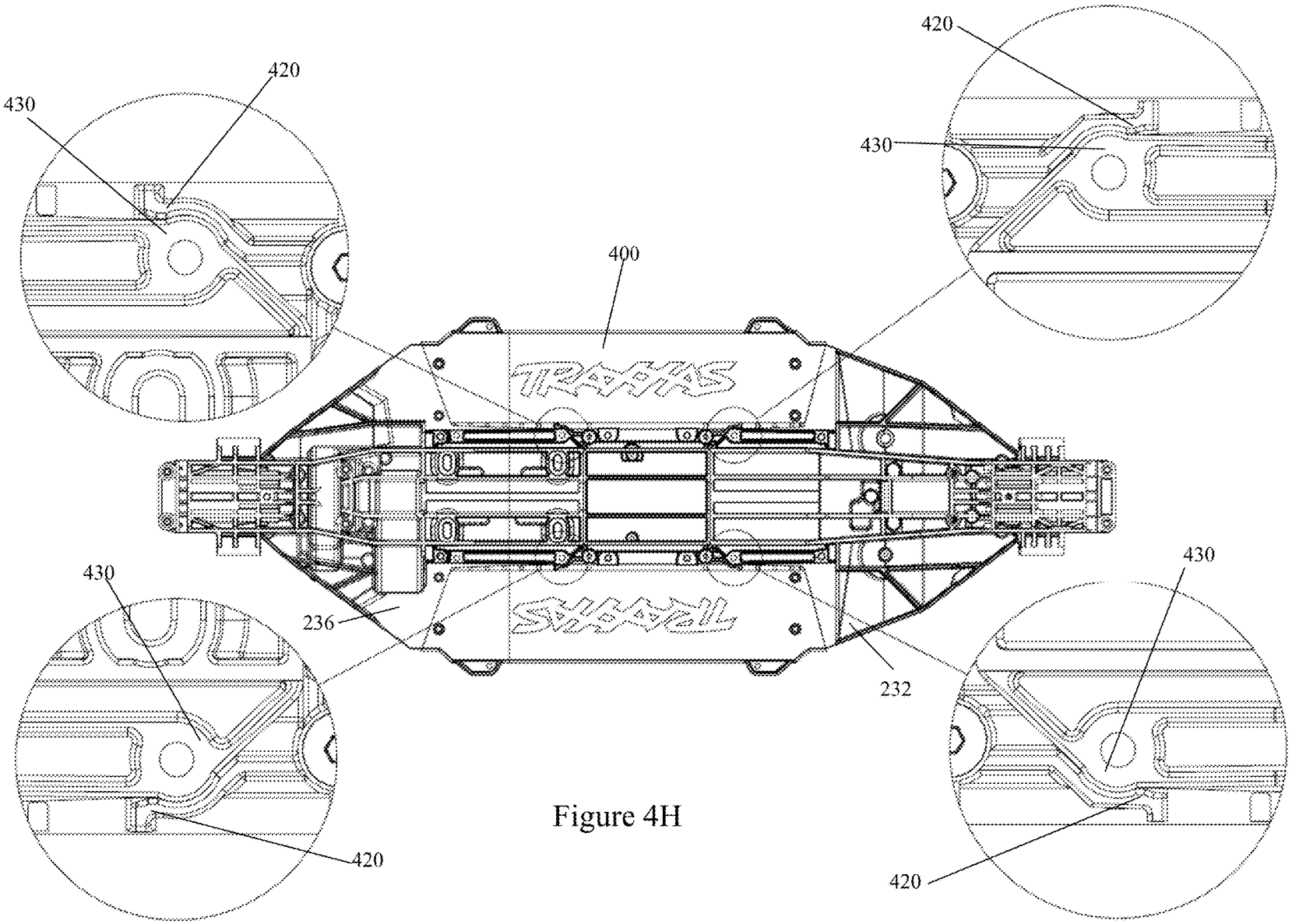
FIG. 4H is a bottom view of the front and rear bulkheads engaged to the chassis with the bottom skid-plate removed and detail views of the "snap in" feature.
Figure 41:
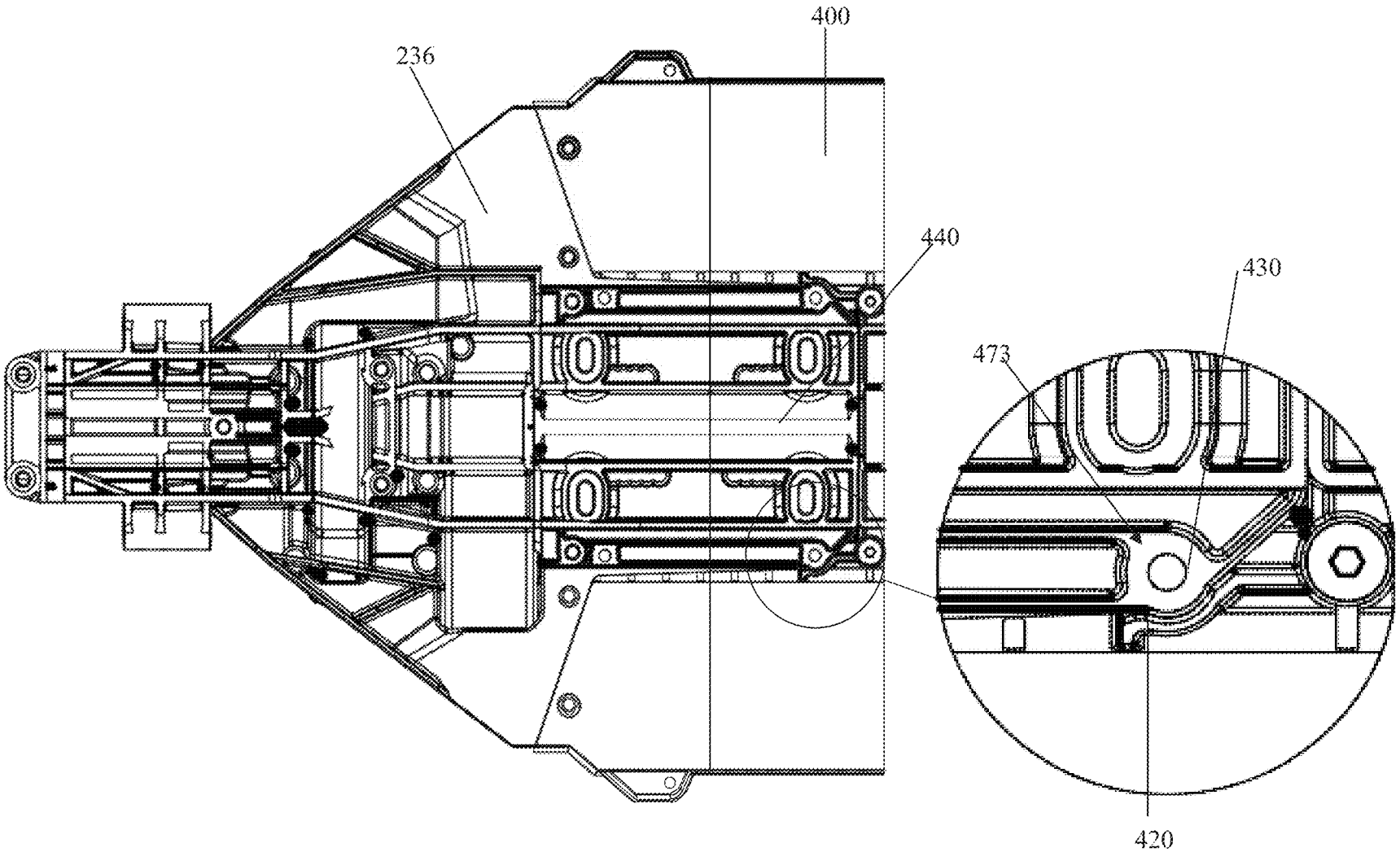
Figure 4J:
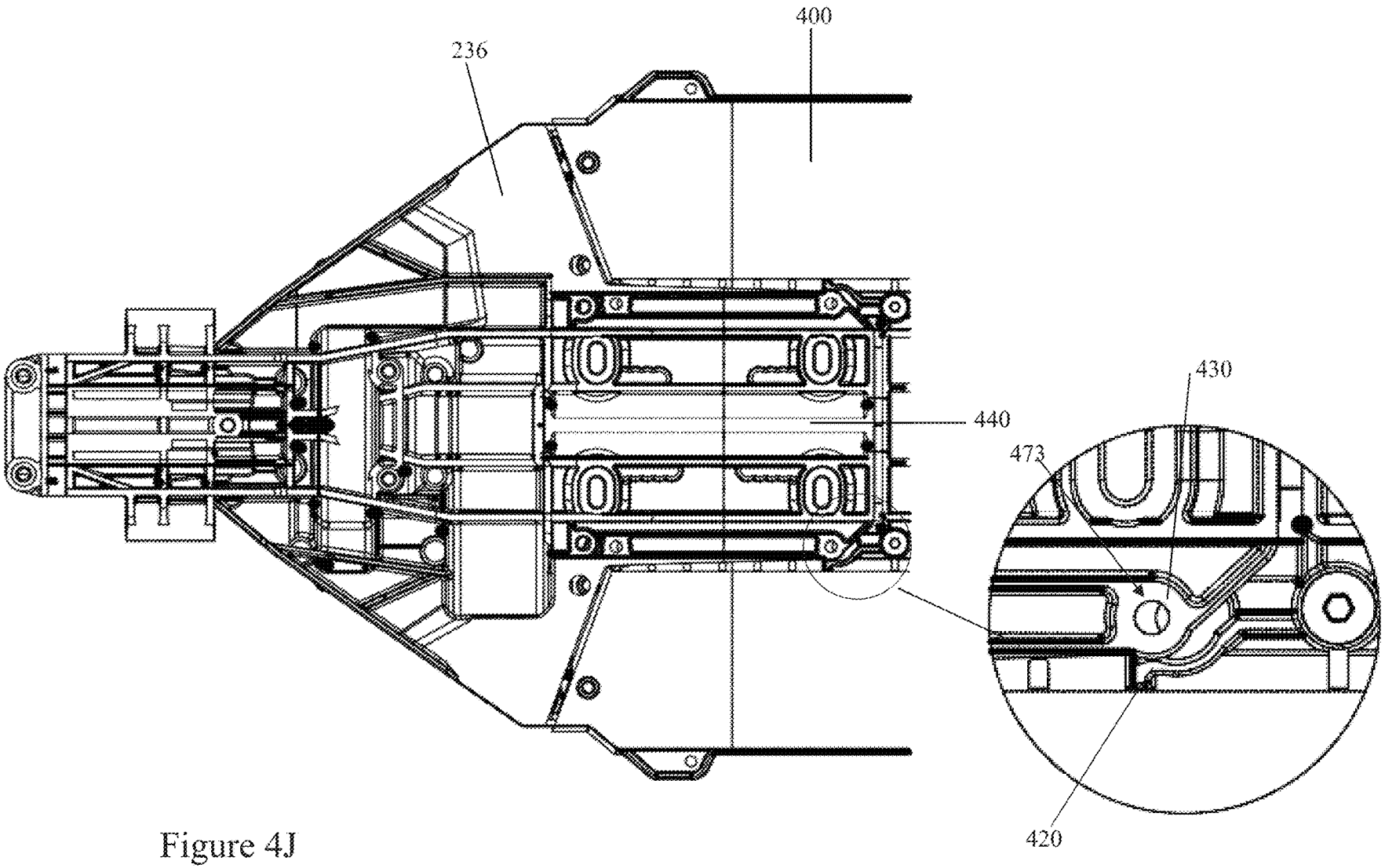
Figure 4K:
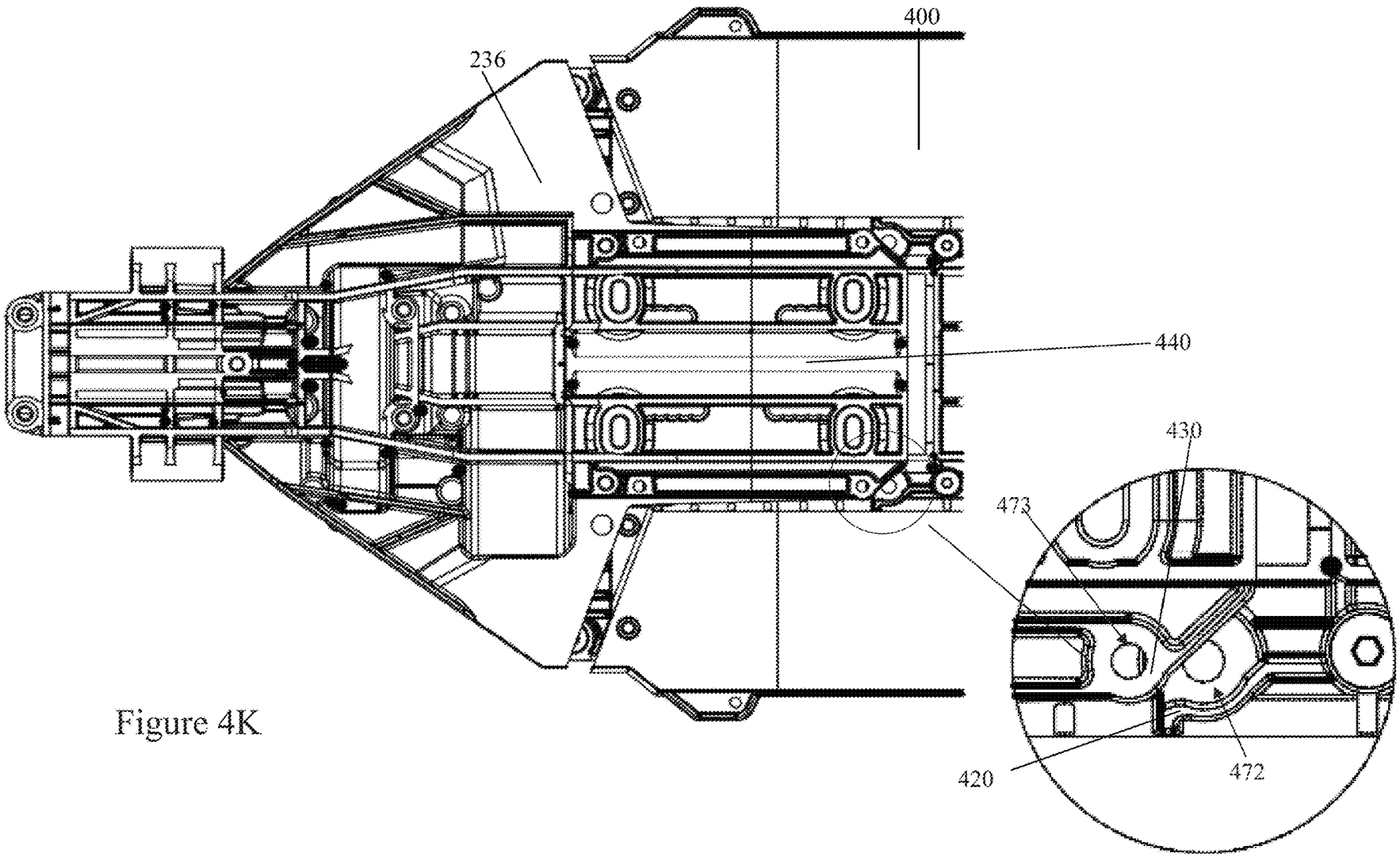
Figure 4L:
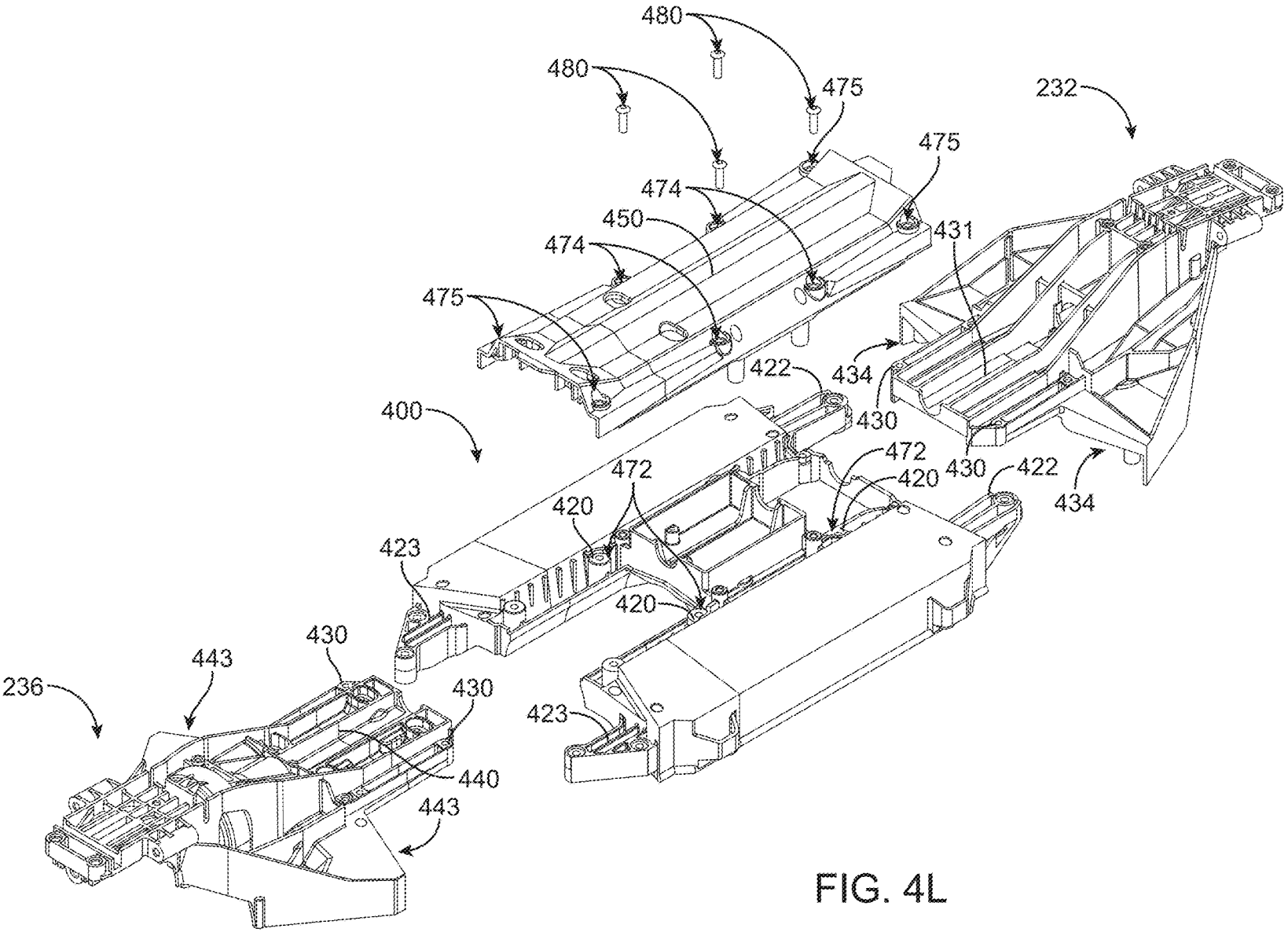
FIG. 4L is a perspective exploded view of the front and rear chassis bulkheads with the chassis and bottom skid plate.
Figure 4M:
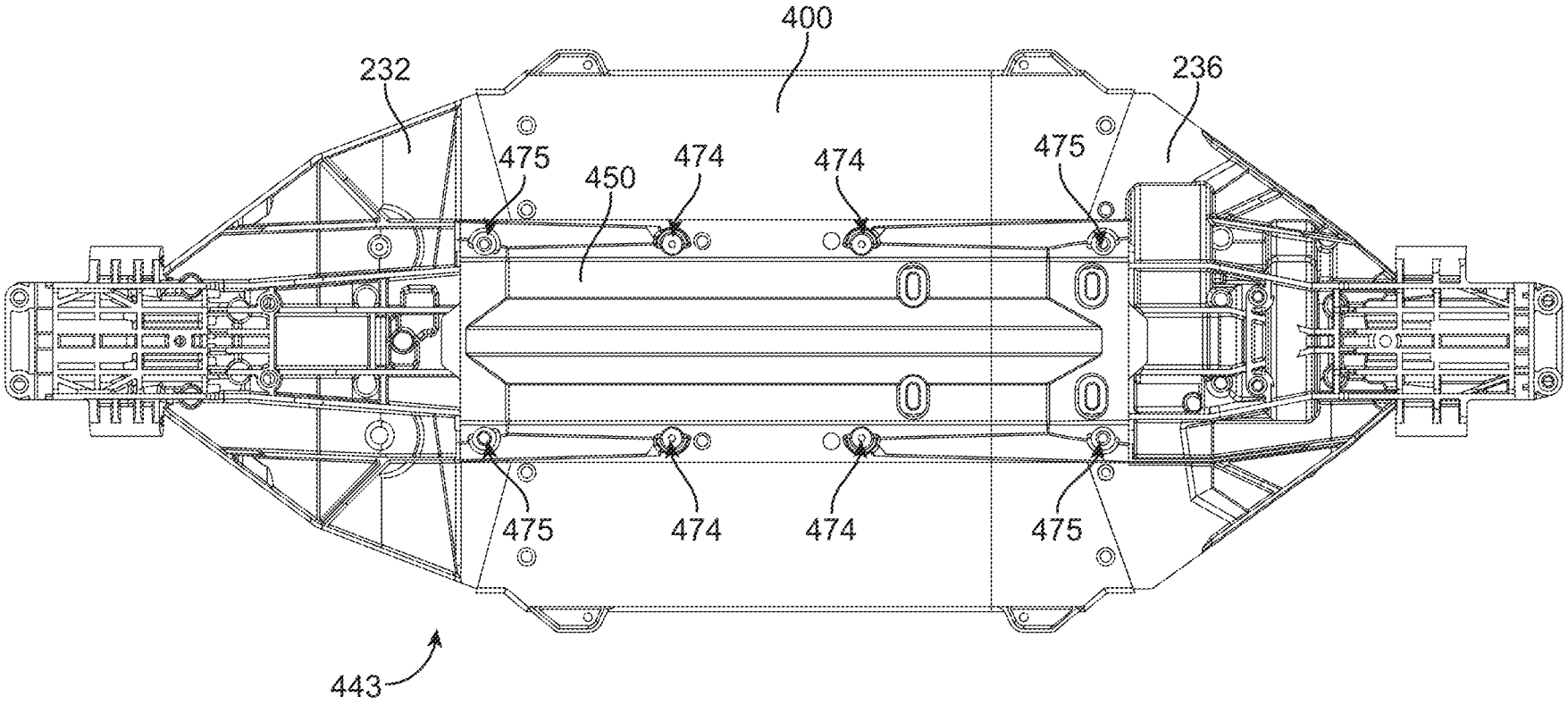
FIG. 4M is a bottom view of the front and rear bulkheads engaged to the chassis and bottom skid-plate
Figure 4N:
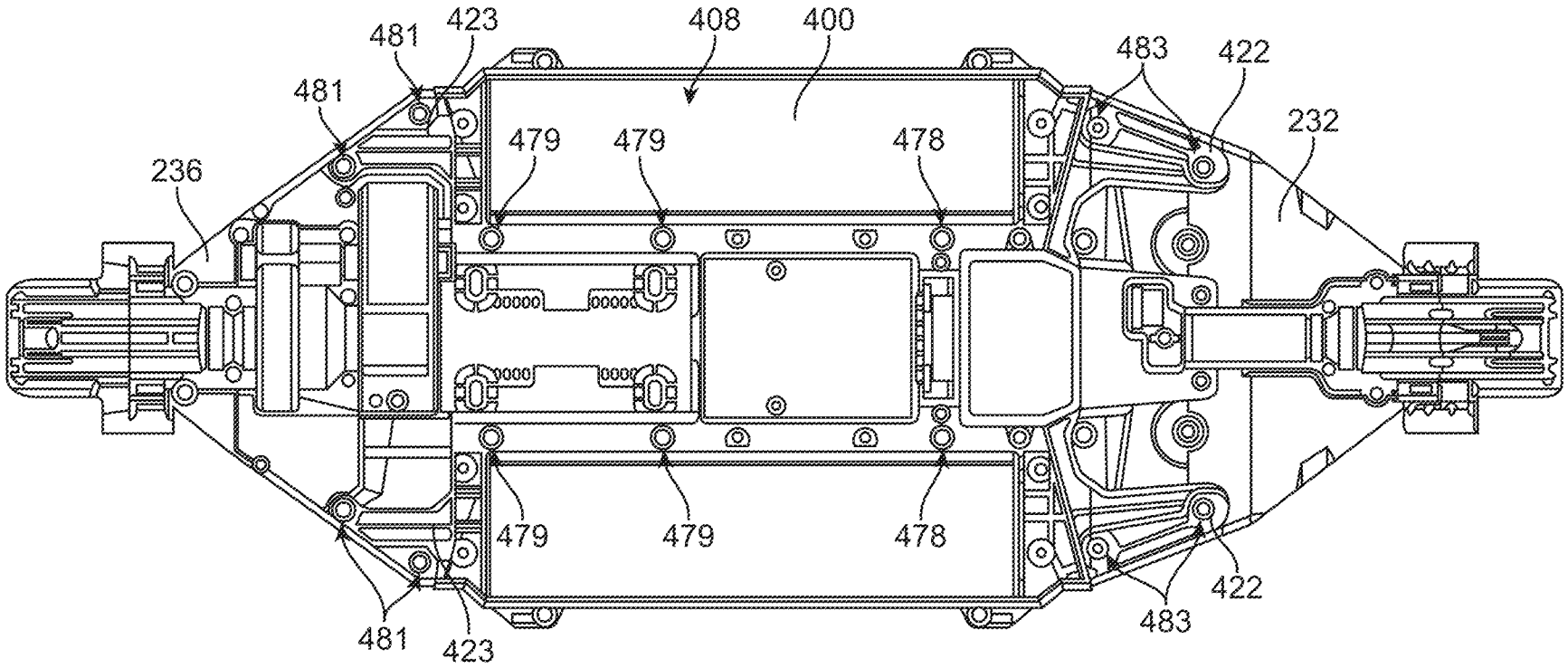
FIG. 4N is a top view of the front and rear chassis bulkheads engaged to the chassis.

Turning to FIG. 4H, the front and rear chassis bulkheads 232, 236 engaged with the chassis 400 is shown with the bottom skid-plate 450 hidden to illustrate the "snap in" connection when the chassis bulkheads 232,236 are being inserted into the chassis assembly 410. When connecting either the lower front chassis bulkhead 232 or the lower rear chassis bulkhead 236 to the chassis 400 via the "snap in" feature, the corresponding quadrilateral extensions 431, 440 may be inserted into the corresponding cutout 405 or the opening 407 to engage the rounded members 430 on the sides of the quadrilateral extension 431, 440 with the rounded detents 420 along the interior surfaces 411,413 of the cutout 405 or the opening 407. As shown in FIGS. 4I to 4K, the lower rear chassis bulkhead 236 may be connected to the chassis 400 by inserting the quadrilateral extension 440 into the opening 407 until the rounded members 430 along each of the rear side contact surface 442 engage with the rounded detents 420 along the interior surface 413. When engaging the rounded members with the rounded detents 420, the extending curved structure of the rounded members 420 may initially force the rounded detents 420 outwards before cradling the rounded members 430 in the rounded portion of the rounded detents 420. When the rounded member 430 reaches the curved portion of the rounded detents 420, the rounded detents 420 may "snap" back and exert a compressive force against the rear side contact surface 442. The compressive force by the rounded detents 420 may secure the lower rear chassis bulkhead 232 to the chassis 400 such that an additional force would be required to pull the rounded members 430 out from the curved surface in the rounded detent 420. When the lower rear chassis bulkhead 236 is snapped into the chassis 400, the rear end contact surface 441 may be in direct contact with the second middle surface 414 of the middle body 401. Furthermore, when the lower rear chassis bulkhead 236 is "snapped" into the chassis 400, the top surface of the rounded members 430 may be flush with the bottom surface 402 of the chassis 400.

The insertion of the lower rear chassis bulkhead 236 into the cavity 462, of the chassis assembly 410 at the rear surface 406 of the chassis 400 may be accompanied by an interlocking engagement at the rear surface 406 of the chassis 400 and the rear chassis wings 443. As shown in FIGS. 4B and 4M, the interlocking engagement may comprise the insertion of the quadrilateral extension 440 into the cavity 462 of the chassis assembly 410 comprising the opening 407 in the chassis 400, as well as the insertion of the pair of rear chassis members 423 into each of the rear chassis wings 443 flanking the quadrilateral extension 440. The triangular rear chassis wings 443 including the rear wing base 444 may be shaped to match the angled rear chassis members 423. Furthermore, the edges of the rear surface 406 on each side of the opening 407 may be shaped to complement the angle of the short edge of the rear wing base 444 extending from the rear side contact surface 442 of the lower rear chassis bulkhead 236. When the rear chassis members 423 are engaged with the rear chassis wings 443, the rear surface 406 on both sides of the opening 407 may be in direct contact with the short edge of the rear wing base 444, and the rear wing base 444 may be flush with the bottom surface 402.

The "snap in" feature connecting the lower front chassis bulkhead 232 to the chassis 400 may be substantially similar to connecting of the lower rear chassis bulkhead 236 to the chassis 400 as described herein. The quadrilateral extension 431 may be inserted into the cutout 405 such that the extension 431 slides over the connecting surface 403 bringing the front side contact surfaces 433 of the lower rear chassis bulkhead 232 in contact with the rib extrusions spaced along both of the interior surfaces 411 of the chassis 400. The quadrilateral extension 431 may be inserted until the rounded members 430 on the front side contact surfaces 433 engage the rounded detents along the interior surface 411. When engaged, the front end contact surface 432 may be in direct contact with the first middle surface 412, and the top surface of the rounded members 430 may be substantially flush with the bottom surface 402.

The insertion of the lower front chassis bulkhead 232 into the chassis assembly 410 may also be an interlocking engagement comprising the engaging of the quadrilateral extension 431 into the front cavity 460 and the front chassis members 422 into the front chassis wings 434. The front chassis members 422 and the front chassis wings 434 may be shaped to be substantially similar such that the front chassis members 422. The front chassis members 422 may snuggly fit into the front chassis wings 434 with the outer edges of the front chassis members 422 in direct contact with the front wing edges 436. Furthermore, the edges of the front surface 404 on each side of the cutout 405 may be shaped to complement the angle of the short edge of the front wing base 435 extending from the front side contact surface 433 of the lower front chassis bulkhead 232. When the front chassis members 422 and the rear chassis wings 443 are engaged, the front surface 404 on both sides of the cutout 405 may be in direct contact with the short edge of the front wing base 435, and the front wing base 435 may be flush with the bottom surface 402 of the chassis 400.

After the lower front chassis bulkhead 232 and the lower rear chassis bulkhead 236 are connected to the chassis assembly 410, as shown in FIG. 4M, the bottom skid-plate 450 may extend across the middle body 401 of the chassis 400 and a portion of each of the quadrilateral extensions 431, 440 on the chassis bulkheads 232, 236. The bottom skid-plate 450 may then be further secured to the chassis bulkheads 232, 236 by threading additional mechanical fasteners such as a screw, bolt, clip, rod, pin, and the like through four bores 475 in the bottom skid-plate 450 into the chassis bulkheads 232, 236. FIG. 4M shows the bottom skid-plate 450 secured to the chassis 400 with four fasteners threaded through the four bores 474 and fastened into the chassis 400. Two additional fasteners may be threaded through the two bores 475 in the bottom skid-plate 450 near the front bulkhead 232, and fastened into the two bores 476 in the front bulkhead 232. Two other additional fasteners may be threaded through the two bores 475 in the bottom skid-plate 450 near the rear chassis bulkhead 236, and fastened into the two bores 477 in the rear chassis bulkhead 236.

The chassis 400 and the chassis bulkheads 232, 236 may be further secured by mechanical fasteners such as a screw, bolt, clip, rod, pin, and the like threaded from the top surface 408 of the chassis 400 into the chassis bulkheads 232,236. As shown in FIG. 4N, two mechanical fasteners may be threaded through two bores 478 in the chassis 400 near the front surface 404 and fastened into the front chassis bulkhead 232 through bores 471. Two fasteners may be threaded through two bores 481 in each of the front chassis members 422, and fastened into the front chassis bulkhead 232. Four mechanical fasteners may be threaded through four bores 479 in the chassis 400 near the rear surface 406 and fastened into the rear chassis bulkhead 236 through at least bores 473. Two fasteners may be threaded through two bores 483 in each of the rear chassis members 423, and fastened into the rear chassis bulkhead 236.

Damper Cartridge

A damper cartridge 490 forms part of a suspension system of the main assembly 102.

Tie Bar Mounting

The main assembly 102 may be provided with a particular tie-bar 492, 493, 494, 495, 496, 497 configuration for securing the suspension system on the front and rear assemblies 104, 106.

Battery Hold-Down

Figure 5A:
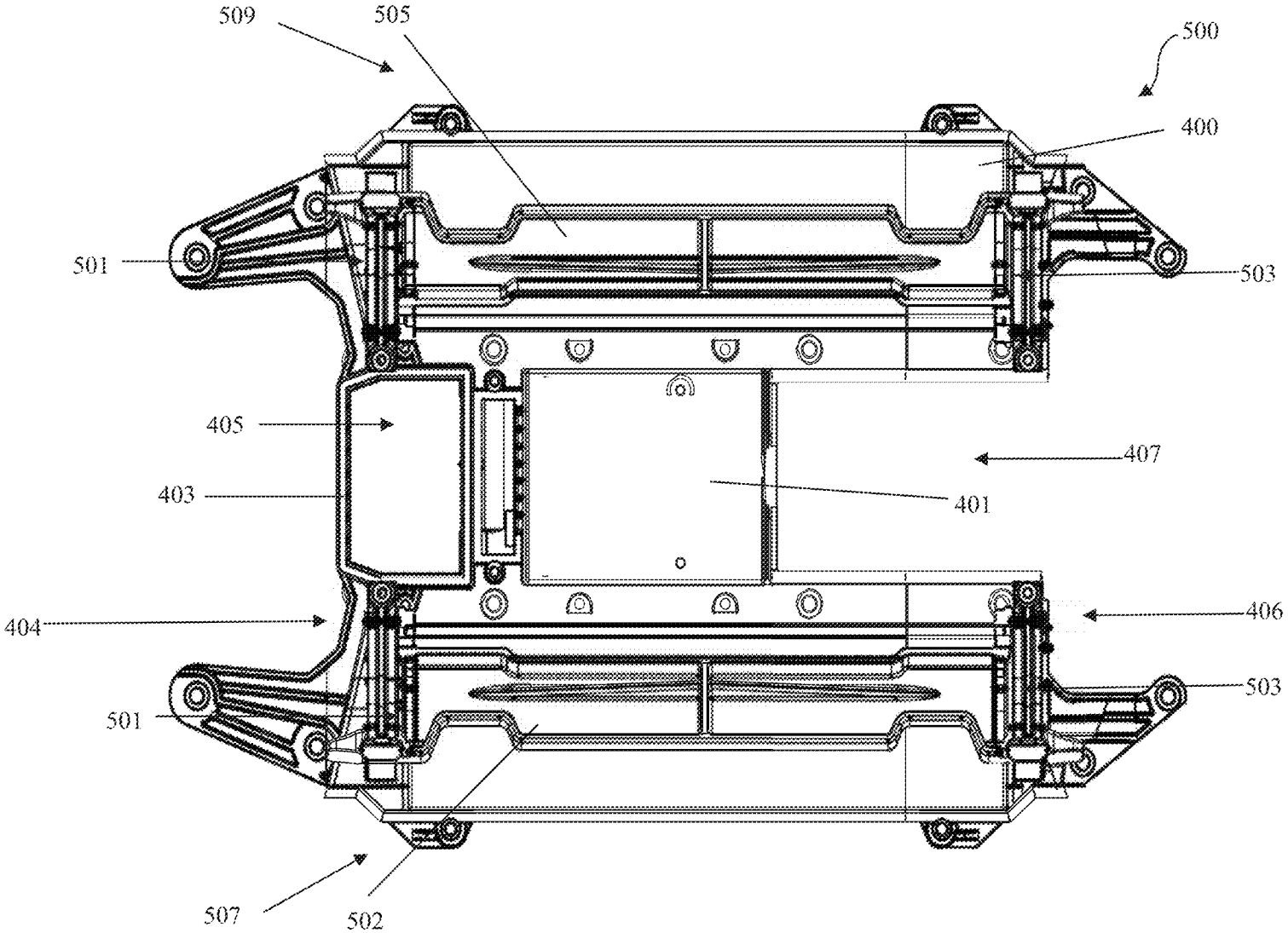
FIG. 5A is a top view of a portion of a model vehicle chassis and a battery hold down.
Figure 5C:
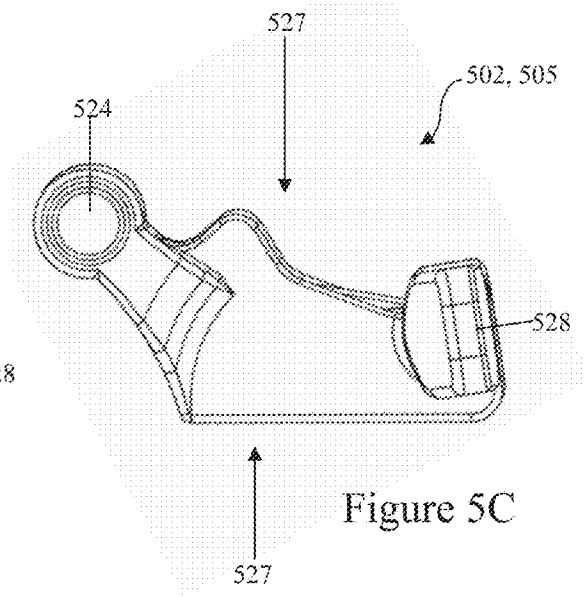
FIGS. 5B-5D are perspective, side, and front views of the battery retainer.

FIG. 5A illustrates a battery hold down 500 supported on a chassis 400 of a model vehicle. In the shown embodiment, the battery hold down 500 may be used to retain at least one battery (550 in FIG. 5T) to be connected to the model vehicle on the chassis 400. At least one battery 550 may be capable of being inserted and retained on each of the left side 507 and the right side 509 of the chassis 400. The left side 507 and the right side 509 of the chassis 400 may comprise mirror imaging sides of one another each capable of retaining and securing at least one battery 550 on the chassis 400. The embodiment shown may be used for retaining a single battery 550 in each of the left side 507 and right side 509 of the chassis 400. Alternatively, other embodiments of the model vehicle may only require a single battery to operate and be retained on the chassis 400. As such, other alternative embodiment may only require the battery hold down to retain a single battery 550. The left and right sides 507, 509 of the chassis 400 may be separated by the connecting surface 403, quadrilateral cutout 405, chassis middle body 401, and quadrilateral opening 407. The battery hold down 500 may prevent the connected battery 550 positioned on each side of the chassis 400 from moving or falling during operation of the model vehicle. The battery hold down 500 may also stabilize each of the connected batteries to prevent the connections powering the model vehicle from coming loose or detached during operation of the model vehicle.

In an embodiment, the battery hold down 500 may comprise a first battery retainer 502 on the left side 507 of the chassis 400 hinged between a first supporting member (504 in FIG. 5G) and a second supporting member (506 in FIG. 5G) for securing a first battery 550. The battery hold down 500 may also comprise a second battery retainer 505 on the right side 509 of the chassis 400 hinged between a third supporting member (508 in FIG. 5G) and a fourth supporting member (510 in FIG. 5G) for securing a second battery 550.

Turning to FIGS. 5B-7D, in an embodiment, the first and second battery retainers 502, 505 may each comprise a rectangular body 526, a front end (501 in FIG. 5A), and a rear end (503 in FIG. 5A). The front end 501 of each of the first and second battery retainers 502, 505 may be the end of the battery retainers 502, 505 positioned towards the front surface 404 of the chassis 400. The rear end 503 of each of the first and second battery retainers 502, 505 may be the end of the battery retainers 502, 505 positioned towards the rear surface 406 of the chassis 400. Each of the front and rear ends 501, 503 of the first and second battery retainers 502, 505 may comprise a sliding member 524 and a wedge clip 528. The front ends 501 of the first and second battery retainers 502, 505 may be positioned flanking the quadrilateral cut out 405 and the connecting surface 403 of the chassis 400. The rear ends 503 of the first and second battery retainers 502, 505 may be positioned flanking the quadrilateral opening 407 in the chassis 400.

Figure 5B:
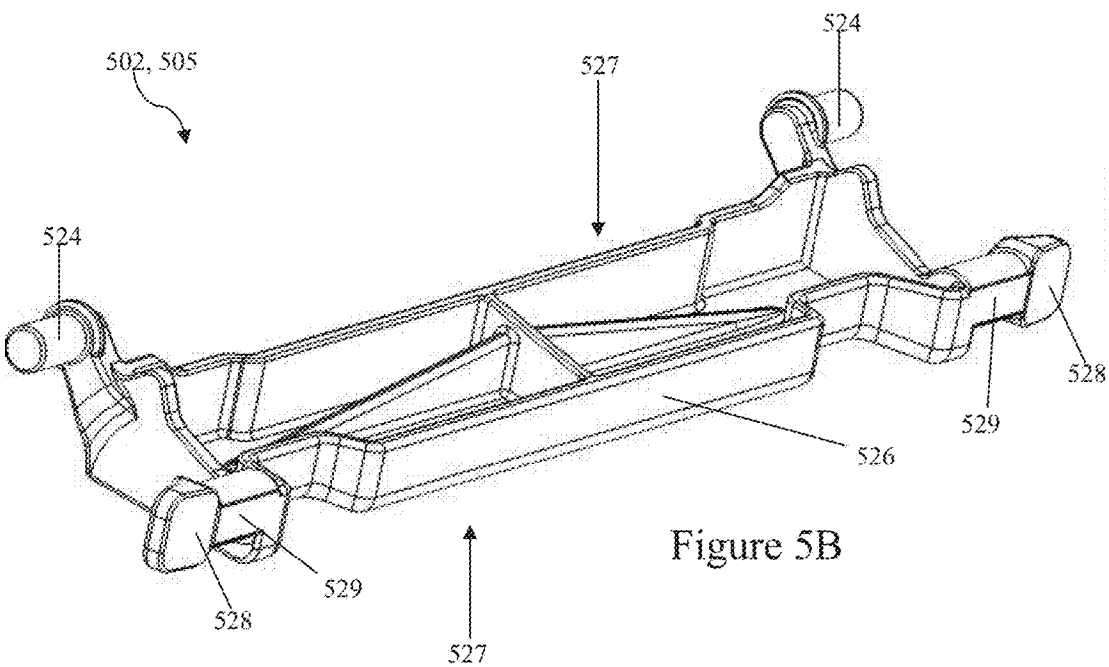
Figure 5D:
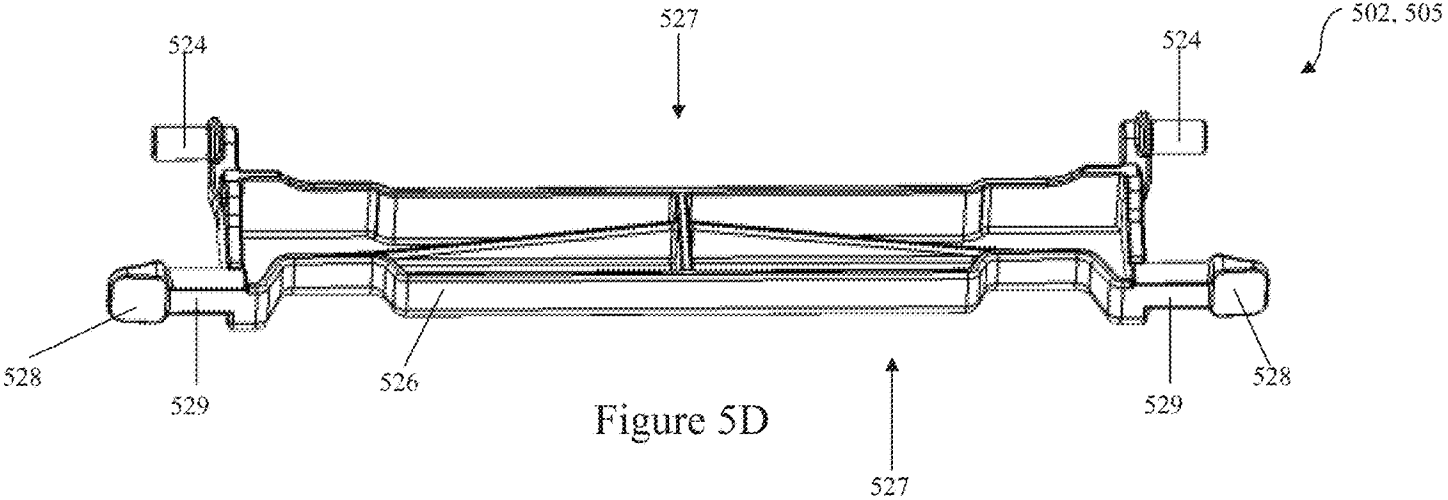

Each of the front and rear ends 501, 503 of the rectangular body 526 may comprise a sliding member 524 extending from one corner of the rectangular body 526, and a wedge clip 528 extending out of an adjacent corner of the rectangular body 526, at the same respective ends. Each of the sliding members 524 extending from the front and rear ends 501, 503 may be on the same half of the rectangular body 526 such that the two sliding members 524 may be positioned directly across from each other, as shown in FIG. 5B. The sliding members 524 may comprise cylindrical extrusion extending away from the rectangular body 526 with the circular base of each of the cylindrical extrusions on the same plane as the front and rear ends 501, 503 of the rectangular body, respectively. Each of the wedge clips 528 may be connected to an extending member 529 extending from the rectangular body 526. The wedge clips 528 may also be positioned on the same half at opposite corners of the rectangular body 526 such that the wedge clips 528 and the extending member 529 at both the front end 501 and the rear end 503 of the battery retainers 502, 505 may be positioned directly across from each other. Each of the front and rear ends 501, 503 of the rectangular body 526 may comprise a sliding member 524 adjacent with an extended wedge clip 526 which may be positioned such that the front and rear ends 501, 503 may be mirrored. The extending member 529 of each of the wedge clips 528 extend from adjacent corners with a respective adjacent sliding member 524 such that the sliding member 524 and the extending member 529 extend in the same direction and substantially parallel to one another. Each of the wedge clips 528 may comprise a rectangular wedge base with a pair of inclined planes extending from opposites sides of the rectangular wedge base forming a peak. The wedge clip 528 may be formed on the extending member 529 beginning with the wedge base closest to the extending member 529 and the peak of each wedge 528 pointing away from and positioned farthest away from the extending member 529 and the rest of the battery retainer 502, 505. The wedge clips may be oriented such that the triangular bases of each the wedge clips 528 may be along the same plane as a top surface 525 and a bottom surface 527 of the rectangular body 526.

The battery hold down 500 may also be hinged and retained on the chassis 400 of the model vehicle by a first supporting member 504, a second supporting member 506, a third supporting member 508, and a fourth supporting member 510 to prevent the battery hold down 500 itself from coming loose or getting lost during operation of the model vehicle. The first battery retainer 502 may be secured and operatively connected to the left side 507 of the chassis 400 by the first and second supporting members 504, 506. The second battery retainer 505 may be secured and operatively connected to the right side 509 of the chassis 400 by the third and fourth supporting members 508, 510, respectively.

Figure 5F:
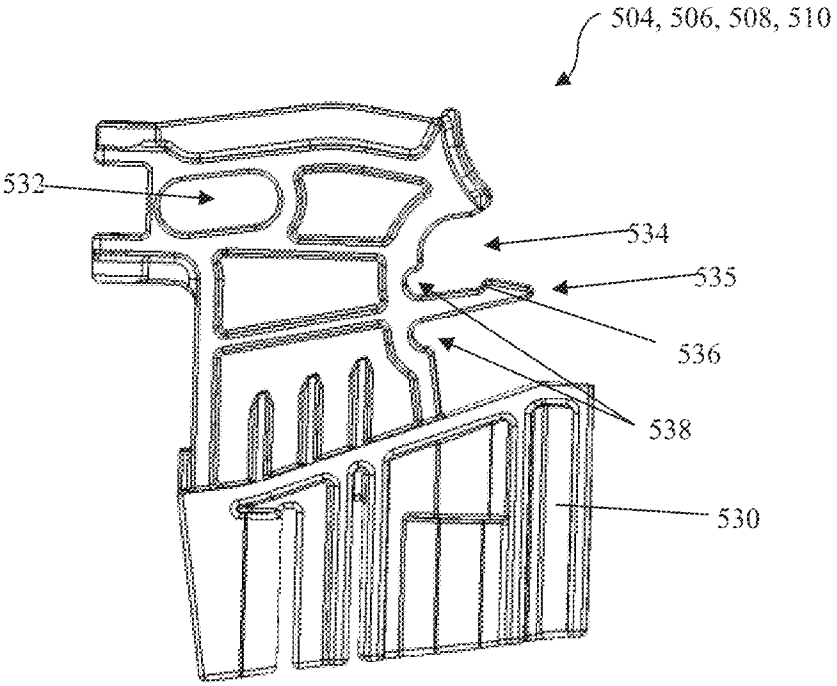
FIGS. 5E and 5F are perspective and side views of the supporting members.
Figure 5E:
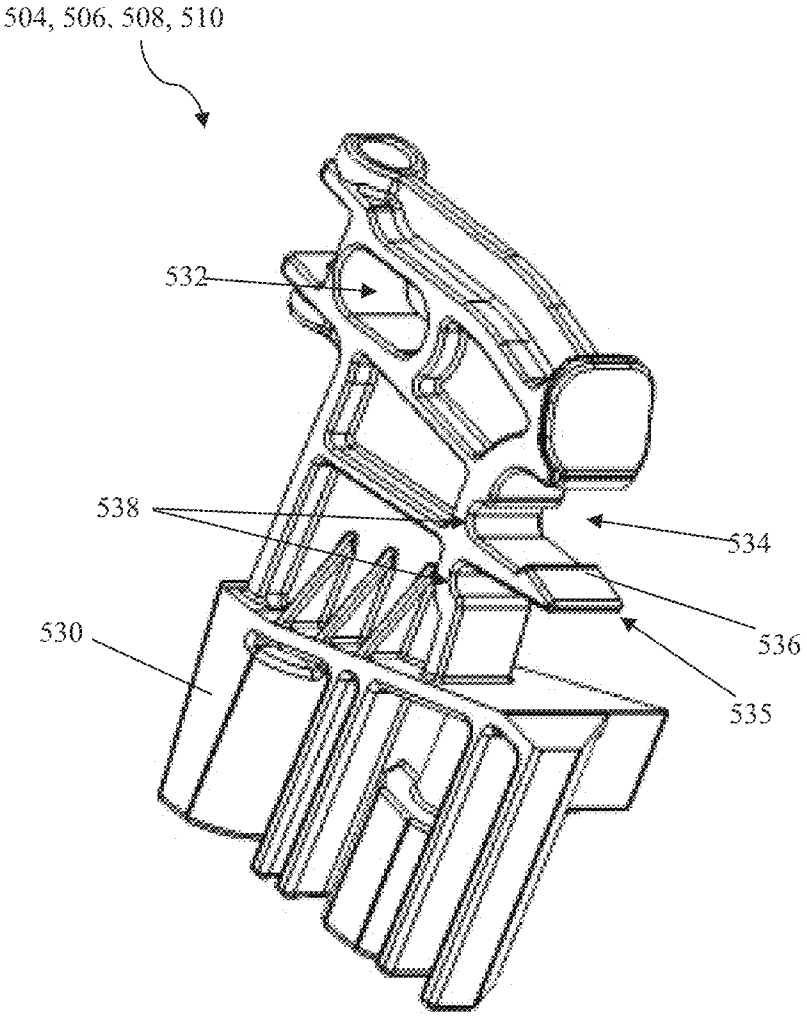

As shown in FIGS. 5E and 5F, each of the supporting members 504, 506, 508, 510 may comprise a base 530 for securing each of the supporting members 504, 506, 508, 510 in the chassis 400, a slider opening 534532 for engaging with each of the sliding members 524, and a wedge fastener 534 for engaging with each of the wedge clips 528. On each of the supporting members 504, 506, 508, 510, the base 530 may comprise an irregular shaped cross sectional perimeter. The chassis 400 may comprise a matching irregular shaped cutout (531 in FIG. 5X) such that the base 530 may be inserted into the cutout 531 to secure the supporting members 504, 506, 508, 510 in the chassis 400. The wedge fasteners 534 may comprise a "C" shaped channel or an open groove, with the groove exposing an opening through the surface of one of the sides of each the supporting members 504, 506, 508, 510. Towards the opening in each of the wedge fasteners 534, the bottom portion of each of the wedge fasteners 534 may comprise a tapered tip 535 with a leaf spring detent 536 to aid in retaining the extending member 529 when engaged with the wedge fasteners 534. As shown in FIG. 5F, the leaf spring detent 536 may be formed by an inclined plane extending from the tapered tip 535 at the bottom of the wedge fastener 534, followed by a short declining surface extending towards the interior of the wedge fastener 534.

Figure 5G:
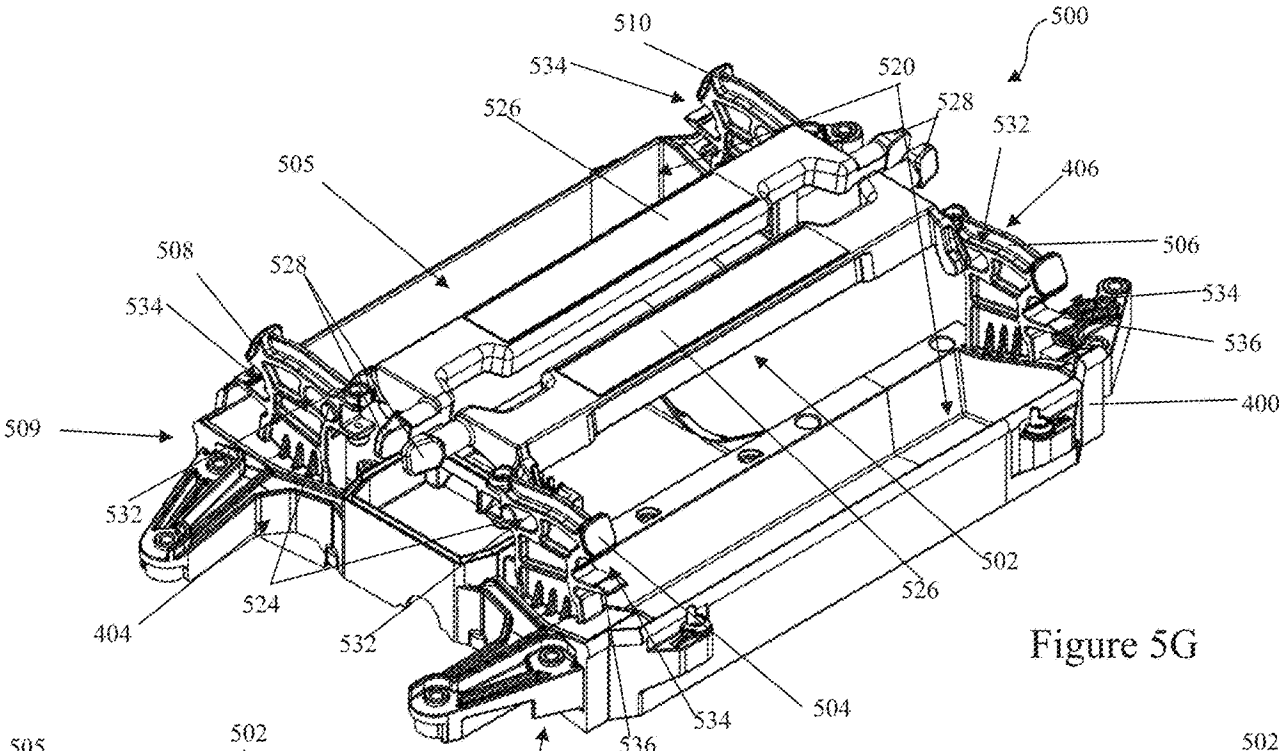
FIGS. 5G-5I is a perspective, end, and longitudinal side views of the battery hold down in an open position.
Figure 5I:
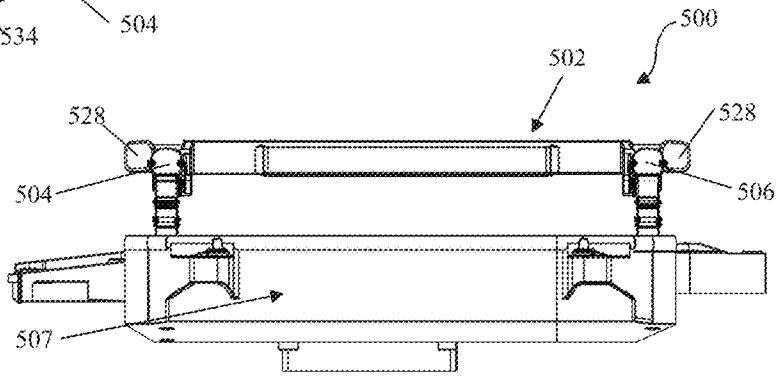
Figure 5H:
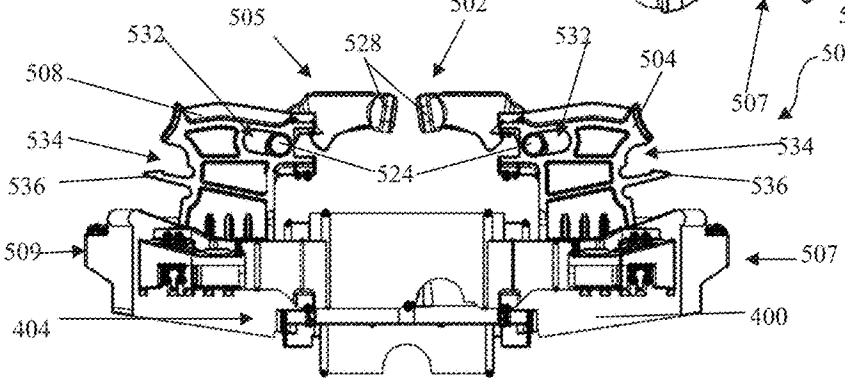
Figure 5K:
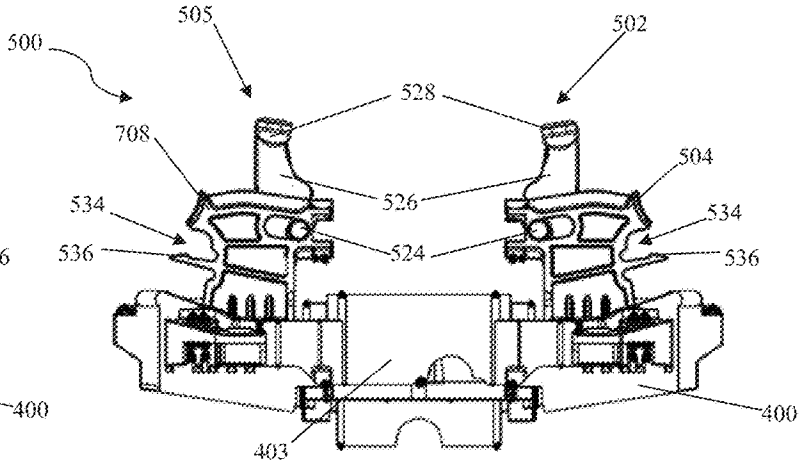
FIGS. 5J-5M are end views of the battery hold down transitioning from an open position towards a closed position.
Figure 5J:
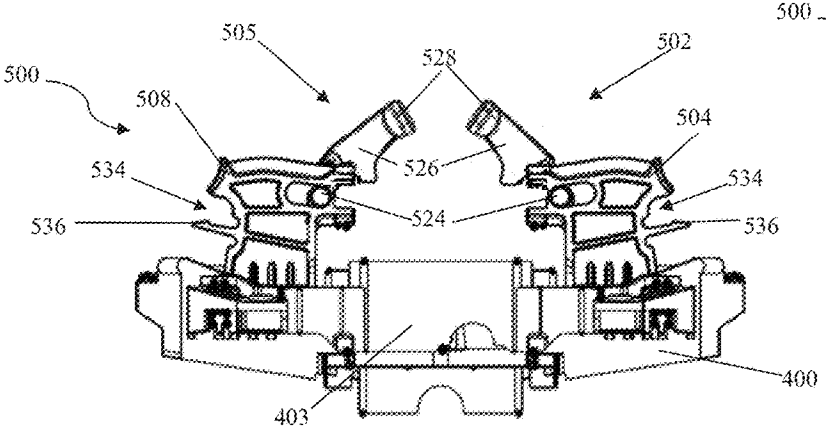
Figure 5M:
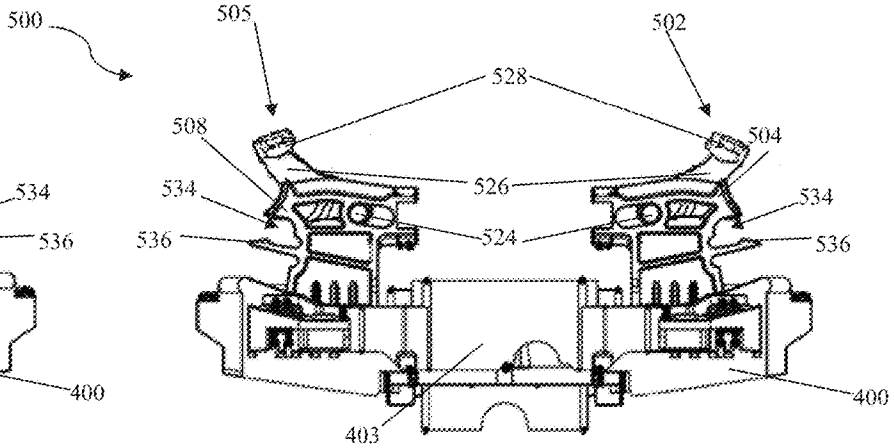
Figure 5L:
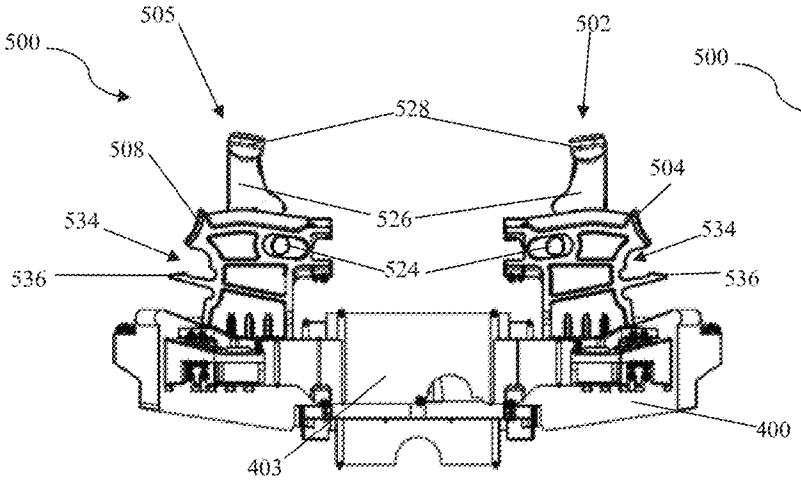
Figure 5N:
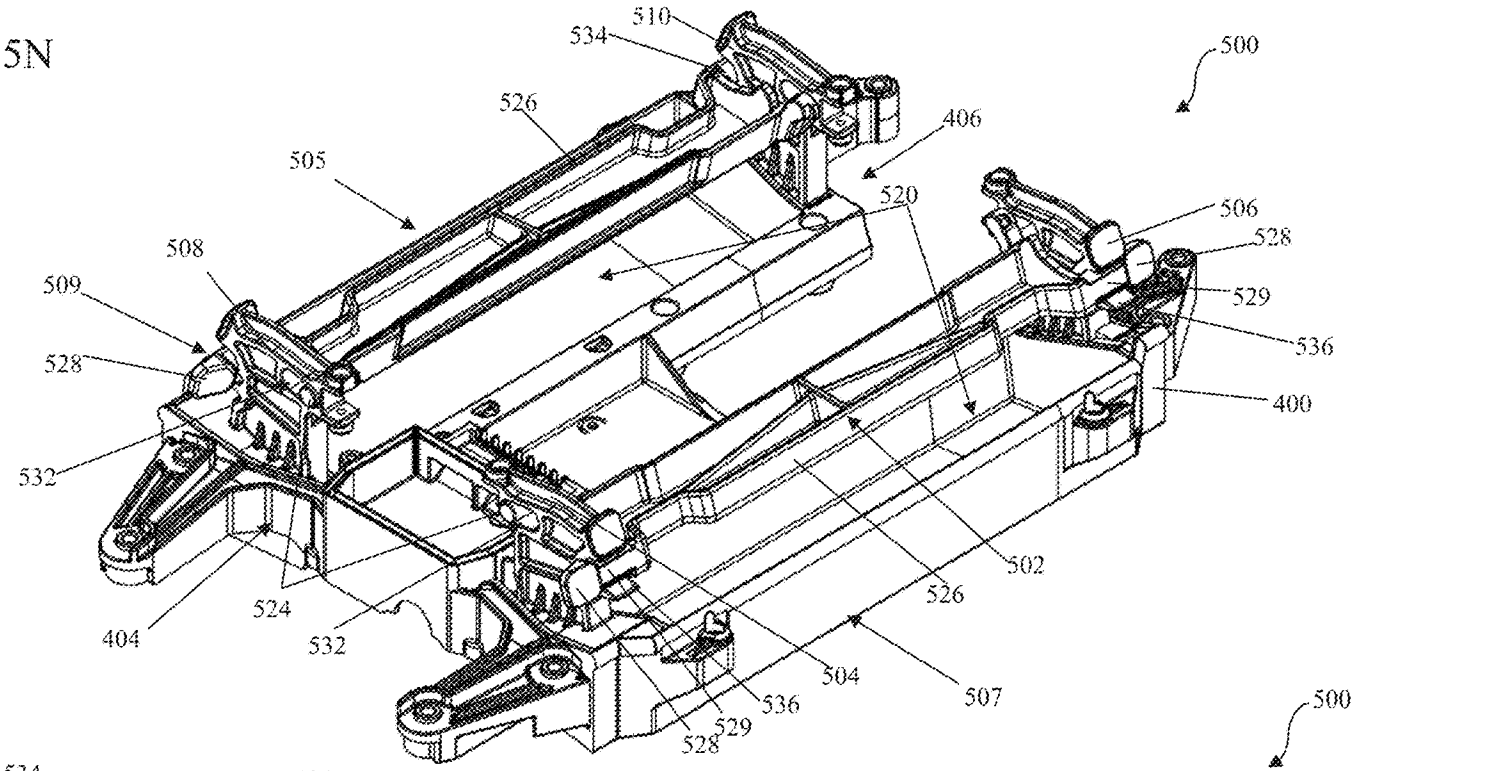
FIG. 5N is a perspective view of the battery hold down in a closed and clasped position.
Figure 5P:
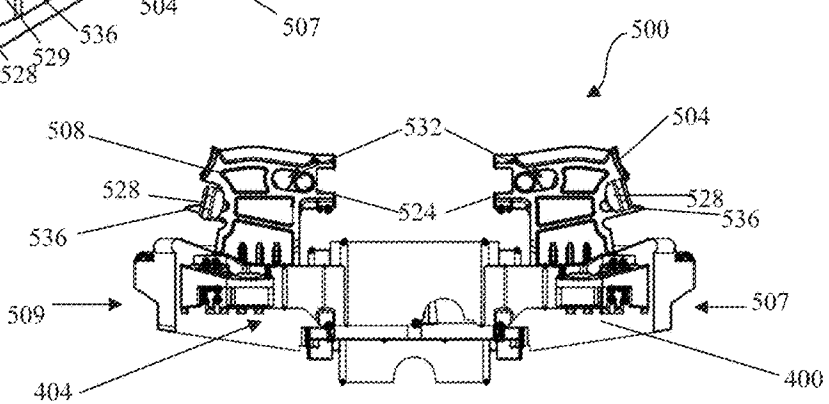
FIGS. 5O and 5P are an end view of the battery hold down transitioning between an unclasped and a clasped position when the battery hold down is closed.
Figure 5O:
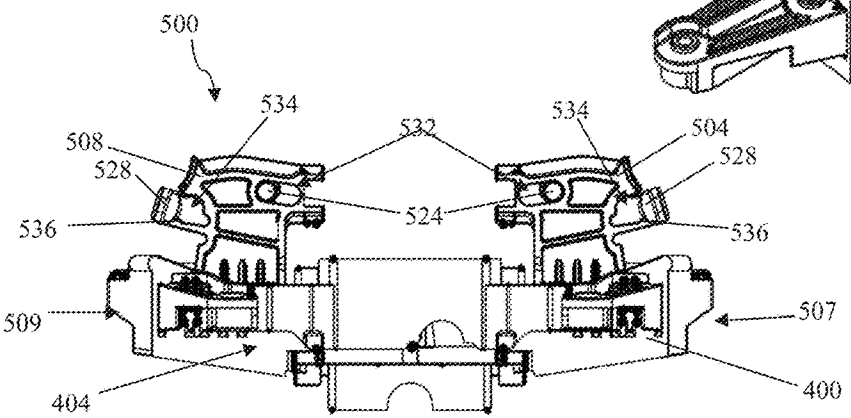

As shown in FIGS. 5O and 5P, the slider openings 532 in each of the supporting members 504, 506, 508, 510 may be positioned adjacent to the wedge fastener 534 on the opposite side of the wedge fastener 534. The slider opening 532 may comprise an elongated rectangular opening with semi-circle cutouts at each of the ends of the opening. The diameter of the semi-circle ends and the widths of the elongated portion of the opening 532 may be at least slightly larger than the diameter of the sliding member 524. The slider opening 532 may be large enough that the sliding member 524 may be inserted into one of the semi-circle ends of the slider opening 532 and slide across the opening to the other semi-circle end of the slider opening 532. The position of the slider opening 532 and the wedge fastener 534 on the supporting members 504, 506, 508, 510 may match the approximate relative positions of the sliding member 524 and the wedge clip 528 on one of the ends of the battery retainer 500, 502. The slider opening 532, the wedge fastener 534, sliding member 524, and wedge clip 528 may be positioned such that the wedge clip 528 may be engaged with the wedge fastener 534 when the sliding member 524 is engaged with the slider opening 532.

Each of the left and right sides 507, 509 of the chassis 400 may comprise an opening for inserting one of the supporting members 504, 506, 508, 510 on each side of a battery tray 520 in the chassis 400 for housing the battery 550 to be retained in each side of the chassis 400. The battery retainers 502, 505 of the battery hold down 500 may engage with one of the battery trays 520 on each side of the chassis 400, respectively, in order to retain the inserted battery 550 in the chassis 400 and the respective battery tray 520. On each of the left and right sides 507, 509 of the chassis 400, there may be a pair of irregular shaped cutouts matching the cross sectional perimeter of the base 530 for inserting one of the supporting members 504, 506, 508, 510 into the chassis 400. The supporting members 504, 506, 508, 510 may be inserted between each of the battery trays 520 and both the front and rear surfaces 404, 406 of the chassis 400. On the left side 507 of the chassis 400, the supporting member 504 may be inserted and positioned between the front surface 404 and the battery tray 520 in the chassis 400. The supporting member 506 may be inserted and positioned between the battery tray 520 and the rear surface 406 of the chassis 400. On the right side 509 of the chassis 400, the supporting member 508 may be inserted and positioned between the front surface 404 and the battery tray 520 in the chassis 400.

The supporting member 510 maybe inserted and positioned between the battery tray 520 and the rear surface 406 of the chassis 400.

The battery hold down 500 may be assembled on the chassis 400 by mounting the battery retainers 502, 505 to the chassis 400 using the supporting members 504, 506, 508, 510. To mount the first battery retainer 502 to the left side 507 of the chassis 400, the first battery retainer 502 may first be engaged with the first and second supporting members 504, 506. The sliding member 524 at the front end 501 of the rectangular body 526 may be inserted into the slider opening 534532 in the first supporting member 504 with the wedge fastener 534 adjacent to the wedge clip 528. The sliding member 524 at the rear end 503 of the rectangular body may be inserted into the slider opening 534532 in the second supporting member 506 with the wedge clip 528 at the rear end 503 of the rectangular body 526 adjacent to the wedge fasteners 534 in the second supporting member 506. With the slider openings 534532 of the first and second supporting members 504, 506 engaged with the sliding members 524 on the front and rear end 501, 503 of the first battery retainer 502, the bases 530 of the supporting members 504, 506 may be inserted into the irregular shaped cutout 531 in the left side of the chassis 400 flanking the battery tray 520. The first supporting member 504 may be inserted into the irregular shaped cutout 531 between the front surface 404 on the left side 507 of the chassis 400 and the battery tray 520. The second supporting member 506 may be inserted into the irregular shaped cutout 531 between the rear surface 406 on the left side 507 of the chassis 400 and the battery tray 520. The supporting members 504, 506 may be inserted such that the wedge fasteners 534 may be closer and open towards the outer edge of the chassis 400, with the slider opening 532 of the first supporting member 504 closer towards the quadrilateral cutout 405, and the slider opening 532 of the second supporting member 504 closer towards the quadrilateral opening 407.

The second battery retainer 505 may be assembled with the chassis 400 in the same away as the first battery retainer 502 to create a mirror image of the battery hold down 500 across the chassis middle body 401. The sliding members 524 on the second battery retainer 505 may be engaged with the slider openings 532 on the third and fourth supporting members 508, 510, with the wedge clip 528 at the front end 501 of the second battery retainer 505 adjacent to the wedge fastener 534 in the third supporting member 508, and the wedge clip 528 at the rear end 503 adjacent to the wedge fastener 534 in the fourth supporting member 510. After the third and fourth supporting members 508, 510 may be engaged to the second battery retainer 505, the third and fourth supporting members 508, 510 may be inserted in the irregular shaped cutouts 531 flanking the battery tray 520 in the right side of the chassis 400. The third supporting member 508 may be inserted in the irregular shaped cutouts 531 between the front surface 404 of the right side 509 of the chassis 400 and the battery tray 520. The fourth supporting member 510 may be inserted in the irregular shaped cutout 531 between the rear surface 406 on the right side 509 of the chassis 400 and the battery tray 520. The third and fourth supporting members 508, 510 may be inserted in the right side 509 of the chassis 400 with the wedge fasteners 532 closer and open towards the outer edge of the chassis 400, and the slider openings 532 in the third and fourth supporting members 508, 510 adjacent to the connecting surface 403, and the quadrilateral opening 407, respectively. The supporting members 504, 506, 508, 510 may be retained in the chassis 400 by screws, bolts, couplings, adhesives, pins, clamps, other mechanical fasteners, and the like.

With the battery hold down 500 engaged to the chassis 400, each of the first and second battery retainers 502, 505 may be used to secure a battery 550 inserted in the battery tray 520 in the left and right side 507, 509 of the chassis 400, respectively. The battery retainers 502, 505 may be positioned between a first, open, position, as shown in FIGS. 5G and 5H, a second, closed and unclasped position, as shown in FIG. 5O, and a third, closed and clasped position, as shown in FIGS. 5N and 5P. With the sliding members 524 engaged with the slider openings 532, the sliding members 524 and the slider openings 532 may operate like a sliding hinge, such that the sliding members 524 may each rotate and slide between opposite ends within the slider opening 532. The movability of each of the sliding members 524 may then permit the attached battery retainers 502, 505 itself to be rotated and moved over the body of each of the supporting members to the extent of the length of the slider openings 532. The transition between the open and closed positions of the battery retainers 502, 505 may primarily be operated by the rotation and sliding of each of the sliding members 524 within their respective slider openings 532.

As shown in FIGS. 5J to 5M, to transition from the open position shown in FIG. 5G towards the closed and clasped position shown in FIGS. 5N and 5P, the rectangular body 526 of each of the battery retainers 502, 505 may be rotated up and over the body of the supporting members 504, 506, 508, 510 towards the wedge fastener 534 side of each of their respective supporting members 504, 506, 508, 510. The rectangular body 526 may be rotated by rotating the sliding member 524 within the slider opening 532. FIGS. 5J to 5M show a transition from an open position as shown in FIG. 5G where the sliding members 524 are positioned in the slider opening 532 at the semi-circle end farthest from the respective wedge fastener 534. To transition towards the closed position from here may require sliding the sliding member 524 across the slider opening 532 to the semi-circle end closest to the respective wedge fastener 534. If transitioning from an open position where the sliding member 524 is already in the semi-circle end of the slider opening 532 closest to the wedge fastener 534, the transition from the open position to the closed position may require only rotating the battery retainers 502, 505 over each of the supporting members 504, 506, 508, 510.

Figure 5Q:
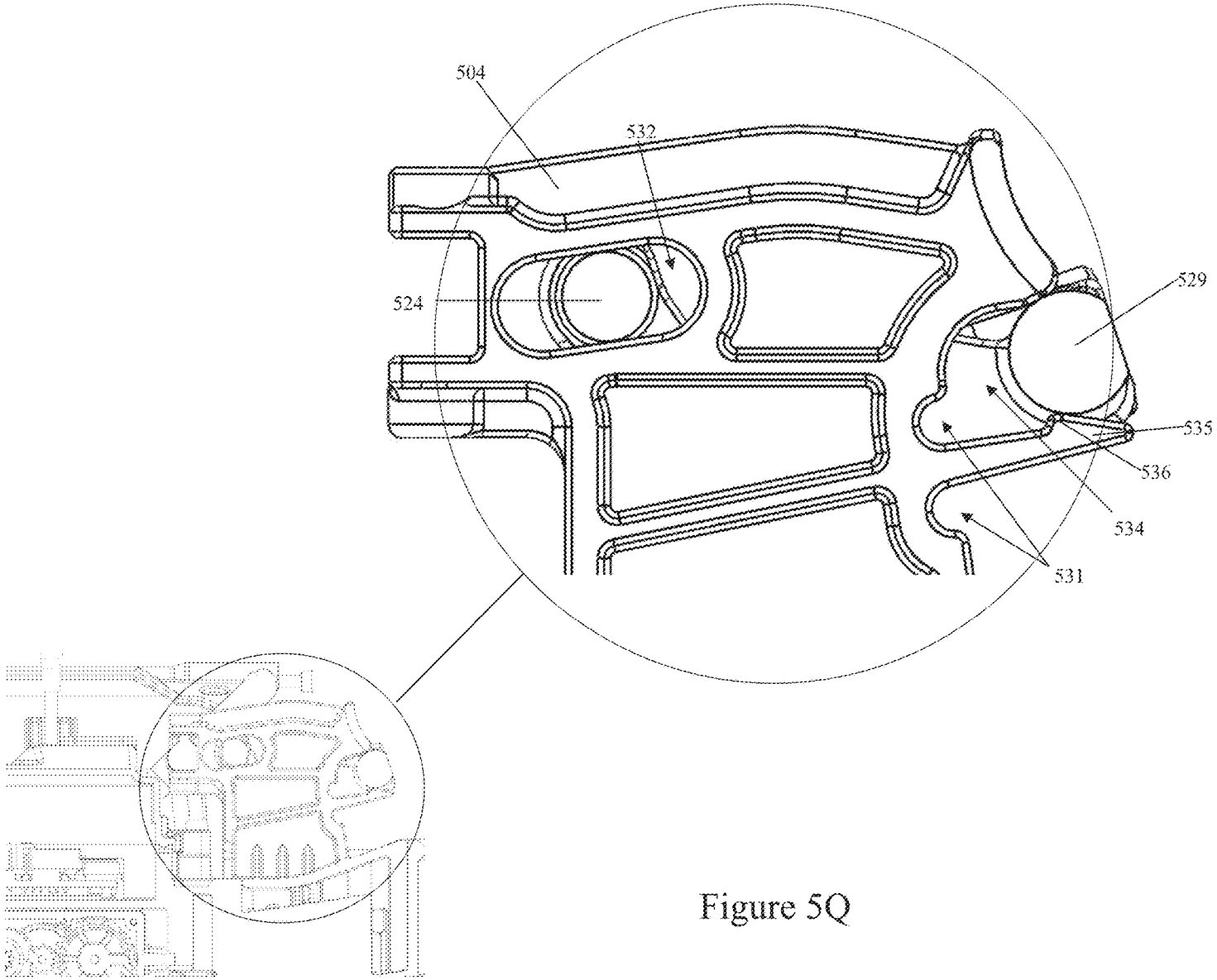
FIGS. 5Q-5R are close up sectional views of the battery hold down transitioning between an unclasped and a clasped position.

The initial transition from the open position may position the battery retainers 502, 505 in the second closed and unclasped position, as shown in FIG. 5O. With the battery retainers 502, 505 in the closed and unclasped position, the sliding members 524 of each of the battery retainers 502, 505 may be positioned in its respective slider opening 532 in the semi-circle end closest to each of the respective wedge fasteners 534 on the same respective supporting member 504, 506, 508, 510. The wedge clips 528 and the extending members 529 at each of the ends 501, 503 of the battery retainers 502, 505 may then be adjacent to the wedge fasteners 534 in each of the same respective supporting members 504, 506, 508, 510, such that the extending member 529 may be in contact and adjacent to the tapered tip 535 at the opening of the wedge fastener 534, as shown in FIG. 5Q. To transition from the closed and unclasped position back to the open position in 7G and 7H, the battery retainers 502, 505 may each be moved by rotating the sliding members 524 in each of the slider openings 532. The battery retainers 502, 505 may be rotated such that the wedge clips 528 and the extending members 529 may be lifted away from the wedge fastener 534 and rotated over the supporting members 504, 506, 508, 510 towards the middle of the chassis 400. With the battery retainers 502, 505 rotated to the open position, the sliding member 524 and slider opening 532 in each of the supporting members 504, 506, 508, 510 may be positioned between each of the wedge clips 528 and the wedge fasteners 534.

Figure 5R:
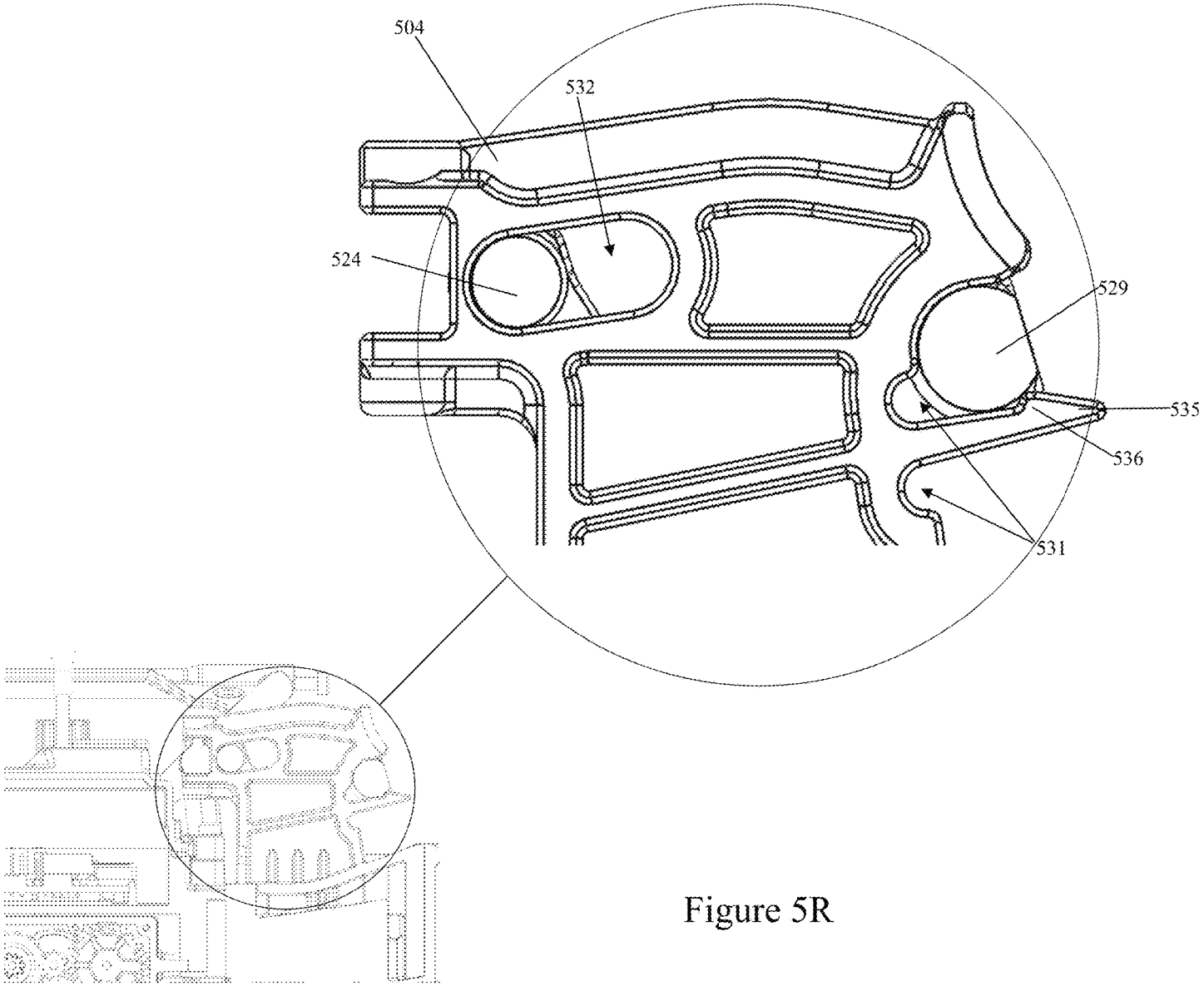
Figure 5T:
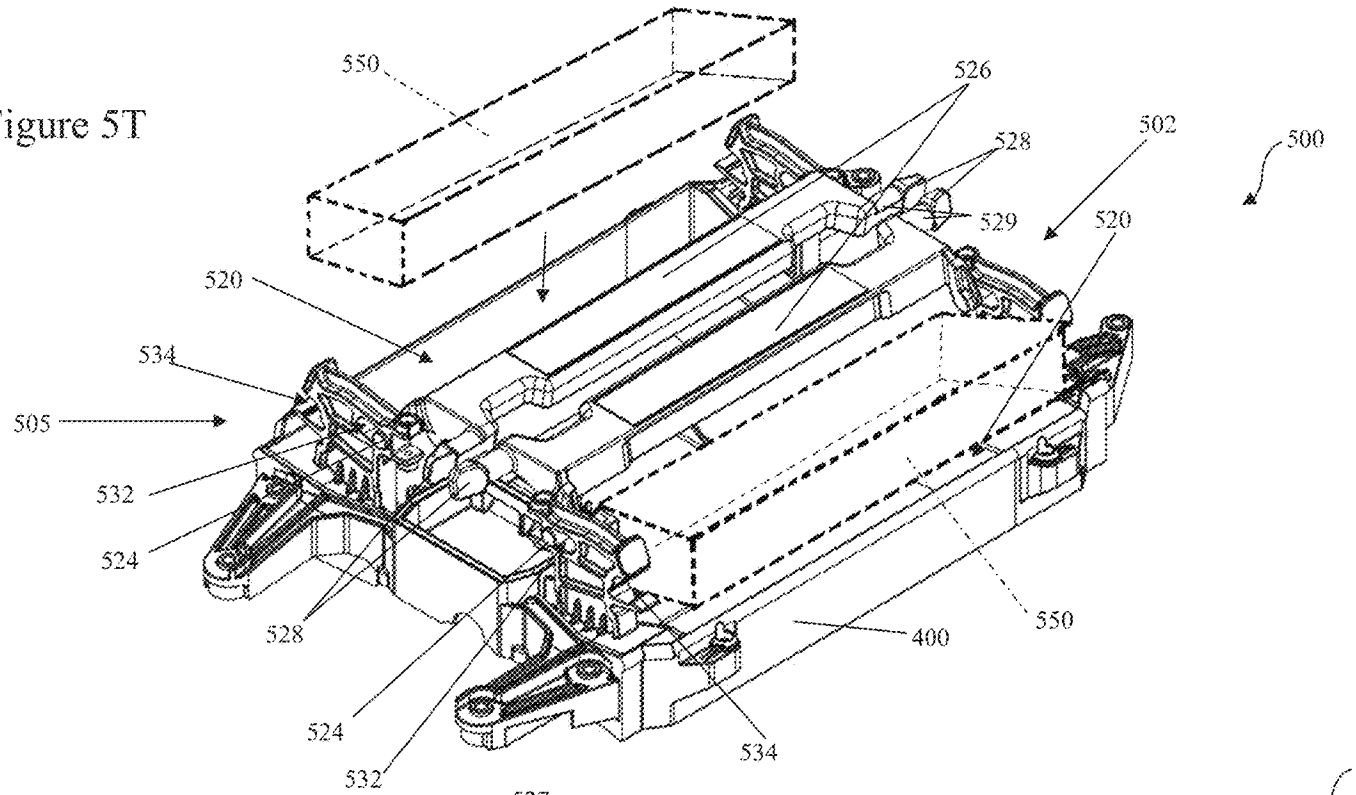
FIGS. 5T and 5U are perspective and side views of the battery being inserted into the chassis when the battery hold down is in the open position.
Figure 5U:
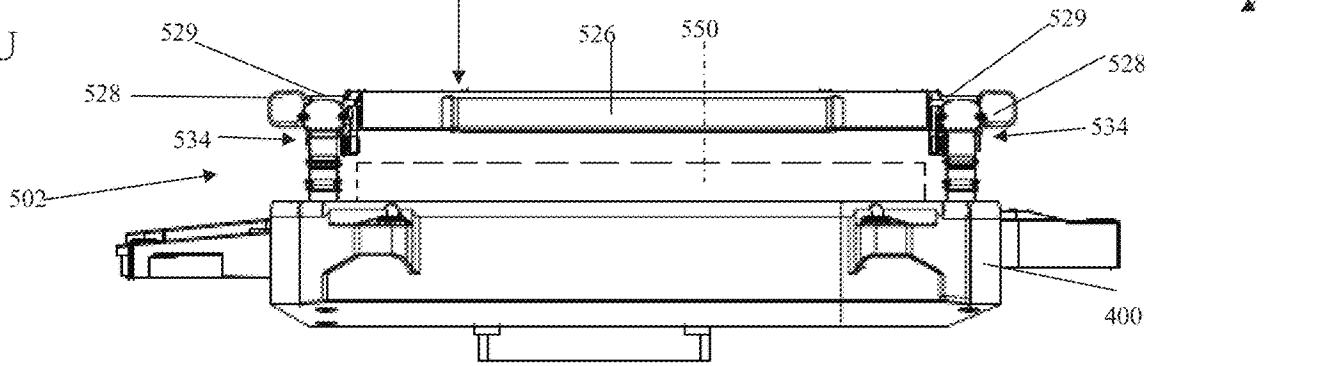

As shown in FIGS. 5T and 5U, with the battery retainers 502, 505 in the first, open, position, the rectangular body 526 of the first and second battery retainers 502, 505 may be rotated and positioned over the middle portion of the chassis 400 via the movement of the sliding members 524 within each respective slider opening 532. The battery trays 520 in the chassis 400 may then become exposed such that a battery 550 may be freely, inserted, taken out, adjusted, or moved around, for example during assembly/servicing of the model vehicle or replacement of the battery. The battery tray 520 in the chassis 400 may each be sized to be at least as large as the battery of the model vehicle. Alternatively, the battery tray 520 may be sized to be larger than the battery of the model vehicle.

Figure 5V:
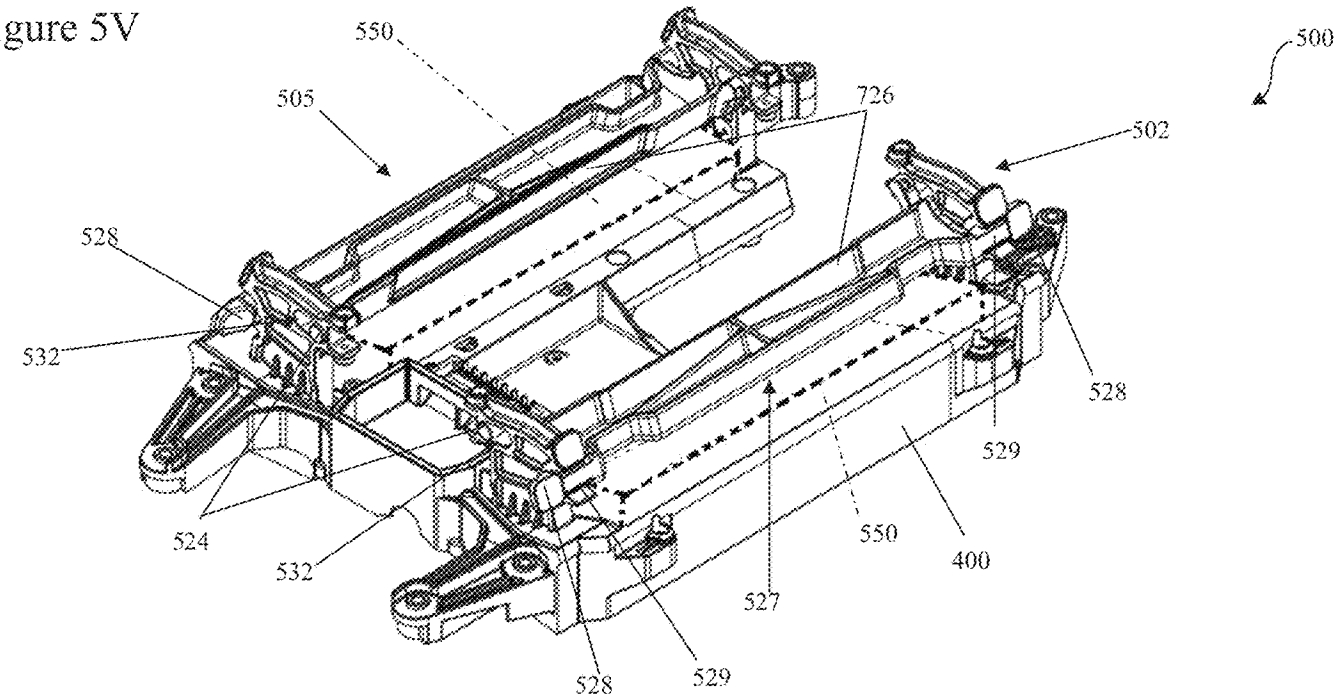
FIGS. 5V and 5W are perspective and side views of the battery hold down in the closed and clasped position retaining the batteries inserted in the chassis.
Figure 5W:
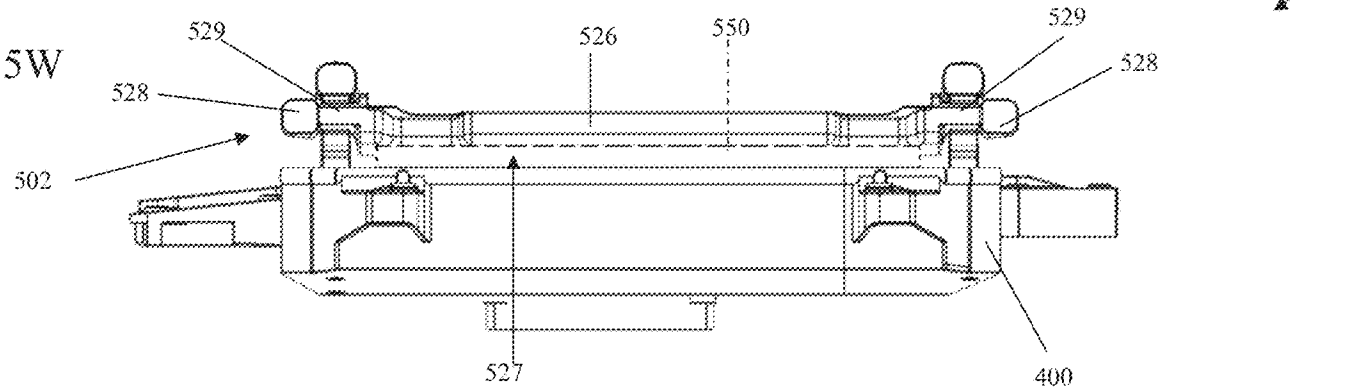

To secure the batteries 550 within the battery tray 520 in the chassis 400, the battery retainers may be transitioned to the closed and clasped position. With the battery retainers 502, 505 in the closed and clasped position as shown in FIGS. 5V and 5W, the bottom surface 527 of the rectangular body 526 may be brought in contact with the battery 550 to retain the battery 550 within the battery trays 520. The rectangular body 526 of each of the battery retainers 502, 505 may prevent the battery 550 inserted in the battery tray 520 from moving, coming loose, or falling out during operation of the vehicle. Alternatively, if in an embodiment, the battery 550 being used may be smaller such that the bottom surface 526 of the rectangular body 526 may not contact the battery 550 when in the engaged position, the inserted battery 550 may be adjusted with the addition of a "snap on" block in the battery tray 520 that may be used to elevate the inserted and retained battery 550 to contact the bottom surface 527. Furthermore, alternatively, the reach of the bottom surface 527 of the rectangular body 526 may be extended with the addition of a block that may be attached by an adhesive, mechanical fastener, Velcro, and the like. The block may also be made of any material including plastic, metal, foam, wood, and the like. The block may be attached to the bottom surface 527 of the rectangular body to bring the bottom surface 527 of the rectangular body 526 in contact with the inserted battery 550.

The rectangular body 526 of the first and second battery retainers 502, 505 may comprise a pair of rectangular indentions with one near each end of the rectangular body 526 adjacent to each of the wedge clips 528 extending from opposite corners of each of the battery retainers 502, 505. With the battery retainers 502, 505 closed, the rectangular indentions may provide an opening through the battery retainers to allow the position and presence of an inserted battery to be visually inspected.

Turning to FIGS. 5O and 5P, with the battery retainers 502, 505 in the closed position, the battery retainers 502, 505 may be transitioned between the second position where the battery retainer 502, 505 may be unclasped as shown in FIG. 5O, and the third position, where the battery retainers 502, 505 may be clasped as shown in FIG. 5P. The battery retainers 502, 505 being in the second, unclasped, position may comprise the battery retainers 502, 505 being in the closed position with each of the rectangular bodies 526 over the respective battery tray 520 in the chassis 400, and the sliding members 524 of the battery retainers 502, 505 being in the semi-circle end of the slider opening 532 closest to the wedge fasteners 534. The extending members 529 of the wedge clips 528 may be in contact with only the tapered tip 536535 at the opening of the wedge fasteners 534 on each of the respective supporting members 504, 506, 508, 510.

In order to transition the closed battery retainers 502, 505 from the second, unclasped, position to the third, clasped, position, the battery retainers 502, 505 may be transitioned to further engage the wedge fasteners 534 on each of the respective supporting members 504, 506, 508, 510. FIGS. 5Q and 5R show in an embodiment, that the battery retainers 502, 505 may be further engaged into the respective wedge fasteners 534 by applying a force to position the lateral body of the extending members 529 into the cavity of the wedge fasteners 534. The wedge clips 528 may provide a handle to be used for positioning the extended member 529 between the unclasped and clasped positions. The bottom portion of the wedge fastener 534 comprising the tapered tip 536535 and the leaf spring detent 536 may be constructed such that the leaf spring detent 536 may exhibit a spring-like feature. In the current embodiment shown, a circular cut 538 may be formed above and below each of the attachment points between the bottom portion of the wedge fastener 534 and the respective supporting member 504, 506, 508, 510. The circular cut 538 may enable the wedge fastener 534 to more freely flex and bend. When applying a force to the wedge clips 528 to re-position the extending member 529 inside the cavity of the wedge fastener 534 as shown in FIG. 5R, the extending member 529 contacts and temporarily deflects the bottom portion of the wedge fastener 534 comprising the leaf spring detent 536 apart since the distance between the peak of the leaf spring detent 536 and the top portion of the wedge fastener 534 may be smaller than the diameter of the extending member 529. The spring-like feature of the leaf spring detent 536 enables the opening of the wedge fastener 534 to be flexible and temporarily parted. The extending member 529 may then be moved between the unclasped position, outside of the cavity of the wedge fastener 534 near the tapered tip 536535 as shown in FIG. 5Q, and the clasped position, inside the cavity of the wedge fastener 534, as shown in FIG. 5R.

When in the clasped position as shown in FIGS. 5P and 5R, the extending member 529 may be secured within the wedge fastener 534 due to the compressive force exerted by the leaf spring detent 536 on the extending member 529. The leaf spring detent 536 helps ensure the extending member 529 stays in the clasped position inside the wedge fastener 534 and prevents the inadvertent release of the battery hold down 500 during the operation of the model vehicle. The leaf spring detent 536 secures the extending member 529 by requiring that an additional force be applied to unclasp or pull the extending members 529 from the wedge fasteners 534. FIG. 5R shows the battery retainers 502, 505 in the clasped position with the extending member 529 positioned inside the cavity of the wedge fastener 534 and the leaf spring detent 536 compressing against the extending member 529.

As shown in FIGS. 5O-5R, the lateral movement of the wedge clips 528 and the corresponding extending members 529 between the unclasped and clasped positions, in and out of the wedge fastener 534, may be enabled by the lateral movement of the adjacent sliding members 524. When moving the battery retainers 502, 505 into the clasped position, each of the sliding members 524 may be moved in the slider opening 534532 from the semi-circle end closest to the respective wedge fastener 534 to the semi-circle end farthest from the wedge fastener 534. FIGS. 5N and 5P show the battery retainers 502, 505 closed and in the clasped position. To transition the battery retainers 502, 505, back to the first open position, a force may be required to first transition the closed battery retainers 502, 505 from the closed, clasped position to the closed, unclasped position. To unclasp the battery retainers, the extending members 529 may be withdrawn out of the wedge fasteners 534 by the repositioning of each of the sliding members 524 of the battery retainers 502, 505 from the semi-circle end farthest from each respective wedge fasteners 534 to the semi-circle end that may be the closest to each of the respective wedge fasteners 534. The lateral movement of the battery retainers 502, 505 actuated by the movement of the sliding members 524 may allow the extending members 529 to be withdrawn out of the wedge fasteners 534.

Alternatively, the spring-like feature used to resist the movement of the battery retainers 502, 505 from the clasped position to the unclasped position within the supporting members 504, 506, 508, 510 may be constructed at different portions of the supporting members. As shown in FIGS. 5S1 and 5S2, an example may include one or more spring-like features being located within the slider opening 534532 in each of the supporting members 504, 506, 508, 510 to resist movement of the sliding members 524 within its respective slider opening 534532. Since moving the battery retainers 502, 505 from a third, clasped, position to a second, unclasped, position may require moving the slider members 524 within the slider opening 534532, securing the sliding member 524 within a portion of the slider opening 534532 may also secure the battery retainers 502, 505 in the third, clasped, position. FIG. 5S1 shows the location of the slider member 524 within the slider opening 534532 on one side of the spring or detent feature when the battery retainers 502, 505 may be in the second, unclasped, position. FIG. 5S2 shows the moved position of the slider member 524 in the slider opening 534532 on the other side of the spring or detent feature when the battery retainers 502, 505 may be in a third, clasped, position.

Figure 5X:
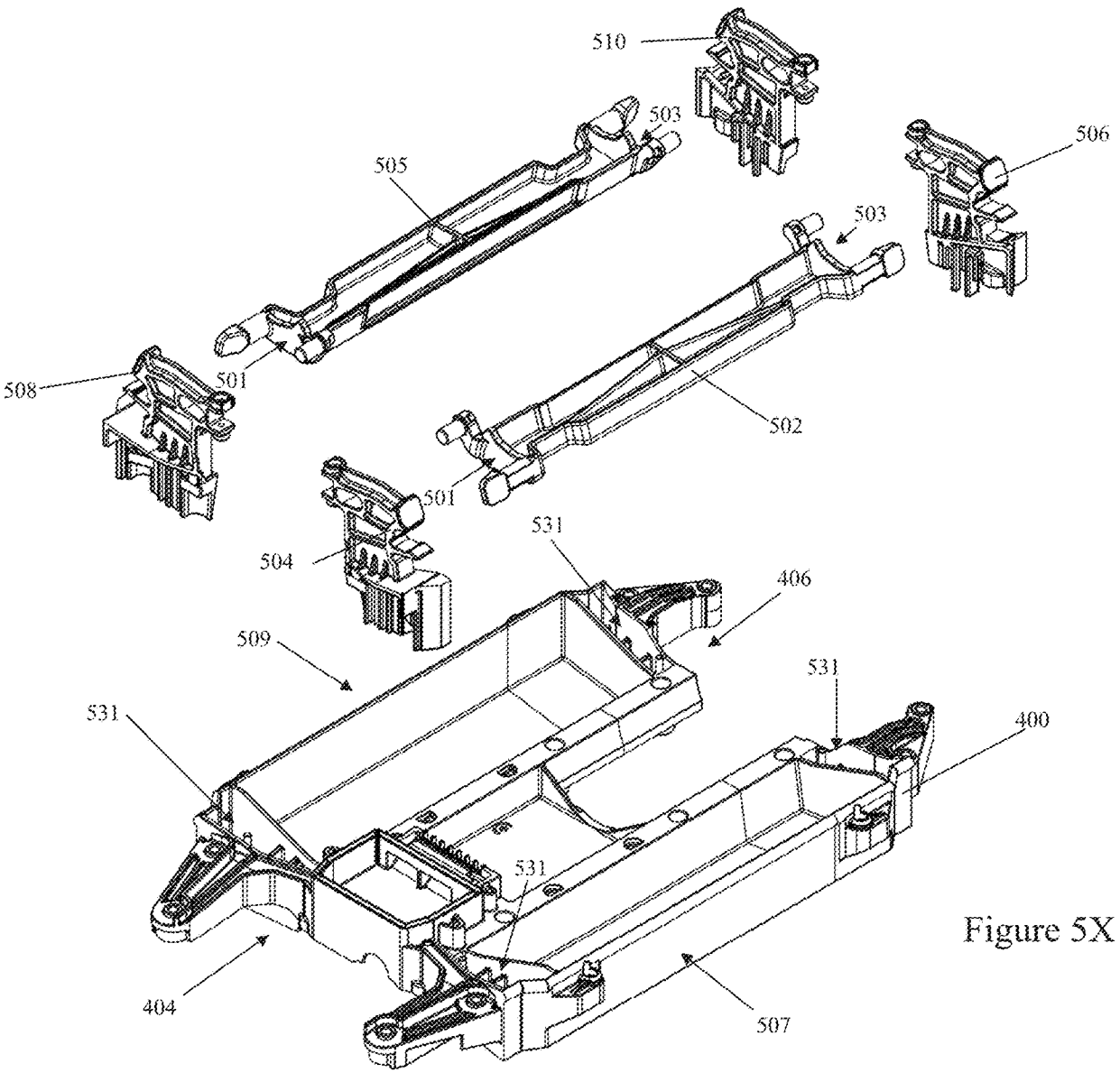
FIG. 5X is an exploded view of the battery hold down being assembled on a portion of a model vehicle chassis.

FIG. 5X illustrates the assembly of the first battery retainer 502 with the first and second supporting members 504, 506 and the second battery retainer 505 with the third and fourth supporting members 508, 510 on the chassis 400.

Servo Mount

The main assembly 102 may be provided with a particular configuration for mounting a servomechanism.

Motor Mount

Figure 6A:
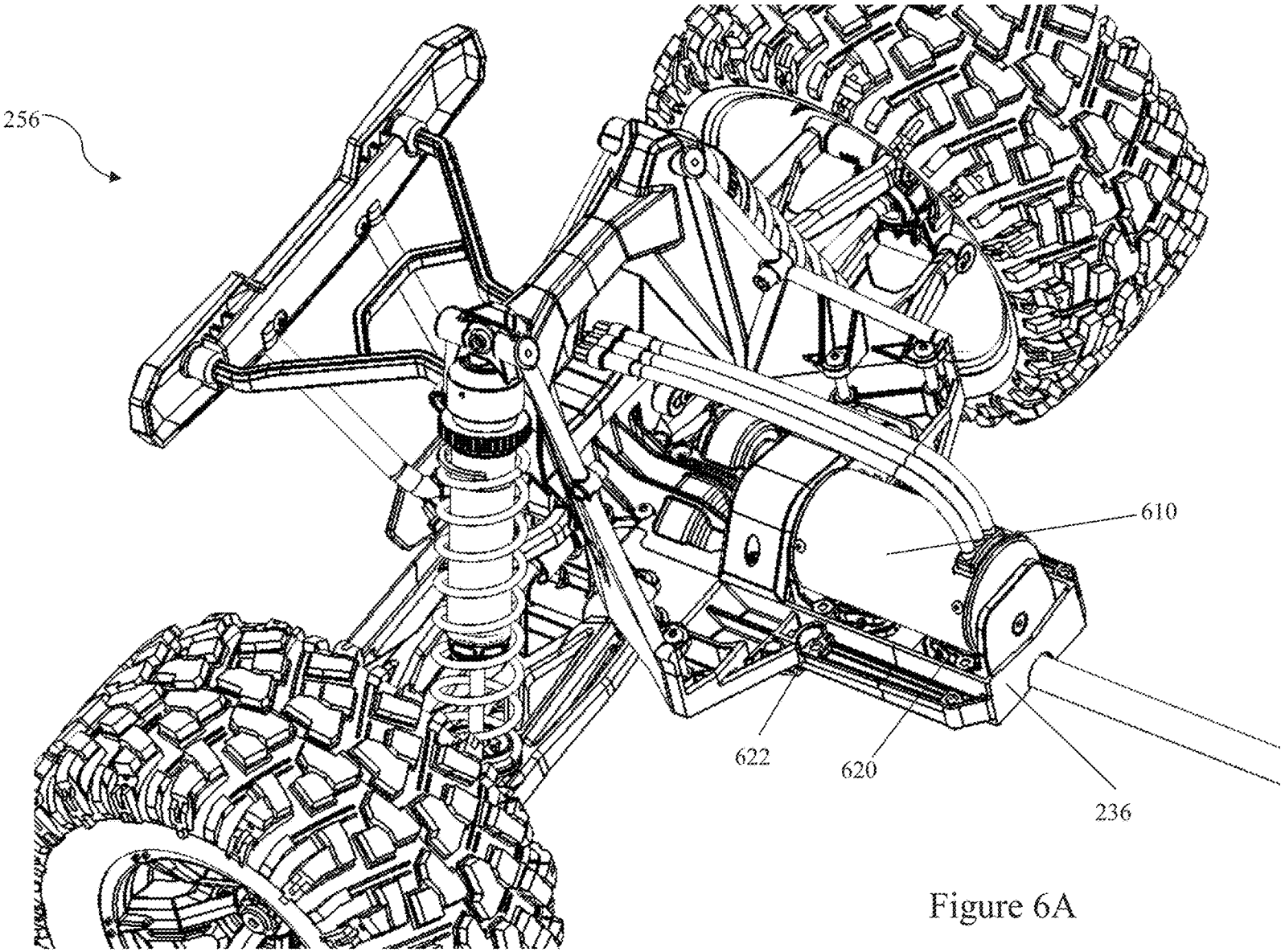
FIG. 6A is a perspective view of the motor and motor mount mounted on the rear chassis bulkhead.
Figure 6B:
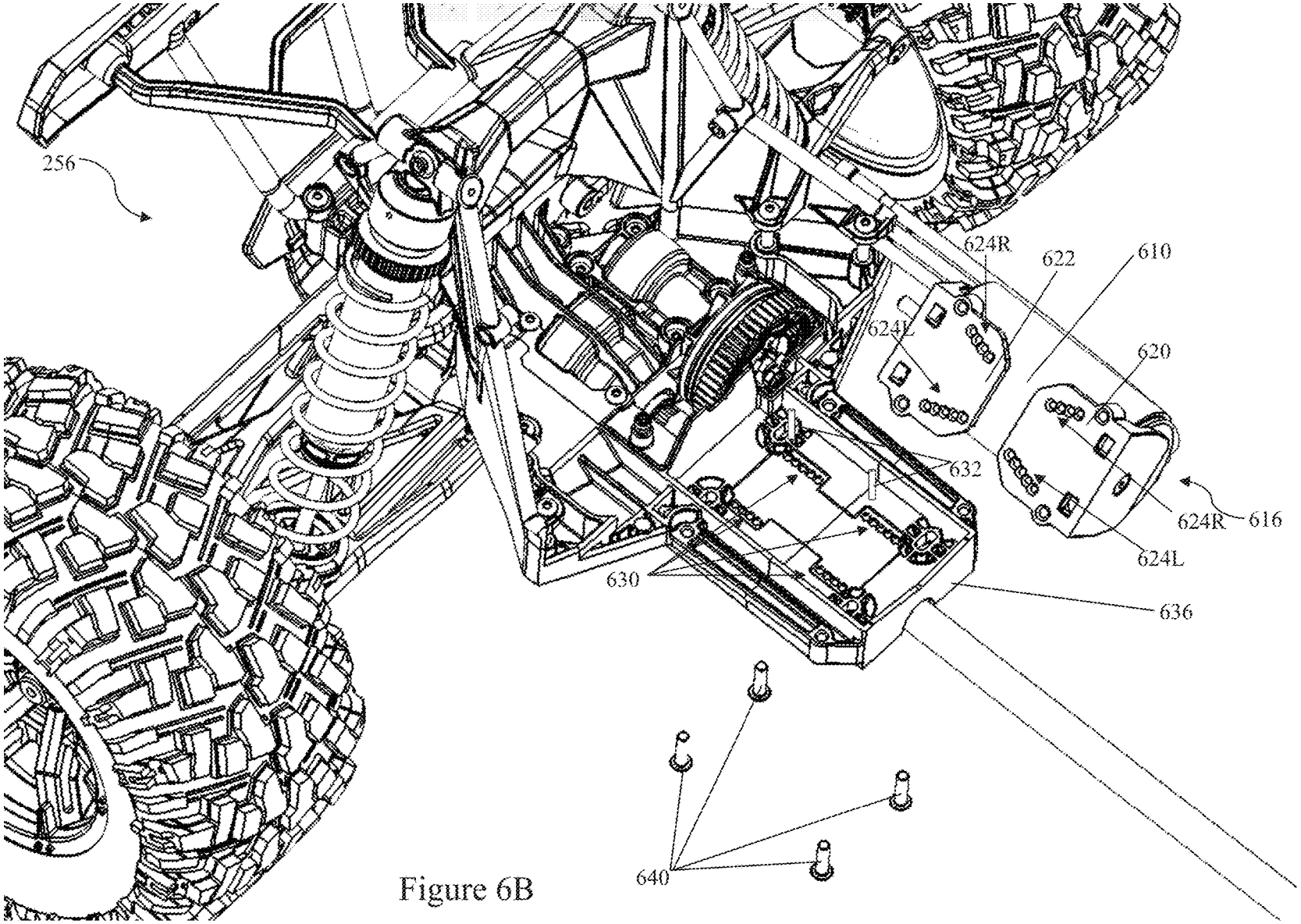
FIG. 6B is a perspective view of the motor with the motor mount disassembled from the rear chassis bulkhead.
Figure 6C:
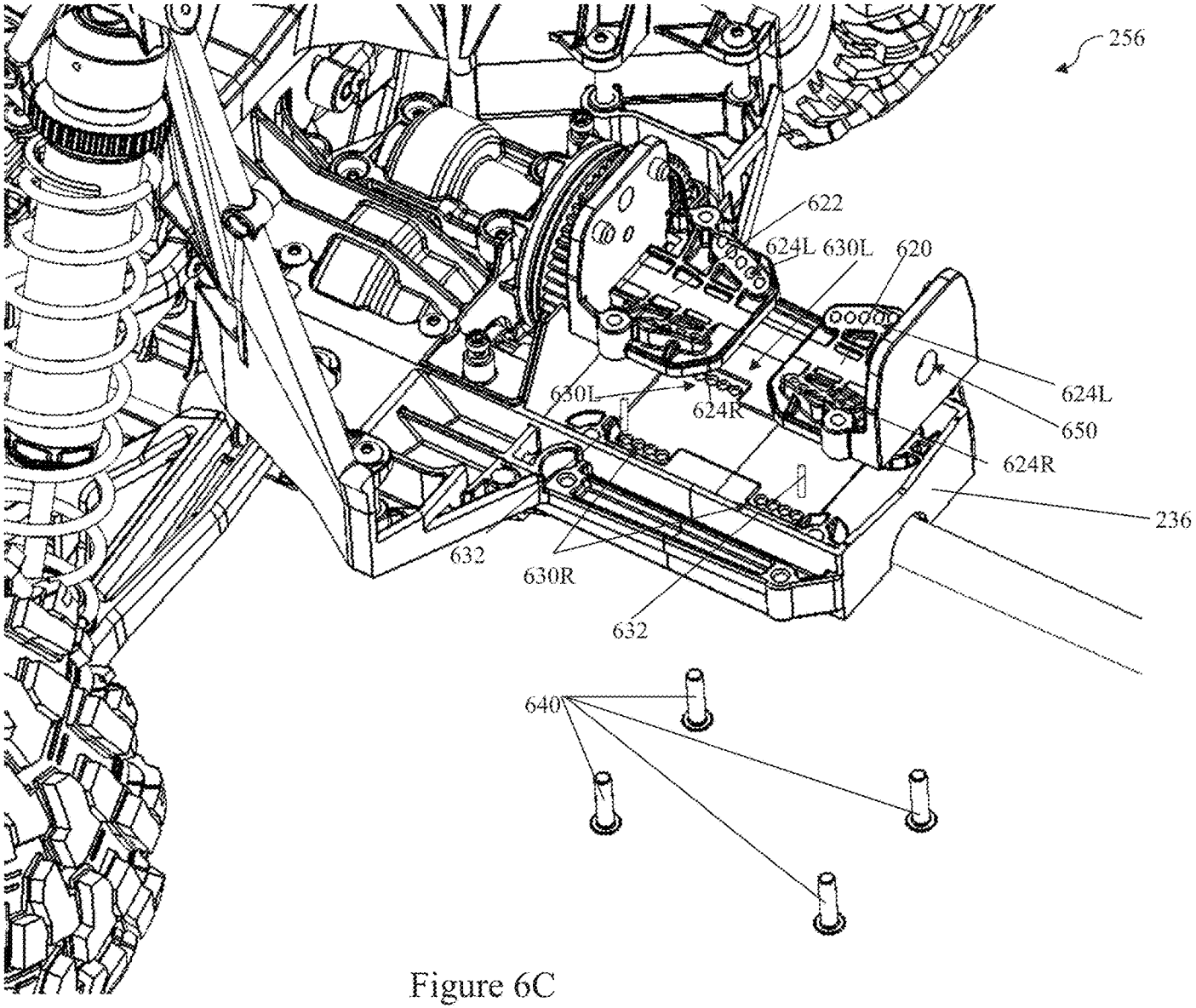
FIG. 6C is a perspective view of the motor mount above the rear chassis bulkhead.

FIGS. 6A-6C illustrate the rear assembly 256 of a model vehicle with a motor 610 mounted on the lower rear chassis bulkhead 236, hereinafter referred to as bulkhead 236. In the embodiment shown, the motor 610 may be retained in a motor mount 616 which may in turn be adjustably mounted to the bulkhead 236.

Figure 6E:
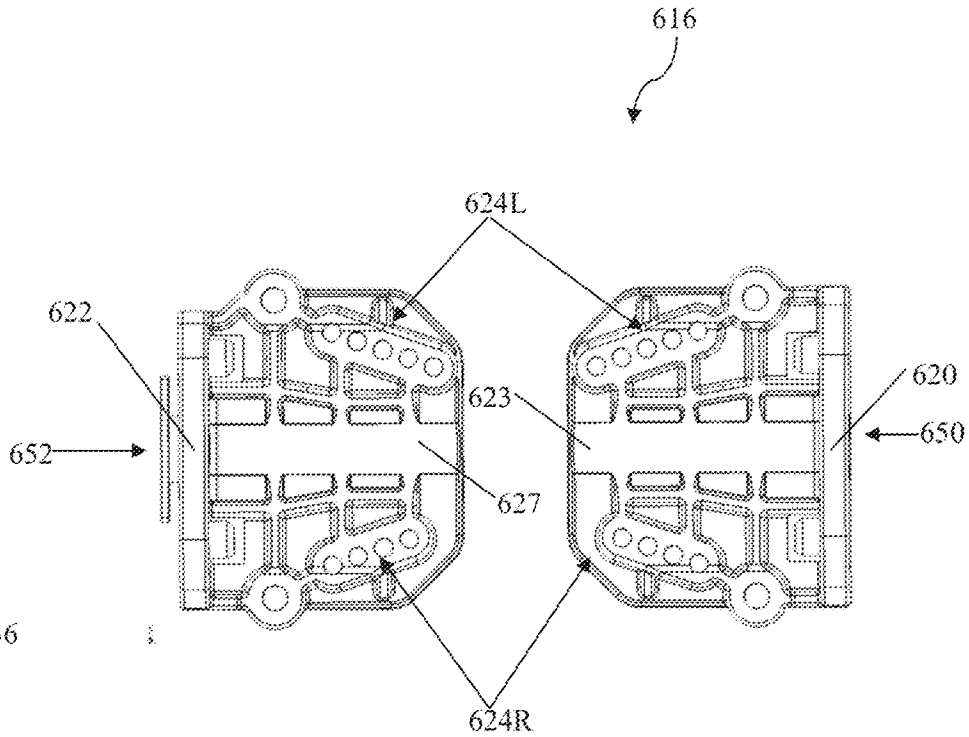
Figure 6D:
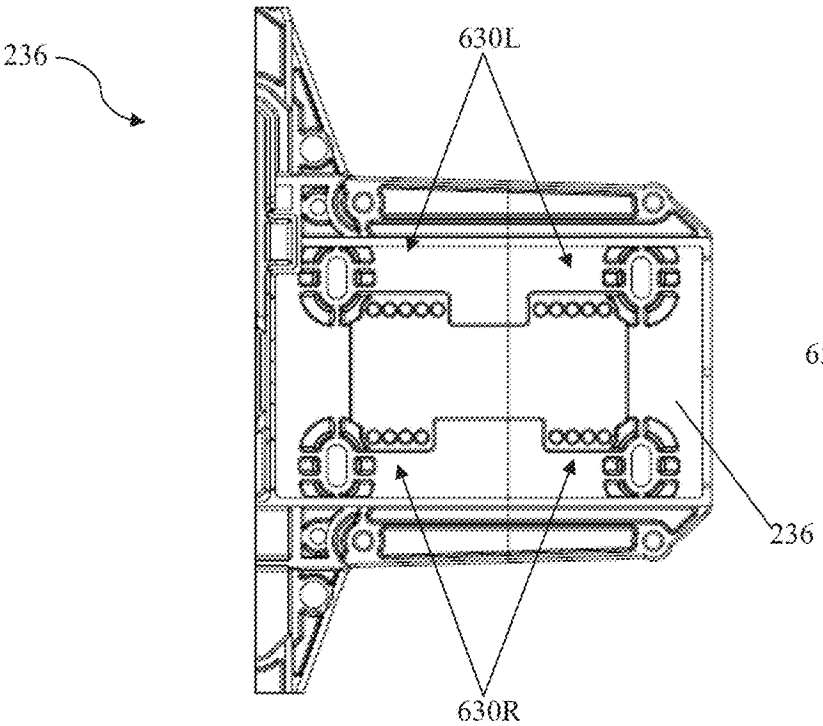

Turning to FIGS. 6D and 6E, in an embodiment, the motor mount 616 may comprise a front motor mount 620 and a rear motor mount 622 which may each be adjustably mounted to the bulkhead 236 next to the transmission assembly. The motor 610 with the motor mount 616 may be mounted such that there may not be a need to additionally "manually set," or finely adjust the gear mesh after the motor 610 is mounted with the motor mount 616 and further mounted to the bulkhead 236. The bulkhead 236 may comprise a selection of pinholes 630 that a pair of gear mesh pins 632 may be set into. The gear mesh pins 632 set in the bulkhead 236 may each respectively mate with a set of corresponding pinholes 624R, 624L in the motor mount 616 to adjustably mount the motor mount 616 to the bulkhead 236. The pinholes 630 provided in the bulkhead 236 that may be used to mount the motor mount 616 to the bulkhead 236, offer a fixed selection of proper gear mesh for the motor 610 depending on which pinholes 630 may be used to mount the motor mount 616. Selecting the specific pinholes 630 to use to mount the motor mount 616 and thus the motor 610 therefore in turn also selects the gear mesh position for the motor 610 when mounting it with the motor mount 616. Once the position of the motor mount 616 is selected and set in the bulkhead 236, the gear mesh position for the motor 610 may be fixed and will not move.

The bulkhead 236 may comprise a rectangular depression that the motor mount 616 and motor 610 may be adjustably mounted into. As shown in FIG. 6D, the rectangular depression in the bulkhead 236 may comprise pinholes 630R, 630L used for selecting the mounting positions of the motor mount 616. There may be two adjacent lines of five pinholes 630L each positioned end to end on the left side of the rectangular depression. One line of five pinholes 630L may be in the front half of the rectangular depression and the second line of five pinholes 630L may be in the rear half of the rectangular depression. There may also be two adjacent lines of four pinholes 630R each positioned end to end on the right side of the rectangular depression. There may be one line of four pinholes 630R in the front half of the rectangular depression across from a line of five pinholes 630L. There may also be a second line of four pinholes 630R in the rear half of the rectangular depression also directly across from a line of five pinholes 630L. The front half and rear half of the rectangular depression may therefore each comprise a line of five pin holes 630L across from a line of four pin holes 630R.

The two lines of pinholes 630R, 630L in the front half of the rectangular depression may mate with a set of corresponding pinholes 624R, 624L in the front motor mount 620 via a gear mesh pin 632. The two lines of pinholes 630R, 630L in the rear half of the rectangular depression may mate with a corresponding set of pinholes 624R, 624L in the rear motor mount 622.

The front and rear motor mounts 620, 622 as shown in FIG. 6E may each comprise a line of five pinholes 624L across from a line of four pinholes 624R. The line of five pinholes 624L may be positioned on the left side of each mount 620, 622, and the line of four pinholes 624R may be positioned on the right side of each mount. Each of the lines of pinholes 624L, 624R on the motor mount 616 may be positioned with each pinhole 624 diagonal from one another. On the front motor mount 620, the line of five pinholes 624L on the left side are positioned with the pinhole 624L closest to the opening 650, closest to the left edge of the of the motor mount 620, and the pinhole 624L farthest from the opening 650, closest to the center. Likewise, with the line of four pinholes 624R on the right side of the front motor mount 620, the pinhole 624R closest to the opening 650 may be positioned closest to the right edge of the motor mount 620, and the pinhole 624R farthest from the opening 650, closest to the center. On the rear motor mount 622, the lines of pinholes 624 are positioned similarly with respect to opening 652. The line of five pinholes 624L on the left side of the rear motor mount 622 has the pinhole 624L closest to the opening 652 closest to the left edge of the rear motor mount 622. The pinhole 624R farthest from the opening 650 may be positioned closest to the center of the rear motor mount 622. The line of four pinholes 624R on the right side of the rear motor mount may similarly be positioned such that the pinhole 624R closest to the opening 652 in the rear motor mount 622 may be positioned closest to the right edge of the rear motor mount 622. The pinhole 624R farthest from the opening 652 may be positioned closest to the center of the rear motor mount 622.

Figure 6F:
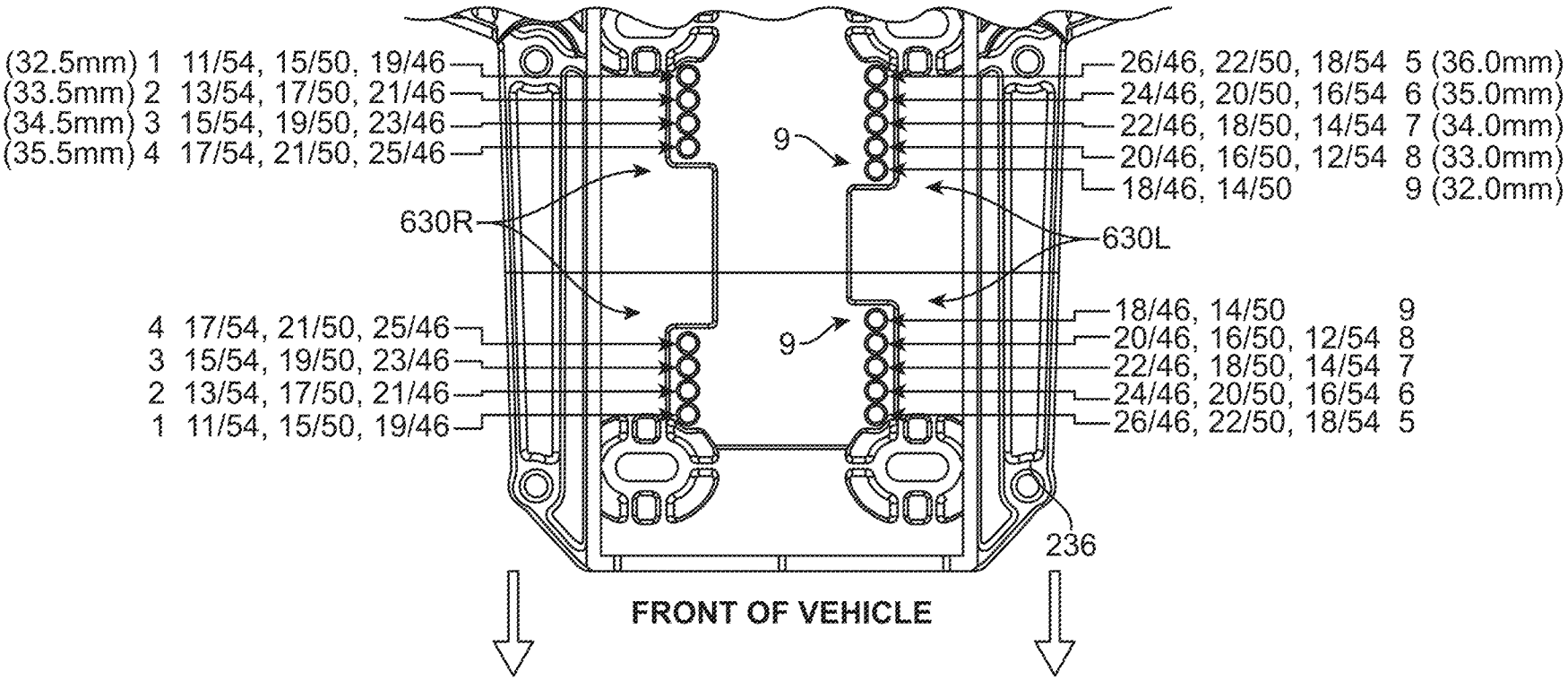
FIG. 6F is a top view of the pinholes in the rear chassis bulkhead with the fixed gear mesh pin locations labelled.
Figure 6G:
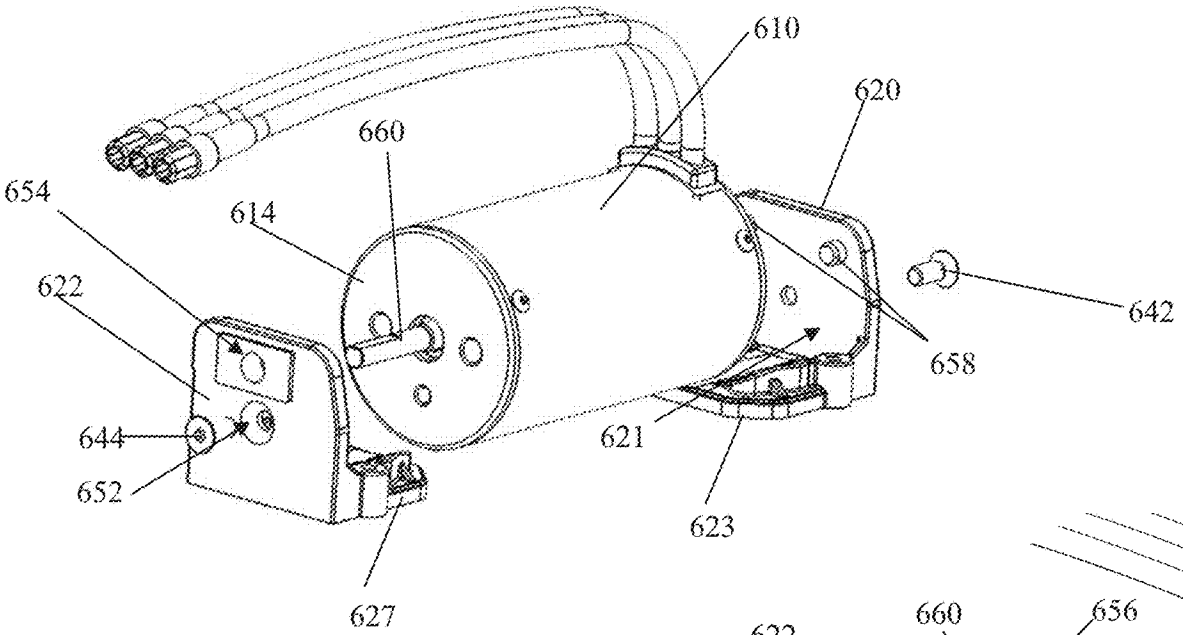
Figure 6H:
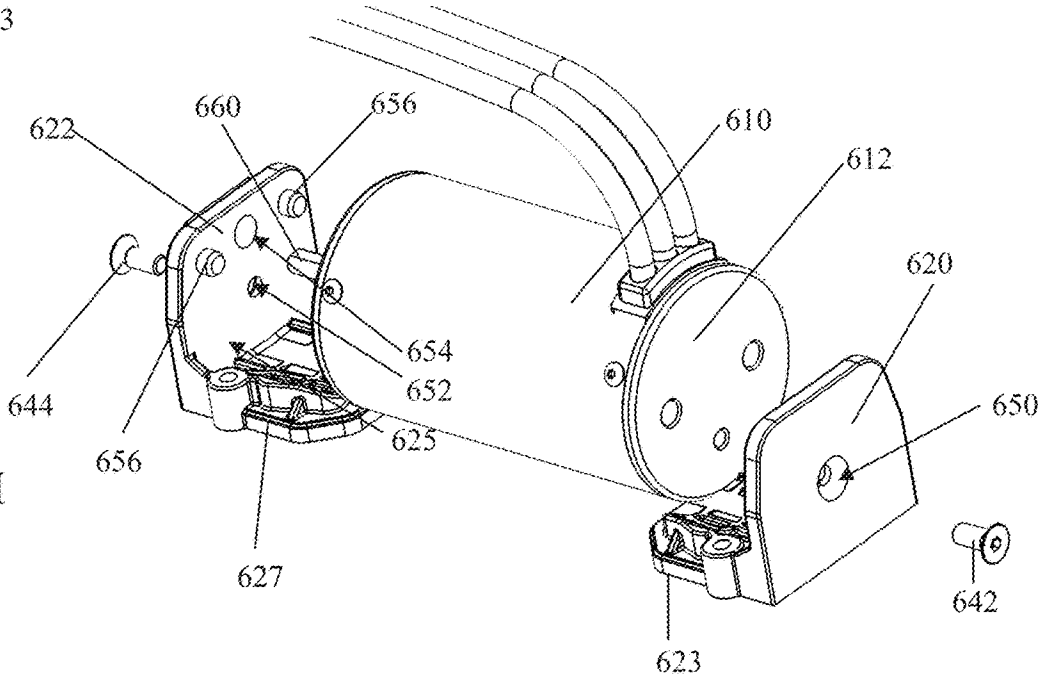

Turning to FIGS. 6G and 6H, the motor 610 may comprise a front endbell 912, a rear endbell 914, and a motor rotor 960. The front endbell 912 may contact a rear surface 921 of the front motor mount 620 when connected to the front motor mount 620. The rear endbell 914 may contact a front surface 925 of the rear motor mount 622 when connected to the rear motor mount 622. The front motor mount 620 may comprise an opening 650, and two bosses 958 that may extend from the rear surface 921 of the front motor mount 620. The front motor mount 620 may comprise a bottom panel 923 adjacent to the interior surface 921 that may extend under and cradle the motor 610. The rear motor mount 622 may comprise two openings 652, 654 and two bosses 956 that extend from the front surface 925 of the rear motor mount 622. The rear motor mount 622 may also comprise a rear bottom panel 927 adjacent to the front surface 925 that may extend under and cradle the motor 610.

The bosses 956, 958 in the front and rear motor mounts 620, 622 may engage with the endbells 912, 914, respectively, when the motor 610 is retained in the motor mount 616. The bosses 956, 958 may retain the motor 610 and rotatably fix it. The bosses 956, 958 may also secure and prevent the motor 610 from rotating due to motor torque when the motor 610 is operating. The bosses 956, 958 may also help retain the motor 610 vertically and laterally in the motor mount 616.

The bottom panels 923, 927 of the front and rear motor mount may comprise a series of pin holes 624R, 624L used for adjustably mounting the motor mount 616 to the bulkhead 236. As shown in FIG. 6C, the top surface of the bottom panels 923, 927 that may contact the motor 610 may be formed like a concave depression to cradle the rounded surface of the cylindrical structure of the motor 610. The concave depression on the bottom panels 923, 927 may be formed from the lines of pinholes 624R, 624L in the front and rear motor mount 620, 622. The pinholes 624R, 624L may be formed to be most elevated near the edge of each of the respective motor mounts 620, 622 and descend lower with each pinhole 624R, 624L positioned closer towards the center of the motor mounts 620, 622. The concave depression may begin as high as required for the motor 610 to be elevated and descend toward the inner pinholes 624R, 624L closer towards the center of the motor mounts. The motor 610 may be retained in the motor mount 616 by being secured to the front and rear motor mount 620, 622.

Figure 6I:
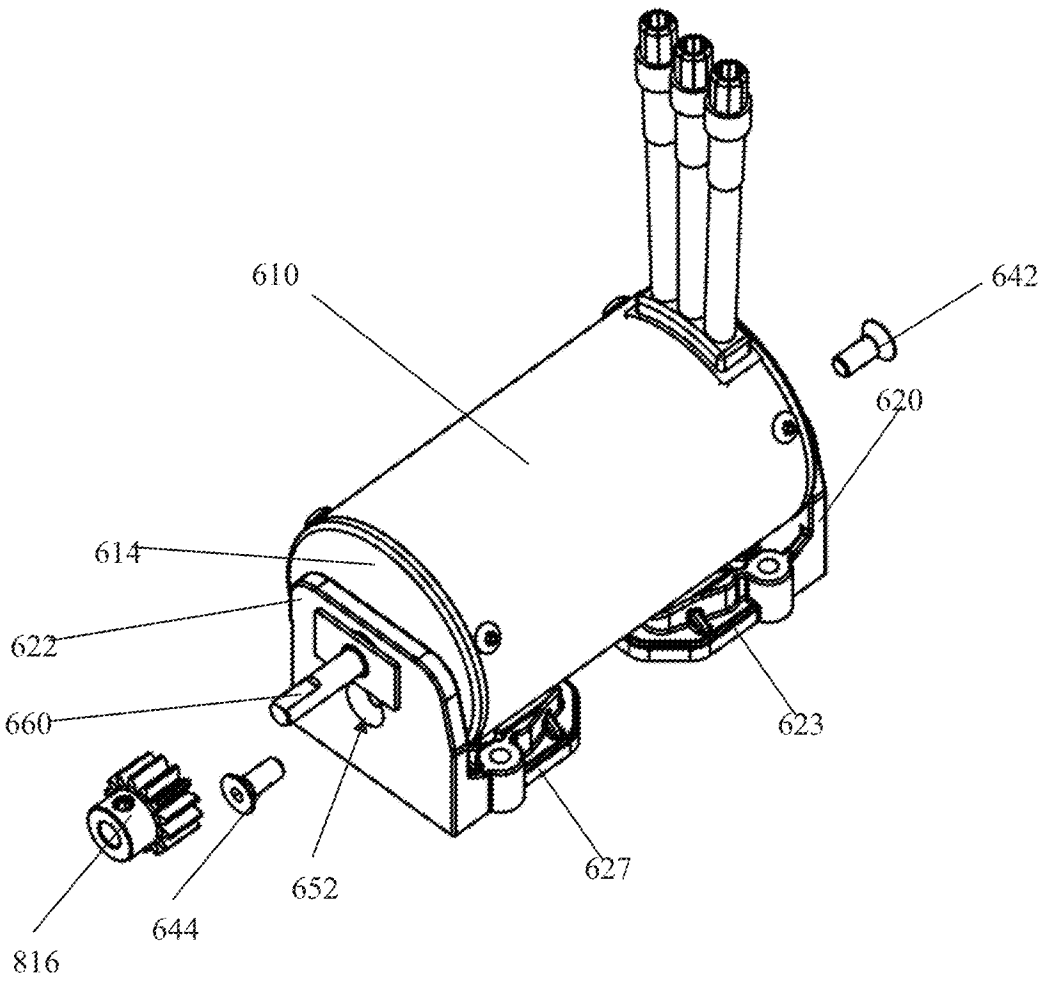
FIG. 6I is a perspective view of the motor retained by the front and rear motor mounts.

To mount the motor 610 to the bulkhead 236, the motor 610 may first be retained by the motor mount 616. To secure the motor 610 to the motor mount 616, the motor 610 may be retained by being secured to the front and rear motor mount 620, 622. As shown in FIG. 6I, when securing the rear motor mount 622, the motor rotor 660 of motor 610 may be fitted through the opening 654 in the rear motor mount 622. The rear endbell 914 may then be brought in contact with the front surface 625 of the rear motor mount 622 and the two bosses 656. The rear motor mount 622 may be secured to the motor 610 by fitting a screw 644 through opening 652 into a threaded bore in the rear endbell 914 of the motor 610. A pinion gear 816 may then be connected to the motor rotor 960 before mounting the motor 610 with the motor mount 616 to the bulkhead 236. To secure the front motor mount 620 to the motor 610, the front endbell 612 may be positioned in contact with the rear surface 921 of the front motor mount 620 and the two bosses 658. A screw 942 may then be fitted through the opening 650 in the front motor mount 620 and fastened into a threaded bore in the front endbell 912 of the motor 610. Alternatively, the screws 642, 644 used to retain the motor 610 in the motor mount 620, 622 may instead be an adhesive, pins, bolts, nails, bindings, clips, and the like.

The motor mount 616 may be set in the rectangular depression in the bulkhead 236 by positioning two gear mesh pin 632 between the pinholes 630R, 630L in the bulkhead 236, and the pinholes 624R, 624L in the motor mount 616. The front motor mount 620 may be set on the front half of the rectangular depression in bulkhead 236 by positioning a gear mesh pin 632 to mate between one of the pinholes 624R, 624L in the front motor mount 620 and one of the pinholes 630R, 630L in the front half of the rectangular depression in the bulkhead 236. The rear motor mount 622 may be set on the rear half of the rectangular depression of the bulkhead 236 by positioning a gear mesh pin 632 to mate between one of the pinholes 624R, 624L in the rear motor mount 622 and one of the pinholes 630R, 630L in the rear half of the rectangular depression in the lower rear chassis bulkhead 236. The eighteen pinholes 630R, 630L in the bulkhead 236 and the eighteen pinholes 624R, 624L in the motor mount 616 may provide nine positions for two gear mesh pins 632 to be set, with one gear mesh pin 632 in one of the nine pinholes 630R, 630L in the front half of the rectangular depression mating with one of the pinholes 624R, 624L in the front motor mount 620, and one gear mesh pin 632 in one of the nine pinholes 630R, 630L in the rear half of the rectangular depression mating with one of the pinholes 624R, 624L in the rear motor mount 622. The nine different placements of the two gear mesh pins 632 may permit the motor mount 616 and the corresponding motor 610 to be positioned in 9 discrete positions in the bulkhead 236. For the embodiment shown, the nine fixed placements that may be provided for two gear mesh pins 632 to be positioned with respect to the pinholes 630R, 630L in the rectangular depression of the bulkhead 236 may be determined by the numbering system illustrated in FIG. 6F. FIG. 6F gives an example of the different placements of the motor mounts 616 on the shown embodiment. Alternatively, different motor mounts may use or require different placements of pins or pinholes to adjustably mount the motor.

The specific pair of pinholes 630R, 630L in the bulkhead 236 that may be used to set the front and rear motor mounts 620, 622 may be selected based on the requirements or preference of the pinion and spur gear mesh for the model vehicle. The nine fixed placements for setting the two gear mesh pins 632 in the pinholes 630R, 630L in the bulkhead 236 provide nine different gear mesh settings that may be used to set the motor 610. As shown in FIG. 6F, the nine discrete positions of pinholes 630 provide the option to vary the pinion-spur center-to-center distance by a total of 4 mm when mounting the motor 610. The nine available positions allow the pinion-spur center-to-center distance to be varied by increments of 0.5 mm each from a minimum of 32 mm to a maximum of 36 mm. In FIG. 6F, the center-to-center distances for each of the fixed positions of the current embodiment are shown in parenthesis when two gear mesh pins 632 are inserted in the corresponding labeled pinholes 630R, 630L in the bulkhead to mount the motor 610.

In the current embodiment, each of the nine pinholes 630 in the front half and second half of the rectangular depression in the bulkhead 326 are labeled 1 through 9 to aid in selecting a desired pinion-spur center-to-center distance. The line of four pinholes 630R on the right side of the rectangular depression are each labeled 1 through 4 in both the front half and rear half of the rectangular depression as shown. The line of five pinholes 630L on the left side of the rectangular depression are each labeled 5-9 in both the front half and the rear half of the rectangular depression as shown. As an example to illustrate how to mount the motor 610 at a specific pinion-spur center-to-center distance using the labeled pinholes 630 as shown in FIG. 6F, in an embodiment, the minimum of 32 mm center-to-center distance may be obtained when placing a pair of gear mesh pins 632 in each of the two pinholes shown labeled 9. Correspondingly, the maximum of 36 mm center-to-center distance when mounting the motor 610 may be obtained when mounting the motor mount 616 on a pair of gear mesh pins 632 inserted in the pinholes 630 at position 5. Inserting a pair of gear mesh pins 632, one to mate with one of the pinholes 624R, 624L in the front motor mount 620 and the other to mate with one pinhole 624R, 624L in the rear motor mount 632, respectively, in either positions 5, 6, 7, 8, or 9, respectively may result in center-to-center distances of 36, 35, 34, 33, or 32 mm, respectively. Inserting a pair of gear mesh pins 632 in each of the positions labeled 1, 2, 3, 4, may result in center-to-center distances of 32.5, 33.5, 34.5, and 35.5 mm, respectively. The specific gear mesh pinhole position may be selected first and the gear mesh pins 632 inserted before mounting the motor 610 retained by motor mount 616. FIG. 6K shows a label that may be placed in the rectangular depression in the bulkhead 236 to aid in identifying and selecting one of the nine fixed gear mesh positions provided.

Once the motor 610 is retained in the motor mount 616, the assembly comprising the motor mount 616 and the motor 610, hereinafter referred to as motor-motor mount assembly, may be mounted to the bulkhead 236 by mating the two gear mesh pins 632 first positioned in one of the nine available placements of pinholes 630R, 630L in the bulkhead 236, to the pinholes 624R, 624L in the motor mount 616. The pinholes 624R, 624L in the motor mount 616 are positioned such that once the motor 610 is retained by the motor mount 616, there may only be one pair of pinholes 624R, 624L in the motor mount 616 that may align and mate with each of the nine fixed placements of gear mesh pins 632 in the bulkhead 236. After the gear mesh pin position is selected in the bulkhead 236 and the gear mesh pins 632 are inserted, the motor-motor mount assembly may then be positioned over the bulkhead 236 and set when a pinhole 624R, 624L in the front motor mount 620, and a pinhole 624R, 624L in the rear motor mount 622 each align with one of the two positioned gear mesh pins 632 in the bulkhead 236. When the motor-motor mount assembly is aligned and set over the gear mesh pins 632, the gear mesh pins 632 may push up into aligned pinholes 624R, 624L of the motor mount 616.

Figure 6J:
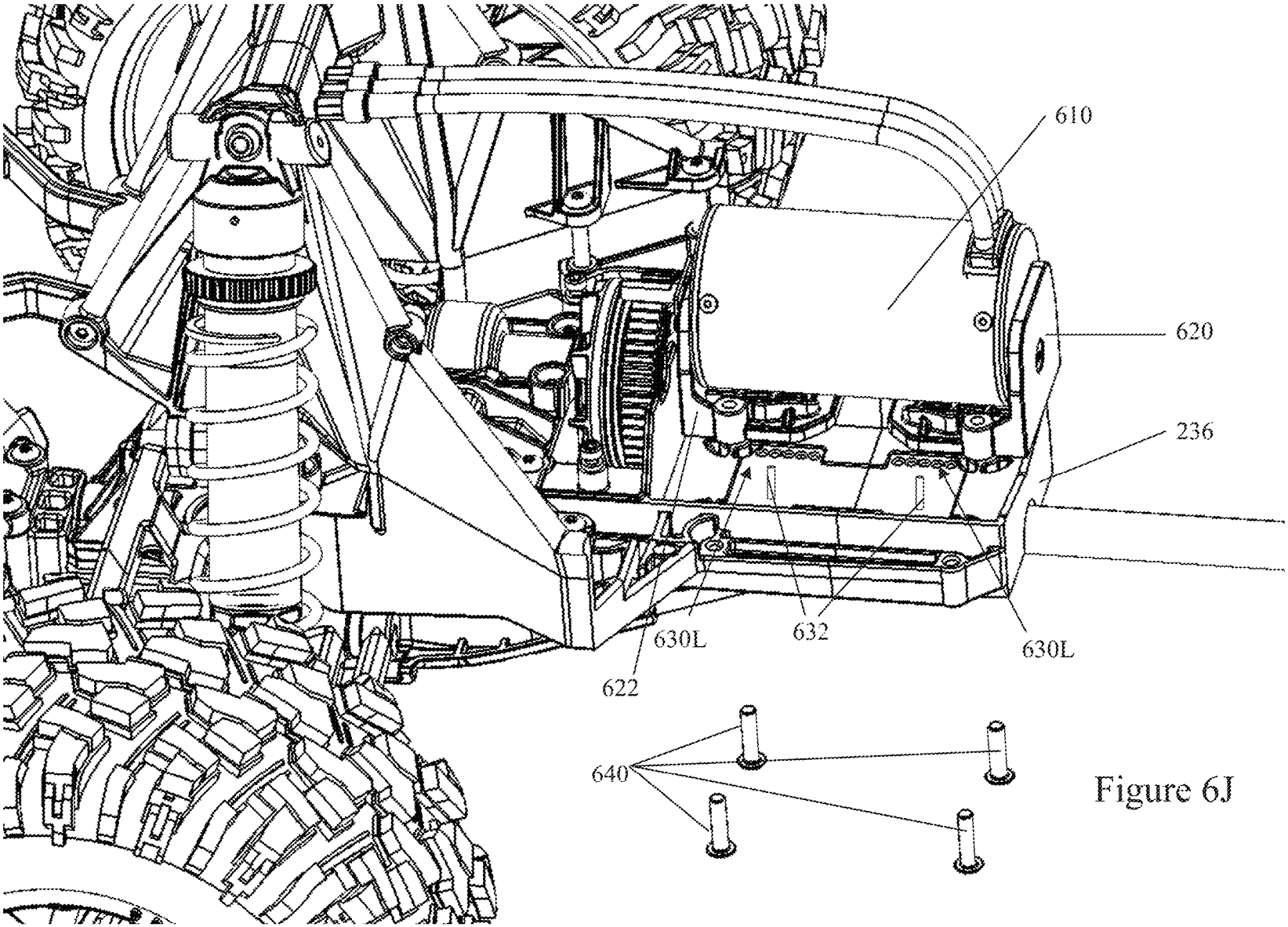
FIG. 6J is a perspective view of the motor retained in the motor mount and positioned above the rear chassis bulkhead.
Figure 6K:
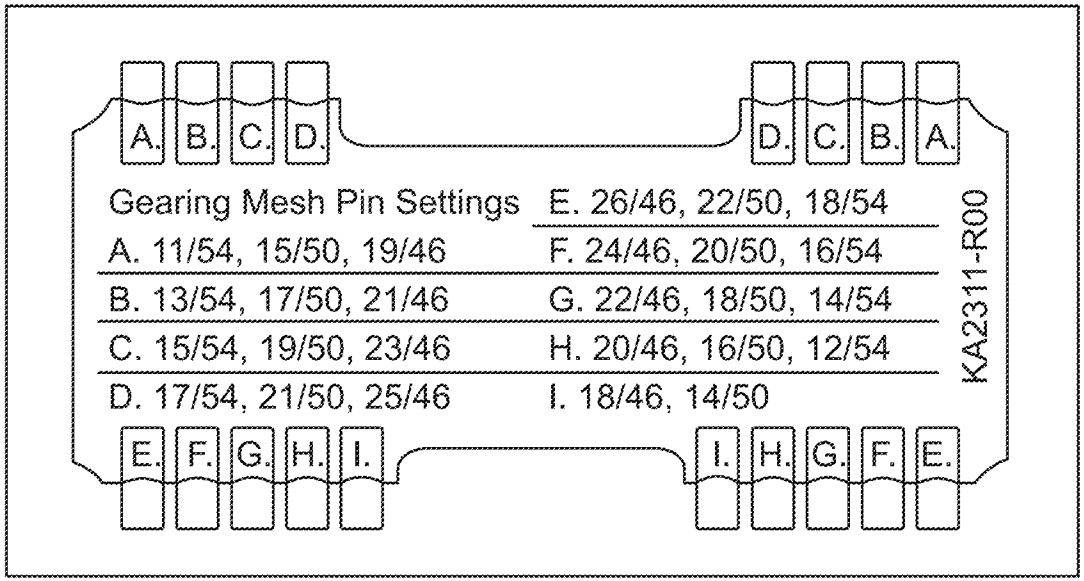
FIG. 6K is a view of a label that may be positioned on the chassis for directing placement of gear mesh pins.

In FIG. 6J, once the motor-motor mount assembly may be mounted to the pair of gear mesh pins 632 in the bulkhead 236, the front and rear motor mounts 620, 622 may then be further secured to the bulkhead 236 by threading a screw 640 through the bulkhead 236 into front and rear mount 620, 622. Alternatively, the screws 640 used to secure the front and rear motor mount 620, 622 to the lower rear chassis bulkhead 236 may instead be an adhesive, pins, bolts, nails, bindings, clips, and the like.

Slipper Clutch

The entire contents of U.S. Pat. No. 8,317,213, entitled: "SLIPPER CLUTCH FOR A MODEL VEHICLE" issued on Nov. 27, 2012; U.S. Pat. No. 7,534,170, entitled: "SLIPPER CLUTCH FOR A MODEL VEHICLE" issued on May 19, 2009; and U.S. Pat. No. 8,549,752, entitled: "METHOD OF ADJUSTING A SLIPPER CLUTCH AND SPUR GEAR ASSEMBLY FOR A MODEL VEHICLE" issued on Oct. 8, 2013, are incorporated herein by reference for all purposes.

FIGS. 7A-10B illustrate a slipper clutch assembly 700 for use in a model vehicle to transfer torque from a spur gear 702 to a transmission input shaft 704 when the model vehicle is operated. In an embodiment, the slipper clutch assembly 700 may protect the spur gear 702 and the rest of the drivetrain 900 from severe or acute shock when the motor 610 as shown in FIG. 6A may be delivering more power than the drive train can handle at a certain point. The slipper clutch assembly 700 may momentarily "slip" the spur gear 702 allowing the spur gear 702 to rotate at a speed faster than the transmission input shaft 704, until the system torque falls below a recoupling threshold torque. The slipper clutch assembly 700 may also protect the drive train from overloading when suddenly braking after landing from a jump or hard braking. The slipper clutch may also serve as a torque limiting traction control aid such as reducing wheel spin when accelerating from low speeds or when accelerating on low-traction surface. When acute shocks to the drive train are not experienced, the slipper clutch assembly 700 preferably transmits rotation torque with little or no slippage.

Figure 7A:
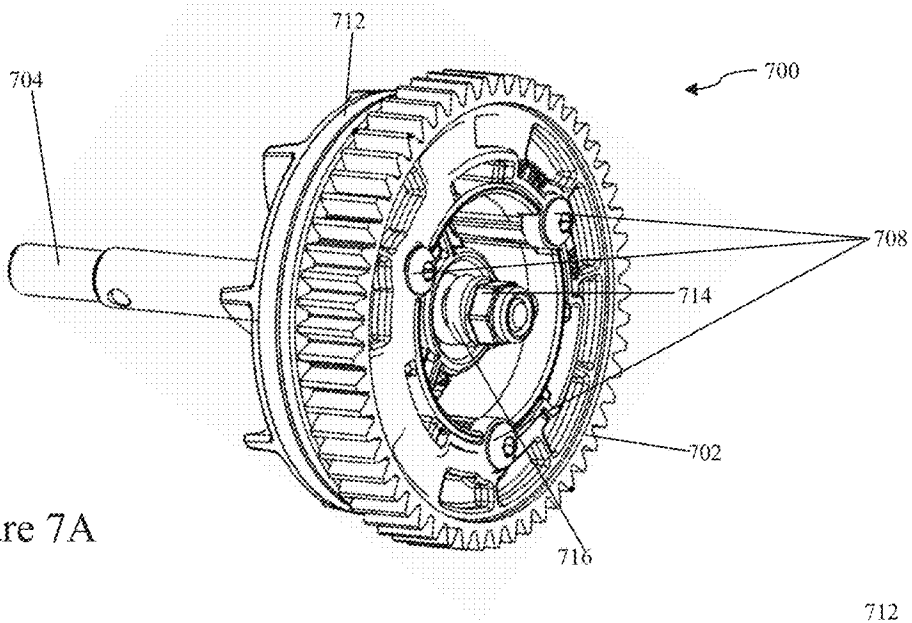
FIGS. 7A and 7B are perspective views of the slipper clutch assembly for use in a model vehicle.
Figure 7B:
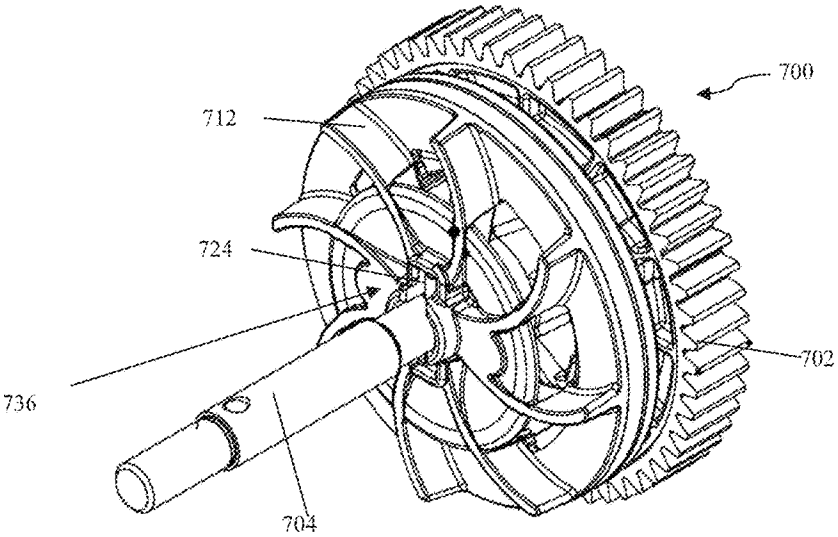
Figure 7E:
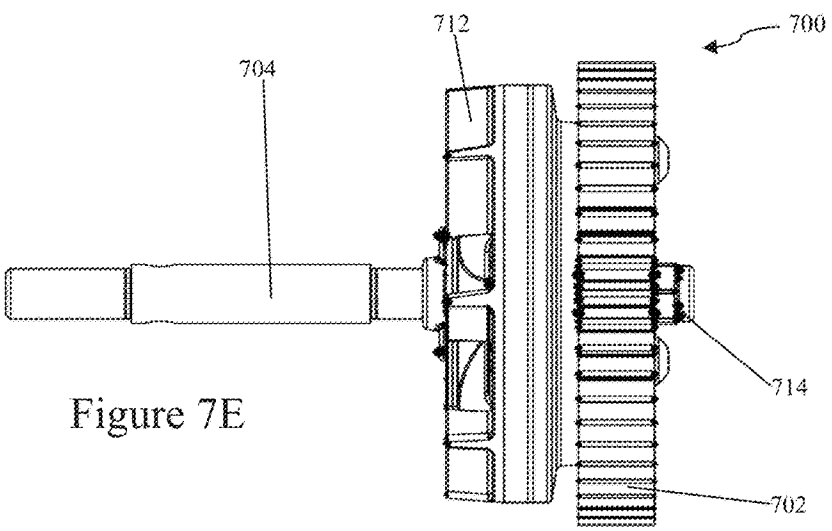
FIGS. 7C, 7D, and 7E are front, back and longitudinal side views of the slipper clutch assembly.
Figure 7D:
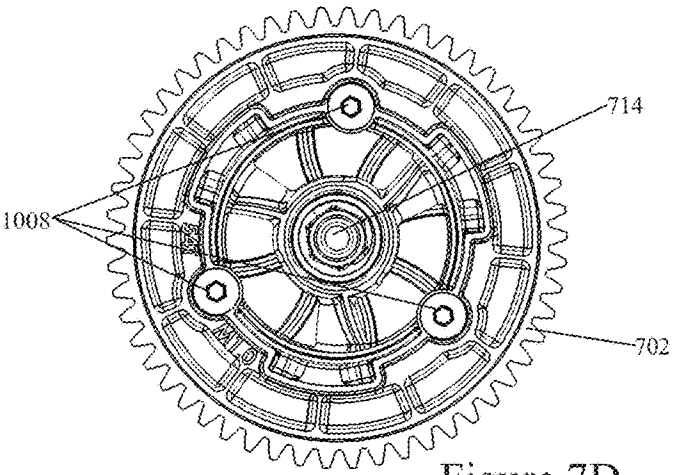
Figure 7C:
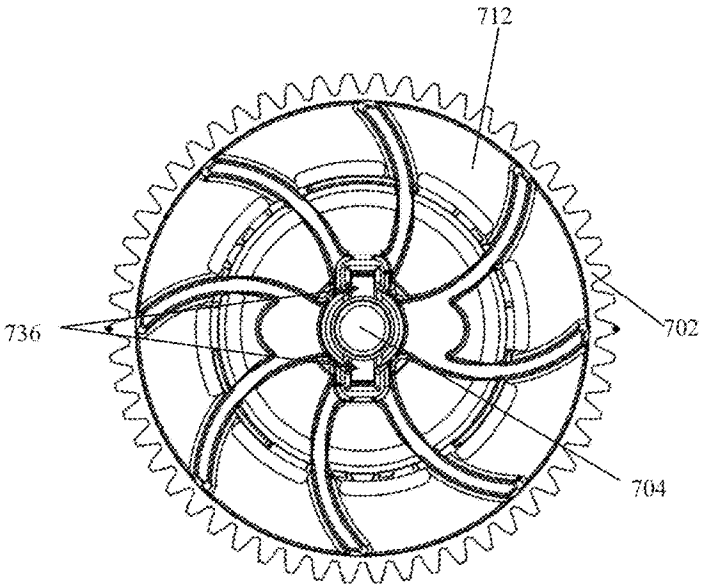
Figures 7F, 7G:
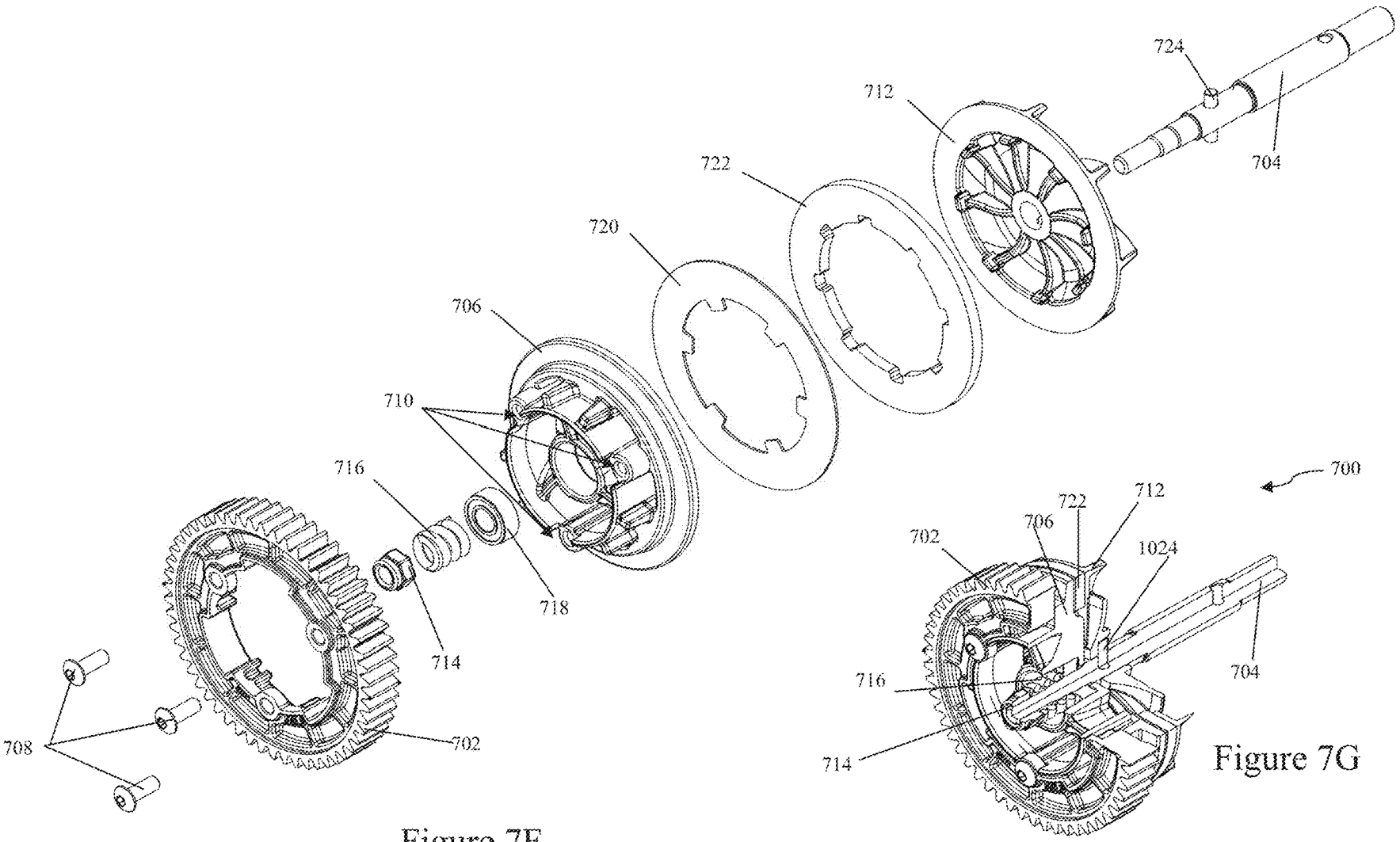
FIGS. 7F and 7G are exploded and sectional cut perspectives views of the slipper clutch assembly from one end.

Turning to FIGS. 7F-7I, the slipper clutch assembly 700 may be assembled to permit the spur gear 702 to be removed without affecting the overall torque setting of the slipper clutch assembly 700. The spur gear 702 may be secured directly to a clutch disc driver plate 706 with bolts 708 threaded through equidistant openings in the body of the spur gear 702. The bolts 708 threaded through the spur gear 702 may be further threaded into aligned openings 810, as shown in FIG. 7F, in the clutch disc driven plate 706. Removing the bolts 708 from the openings 810 in the clutch disc driven plate 706 may allow the spur gear 702 to be removed from the slipper clutch assembly 700 for service or replacement.

The slipper clutch assembly 700 transfers torque between the spur gear 702 and the transmission input shaft 704, depending upon the compressive force applied to the clutch disc driver plate 706 and a clutch disc driven plate 812. The compressive force may be adjusted by an adjustment nut 714 threaded on the end of the transmission input shaft 704 extending from the vehicle transmission. The adjustment nut 714 abuts and compresses a helical spring 716 mounted on the transmission input shaft 704 to maintain the desired compressive force. Alternatively, the springs 714 may be other suitable springs such as spring washers, air springs, torsional springs, and the like. The spring 716 may compress a radial ball bearing assembly 718 against the clutch disc driver plate 706. Pressure on the clutch disc driver plate 706 may in turn compress a clutch plate 720 held by the clutch disc drive plate 706 against a clutch frictional insert 722 held by the clutch disc driven plate 812. Frictional resistance to movement between the clutch plate 720 and the clutch disc driven plate 712 due to the clutch friction insert 722 held by the clutch disc driven plate 712 may couple the spur gear 702 to the transmission input shaft 704. The greater the compressive force applied to the clutch plate 720, the greater the torque that may be required to cause slippage of the slipper clutch assembly 700.

Figures 7H, 7I:
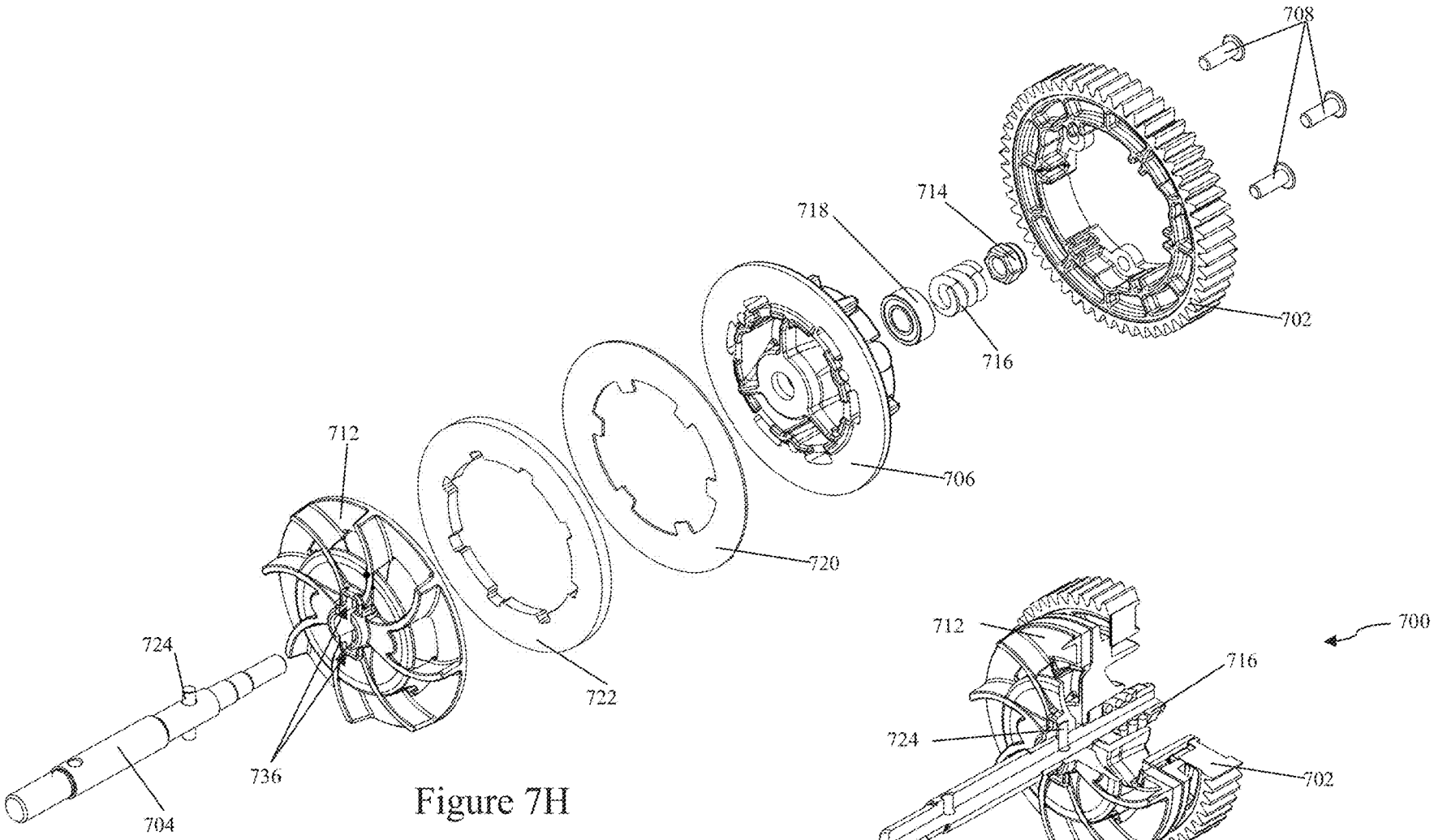
FIGS. 7H and 7I are exploded and sectional cut perspectives views of the slipper clutch assembly from another end.
Figure 7J:
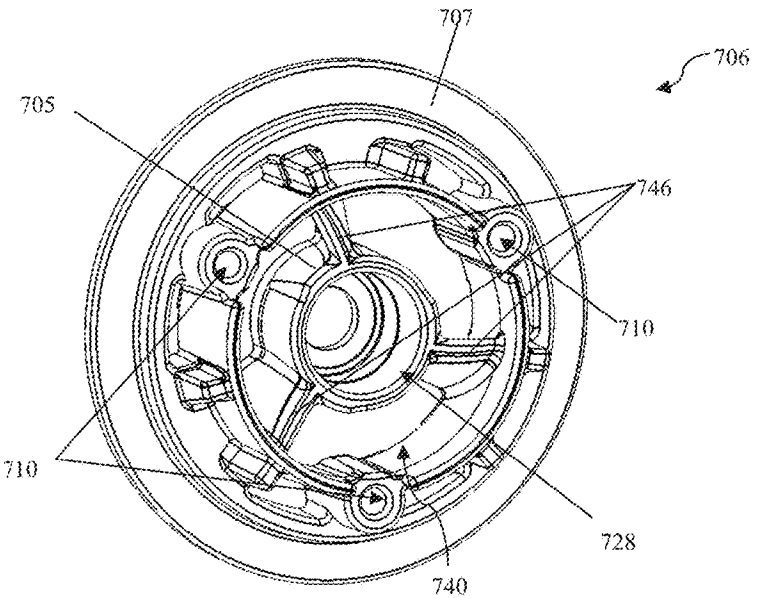
FIG. 7J is a perspective view of the clutch disc driver plate.

The clutch disc driver plate 706 and the clutch disc driven plate 812 may act as a dual-stage fan during operation of the model vehicle which may keep the slipper clutch assembly 700 at a lower temperature. As shown in FIG. 7J, the clutch disc drive plate 706 may comprise an axial fan 740 with axial fan blades 746. The axial fan 740 may comprise three axial fan blades 1046 extending between an inner ring surface 705 and an outer ring surface 707. The axial fan blades 746 may extend from the inner ring surface 705 to the interior surface of the outer ring 707. The inner ring 705 may comprise an aperture 728 where the transmission input shaft 705 may be threaded through. The outer ring surface 707 may comprise integrally raised surface features that may include the equidistant openings 810 that bolts 708 may pass through to secure the spur gear 702 to the clutch disc driver plate 706. The spur gear 702 may be mounted over the integrally formed raised surface features of the outer ring surface 707 when being secured directly to the clutch disc driver plate 706.

Figure 7K:
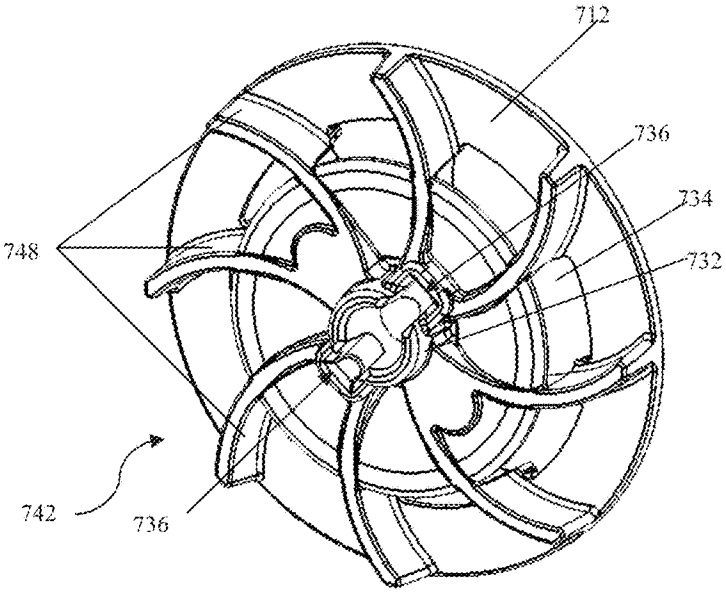
FIG. 7K is a perspective view of the clutch disc driven plate.

As shown in FIG. 7K, the clutch disc driven plate 812 may comprise a larger centrifugal fan 742 comprising a series of centrifugal fan blades 748. The centrifugal fan blades 748 may extend and radiate from an inner ring surface 732 in the center of the clutch disc driven plate 812 to an outer ring surface 734. Each of the centrifugal fan blades 748 may continue to extend throughout the outer ring surface 734 until reaching the outer perimeter edge of the clutch disc driven plate 812.

As the clutch disc driver plate 706 and the clutch disc driven plate 812 are compressed and rotated together, the dual axial and centrifugal fan 746, 748 may rotate together to draw air through the slipper clutch assembly 700. The air flow may aid in dissipating heat caused by the friction from the clutch friction insert 722 between the clutch plate 720 and the clutch disc driven plate 712. Maintaining the slipper clutch assembly 700 at a low temperature may prevent slipper fade.

The ball bearing assembly 718 may also support the clutch disc driver plate 706 with the attached spur gear 702 for rotation about the transmission input shaft 704, in addition to transmitting compressive forces from the spring 714. The aperture 728 within the inner ring 705 of the clutch disc driver plate 706 as shown in FIG. 7J may also fit snugly over the ball bearing assembly 718. The ball bearing assembly 718 may also fit snugly over the transmission input shaft 704. This configuration may reduce the total clearance encountered between the transmission input shaft 704 and the clutch disc drive plate 706 holding the spur gear 702, reducing the risk of run out by the spur gear 702.

The rotational and axial position of the clutch disc driven plate 812 may be secured by a pin 724 that extends through a diametrically extending hole through the transmission input shaft 704 as shown in FIG. 7B. Opposing ends of the pin 724 as shown in FIGS. 7F and 7H may extend from the transmission input shaft 704 into cavities in clutch disc driven plate 812 to prevent rotation of the plate around the transmission input shaft 704. The cavities may extend from openings in the inner ring surface 732 in the clutch disc driven plate 812. To permit the clutch disc driven plate 812 to be moved perhaps for assembly, service or replacement, the cavity of the clutch disc driven plate 812 housing the pin 724 may have a pair of openings 736 in the surface of the clutch disc driven plate 812 opposite of the surface in contact with the clutch friction inserts 722, as shown in FIG. 7K. The pair of openings 736 in the clutch disc driven plate 812 may expose the ends of the pin 724 extending from the transmission input shaft 704 and permit the clutch disc driven plate 812 to be moved axially along the transmission input shaft 704 away from the extended pin 724 towards the adjustment nut 714.

The clutch plate 720 may be secured against movement by the clutch disc drive plate 706 of the slipper clutch assembly 700. The clutch plate 720 may have a circular outer perimeter that substantially matches the circular perimeter of the clutch disc driver plate 706. However, a central portion may be cut from the clutch plate 720 in an irregular pattern substantially matching a similar pattern of extrusions from the surface of the clutch disc driver plate 706. The perimeter of the irregular pattern cut in the clutch plate 720 may fit around the similar pattern extrusions from the clutch disc driver plate 706 to secure the clutch plate 720 for rotation with the clutch disc driver plate 706.

The clutch frictional insert 722 is secured against movement by the clutch disc driven plate 812 in order to create frictional resistance between the clutch plate 720 and the clutch disc driven plate 712. The clutch frictional insert 722 may have a circular outer perimeter that substantially matches the circular perimeter of the clutch disc driver plate 706. However, a central portion may be cut from the pair of clutch frictional inserts 722 in a pattern substantially matching a similar pattern of extrusions from the surface of the clutch disc driven plate 712. The perimeter of the pattern cut in the pair of clutch frictional inserts 722 may fit around the similar pattern extrusions from the clutch disc driven plate 712 to secure the pair of clutch frictional inserts 722 for rotation with the clutch disc driven plate 712.

Integrated Transmission Housing

FIGS. 8A-D illustrate an integrated transmission housing assembly 800 for a model vehicle 100. In an embodiment, the integrated transmission housing assembly 800 may encase portions of the motor 610, the slipper clutch assembly 700, portions of the differential 930A and a combination of transmission components which may include shafts, gears, couplings, and/or the like mounted on the lower rear chassis bulkhead 236. During operation of the model vehicle, the transmission housing assembly 800 may protect the enclosed operating gears and parts from interference by any other parts of the vehicle that may come loose during operation or outside debris that may get under the vehicle body 350. According to such an embodiment, the integrated transmission housing assembly 800 may allow any combination of transmission components to be positioned adjacent to the motor 610 on the same portion of the model vehicle 100. The transmission in the model vehicle 100 may be a single reduction transmission with the slipper clutch assembly 700 as an additional reduction. The slipper clutch assembly 700 may transfer torque from the motor 610 to the transmission assembly of the model vehicle 100. The transmission assembly may then proceed to deliver power through the drivetrain 900 to the differential 930A.

The integrated transmission housing assembly 800 may be configured to house the slipper clutch assembly 700, the drivetrain 900, and the differential 930A together and adjacent to one another on the lower rear chassis bulkhead 236. The integrated transmission housing assembly 800 may comprise the transmission gear cover cap 810; the transmission top shaft cover 812, the upper rear chassis bulkhead 456, and the rear chassis differential cover 254. In alternative embodiments, the integrated transmission housing assembly may be provided with additional, fewer, or different components than those of the embodiment shown. For example, in an embodiment, two or more components of the integrated transmission housing assembly 800 may be combined within a single component, such as the transmission gear cover cap 810 and the transmission top shaft cover 812. Alternatively, in an embodiment, the rear chassis differential cover 254 and the upper rear chassis bulkhead 456 may also be combined within a single component.

Figure 8A:
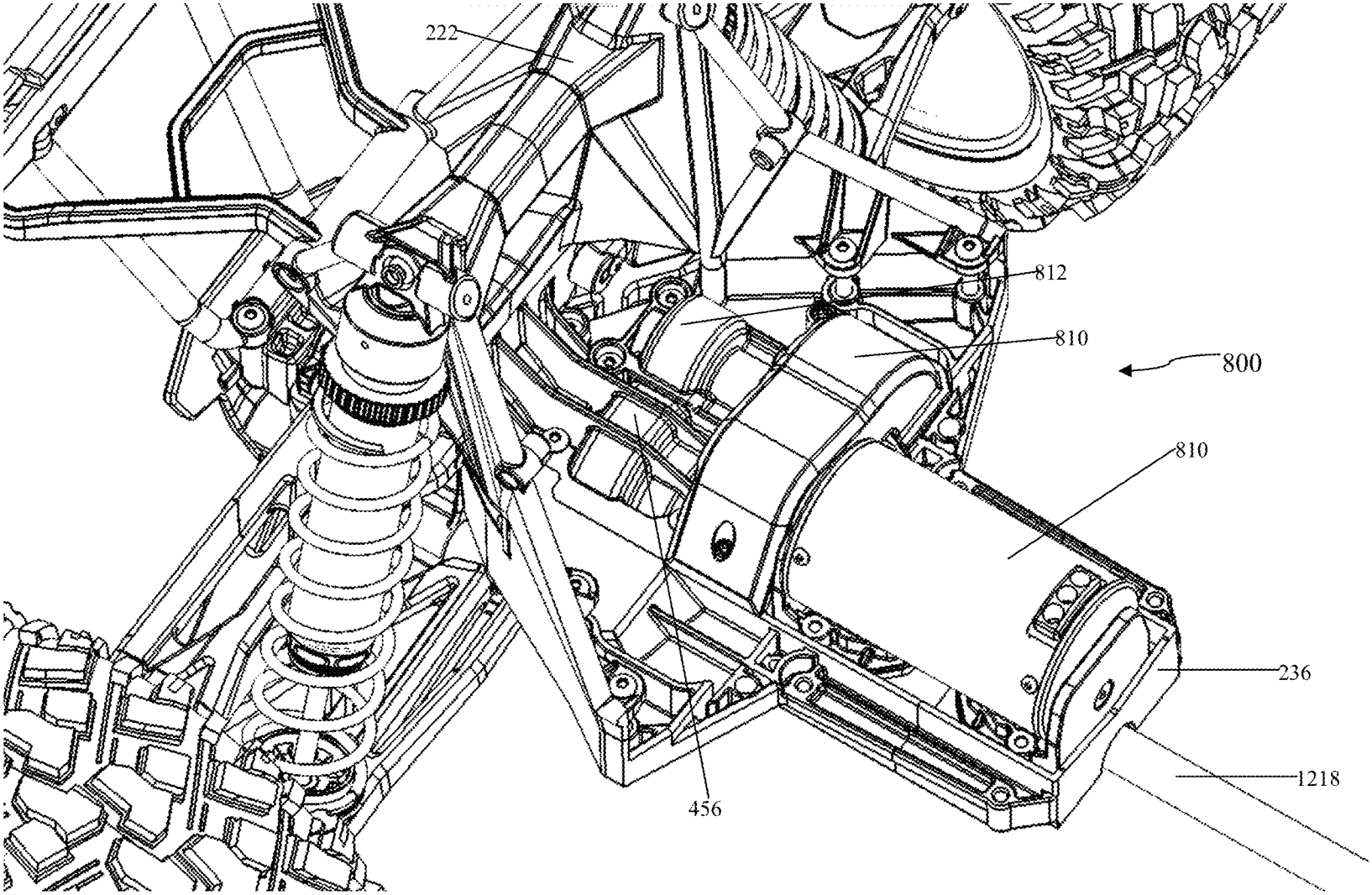
FIG. 8A is a perspective view of the integrated transmission housing on the rear assembly.
Figure 8B:
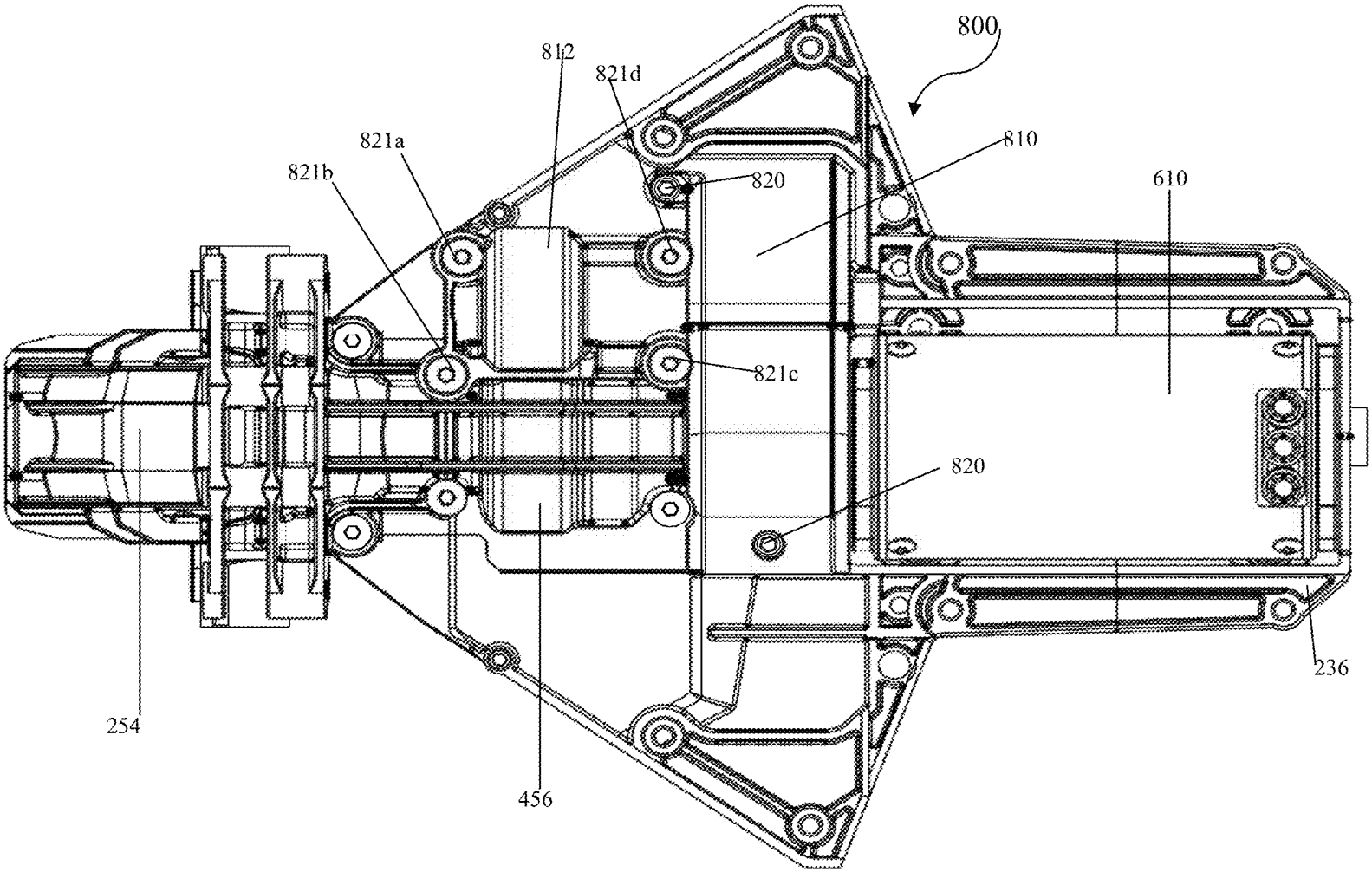
FIG. 8B is a top view of the integrated transmission housing and the motor.
Figure 8C:
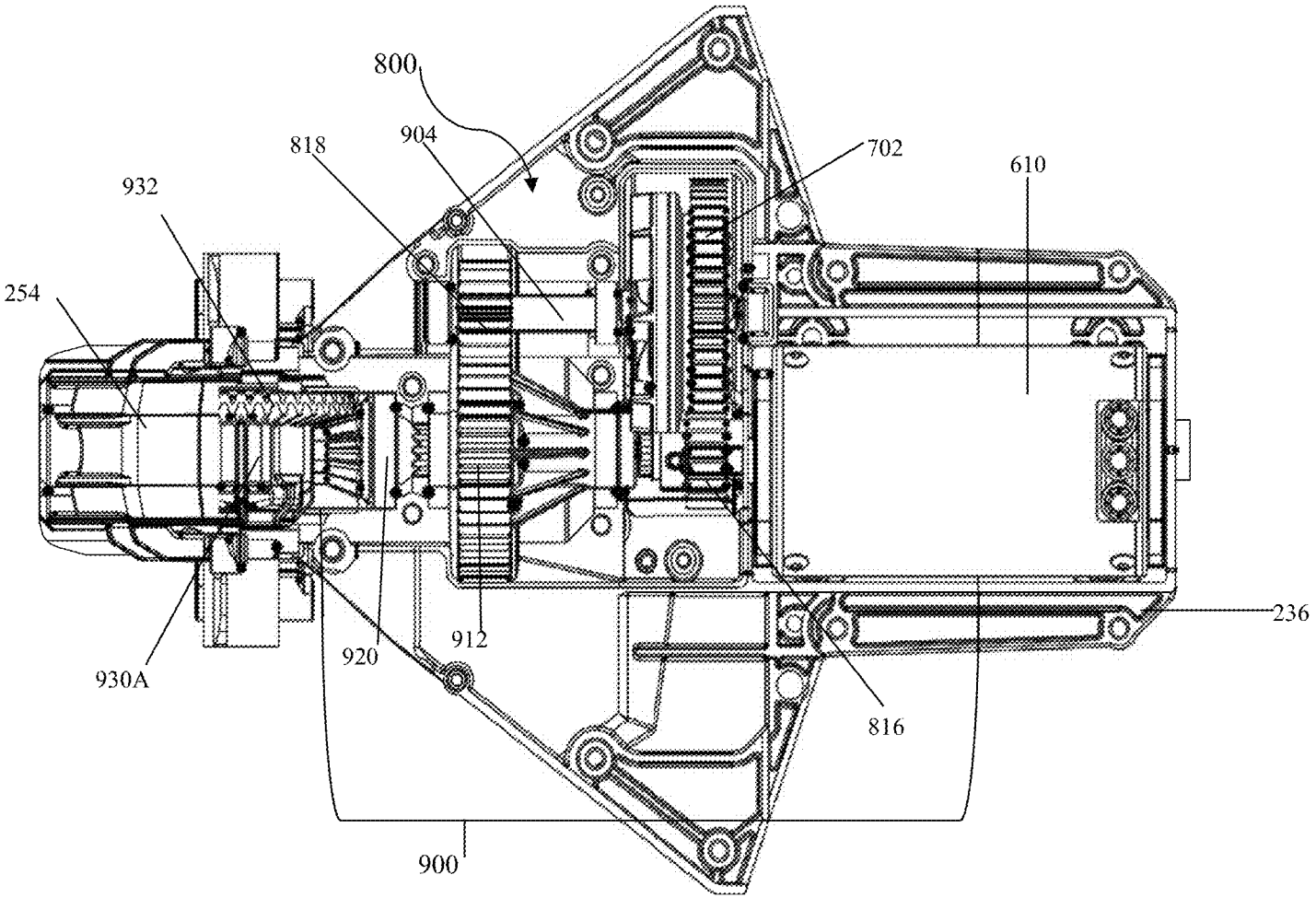
FIG. 8C is a top view of a portion of the integrated transmission housing and the motor.

As shown in FIG. 8B, the transmission gear cover cap 810 may be mounted on the lower rear chassis bulkhead 236 adjacent to the motor 610. The transmission gear cover cap

810 may be flanked by the motor 610 and the upper rear chassis bulkhead 456. The transmission gear cover cap 810 may encase a pinion gear 816 attached to the end of the motor rotor 960 extending from motor 610, and a portion of the slipper clutch assembly 700, specifically, the spur gear 702. The transmission gear cover cap 810 may comprise a cross sectional shape similar to that of the combined structure of the pinion gear 816 adjacent to the spur gear 702, and sized to fit over the portion of the pinion 816 and the spur gear 702 extending from the lower rear chassis bulkhead 236. As shown in FIG. 8G, the pinion gear 816 may mesh with the spur gear 702 where the center of the pinion gear 816 may form approximately a 45 degree angle from the lateral axis of the center of the spur gear 102, and therefore may be positioned higher than the spur gear 702. As such, the transmission gear cover cap 810 may comprise a dual rounded peak cross sectional shape with a higher rounded peak for enclosing the pinion gear 816, and a lower rounded peak for enclosing the spur gear 702. There may be a clearance area between the interior surface of the transmission gear cover cap 810 and the pinion gear 816 and the spur gear 702 to allow the pinion gear 816 and the spur gear 702 to rotate freely without risk of contact or interference by the cover cap 810.

The transmission gear cover cap 810 may also comprise openings in both a first surface 811 and a second surface 813 of the transmission gear cover cap 810. The first surface 811 may be in contact with the motor mount 616. The second surface 813 may be opposite of the first surface 811 in contact with the transmission top shaft cover 812. The first surface 811 may comprise an opening 817 where the motor rotor 960 extends between the motor 610 and the pinion gear 816. The second surface 813 may comprise an opening 819, as shown in FIG. 8G, where the transmission input shaft 704 of the slipper clutch assembly 700 may extend from the spur gear 702 to the transmission input gear 818 encased by the transmission top shaft cover 812. The transmission gear cover cap 810 may be affixed over the pinion 816 and the spur gear 702 encasing the two parts between the transmission gear cover cap 810 and the lower rear chassis bulkhead 236. The transmission top gear cover cap 810 may also be affixed to the lower rear chassis bulkhead 236 by threading mechanical fixtures 820 through two bores in the transmission top gear cover cap 810. The mechanical fixtures used to secure the transmission top gear cover cap 810 may be screws, bolts, pins, clips, and the like.

The integrated transmission housing assembly 800 may also comprise the transmission top shaft cover 812 adjacent to the transmission gear cover cap 810 on the opposite side of the motor 610. The transmission top shaft cover 812 may encase a portion of the slipper clutch assembly 700 to house the transmission input gear 818 at the end of the transmission input shaft 704. The transmission top shaft cover 812 may comprise a cylindrical cross sectional shape that may be sized to fit over the cylindrical shape of the transmission input gear 818. There may be a clearance area between the interior surface of the transmission top shaft cover 812 and the teeth of the transmission input gear 818 to ensure the transmission input gear 818 may rotate freely without risk of interference from the transmission top shaft cover 812. The transmission input gear 818 is connected to the spur gear 702 by the transmission input shaft 704. As such, the transmission input shaft 704 may extend from the transmission input gear 818 underneath the transmission top shaft cover 812 to the spur gear 702 underneath the transmission gear cover cap 810. There may be an opening in the surface of the transmission top shaft cover 812 adjacent to and in contact with the transmission gear cover cap 810 for the transmission input shaft 704 to extend through. As shown in FIG. 8E, the top shaft cover 812 and the transmission gear cover cap 810 may overlap to seal the internal gears including the slipper clutch 700 from outside elements such as dirt, debris, sand, dust, and the like.

The transmission top shaft cover 812 may also be affixed to the lower rear chassis bulkhead 236 encasing the transmission input gear 818 between the lower rear chassis bulkhead 236 and the transmission top shaft cover 812. The transmission top shaft cover 812 may be secured to the lower rear chassis bulkhead 236 by four mechanical fixtures 821*a-d* threaded through four bores in the transmission top shaft cover 812. The mechanical fixtures used to secure the transmission top shaft cover 812 may be screws, bolts, pins, clips, and the like. In addition to securing the transmission top shaft cover 812 to the bulkhead 236, the mechanical fixtures 821*b-c* also secure a portion of the transmission top shaft cover 812 over the upper rear chassis bulkhead 456 into the bulkhead 236.

The integrated transmission housing 800 may also comprise the upper rear chassis bulkhead 456 adjacent to the transmission top shaft cover 812812 and the transmission top gear cover cap 810. As shown in FIG. 8B, the upper rear chassis bulkhead 456 may be adjacent to the transmission top shaft cover 812 due to the meshing between the transmission input gear 818 from the slipper clutch assembly 700 and the main drive input gear 912 connected to the drivetrain 900, as shown in FIG. 8I. There may be an opening in the surfaces between the transmission top shaft cover 812 and the upper rear chassis bulkhead 456 to allow the transmission input gear 818818 and the main drive input gear 912 to mesh freely. The transmission top shaft cover 812 may also be partially affixed to the upper rear chassis bulkhead 456 to secure the transmission top shaft cover 812 without interfering with the meshing of the two gears. FIG. 8B shows mechanical fixtures 821*b-c* securing the transmission top shaft cover 812 to the upper rear chassis bulkhead 456. Alternatively, mechanical fixtures 821*b-c* may be screws bolts, pins, clips, and the like. Furthermore, alternatively in an embodiment, the transmission top shaft cover 812 and the upper rear chassis bulkhead 456 may also be a single component.

Figure 8D:
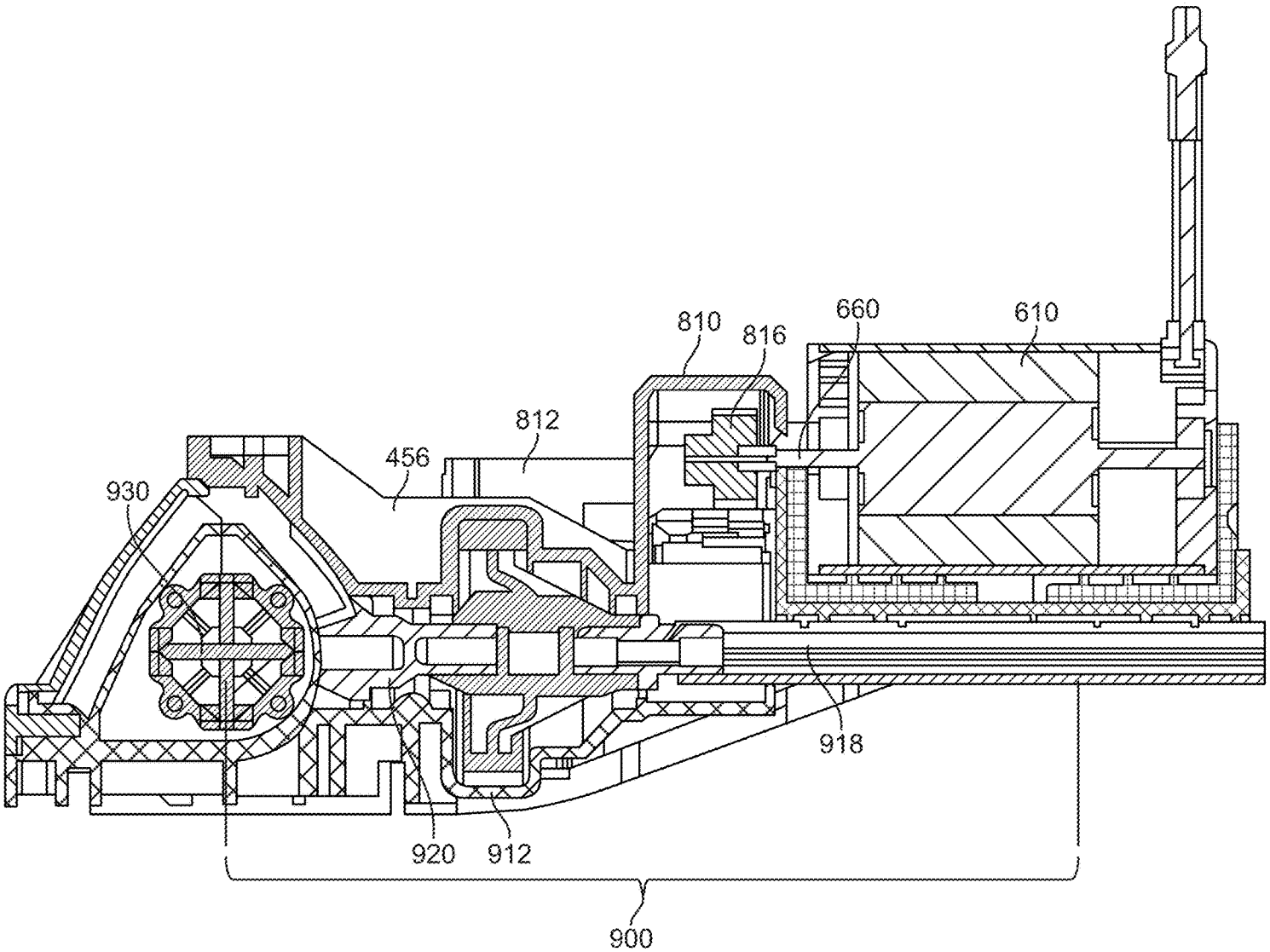
FIG. 8D is a longitudinal sectional view of a portion of the integrated transmission housing.
Figure 8E:
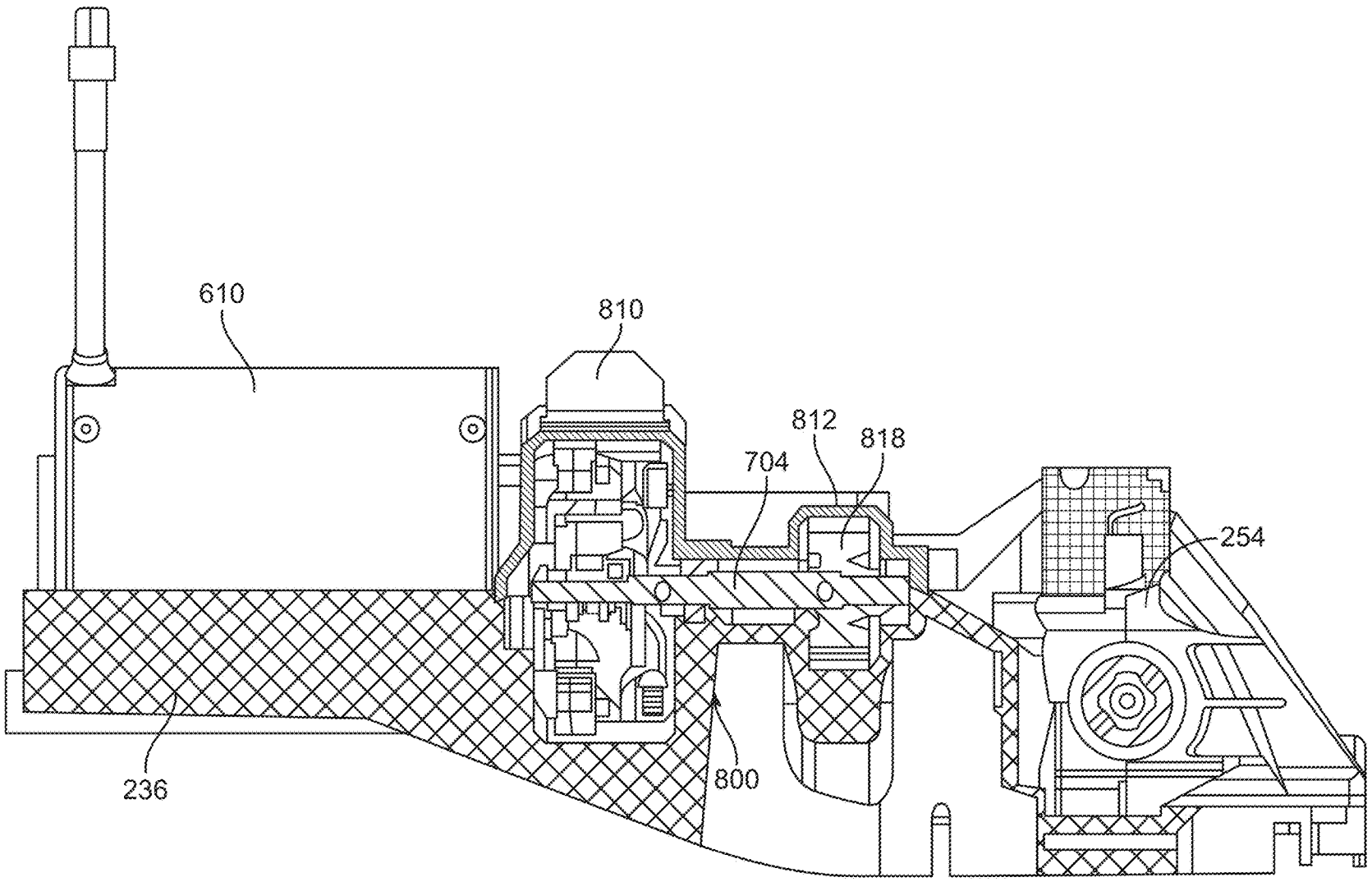
FIG. 8E is another longitudinal sectional view of another portion of the integrated transmission housing.
Figure 8G:
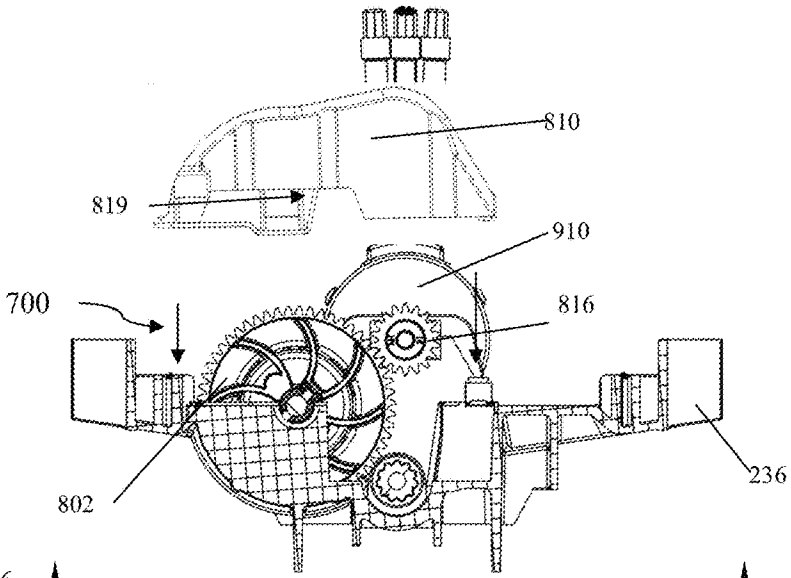
FIGS. 8F and 8G are a top and cross sectional view of a portion of the integrated transmission.
Figure 8F:
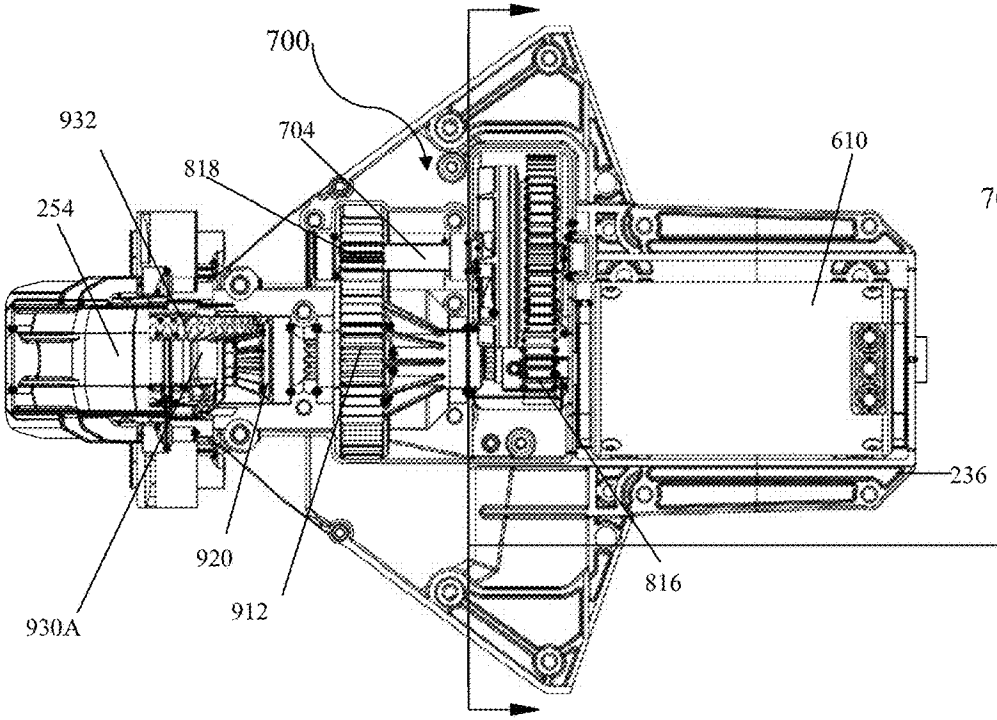
Figure 8I:
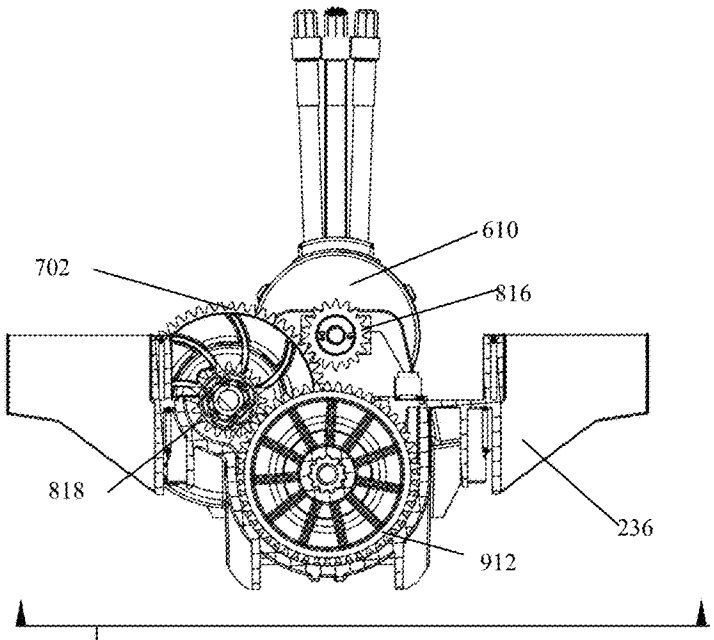
FIGS. 8H and 8I are a top and cross sectional view of another portion of the integrated transmission.
Figure 8H:
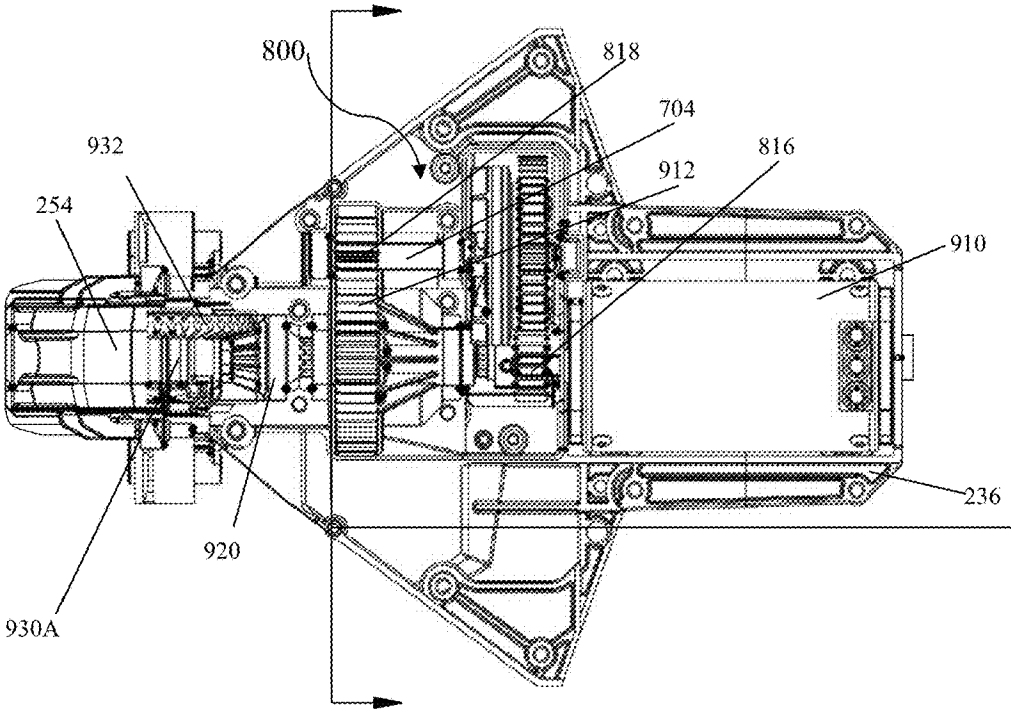

As shown in FIG. 8D, the upper rear chassis bulkhead 456 may also be adjacent to and partially overlap a portion of the transmission gear cover cap 810. The upper rear chassis bulkhead 456 may encase the drivetrain 900 which may include the main drive input gear 912. The main drive input gear 912 may transfer power from the slipper clutch assembly 700 to the differential 930A. The drivetrain 900 including the driveshaft 918 may begin from the main drive input gear 912 and extend under the pinion gear 816, motor rotor 960, and the motor 610. The upper rear chassis bulkhead 456 may therefore also comprise an opening in the surface adjacent to the transmission gear cover cap 810 to extend the driveshaft 918 from the main drive input gear 912 towards the front of the vehicle. The upper rear chassis bulkhead 456 may comprise a conical cross sectional shape to house the conical shape of the main drive input gear 912. The main drive input gear 912 may comprise a large cylindrical perimeter surface adjacent to a conical end connecting the main drive input gear 912 to the driveshaft 918. The upper rear chassis bulkhead 456 may be sized to match and enclose the main drive input gear 912. There may be a clearance area between the interior surface of the upper rear chassis bulkhead 456 and the top surface of the main drive input gear 912. This may allow the main drive input gear 912 to rotate freely without risk contacting the upper rear chassis bulkhead 456 during operation.

The upper rear chassis bulkhead 456 may comprise extending between the transmission gear cover cap 810 and the rear chassis differential cover 254. In addition to housing the main drive input gear 912, the upper rear chassis bulkhead 456 shown may further encase a portion of the differential 930A, including a part of the differential ring gear 932 connected to the drivetrain 900 at the differential pinion gear 920. The upper rear chassis bulkhead 456 shown may only partially encase the differential ring gear 932. As such, the upper rear chassis bulkhead 456 may comprise an opening 822 at the rear of the bulkhead towards the rear of the vehicle where the main drive input gear 912 outputs to the differential ring gear 932 via the differential pinion gear 920. The opening 822 in the upper rear chassis bulkhead 456 may be at least as high as the peak of the of the differential ring gear 932. The upper rear chassis bulkhead 456 may also comprise a clearance area between the interior surface of the upper rear chassis bulkhead 456 and the top surface of the differential ring gear 932 to permit the differential ring gear 932 to rotate freely during operation of the vehicle.

The upper rear chassis bulkhead 456 may overlap a portion of the rear chassis differential cover 254 at the opening 822 to complete the enclosure of the differential ring gear 932. The rear chassis differential cover 254 encases the remaining exposed portion of the differential ring gear 932 not housed by the upper rear chassis bulkhead 456. The rear chassis differential cover 254 partially protects the rear differential 932 when outputting power to the wheels from any parts of the vehicle that may come loose during operation or outside debris that may get inside the vehicle during operation. The rear chassis differential cover 254 may comprise a pair of half circle openings that match with corresponding half circle openings in the upper rear chassis bulkhead 456 at their attachment points in order for the differential 930A to output to the wheels. The rear chassis differential cover 254 may be secured to the upper rear chassis bulkhead 456 to close the opening 822 to completely house the differential ring gear 932. Alternatively, the upper rear bulkhead 456 and the rear chassis differential cover 254 may be a single component.

Figure 8J:
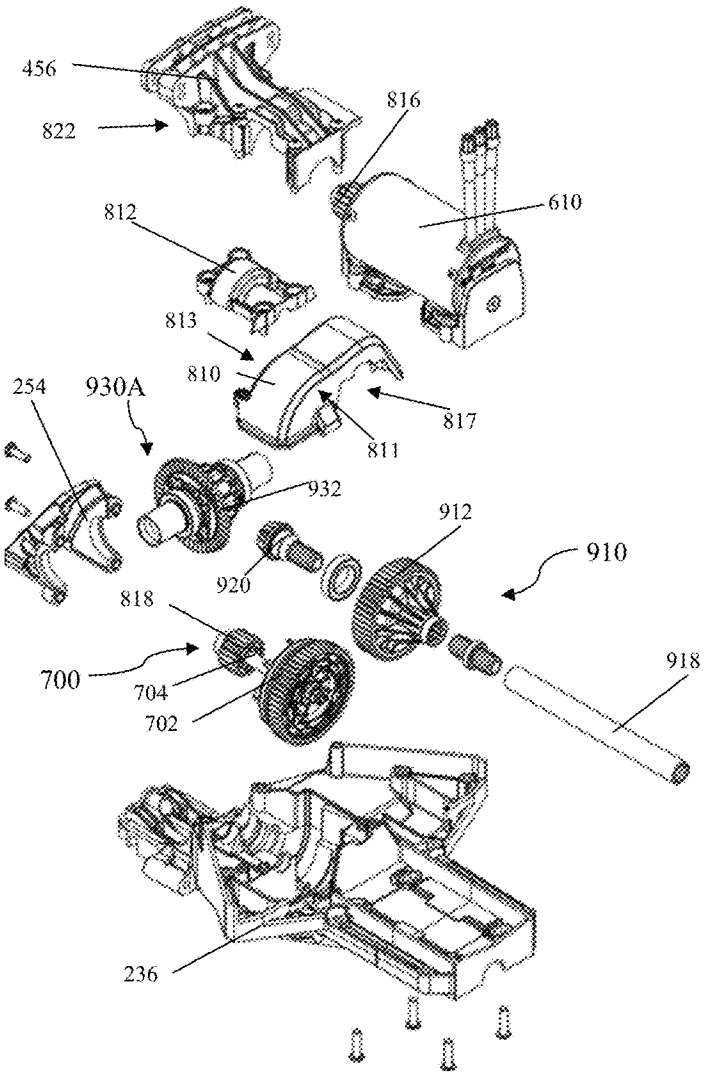
FIG. 8J is a perspective exploded view of the integrated transmission housing being assembled on the lower rear chassis bulkhead with the motor, the clutch, drivetrain and rear differential.

FIG. 8J shows an exploded view of the internal gears with the integrated transmission housing 800 being assembled on the rear chassis bulkhead 236.

Pin-Less Drive Train

The main assembly 102 may be provided with a drivetrain 900 mounted to the chassis 400.

Wheel Mounting Provisions

The drivetrain 900 may span from the chassis 400 to the front assembly 104 and rear assembly 106 to couple the wheel assemblies 1000 of the main assembly 102 to the motor 610.

Having thus described the present invention by reference to certain of its exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of exemplary embodiments. Accordingly, it is appropriate that any claims supported by this description be construed broadly and in a manner consistent with the scope of the invention.

We claim:

1. A model vehicle with a body mount comprising:
- a lever member comprising:
  - a jaw clamp comprising;
    - a first jaw clamp member extending below an outer surface of a model vehicle body of the model vehicle; and
    - a second jaw clamp member fixedly coupled to the first jaw clamp member and extending in a first direction;
    - a lever handle accessible from outside of the model vehicle body;
    - a lever pivot fixedly coupled to the lever handle and the jaw clamp and rotatively coupled to the model vehicle body;
  - wherein the lever member rotates relative to the model vehicle body between an engaged position and an unengaged position;
  - wherein when the lever member is in the engaged position, the second jaw clamp member is configured to engage a securing member coupled to a model vehicle chassis of the model vehicle in a second direction perpendicular to the first direction.

2. The model vehicle in claim 1, wherein the lever handle pivots above the outer surface of the model vehicle body in the unengaged position and is parallel to the outer surface in the engaged position.

3. The model vehicle in claim 1, wherein the lever handle further comprises:
- a retaining mechanism, the retaining mechanism comprising:
  - a rotating member rotatively coupled to the lever handle and configured to rotate between a retained position and an unretained position and comprising:
    - a first rotating end operable from the outside of the model vehicle body; and
    - a second rotating end extending below the outer surface of the model vehicle body when the lever handle is in the engaged position;
  - wherein the retaining mechanism inhibits the actuating of the lever handle when the lever handle is in the engaged position and the rotating member is rotated to the retained position.

4. The model vehicle in claim 3, wherein rotating the first rotating end correspondingly rotates the second rotating end between the retained position and the unretained position.

5. The model vehicle in claim 3, wherein the second rotating end is inserted into an opening in the outer surface of the model vehicle body when the lever handle is rotated from the unengaged position to the engaged position and the retaining mechanism is in the unretained position.

6. The model vehicle in claim 3, wherein the second end further comprises a locking member; and
- rotating the rotating member when the lever member is in the engaged position, correspondingly engages the locking member with a locking mechanism, retaining the locking member in a locked configuration.

7. The model vehicle in claim 6, wherein the locking mechanism is a leaf spring detent.

8. The model vehicle in claim 1, wherein the jaw clamp further comprises a third member fixedly coupled to the second member at an angle and configured to draw the model vehicle body towards the model vehicle chassis during engagement with the securing member.

9. The model vehicle in claim 1, wherein the jaw clamp constrains the securing member between a first support member and a second support member to inhibit movement of the model vehicle body relative to the model vehicle chassis in at least two dimensions.

10. A model vehicle with a body mount system comprising:

a first body mount comprising:

a tongue member comprising:

a first tongue member extending from a first end proximate to an interior surface of a model vehicle body of the model vehicle; and a second tongue member fixedly coupled to a second end of the first tongue member and extending in a first direction;

wherein the second tongue member is configured to engage a first securing member mounted to a model vehicle chassis of the model vehicle in a second direction perpendicular to the first direction;

a second body mount comprising:

a lever member comprising:

a jaw clamp comprising:

a first jaw clamp member provided below an outer surface of the model vehicle body; and a second jaw clamp member fixedly coupled to the first jaw clamp member and extending in the first direction;

a lever handle accessible from outside of the model vehicle body;

a lever pivot fixedly coupled to the lever handle and the jaw clamp and pivotally coupled to the model vehicle body;

wherein the lever member rotates relative to the model vehicle body between an engaged position and an unengaged position; and wherein when the lever member is in the engaged position, the second jaw clamp member is configured to engage a second securing member transversely coupled to the model vehicle chassis in the second direction.

11. The model vehicle in claim 10, wherein the lever handle further comprises:

a retaining mechanism, the retaining mechanism comprising:

a rotating member rotatively coupled to the lever handle and configured to rotate between a retained position and an unretained position and comprising:

a first rotating end operable from the outside of the model vehicle body; and a second rotating end extending below the outer surface of the model vehicle body when the lever handle is in the engaged position;

wherein the retaining mechanism inhibits the actuating of the lever handle when the lever handle is in the engaged position and the rotating member is rotated to the retained position.

12. The model vehicle in claim 10 wherein a top surface of the second tongue member is configured to draw the model vehicle body towards the model vehicle chassis when engaging the first securing member.

13. The model vehicle in claim 10, wherein the second rotating end is inserted into an opening in the outer surface of the model vehicle body when the lever handle is rotated from the unengaged position to the engaged position and the retaining mechanism is in the unretained position.

14. The model vehicle in claim 10, wherein the jaw clamp constrains the second securing member between a first support member and a second support member to inhibit movement of the model vehicle body relative to the model vehicle chassis in at least two dimensions.

* * * * *